US006435670B1

(12) United States Patent
Inoue et al.

(10) Patent No.: US 6,435,670 B1
(45) Date of Patent: Aug. 20, 2002

(54) LIQUID DISCHARGE HEAD, LIQUID DISCHARGE METHOD, LIQUID DISCHARGE APPARATUS, RECOVERY METHOD FOR LIQUID DISCHARGE HEAD, AND FLUID STRUCTURE BODY

(75) Inventors: Ryoji Inoue; Masanori Takenouchi, both of Yokohama; Masahiko Kubota, Tokyo; Kiyomitsu Kudo, Kawasaki, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/781,442

(22) Filed: Feb. 13, 2001

(30) Foreign Application Priority Data

| | | |
|---|---|---|
| Feb. 15, 2000 | (JP) | 2000-037090 |
| Feb. 15, 2000 | (JP) | 2000-037091 |
| Feb. 15, 2000 | (JP) | 2000-037106 |
| Feb. 15, 2000 | (JP) | 2000-037107 |
| Feb. 15, 2000 | (JP) | 2000-037150 |
| Feb. 15, 2000 | (JP) | 2000-037157 |
| Feb. 15, 2000 | (JP) | 2000-037187 |
| Feb. 15, 2000 | (JP) | 2000-037192 |

(51) Int. Cl.[7] ..... B41J 2/05
(52) U.S. Cl. ..... 347/65; 347/67
(58) Field of Search ..... 347/56, 63, 65, 347/67, 20

(56) References Cited

U.S. PATENT DOCUMENTS

| | | | |
|---|---|---|---|
| 4,723,129 A | 2/1988 | Endo et al. | 347/56 |
| 5,748,213 A | 5/1998 | Karita et al. | 347/63 |
| 6,062,680 A | 5/2000 | Yoshihira et al. | 347/65 |
| 6,095,640 A | 8/2000 | Ishinaga et al. | 347/65 |
| 6,109,735 A | 8/2000 | Kashino et al. | 347/65 |
| 6,154,237 A | 11/2000 | Kashino et al. | 347/48 |
| 6,174,050 B1 | 1/2001 | Kashino et al. | 347/65 |
| 6,196,667 B1 | 3/2001 | Hiroki et al. | 347/65 |

FOREIGN PATENT DOCUMENTS

| | | | |
|---|---|---|---|
| EP | 0436047 | 10/1991 | B41J/2/055 |
| EP | 0 894 628 | 2/1999 | B41J/2/14 |
| EP | 0 436 047 | 7/1999 | B41J/2/055 |
| EP | 0 976 562 | 2/2000 | B41J/2/14 |

OTHER PUBLICATIONS

Patent Abstracts of Japan, vol. 14, No. 331, Jul. 17, 1990, JP 02–113950 A (Apr. 26, 1990).

*Primary Examiner*—John Barlow
*Assistant Examiner*—Juanita Stephens
(74) *Attorney, Agent, or Firm*—Fitzpatrick, Cella, Harper & Scinto

(57) ABSTRACT

A liquid discharge head having a plurality of discharge ports to discharge a liquid, a plurality of liquid flow paths, in which an end part permanently communicates with the respective discharge ports, having a bubble generating area to generate a bubble in the liquid, bubble generating unit to generate energy to generate and grow the bubble, a plurality of liquid supply ports arranged in the plurality of liquid flow paths and communicating with a common liquid supply chamber, and a movable member, having a free end, supported with a very small gap by at least part of the liquid flow path side of the liquid supply port, the area surrounded by at least the free end part of the movable member and both side parts continuing thereto being larger than an opening area prepared in the liquid flow path of the liquid supply port, in which in a status of the movable member at rest, the part of the discharge port side of the movable member contacts with a member for forming the liquid supply port and a very small gap is placed between the part of a fulcrum side of the movable member and the liquid supply port.

103 Claims, 128 Drawing Sheets

LIQUID DISCHARGE HEAD, LIQUID DISCHARGE METHOD, LIQUID DISCHARGE APPARATUS, RECOVERY METHOD FOR LIQUID DISCHARGE HEAD, AND FLUID STRUCTURE BODY

BACKGROUND OF THE INVENTION

1. Field of the Invention

The present invention relates to a liquid discharge head to discharge a liquid by generating a bubble by acting a thermal energy to the liquid, a liquid discharge method using the liquid discharge head, a recovery method, a liquid discharge apparatus, and a fluid structure body.

The present invention is applicable to an apparatus such as a printer to carry out recording to a recording medium such as a paper, thread, fiber, fabric, leather, metal, plastic, glass, wood, and ceramic, copier, facsimile having a communication system, and word processor having a printer part and an industrial recording apparatus in composite combination with various processing apparatus.

For reference, "recording" in the present invention means not only attaching an image such as a character and a figure having a meaning to the recording medium, but also attaching the image such as a pattern without any meaning.

2. Related Background Art

Conventionally, in a recording apparatus such as printer, an ink jet recording method, namely, so-called bubble jet recording method, in which such energy as heat is applied to a liquid ink in a flow path to generate the bubble and the ink is discharged from a discharge port by an action force caused by an acute volume change according to generation of the bubble to form the image by attaching this to the recording medium, has been known. In the recording apparatus using the bubble jet recording method, as disclosed in U.S. Pat. No. 4,723,129, the discharge port to discharge the ink, the flow path communicating with the discharge port, and an electrothermal converting element as energy generating means to discharge the ink flown in the flow path is generally arranged.

According to such recording method, a high quality image can be recorded in a high speed and with a low noise and also in the head to do this recording method, the discharge port to discharge the ink can be arranged in a high density and thus, there are many advantageous points in which a small apparatus can easily yield the recorded image of a high resolution and a color image. Therefore, the bubble jet recording method is recently applied to many office instruments such as printer, copier, and facsimile and besides, applied to the industrial systems such as textile printing apparatus.

As described above, as the bubble jet technology is increasingly applied to products of many fields, various kinds of requirements have increased. For example, in order to obtain the high quality image, a driving condition was proposed to present the liquid discharge method capable of better ink discharge with a high speed ink discharge and a stable bubble generation and in view of high speed recording, an improved shape of flow path was proposed to realize the liquid discharge head with the high speed to refill the discharged liquid in the liquid flow path.

Among them, in the head to generate the bubble in a nozzle to discharge the liquid according to growth of the bubble, bubble growth toward an opposite direction of the discharge port and a liquid flow caused thereby have been known as factors to lower a discharge energy efficiency and a refilling characteristic. An invention of a structure to improve such discharge energy efficiency and refilling characteristic was proposed in European Patent Application Laid-Open No. EP0436047A1.

In the invention described in the publication, a first valve put between an area around the discharge port and a bubble generating part to shut these and a second valve put between the bubble generating part and an ink supply part to shut these completely are alternately opened and closed (FIG. 4 to FIG. 9 of EP436047A1). For example, in FIG. 7 of the publication, as shown in FIG. 133, a heat generating body 110 is installed in almost center of the ink flow path 112 between an ink vessel 116 on a substrate 125 forming an internal wall of the ink flow path 112 and a nozzle 115. The heat generating body 110 is located in a section 120, of which circumference is all closed, inside the ink flow path 112. The ink flow path 112 is configured by the substrate 125, thin films 123 and 126, directly layered on the substrate 125, and tongue piece 113 and 130 as closing bodies. Tongue piece released are shown by a broken line in FIG. 133. Another thin film 123 extending in a plane parallel to the substrate 125 and ending at a stopper 124 covers over the ink flow path 112. When the bubble occurs in the ink, a free end of the tongue piece 130, in the area of the nozzle, closely contacting with the stopper 126 in a static status is displaced upward and an ink liquid is ejected from the section 120 to the ink flow path 112 subsequently through the nozzle 115. Here, the tongue piece 113 installed in the area of the ink vessel 116 closely contacts with the stopper 124 in the static status and thus, the ink liquid in the section 120 does not go to an ink layer 116. When the bubble in the ink disappears, the tongue piece 130 is displaced downward to contact closely again with the stopper 126. And, the tongue piece 113 falls down in the section 120 and hence, the ink liquid flows in the section 120.

SUMMARY OF THE INVENTION

However, in the invention described in EP436047A1, three chambers of the area around the discharge port, the bubble generating part, and the ink supply part are divided in two parts and therefore, in discharge, the ink following a liquid droplet largely tails resulting in a considerable amount of a satellite dots in comparison with a normal discharge system, in which growing, shrinking, and disappearing of a bubble take place (it is presumed that an effect of retreat of a meniscus caused by disappearance of the bubble cannot be employed). On the other hand, a valve in the discharge port side for the bubble causes a great loss of discharge energy. In addition, in replenishment (refilling the ink in the nozzle), the liquid is supplied to the bubble generating part in accordance with disappearance of the bubble. However, the liquid cannot be supplied to the area around the discharge port until the next bubbling occurs and hence, not only a size variation of the liquid droplets discharged is large, but also a frequency responding to discharge is very high and therefore it is not practical.

The present invention proposes the invention to improve a suppressing efficiency of a component to grow a bubble toward a direction opposite to the discharge port and also, on the contrary thereto, improve a discharge efficiency on the basis of a new idea to find out an innovative method and head constitution to realize a high efficiency of the refilling characteristic.

The present inventors, as a result of an intensive research, found that in a nozzle structure of the liquid discharge head, by which a bubble is generated in the nozzle formed linearly and the liquid is discharged according to growth of the bubble, a function of a special check valve allows suppressing bubble growth in the direction opposite (backward) to the discharge port and an effective use of the backward discharge energy for the discharge port side. Furthermore, the present inventors also found that the function of the special check valve allows suppressing a backward bubble growth component and realizing an effective refilling characteristic to make the frequency responding to discharge very high.

Consequently, an object of the present invention is to realize both improvement of a discharge power and improvement of discharge frequency by the nozzle structure and the discharge method using a new valve function and to establish a new discharge system (structure) to achieve the head of the high speed and high image quality of a level, which has not been achieved so far.

To achieve the above described object, the liquid discharge head according to the present invention is characterized by having a plurality of discharge ports to discharge a liquid, a plurality of liquid flow paths, in which an end part is permanently communicated with the respective discharge ports, having a bubble generating area to generate a bubble in the liquid, bubble generating means to generate energy to generate and grow the above described bubble, a plurality of liquid supply port arranged in the plurality of liquid flow paths and communicated with a common liquid supply chamber, and a movable member, having a free end, supported with a very small gap by at least part of the above described liquid flow path side of the above described liquid supply port, and at least the free end part of the above described movable member and an area surrounded by both side parts continuing thereto becomes larger than an opening area prepared in the liquid flow path of the above described liquid supply port, wherein in a status of the above described movable member at rest, the part of the above described discharge port side of the above described movable member contacts with a member for forming the above described liquid supply port and a very small gap is placed between the part of a fulcrum side of the above described movable member and the above described liquid supply port.

Additionally, in the status of the above described movable member at rest, the part of the above described discharge port side of the above described movable member may contact with the member for forming the above described liquid supply port and the very small gap may be placed between a side part in the part of a fulcrum side of the above described movable member and the member to form the above described liquid supply port.

Further, in the status of the above described movable member at rest, the part of the above described discharge port side of the above described movable member may press the member for forming the above described liquid supply port to curve elastically convexly the above described movable member toward the above described liquid supply port side.

According to the above described invention, in the liquid discharge head disposing the movable member by generating the bubble in the bubble generating area by the bubble generating means and discharge the liquid from the discharge port after the liquid flow path is closed almost tightly by closing almost the liquid supply port of the liquid flow path with the movable member, in the status in which the movable member at rest, by contacting the part of the discharge port of the movable member to the member to form the liquid supply port, the time after the bubble generated until the liquid flow path except the discharge port becomes the almost tightly closing status is shortened to suppress movement of the liquid from the liquid flow path to the liquid supply port to a maximum limit. By this, in discharge action, a loss of a discharge power caused by movement of the liquid from the liquid flow path to the liquid supply port reduces to improve discharge efficiency of the liquid discharge head. In addition, together with this, quick transition from the isotropic growth of the bubble to the partial growing and the partial shrinking period, while the part, of the bubble, in the discharge port side grows and the part, of the bubble, in the liquid supply port side shrinks, becomes possible. Further, in the standing status in which the movable member at rest, there is the small gap between the part of the fulcrum side of the movable member and the liquid supply port and there is the very small gap between the side part in the part of the fulcrum side of the movable member and the member to form the liquid supply port and thus, in the status in which the movable member at rest, the liquid supply port communicates with the liquid flow path through the small gap. By this, even in the case where the movable member at rest before a meniscus in the discharge port completely is recovered by the discharge action and the movable member at rest through overshoot in refilling the liquid in the liquid flow path in the status in which the meniscus projects from the discharge port, the liquid moves through the very small gap between the fulcrum side of the movable member and the liquid supply port to make displacement of the meniscus to an appropriate position possible.

In the status of the movable member at rest, the part of the discharge port side of the movable member presses the member to form the liquid supply port to curve elastically and convexly the movable member toward the liquid supply port and thus, when a heat generating body causes membrane boiling to grow the bubble isotropically, by further curving of the movable member convexly to the liquid supply port side, the liquid supply port is closed by the movable member to make the liquid flow path except the discharge port to the substantially tightly closed status. At this time, the movable member curves elastically and convexly toward the an upstream before the bubble grows in maximum size and then, an inconstant heating characteristic of the heat generating body and an inconstant bubbling status, which are caused by an ambient temperature change, are canceled by curving of the movable member. As a result, an inconstant bubbling status caused by the heat generating body and inconstant discharge caused by the ambient temperature change is suppressed. In addition, in this case, the movable member displaces downward in a high order vibration mode and therefore, downward displacement of the free end of the movable member is large and the movable member opens quicker and close quicker and hence, refilling time can be shortened.

Furthermore, the liquid discharge head of the present invention is characterized by having the discharge port to discharge the liquid, the liquid flow path, in which the one end is permanently communicated with the discharge port, having the bubble generating area to generate the bubble in the liquid, the liquid supply port opened in the above described liquid flow path to communicate the liquid supply chamber to hold the liquid supplied to the above described liquid flow path and the above described liquid flow path, and the movable member arranged oppositely to the above described liquid supply port through the gap in the above described liquid flow path, supported making one end of one liquid flow path as the free end, and at least the free end and the area surrounded by both side parts continuing thereto becomes larger than the opening area prepared in the above described liquid flow path of the above described liquid supply port, wherein in the free end of the above described movable member, the flow path passing from the above described liquid supply port formed by the gap to the above described liquid flow path bends.

Such bent flow path can be yielded by having a projected part in a position oppositely located to the free end of the movable member through the gap. Besides, the discharge port and the bubble generating area are in a linear communication status.

The liquid discharge head of the present invention is characterized by having the discharge port to discharge the liquid, the liquid flow path, in which the one end is permanently communicated with the above described discharge port, having the bubble generating area to generate the bubble in the liquid, the liquid supply port opened in the above described liquid flow path to communicate the liquid supply chamber to hold the liquid supplied to the above described liquid flow path and the liquid flow path, and the movable member arranged oppositely to the above described liquid supply port through the gap in the above described liquid flow path, supported making one end of the above described liquid flow path as the free end, and at least the above described free end and the area surrounded by both side parts continuing thereto becomes larger than the opening area prepared in the above described liquid flow path of the above described liquid supply port, wherein the above described liquid flow path has a projected part in the position oppositely located to the above described free end of the above described movable member through the gap.

Furthermore, the liquid discharge head according to the present invention preferably is that the liquid supply port is substantially shut by the above described movable member during a period, while a whole of the bubble generated in the bubble generating area grows isotropically, and during subsequent period, while the part, of the bubble, in the discharge port side grows and the part in the movable member side shrinks, the movable member displaces to the bubble generating area to allow liquid supply from the liquid supply chamber to the liquid flow path through the liquid supply port, or the free end of the movable member in an early period of the bubble displaces to the liquid supply port to shut substantially the liquid supply port toward the liquid flow path, and together with disappearance of the bubble, the free end of the movable member displaces toward the bubble generating area to allow liquid supply from the liquid supply chamber to the liquid flow path through the liquid supply port, or from application of a driving voltage to the bubble generating area until the period, while whole of bubble is isotropically grown by the bubble generating means, is terminated, the movable member closes tightly the liquid supply port to shut substantially and the movable member closes the opening area is closed tightly to shut substantially, and thereafter, during the part, of bubble generated by the bubble generating means, in the discharge port side part grows, the movable member starts to displace from the position, in which the opening area is closed tightly to shut substantially, to the above described bubble generating means side to make liquid supply from the common liquid supply chamber to the above described liquid flow path possible. By this, in the free end of the movable member, the flow path from the liquid supply port to the liquid flow path bends and thus, the flow of the liquid from the liquid flow path to the liquid supply port in the early period of bubbling is suppressed. By this, the substantially tightly closed situation of the liquid flow path and the liquid supply port is reliably created and hence, discharge characteristics are more improved. In addition, by suppressing the flow of the liquid from the liquid flow path to the liquid supply port in the early period of bubbling, a retreat distance of the meniscus in the discharge port after a droplet is discharged can be minimized. As the result, after discharge, the time for recovery of the meniscus to the initial status is very quick. In other words, the time, in which ink replenishment (refilling) of a predetermined volume in the liquid flow path is completed, is short and therefore, in practicing ink discharge of a high accuracy, (a predetermined volume) a discharge frequency (driving frequency) can be greatly improved.

Furthermore, the liquid discharge apparatus of the present invention has any one of the above described liquid discharge heads according to the present invention, and carrying means to carry the recording medium to receive the liquid discharged from the liquid discharge head.

Specifically, the above described liquid discharge apparatus operates recording by discharging the ink from the above described liquid discharge head to attach the ink to the above described recording medium.

According to the above described liquid discharge apparatus, recording can be operated by equipping with the above described liquid discharge head to increase the discharge efficiency of the liquid and suppress inconstant discharge volume.

According to the above described configuration, when the bubble occurs in the bubble generating area, the liquid flow path and immediately in the early period thereof, the liquid supply port are substantially tightly closed by the movable member. Therefore, a pressure wave generated by growth of the bubble in the bubble generating area is not propagated to the liquid supply port side and the liquid supply chamber side, but a large part thereof is directed to the discharge port and thus, a discharge power is greatly improved. In the case where a high viscosity recording liquid is used to fix the ink to a recording paper in a high speed and prevent smearing in a boundary between black and color areas, the great improvement of the discharge power allows better discharge. In addition, under an environmental change in recording, particularly in a low temperature and a low humidity environment, the following case may occur: the area, in which the ink increases viscosity, spreads in the discharge port to disturb normal ink discharge on use, however, in the present invention, even a first occasion of discharge is no problem. The discharge power has been greatly increased and therefore, energy consumed for discharge can be reduced by reducing the size of the heat generating body used for the bubble generating means.

The bubble in the bubble growing area is largely grown toward the discharge port side and suppressed to grow toward the liquid supply port side. Thus, by locating a disappearing point in the part from near a center of the bubble generating area to the discharge port side and keeping a bubbling power, the bubble disappearing power can be reduced. Therefore, a life of the heat generating body influenced by a mechanical and physical break caused by the bubble disappearing power of the bubble generating area can be greatly prolonged.

Other configuration and effect of the present invention will be understood on the basis of a description of each embodiment.

For reference, "upstream" and "downstream" used in description of the present invention are used as expressions concerning the direction of the flow from the supply source of the liquid to the discharge port through the bubble generating area (or, the movable member) or the direction in this configuration.

The "downstream side" related to the bubble itself means the downstream side related to the direction in the above described flow direction to the center of the bubble and the above described configuration, or the bubble generated in the area of the downstream than the center of the area of the heat generating body.

BRIEF DESCRIPTION OF THE DRAWINGS

FIG. 110 is a sectional view taken on line 110—110 of FIG. 108;

FIG. 111 is a sectional view of a flow path for explaining the "linear communication state";

FIGS. 112A and 112B are illustrations of the discharge operation of the liquid discharge head of the structure shown in FIGS. 108 to 110, expressed in terms of sectional views taken along the direction of one liquid flow path and divided into characteristic phenomena;

FIGS. 113A and 113B are illustrations of the discharge operation subsequent to that of FIGS. 112A and 112B, expressed in terms of sectional views of a liquid discharge head taken along the direction of one liquid flow path;

FIGS. 114A and 114B are illustrations of the discharge operation subsequent to that of FIGS. 113A and 113B, expressed in terms of sectional views of a liquid discharge head taken along the direction of one liquid flow path;

FIG. 115 is an illustration of the discharge operation subsequent to that of FIGS. 114A and 114B, expressed in terms of sectional views of a liquid discharge head taken along the direction of one liquid flow path;

FIG. 116A is a sectional view taken along the direction of one liquid flow path of a liquid discharge head according to the eighth embodiment of the present invention, where the whole heat generating element is covered with the free end of a movable member;

FIG. 116B is a sectional view taken along the direction of one liquid flow path of a liquid discharge head according to the eighth embodiment of the present invention, where the heat generating element is separated from a movable member;

FIG. 117 is a sectional view taken along the direction of one liquid flow path of a liquid discharge head according to variation of the eighth embodiment of the present invention;

FIG. 118 is a sectional view taken on line 118—118 of FIG. 117;

FIG. 119 is a sectional view taken along the direction of one liquid flow path of a liquid discharge head according to variation of the eighth embodiment of the present invention;

FIG. 120 is a sectional view taken on line 120—120 of FIG. 119;

Figure 121:
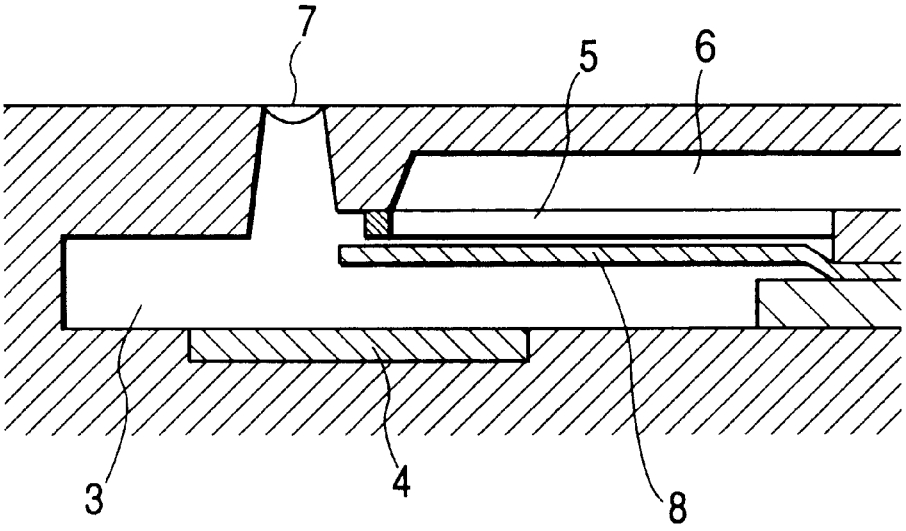
Figure 122A:
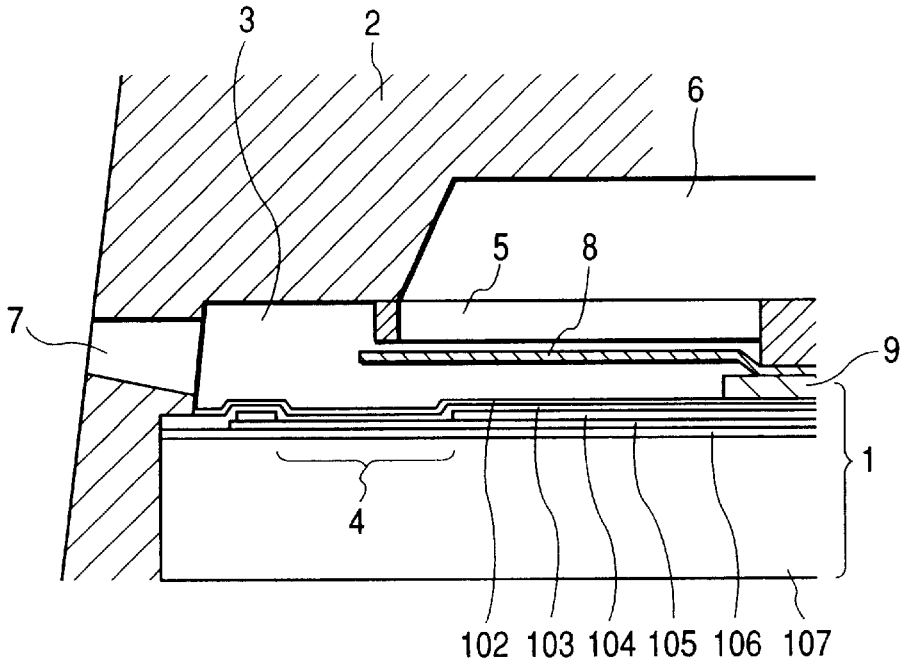
Figure 122B:
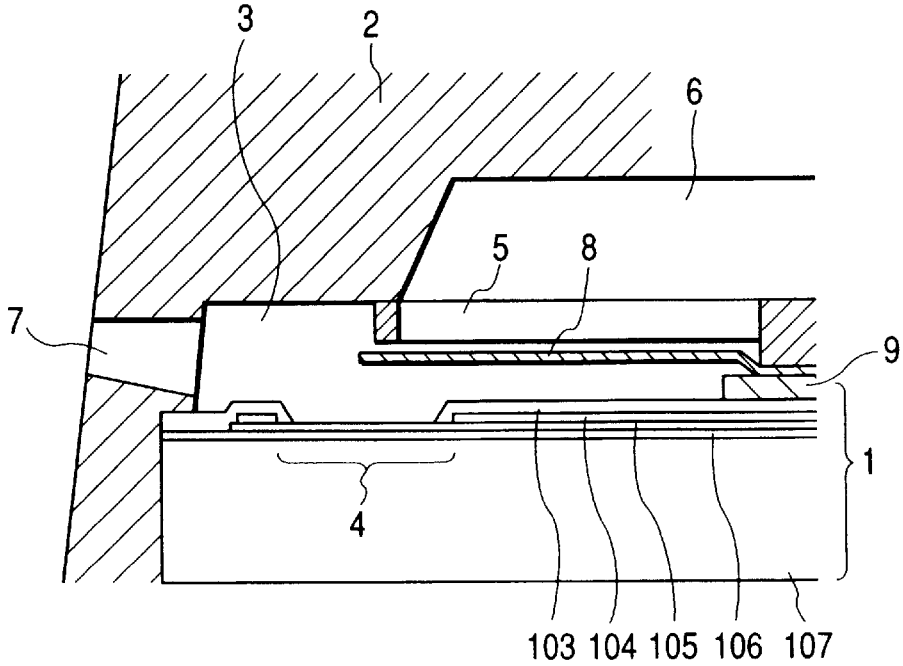
Figure 124:
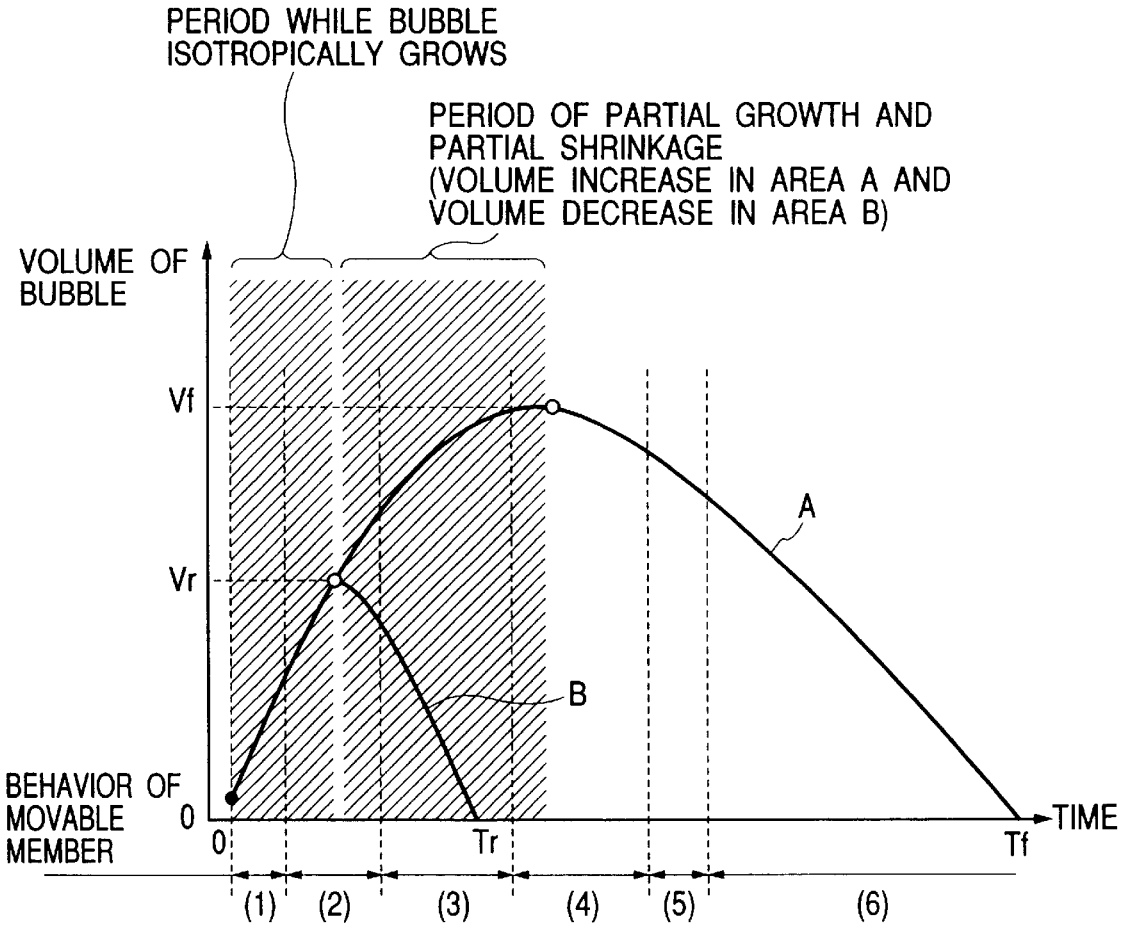
Figure 125:
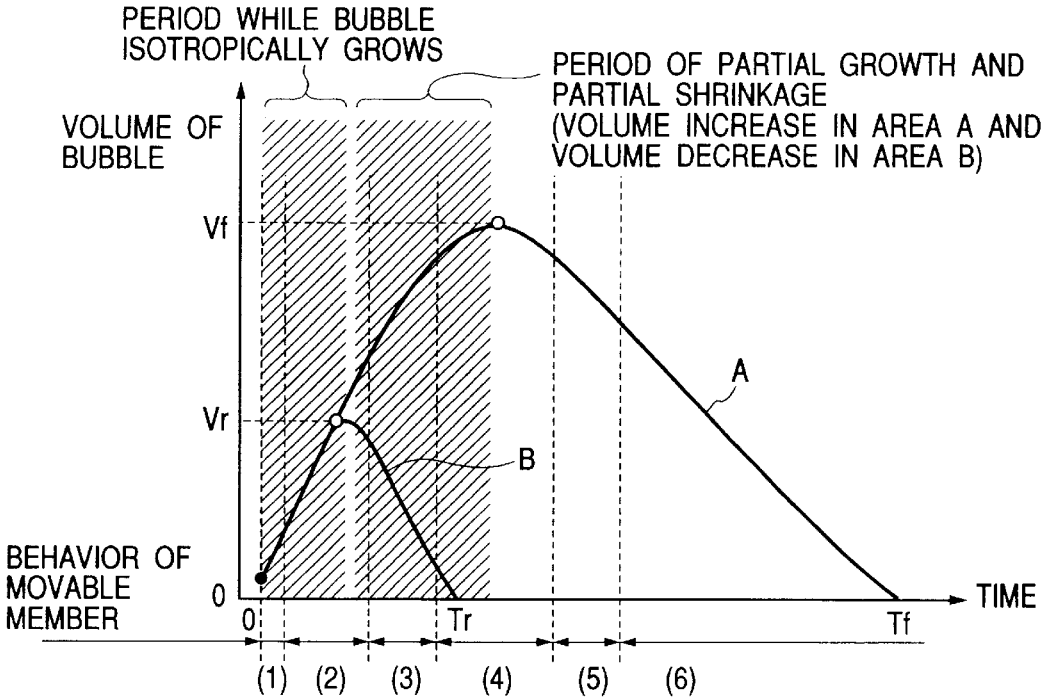
Figure 126:
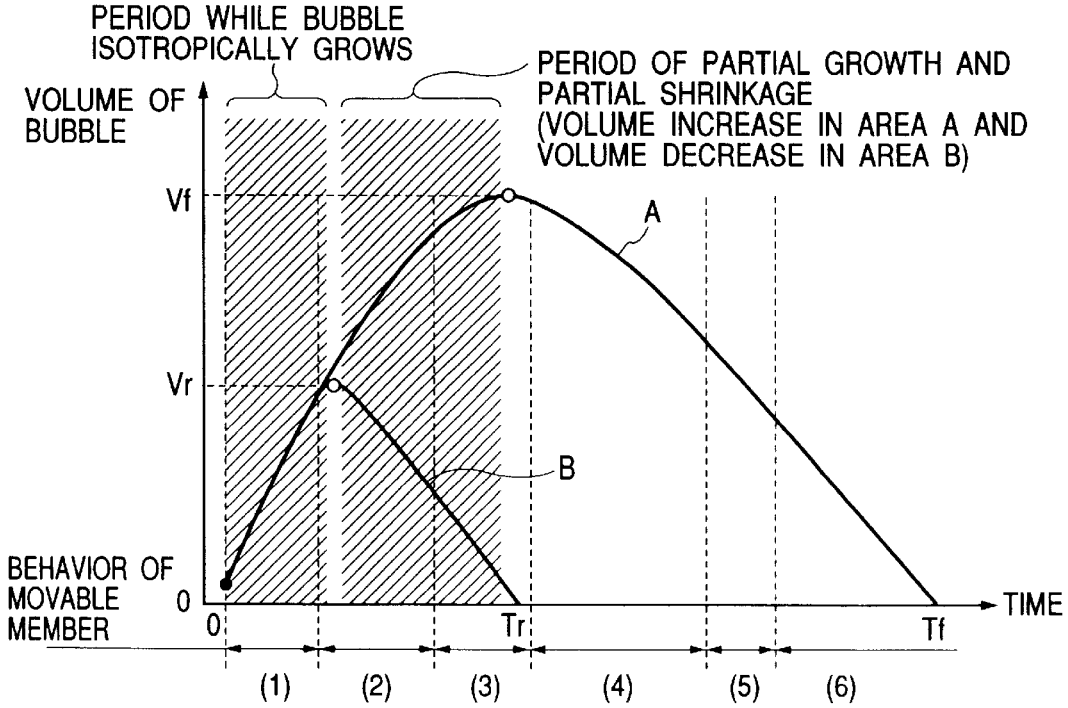
Figure 127:
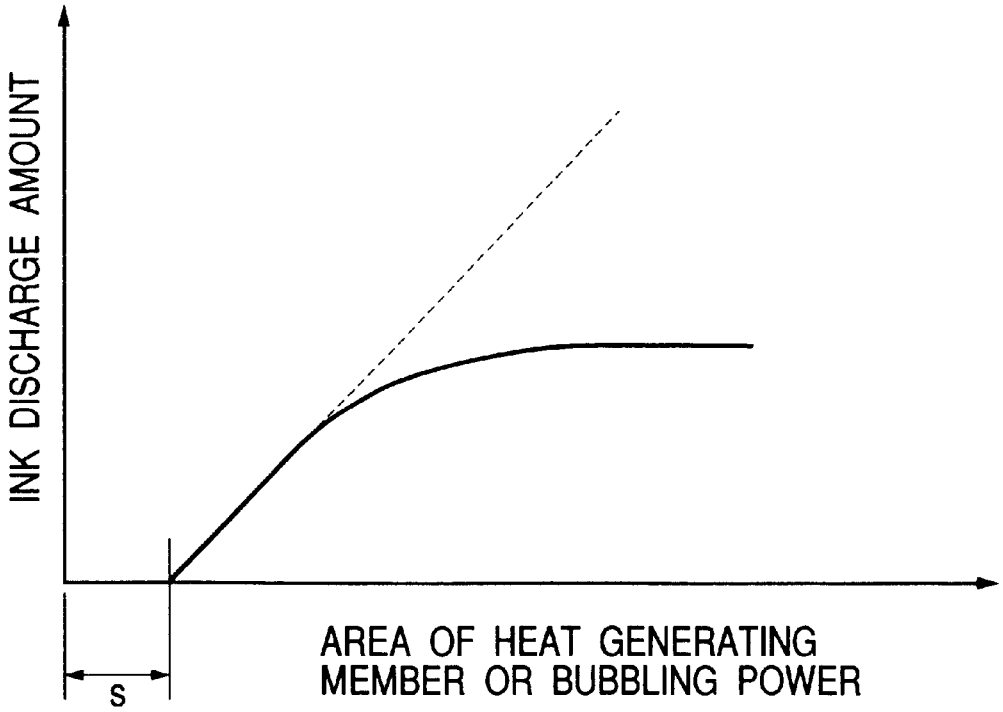
Figure 128:
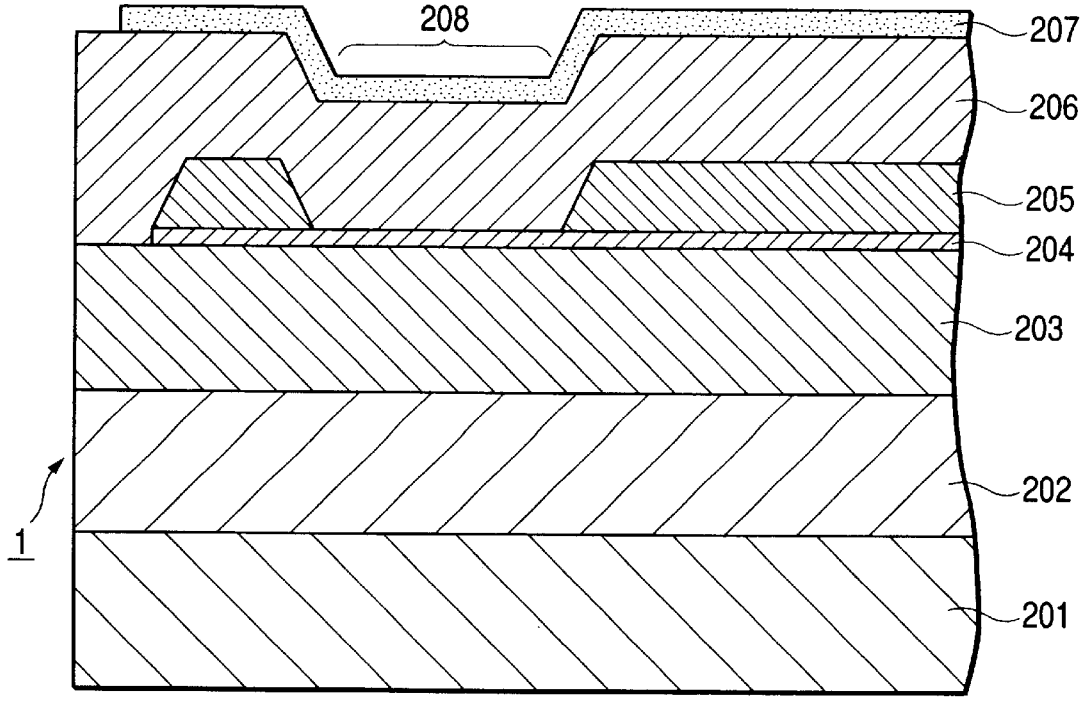
Figure 129:
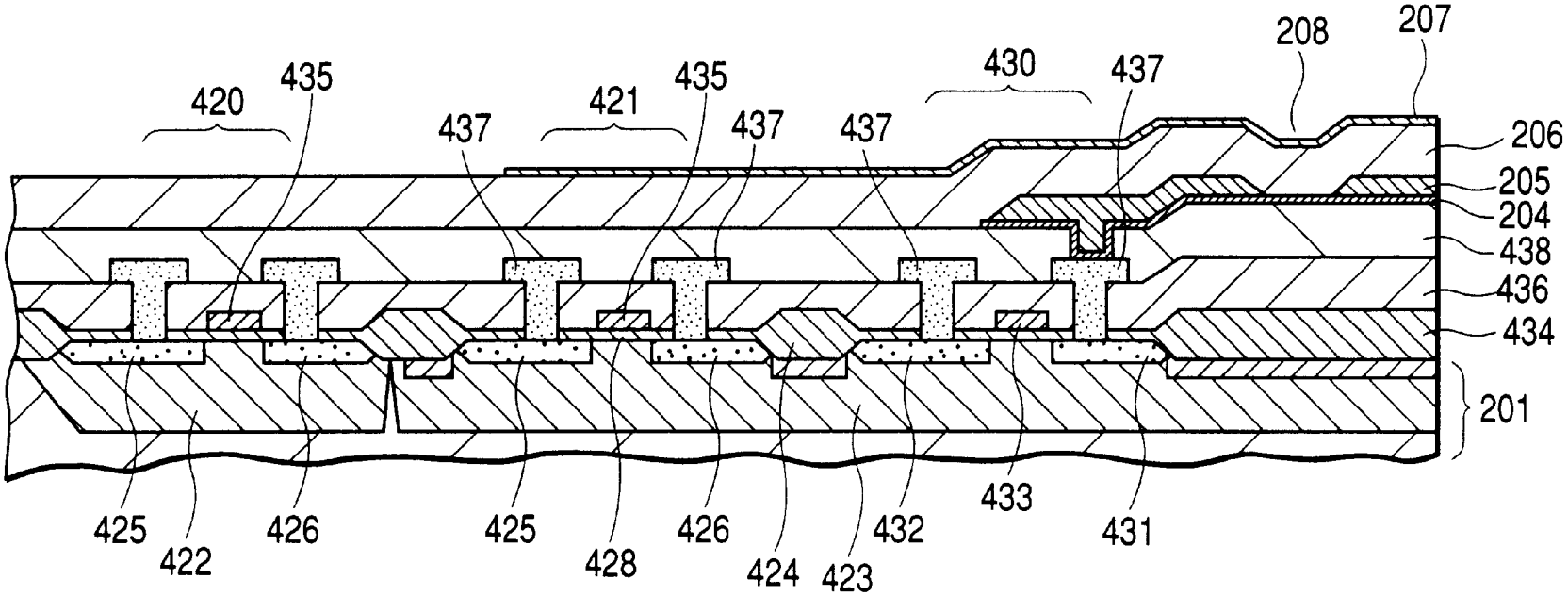
Figure 130:
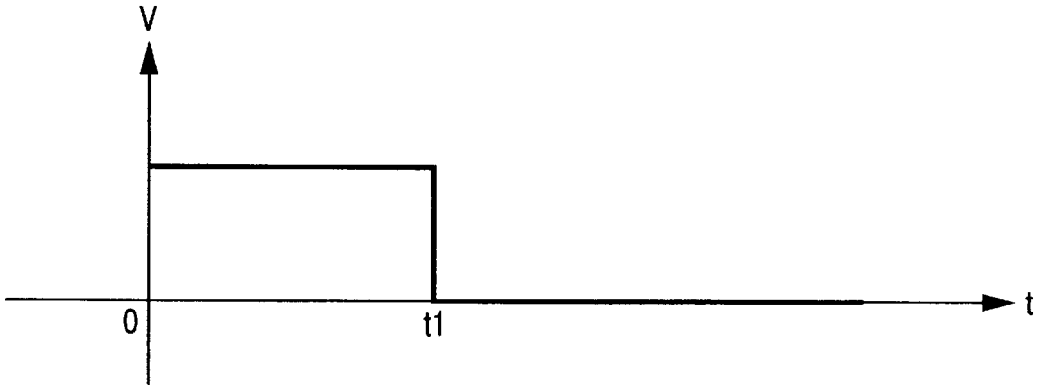
Figure 131:
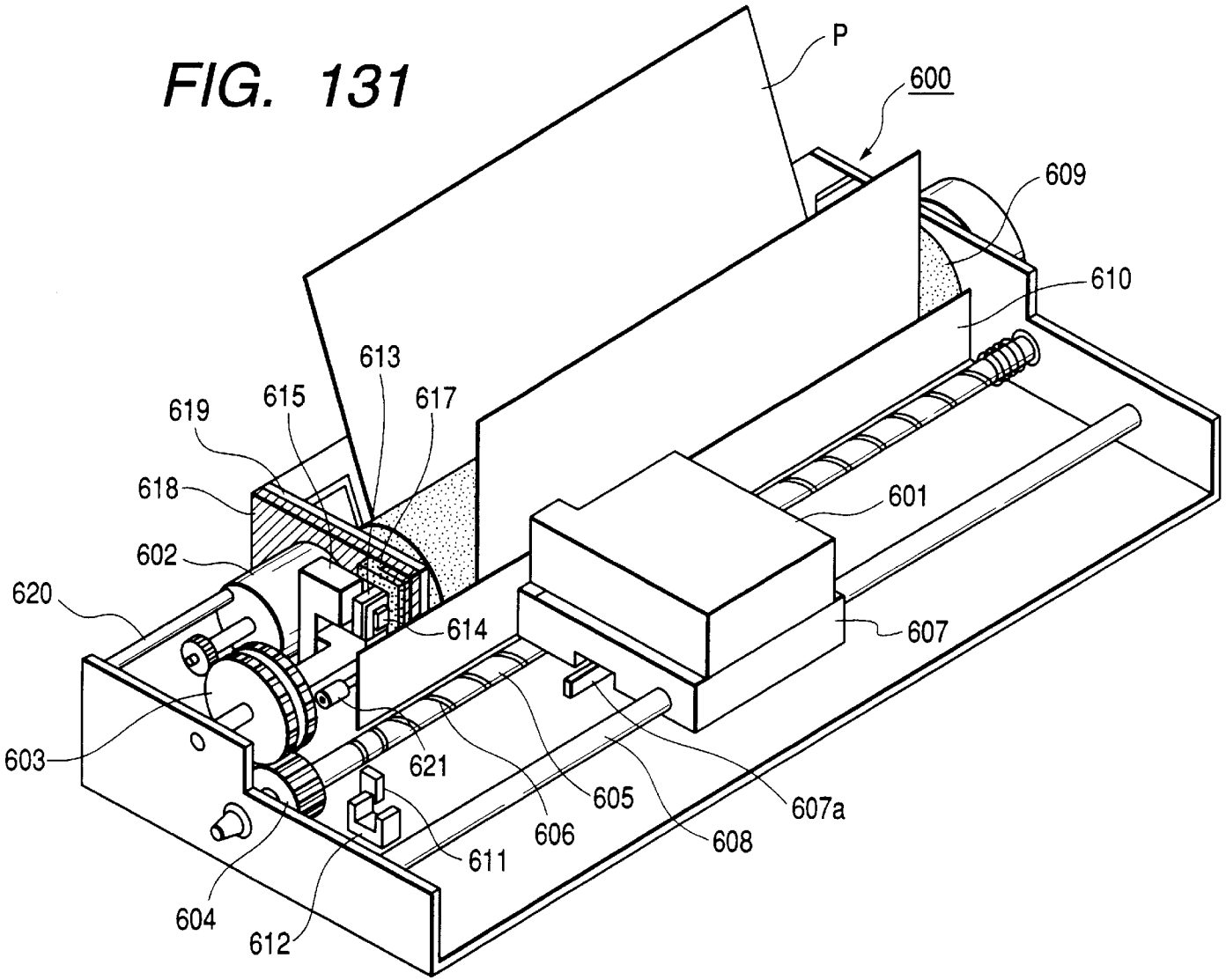
Figure 132:
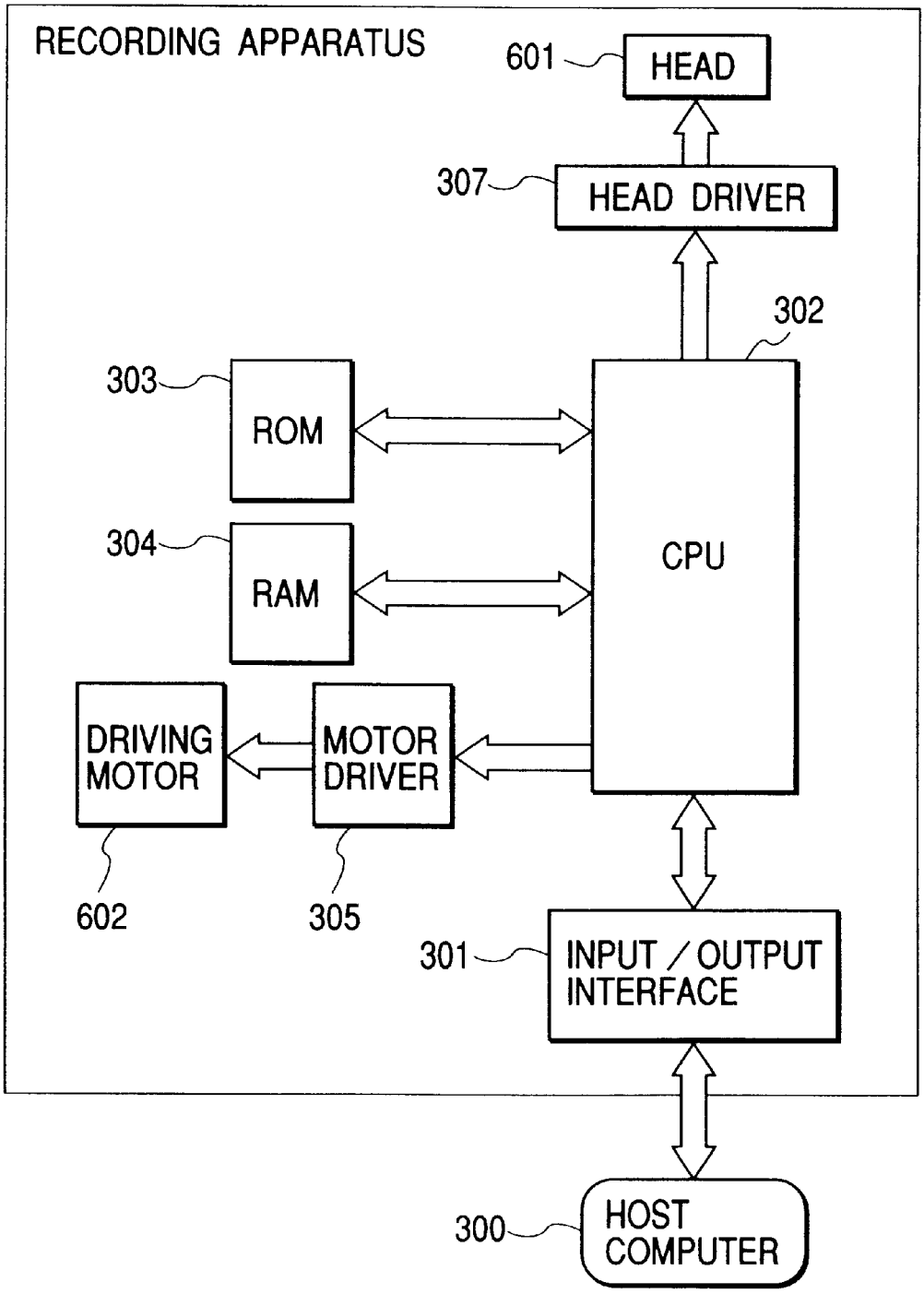
Figure 133:
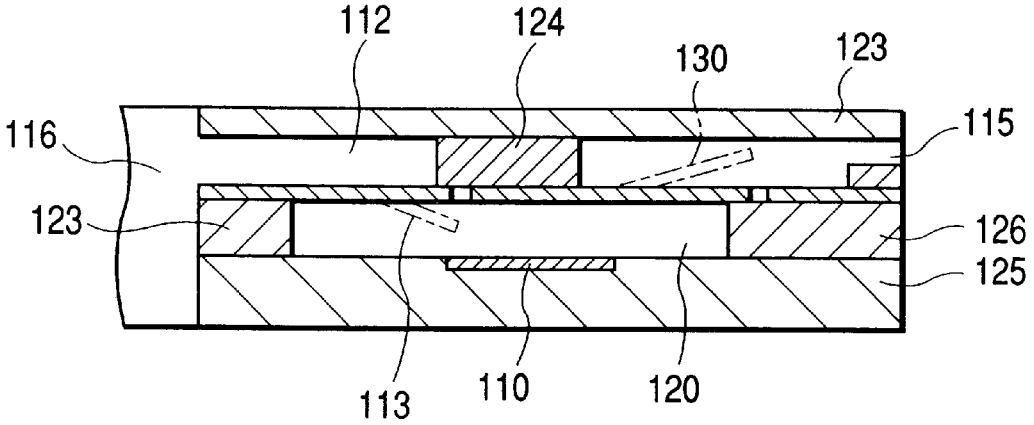

FIG. 121 is an illustration of an example of side-shooter type liquid discharge head corresponding to the configuration of a liquid discharge head according to the eighth embodiment of the present invention;

FIG. 122A is a vertically sectional view of a liquid discharge head according to the eighth embodiment of the present invention with a protective film;

FIG. 122B is a vertically sectional view of a liquid discharge head according to the eighth embodiment of the present invention without a protective film;

FIGS. 123A, 123B, 123C, 123D and 123E are illustrations of a isotropic growth state of a bubble;

FIG. 124 is a graph showing a correlation between a time change in bubble growth and the behavior of a movable member for Areas A and B in steps of the discharge operation;

FIG. 125 is a graph showing a correlation between a time change in bubble growth and the behavior of a movable member in a liquid discharge head according to the present invention, of a configuration that the whole heat generating element is covered with the free end of the movable member;

FIG. 126 is a graph showing a correlation between a time change in bubble growth and the behavior of a movable member in a liquid discharge head according to the present invention, of a configuration that the heat generating element is remote from the free end of the movable member;

FIG. 127 is a graph showing a correlation between the area of a heat generating element and the discharge amount of ink;

FIG. 128 is a sectional view of an element substrate to be used for liquid discharge heads according to various embodiments;

FIG. 129 is a typical sectional view of an element substrate sectioned in such a manner as to divide its main elements vertically shown in FIG. 128;

FIG. 130 is a graph of the wave form of a voltage for driving the heat generating element used in the present invention;

FIG. 131 is a perspective view showing the outline configuration of a liquid discharge apparatus with a liquid discharge head according to the present invention loaded;

FIG. 132 is a block diagram of the whole apparatus helpful in understanding a liquid discharge method according to the present invention for performing the liquid discharge recording by using a liquid discharge head according to the present invention; and FIG. 133 is a sectional view showing the arranging manner of a movable member in a conventional liquid discharge head.

DESCRIPTION OF THE PREFERRED EMBODIMENTS

Next, embodiments of the present invention will be described referring to the drawings.

First Embodiment

Figure 1:
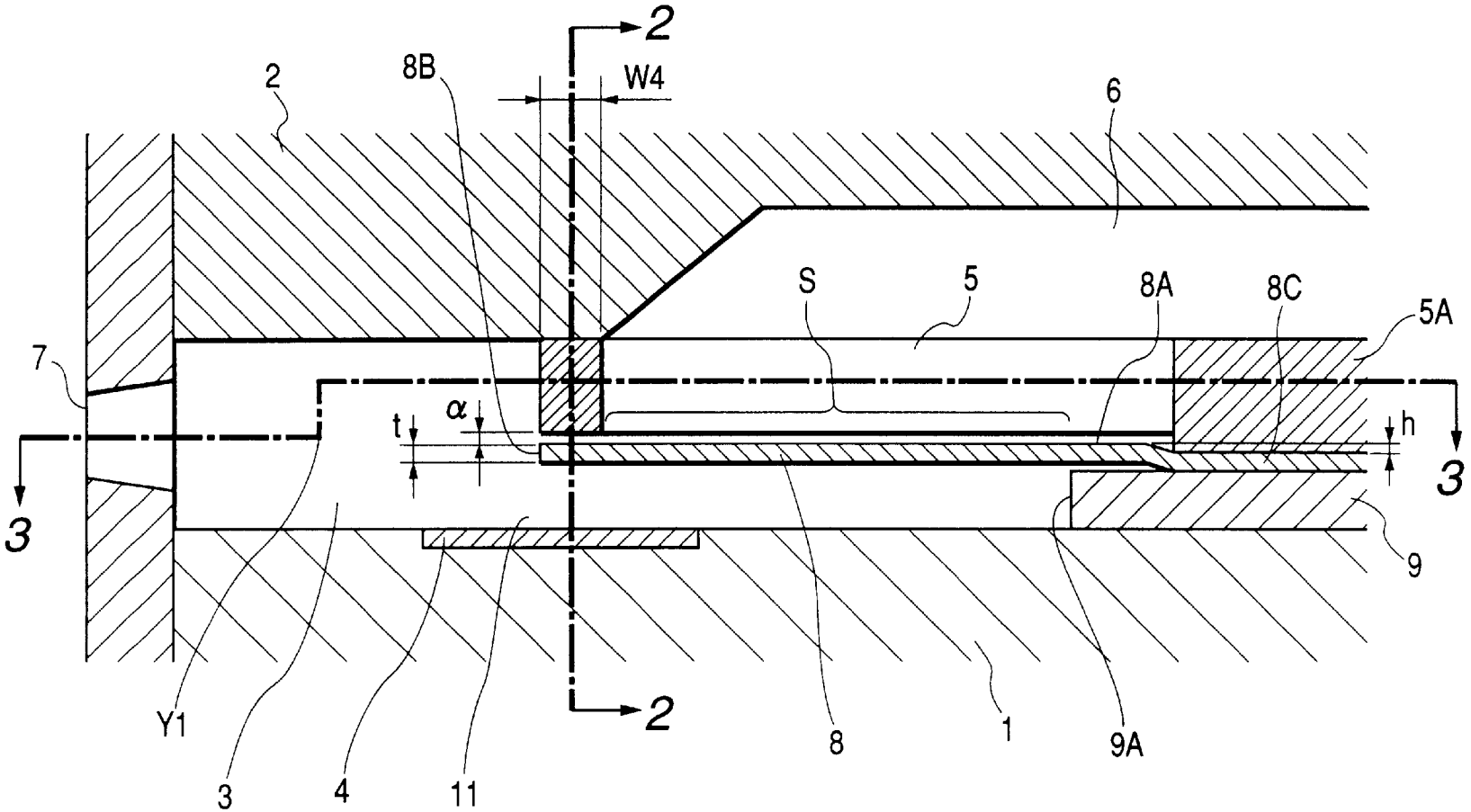
FIG. 1 is a sectional view taken along the direction of one liquid flow path of a liquid discharge head according to the first embodiment of the present invention.
Figure 2:
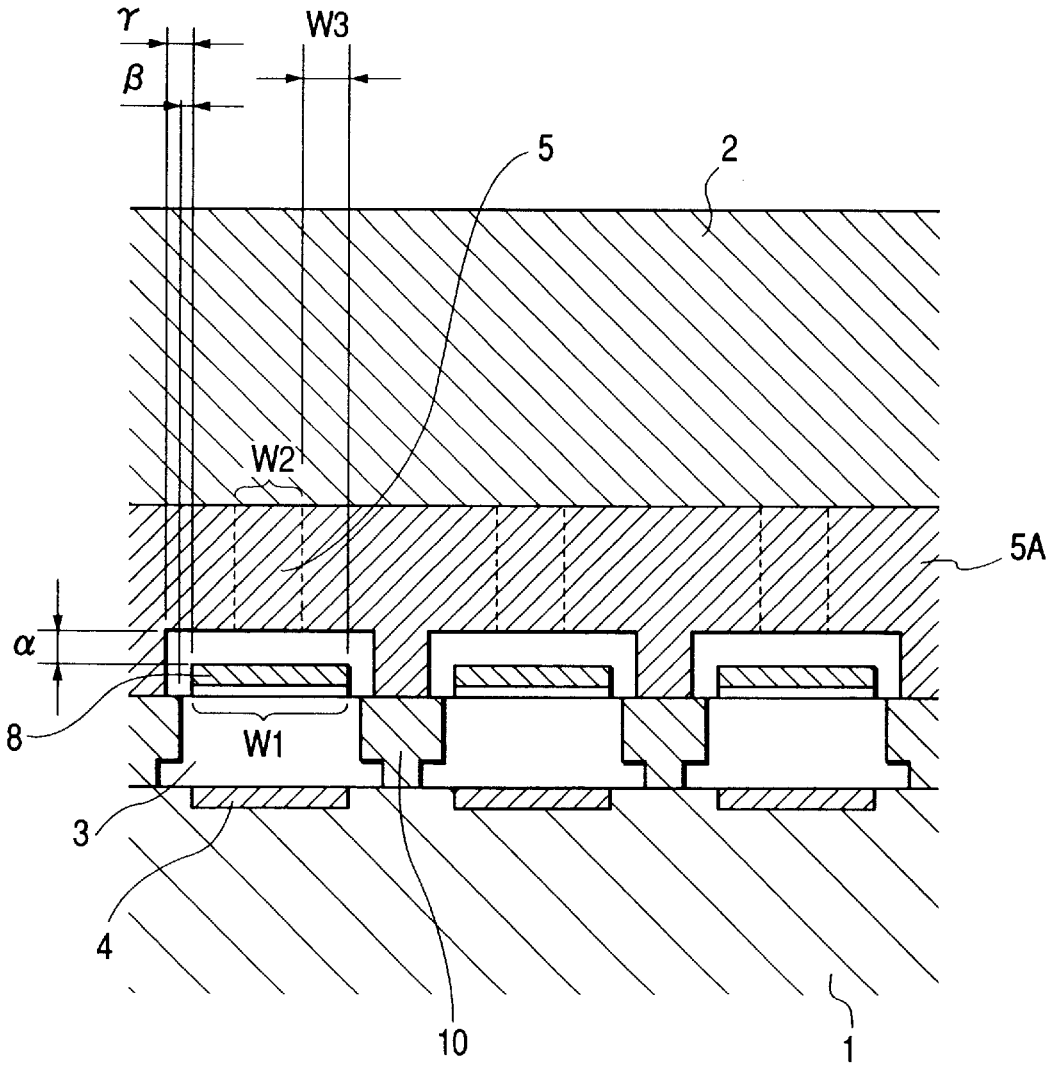
FIG. 2 is a sectional view taken on line 2—2 of FIG. 1.

FIG. 1 is a sectional view taken along one liquid flow path of a liquid discharge head according to the first embodiment of the present invention; FIG. 2 is a sectional view taken along line 2—2 of FIG. 1; and FIG. 3 is a sectional view taken along line 3—3 shifted to the side of a top board 2 at the point Y1 from the discharge port of FIG. 1.

Figure 3:
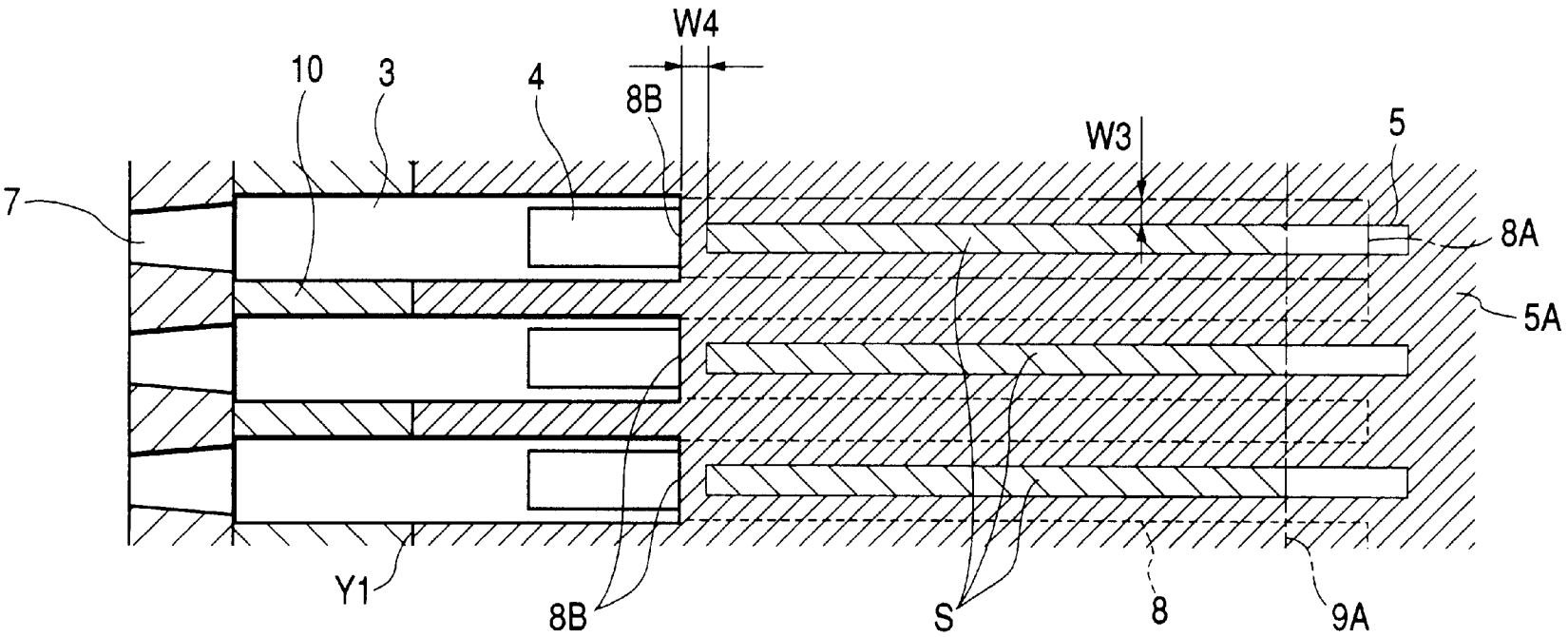
FIG. 3 is a sectional view taken on line 3—3 of FIG. 1.

In the liquid discharge head of the form of multiple liquid paths-a common chamber shown in FIGS. 1 to 3, an element substrate 1 and a top board 2 are fastened via a liquid path side wall 10 in a stacked state and a liquid flow path 3 communicating to a discharge port 7 at one end and closed at the other end is formed between both plates 1 and 2. A great number of such liquid flow paths 3 are provided at one head. Besides, in the element substrate 1, heat generating elements 4 such as electro-thermal converter elements as bubble generator means for generating bubble in liquids filled up at liquid flow paths 3 are disposed to individual liquid flow paths 3. In the vicinity area at the contact surface between a heat generating element 4 and a discharge liquid, there is present a bubble generating area 11 where a heat generating element 4 is rapidly heated to generate bubble in a discharge liquid.

In each of many liquid flow paths 3, a liquid supply port 5 formed at a supply part forming member 5A is disposed and a common liquid supply chamber 6 communicating to all individual liquid supply ports 5 is provided. In other words, a form of being branched from a single common liquid supply chamber 6 into many liquid flow paths 3 is observed and an amount of liquid corresponding to that of liquid discharged from the discharge port 7 communicating to each liquid flow path 3 is received from this common liquid supply chamber 6.

Between a liquid supply port 5 and a liquid flow path 3, a movable member 8 is provided an infinitesimal gap apart from the opening area S of the liquid supply port 5. The movable member 8 is situated in parallel with the element substrate 1. One end of the movable member 8 is a free end 8B situated at the side of a heat generating element 4 of the element substrate 1, whereas the other end is supported by a fixed member 9. Closed by this fixed member 9 is the port opposite from the discharge port 7 of the liquid flow path 3.

In a standstill state of the movable member 8 as shown in FIG. 1, the tip end of the movable member 8 at the side of the free end 8B is in contact with the supply part forming member 5A serving for a member for forming the liquid supply port 5 by means of its elastic force. Thus, a portion of the supply part forming member 5A at the side of the discharge port 7 constitutes a stopper part 5*b* pressed by the movable member 8 which the end of the side of free end 8B of the movable member 8 is in butt contact with. The portion of the movable member 8 between the portion in contact with the stopper part 5*b* and the portion fixed to the fixing part 9 is only an infinitesimal gap apart from the liquid supply port 5 and the infinitesimal gap between the movable member 8 and the liquid supply port gradually broadens from the free end 8B toward the side of the fulcrum 8A.

The area enclosed by at least the free end part of the movable member 8 and the both lateral parts adjacent thereto becomes greater than the opening area of the liquid supply port 5 (See FIG. 3) and an infinitesimal gap $\beta$ is present between the lateral part of the movable member 8 and both the respective flow path side walls 10 (See FIG. 2). The above supply part forming member 5A is apart via a gap $\gamma$ from the movable member 8 as shown in FIG. 2. Gaps $\mu$ and $\gamma$ depend on the pitch of the flow path, but a great value of $\gamma$ makes it easy for the movable member 8 to shut off the opening area S and a large value of $\beta$ makes it easy for the movable member 8 to move to the side of the element substrate 1 with the disappearance of bubble rather than the stationary state of being situated via a gap from the liquid supply port 5. With this embodiment, gaps between the fulcrum 8A of the movable member 8 and the liquid supply port 5, concretely the gap $\alpha$ shown in FIG. 2 was set to 3 $\mu$m, the gap $\beta$ was set to 3 $\mu$m and the gap $\gamma$ was set to 4 $\mu$m.

Besides, in width with the flow path side wall 10, the movable member 8 has a greater width W1 than the width W2 of the above opening area S, which is wide enough to seal the opening area S. On an extension of the end part at the side of the free end of the continuous part continuous concerning the crossing direction of movable members to flow paths, the fulcrum 8A of the movable member 8 prescribes the upstream side end part of the opening area S of the liquid supply port 5 (See FIG. 3). In this embodiment, as shown in FIGS. 2 and 3, the portion of the supply part forming member 5A along the movable member 8 is set less wide than the flow path side wall 10 itself and the supply part forming member 5A is stacked on the flow path side wall 10. Incidentally, the supply part forming member 5A is set equal in width to the flow path side wall 10 at the side of discharge port 7 rather than at the side of the free end 8B of the movable member 8 as shown in FIG. 3.

By these, whereas the movable member 8 is movable without a frictional resistance in the liquid flow path 3, its displacement toward the side of the opening area S can be regulated by the peripheral part thereof. Thereby, the opening area S can be substantially blocked to prevent the liquid flow from inside the liquid flow path 3 to the common liquid supply chamber 6 from being reversed, while on the other hand, the movement from the substantially sealed state to the refillable state becomes possible to the liquid flow path side with the disappearance of bubble. In a state that the movable member 8 is at rest, the tip end of the movable member 8 at the side of the free end 8B is in contact with the stopper part 5*b* of the supply part forming member 5A and moreover an infinitesimal gap is present between the lateral part in a portion of the movable member 8 at the side of its fulcrum 8A and the supply part forming member 5A, while there is a slight communication between the liquid supply port 5 and the liquid flow path 3 through the infinitesimal gap.

Incidentally, the opening area S is a substantial area for supplying a liquid from the liquid supply port toward the liquid flow path 3 and an area enclosed by the three sides of the liquid supply port 5 and the end part 9A of the fixed member 9 in this embodiment as shown in FIGS. 1 and 3.

Figure 4:
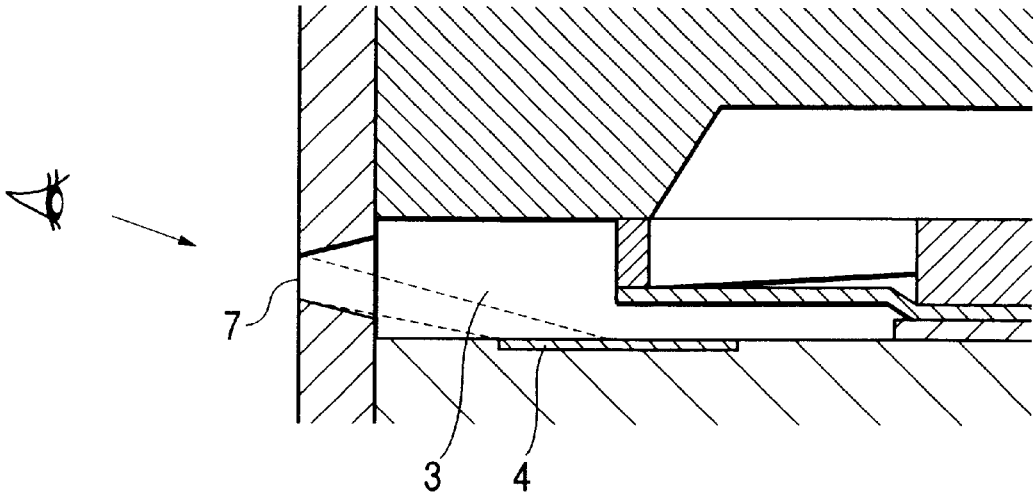
FIG. 4 is a sectional view of a flow path for explaining the "linear communication state"

Besides, as shown in FIG. 4, this embodiment, having no such an obstacle as valve between the heat generating element 4 as an electro-thermal converter and the discharge port 7, is in a "straight communicable state" with the structure of a straight flow path kept to a liquid flow. This becomes well preferable if an ideal state of stabilizing the discharge conditions such as discharge direction and discharge rate of discharge drops at an extremely high level is formed by matching the propagating direction of a pressure wave occurring at the generation of bubble with the accompanying flow direction and the discharge direction of the liquid straightly. In this present invention, it is only necessary as one definition for attaining or approaching to this ideal state to choose a construction of directly combining the discharge port 7 with the side of the discharge port 7 (downstream side) of a heat generating element 4, in particular, the heat generating element 4 influential to the side of the discharge port 7 of bubble, by using a straight line, which means an observable state of the heat generating element 4, in particular, the downstream side thereof, when viewed from the exterior of the discharge port 7 in absence of a liquid in the liquid flow path 3 (See FIG. 4).

Next, the movement of the movable member 8 in a liquid discharge port according to the present invention will be described in detail. FIGS. 5A and 5B to FIGS. 8A and 8B show not only a liquid discharge head in a sectional view taken along a liquid flow path to illustrate the movement of a movable member 8 in the liquid discharge head of such a structure as shown in FIGS. 1 to 3, but a characteristic phenomenon divided in 8 steps of FIGS. 5A to 8B.

Figure 5A:
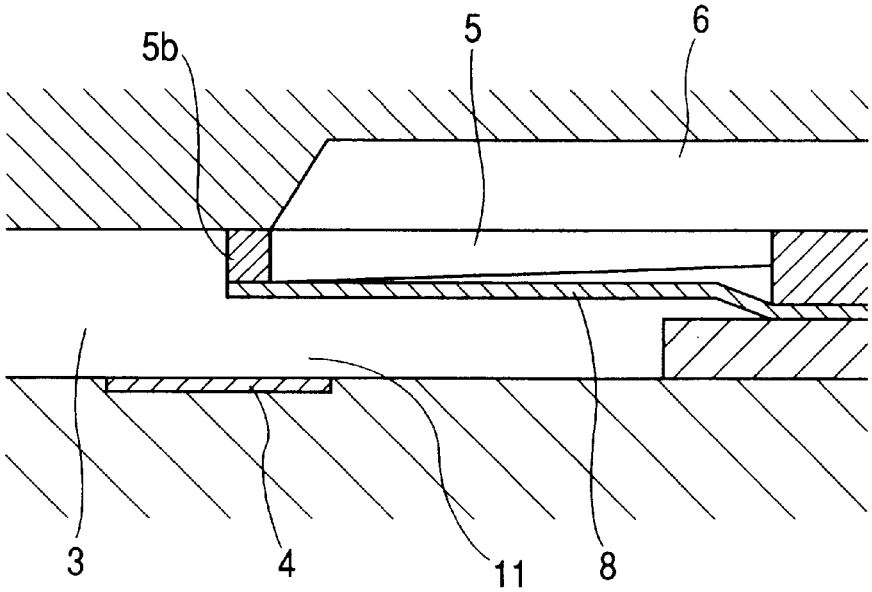
FIGS. 5A and 5B are illustrations of the discharge operation of the liquid discharge head of the structure shown in FIGS. 1 to 3, expressed in terms of sectional views taken along the direction of one liquid flow path and divided into characteristic phenomena.

FIG. 5A shows a state prior to the application of an energy such as electric energy to a heat generating element 4 and before the heat generating element 4 generates heat. In this state, an infinitesimal gap (not greater than 10 $\mu$m) is present apart from the formed surface of the liquid supply port 5 over an extent from the center part to the fulcrum side in the movable member 8 provided between the liquid supply port 5 and the liquid flow path 3.

Here, it is important that a movable member 8 is provided at a position facing nearly a half of the upstream side of a bubble generated by heat of a heat generating element 4, the free end part of the movable member 8 and the stopper part 5*b* of a supply part forming member 5A are disposed above the center of a bubble generating area 11 and the movable member 8 is in contact with the stopper part 5*b* before the generation of bubble by dint of a liquid flow path structure, the disposing position of the movable member 8 and an elastic force of the movable member 8.

Figure 5B:
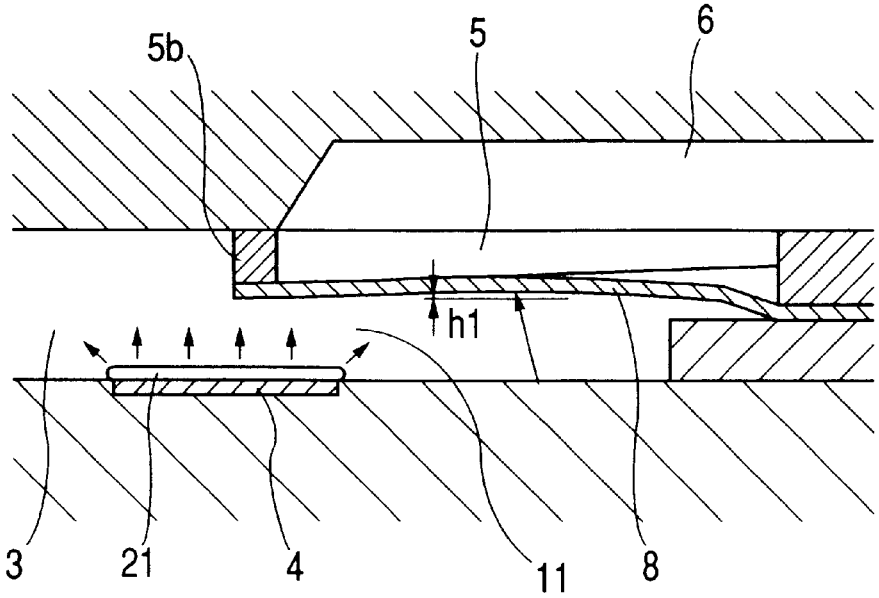

FIG. 5B shows a state that part of the liquid filling the liquid flow path 3 is heated by a heat generating element 4, film boiling occurs on the heat generating element 4 and bubble 21 grow isotropically. Here, the phrase "the growth of a bubble is isotropic" means a state that the growing rate of a bubble toward the normal of a bubble surface is almost equal in positions of the bubble surface.

In an isotropic growth process of a bubble 21 at this initial stage of bubble generation, the displacement of an extent of the movable member 8 between the portion in contact with the stopper part 5*b* and the portion near the fulcrum 8A toward the side of the liquid supply port 5 brings the movable member 8 into close contact with the peripheral portion of the liquid supply port 5 to block up the liquid supply port 5, so that the interior of the liquid flow path 3 comes substantially into a sealed state except the discharge port 7. By the way, a period while the sealing state is established and maintained may lie within a period from the application of a driving voltage to a heat generating element 4 to the completion of an isotropic growth of a bubble 21. Besides, in this sealed state, the inertance (difficulty in moving when a still water begins to move suddenly) from the center of the heat generating element 4 to the side of the liquid supply port amounts substantially to an infinity in the liquid flow path 3. At this time, the inertance from the heat generating element 4 to the side of the liquid supply port approaches more to an infinity the greater distance is taken between the heat generating element 4 and the movable member 8. Furthermore, at this time, hi is let to be a maximum displacement of a portion near the fulcrum of the movable member 8 to the side of the liquid supply port 5.

In this embodiment, contact of the free end of the movable member 8 with the stopper part 5*b* in a stationary state as mentioned above shortens the time from the generation of bubble till the blockage of the liquid supply port 5 with the movable member 8 in comparison with the case where the free end of the movable member 8 is remote from the stopper part 5*b* in a stationary state, thus suppressing the move of ink from the liquid flow path 3 to the liquid supply port 5 at the greatest possible. Thereby, loss of discharge power due to the move of ink from the liquid flow path 3 to the liquid supply port 5 is lessened in the discharge operation and the discharge efficiency of a liquid discharge head is improved. Besides, along with this, a rapid transit is enabled from the isotropic growth of a bubble to the period of partial growth and partial shrinkage while the portion at the side of the discharge port 7 in the bubble 21 grows and the portion at that of the liquid supply port 5 in the bubble 21 shrinks.

Figure 6A:
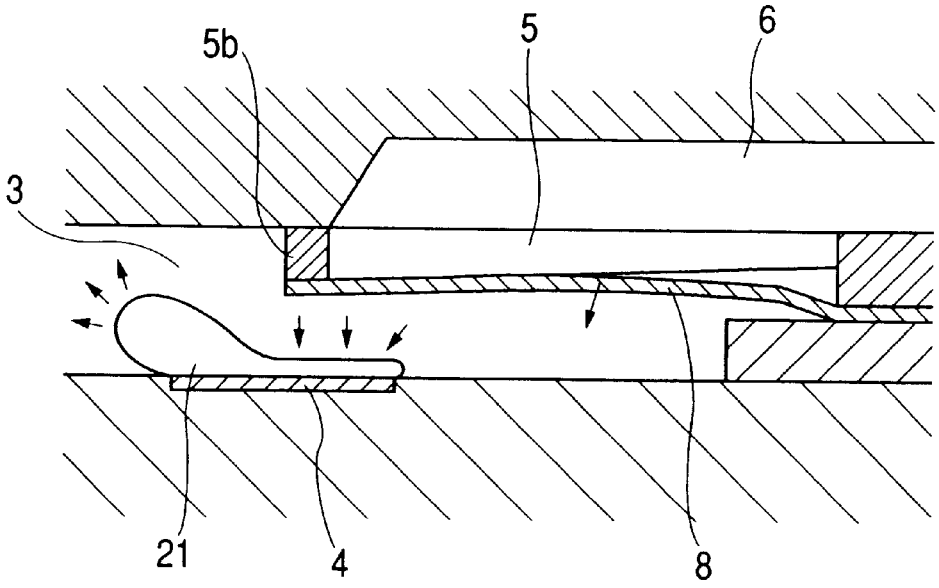
FIGS. 6A and 6B are illustrations of the discharge operation subsequent to that of FIGS. 5A and 5B, expressed in terms of sectional views taken along the direction of one liquid flow path of a liquid discharge head.

FIG. 6A shows a state of a bubble 21 keeping to grow. In this state, since the interior of the liquid flow path 3 is substantially in a sealed state except the discharge port 7, the flow of a liquid does not reach the side of the liquid supply port 5. Accordingly, the bubble 21 can expand greatly to the side of the discharge port 7, but does not so much to that of the liquid supply port 5. And, at the side of the discharge port 7 in the bubble generating area 11, the bubble growth continues, but by contraries, the bubble growth stops at that of the liquid supply port 5 in the bubble generating area 11. In brief, this bubble growth stop state becomes a maximum bubbling state at the side of the liquid supply port 5 in the bubble generating area 11. Vr is let to be the bubbling volume of this time.

At this time, the bubble growth of Area B stops and a force pressing the movable member 8 to the liquid supply port 5 weakens. In this way, by the elastic force of the movable member 8, the vicinity of the center part of the movable member 8 is just about to begin a downward displacement toward a stationary state.

Figure 123A:
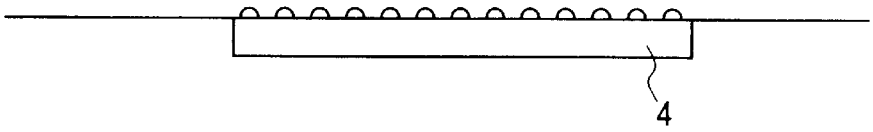
Figure 123B:
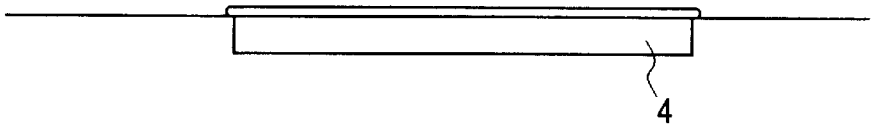
Figure 123C:
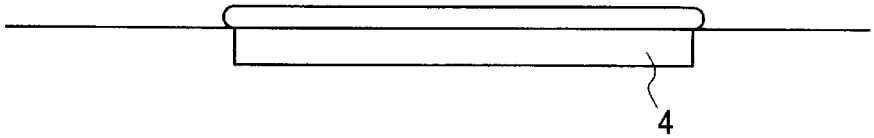
Figure 123D:
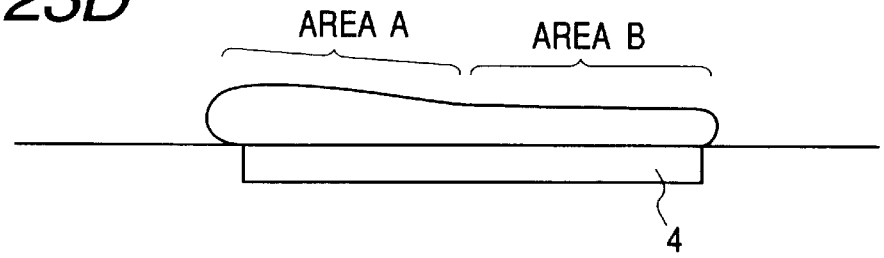
Figure 123E:
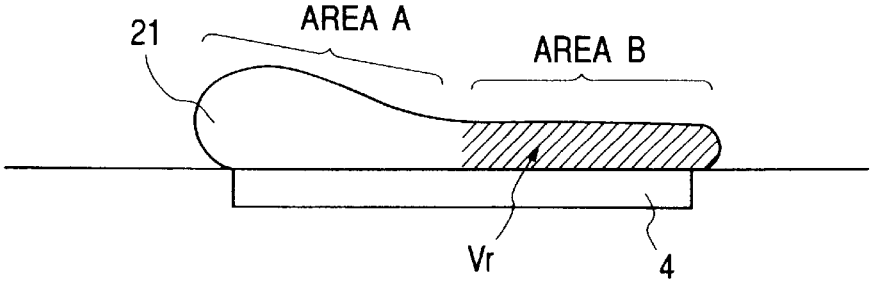

Here, referring to FIGS. 123A–123E, the growing process of a bubble in FIGS. 5A, 5B and 6A will be described in detail. On heating a heat generating element 4, as shown in FIG. 123A, an initial boiling takes place on the heat generating element 4, then changing to a film boiling in which a filmy bubble covers over the heat generating element 4 as shown in FIG. 123B. And, the bubble of a film boiling state keeps growing isotropically as shown in FIGS. 123B and 123C (such an isotropically growing state of a bubble is referred to as semi-pillow state). When the interior of the liquid flow path 3 turns substantially into a sealed state except the discharge port 7 as shown in FIG. 5B, however, the move of a liquid toward the upstream side is disabled, so that part of a bubble in the semi-pillow state at the upstream side (side of the liquid supply port 5) becomes unable to grow so much and the rest portion of downstream side (side of the discharge port 7) grows greatly. This state is shown in FIG. 6A or FIGS. 123D and 123E. Here, for the convenience of explanation, an area in which no bubble grows on the heat generating element 4 and an area at the side of the discharge port 7 in which a bubble grows when heating the heat generating element 4 are designated with Area B and Area A, respectively. Incidentally, in Area B shown in FIG. 123E, the bubbling volume reaches a maximum and Vr is let to be the bubbling volume of this time.

Figure 6B:
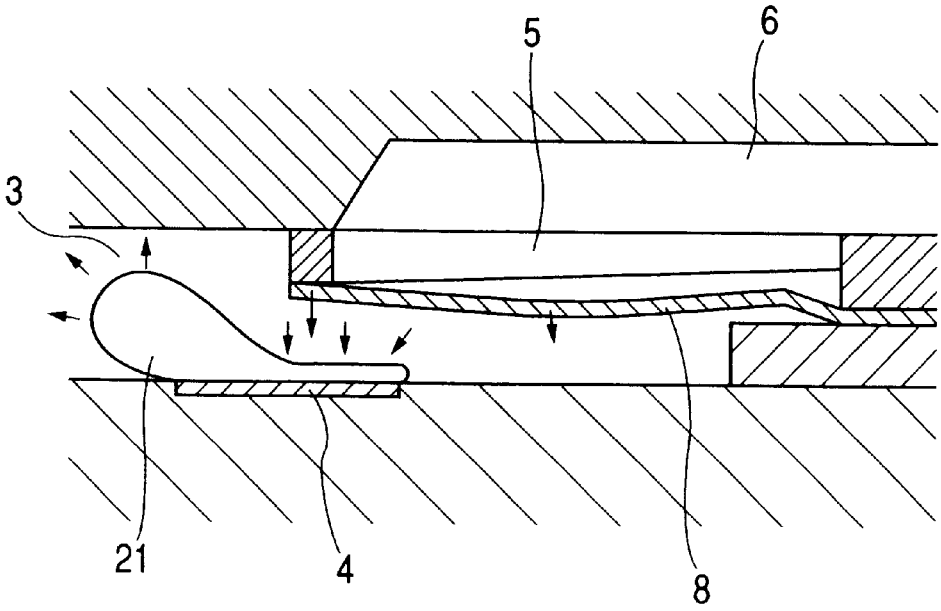

Next, FIG. 6B shows a state at which the growth of a bubble continues in Area A and the shrinkage of a bubble has begun in Area B. In this state, a bubble grows greatly toward the side of the discharge port in Area A and the volume of a bubble begins to decrease in Area B. Thereby, an extent between the portion in contact with the stopper part 5*b* and the portion fixed to the fixed member 9 of the movable member 8 begins to be displaced downward to the stationary state position under action of the recovering force due to its rigidity and the disappearing force of a bubble in Area B. As a result, the liquid supply port 5 opens near the fulcrum part of the movable member 8, while the common liquid supply chamber 6 and the liquid flow path 3 turn into a communicable state through an infinitesimal gap between the portion near the fulcrum part of the movable member 8 and the liquid supply port 5.

Figure 9:
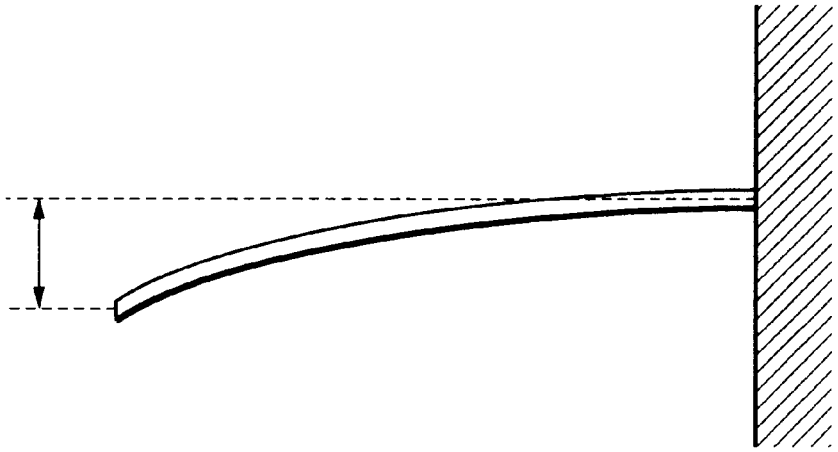
FIG. 9 is a pictorial view showing the first order vibrational mode of a cantilever with a free end at one side.
Figure 10:
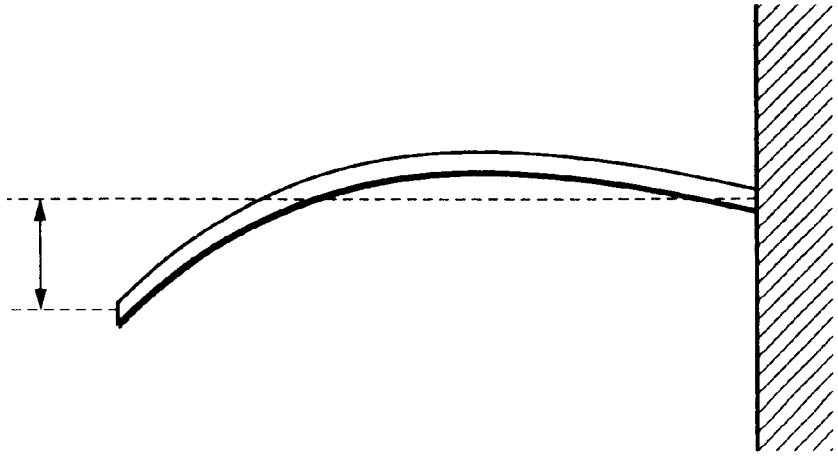
FIG. 10 is a pictorial view showing the second order vibrational mode of a cantilever with a free end at one side.

At this time, the center part of the movable member 8 begins the downward displacement at first and subsequently the free end of the movable member 8 is displaced downward. For this reason, the movable member 8 is displaced at a second or higher order vibrational mode. Referring to FIGS. 9 and 10, higher order vibrational modes will be described below.

Figure 7A:
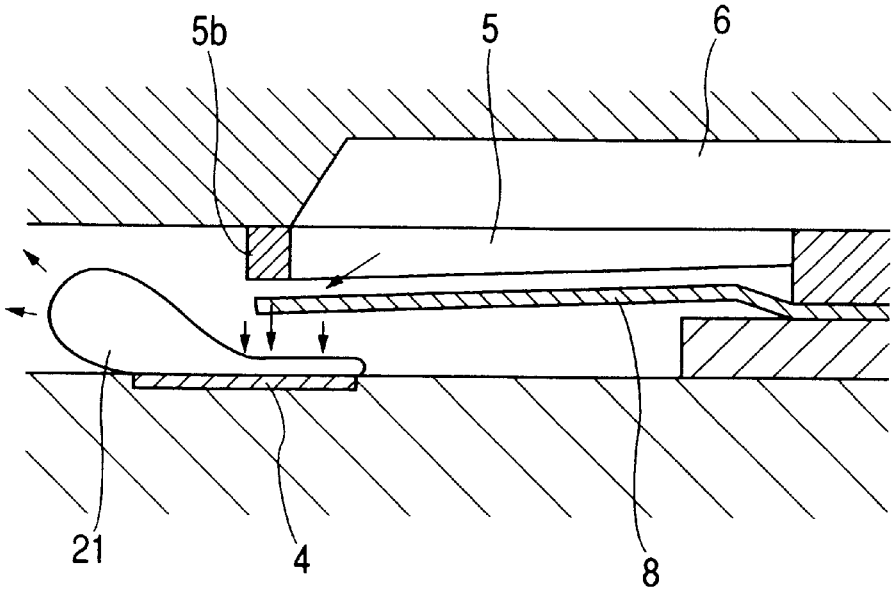
FIGS. 7A and 7B are illustrations of the discharge operation subsequent to that of FIGS. 6A and 6B, expressed in terms of sectional views taken along the direction of one liquid flow path of a liquid discharge head.

FIG. 7A shows a state that the free end 8B also starts the downward displacement subsequently to the center part of the movable member 8 and the refill of a liquid from the liquid supply port 5 begins in consequence. Accompanying the refill of a liquid, the bubble of Area B begins to shrink, but the bubble of Area A still remains growing. At this time, since the vibration of the movable member 8 is of a higher mode, the displacement velocity of the free end 8B is great.

Here, referring to FIGS. 9 and 10, higher order vibrational modes will be described in detail. The first order vibrational mode of a cantilever with one end being free is shown in FIG. 9 and the second order vibrational mode is shown in FIG. 10. Compared with the first order vibrational mode, the second order vibrational mode has a large natural frequency and also exhibits a great displacement at the free end. Thus, in this embodiment, vibrating the movable member 8 at the second order vibrational mode makes it possible to shorten the duration of downward displacement in the movable member 8 and to complete the refill for a short time while increasing the displacement of the free end in the movable member 8.

Figure 7B:
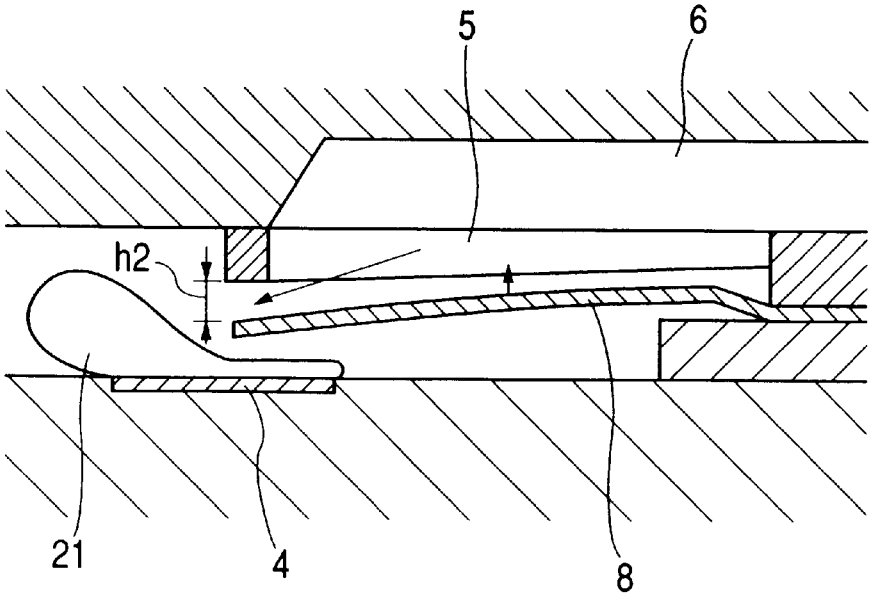

FIG. 7B shows a state that the bubble 21 has grown to a nearly maximum. At this state, a bubble in Area A has grown to a maximum and almost all bubbles in Area B disappear by the refill from the liquid supply port 5. Furthermore, the downward displacement rate of the free end in the movable member 8 decreases and its displacement is just about to stop, whereas the vicinity of the center part of the movable member 8 has already started the upward displacement. Vf is let to be a maximum bubble volume in Area A at this time. Besides, the discharge liquid under discharge from the discharge port 7 is still tied to a meniscus with a long tail drawn.

Figure 8A:
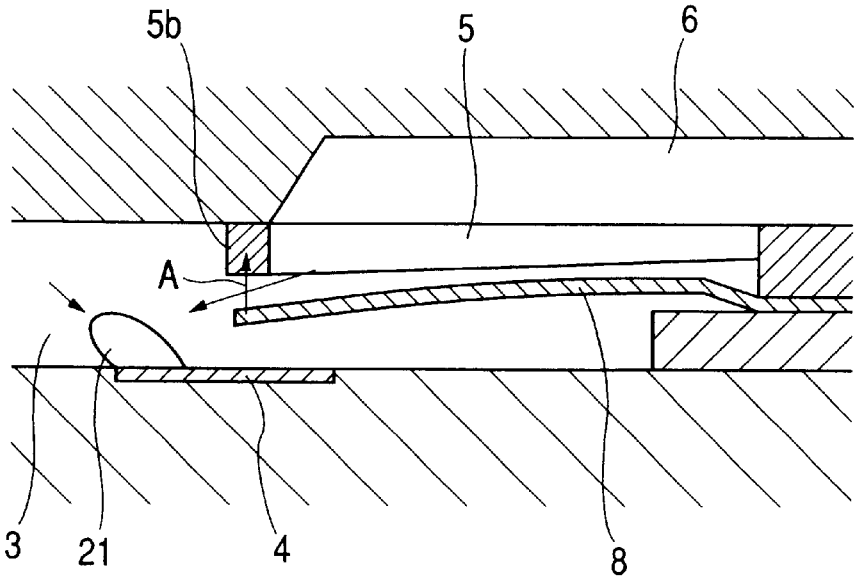
FIGS. 8A and 8B are illustrations of the discharge operation subsequent to that of FIGS. 7A and 7B, expressed in terms of sectional views taken along the direction of one liquid flow path of a liquid discharge head.

FIG. 8A shows the bubble disappearing step of a bubble in Area A. Along with the refill of a liquid from the liquid supply port 5, the free end 8B of the movable member 8 starts the upward displacement quickly and the movable member 8 is about to recover to a stationary state.

Figure 8B:
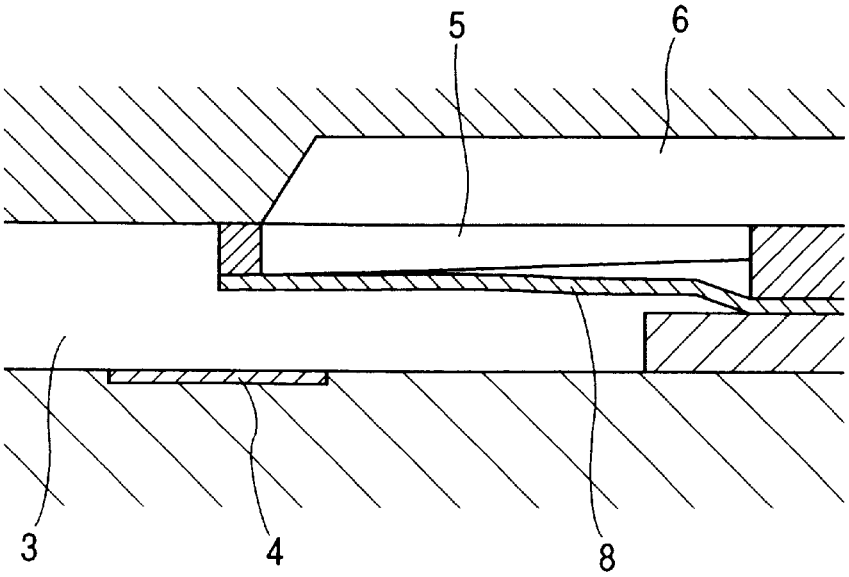

FIG. 8B corresponds to the stage of a bubble disappearing step alone at which the growth of the bubble 21 stops. Right after the bubble growth changes into the bubble disappearance in Area A, the shrinking energy of the bubble 21 acts as a force of moving the liquid near the discharge port 7 toward the upstream direction as a result of total balance. Thus, the meniscus is pulled into the liquid flow path 3 from the discharge port 7 at this point, thus cuts off the liquid pole combined with the discharge bubble liquid droplet swiftly by a strong force. On the other hand, along with the shrinkage of a bubble, a liquid flows rapidly from the common liquid supply chamber 6 via the liquid supply port 5 into the liquid flow path 3 in a large current. Thereby, the flow rapidly pulling the meniscus into the liquid flow path 3 lowers abruptly, so that the meniscus begins to return to the position prior to the bubbling at a relatively low speed and therefore the convergency of vibration of the meniscus is very good in comparison with the liquid discharge scheme equipped with no movable member according to the present invention. Incidentally, h2 (See FIG. 7B) is let to be a maximum displacement of the free end of the movable member 8 to the side of the bubble generating area 11.

Finally, when the bubble 21 completely disappears, the movable member 8 also recovers to the stationary state position shown in FIG. 5A. Toward this state, the movable member 8 is displaced upward under action of its elastic force (along Arrowhead A of solid line in FIG. 8A). Besides, in this state, the meniscus has already recovered near the discharge port 7. Here, as mentioned above, an infinitesimal gap is present between the fulcrum part of the movable member 8 and the liquid supply port 5, while the liquid supply port and the liquid flow path 3 communicate with each other through the infinitesimal gap even in a state that the movable member 8 stands completely still. Thereby, even if the movable member 8 comes to a standstill before the meniscus completely recovers or if the movable member 8 comes to a standstill in a state that the meniscus protrudes from the discharge port 7 by the overshoot during the refill of ink into the liquid flow path 3, ink moves through an infinitesimal gap between the fulcrum part of the movable member 8 and the liquid supply port 5, thereby enabling the meniscus to be displaced to a proper position.

Next, a correlation between the time volume change of a bubble in Area A as well as Area B shown in FIGS. 5A and 5B to 8A and 8B and the behavior of the movable member 8 will be described referring to FIG. 124. FIG. 124 is a graph representing the relevant correlation, Curve A shows the time volume change of a bubble in Area A and Curve B shows the time volume change of a bubble in Area B.

As shown in FIG. 124, the time volume change of a bubble in Area A draws a parabola having a maximum. In other words, the volume of a bubble increases with the lapse of time from the start of bubbling till the disappearance of the bubble and reaches a maximum at a certain point, then decreasing. On the other hand, with respect to Area B, the time taken from the start of bubbling till the disappearance of the bubble is shorter, the maximum growth volume of the bubble is smaller and the time of arrival at the maximum growth is shorter than in Area A. In brief, the time of arrival at the maximum growth and the growth volume change of a bubble differ greatly and are smaller in Area B.

Especially in FIG. 124, Curves A and B overlap each other for the initial generation of the bubble, because the volume of a bubble increases at the same time change rate. Namely, the period that a bubble is growing isotropically (in the form of semi-pillow) comes into existence for the initial generation of the bubble. Thereafter, though drawing an increasing curve identical with Curve A till reaching a maximum, Curve B branches from Curve A at a certain point and draws a curve decreasing in the volume of the bubble. Namely, a period that the time of a bubble decreases in Area B though increasing in Area A (period of partial growth and partial shrinkage) appears.

And, based on a manner of bubble growth as mentioned above, the movable member 8 takes the following behavior in a form that part of the heat generating element 4 is covered with the free end of the movable member 8 as shown in FIG. 1. Namely, for the period (1) of FIG. 124, the portion of the movable ember between the free end and the vicinity of the fulcrum is displaced up toward the liquid supply port. For the period (2) of FIG. 124, the movable member is in close contact with the liquid supply port and the interior of the liquid flow path becomes substantially a sealed state except the discharge port. The start of this sealed state is carried out for a period that a bubble grows isotropically. Next, for the period (3) of FIG. 124, the portion of the movable member between the free end and the vicinity of the fulcrum is displaced down toward the stationary state position.

The opening start of the liquid supply port by this movable member is carried out at the lapse of a given time from the start of the period of partial growth and partial shrinkage. Then, for the period (4) of FIG. 124, the movable member is further displaced downward from the stationary state position. Next, for the period (5) of FIG. 124, the downward displacement of the movable member almost stops and the movable member is in an equilibrium state at an open position. Finally, for the period (6) of FIG. 124, the movable member is displaced up toward the stationary state position.

The correlation between such a bubble growth and the behavior of the movable member is affected by the relative position of the movable member to the heat generating element. Such being the case, referring to FIGS. 11A and 11B, FIG. 125 and FIG. 126, a correlation between the bubble growth and the behavior of a movable member in the liquid discharge head equipped with the movable member and the heat generating element disposed in relative positions different from those of this embodiment will be described.

Figure 11A:
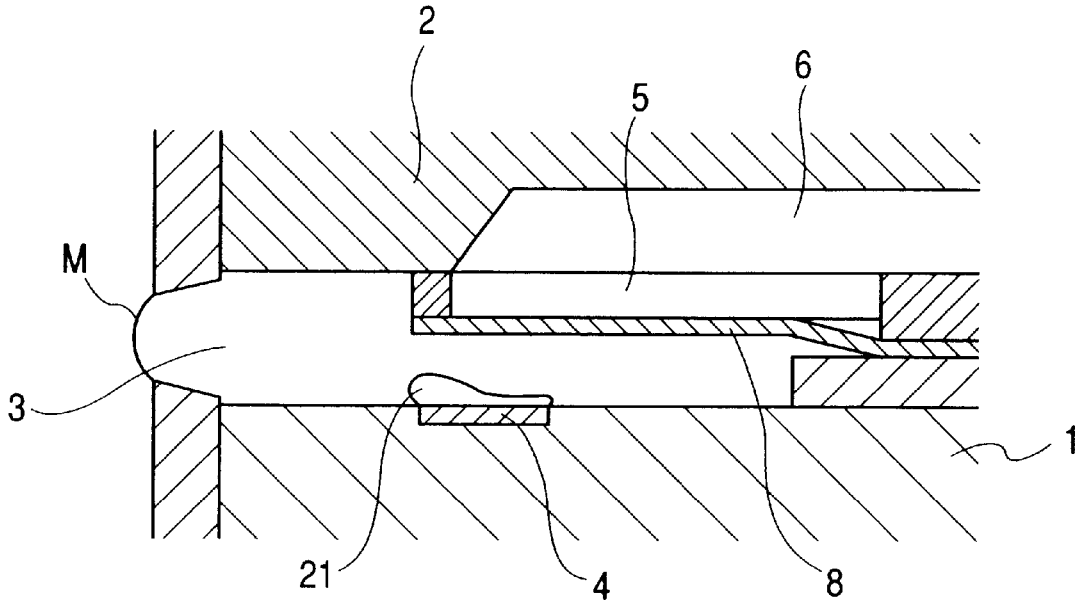
FIGS. 11A and 11B are sectional views taken along the direction of one liquid flow path of a liquid discharge head according to the first embodiment of the present invention, where FIG. 11A relates to a configuration of covering the whole heat generating element with the free end of a movable member and FIG. 11B relates to a configuration of separating a heat generating element from a movable member.

FIGS. 125 and 11A serve to explain a correlation between the bubble growth and the behavior of a movable member in a form that the whole heat generating element is covered with the free end of the movable member, FIG. 11A shows the relevant form and FIG. 125 is a graph showing the correlation. When the overlapping area of a heat generating element and a movable member is large as shown in FIG. 11A, the period (1) of FIG. 125 becomes shorter than in the form of FIG. 1, the liquid flow path comes into a sealed state in a short time from heating the heat generating element and accordingly this form is well preferable. Incidentally, the behavior of a movable member in each of the periods (1) to (6) in FIG. 125 is identical with the behavior described referring to FIG. 124. Besides, since a movable member becomes susceptible to a decrease in the volume of a bubble on taking the form of FIG. 11A, opening start of the liquid supply port by this movable member is carried out immediately after the start of the period of partial growth and partial shrinkage as understood from the start point of the period (3) of FIG. 125. Namely, the opening timing of the movable member is earlier than in the form of FIG. 1. For a similar reason, the reason of the amplitude of the movable member 8 increases.

Figure 11B:
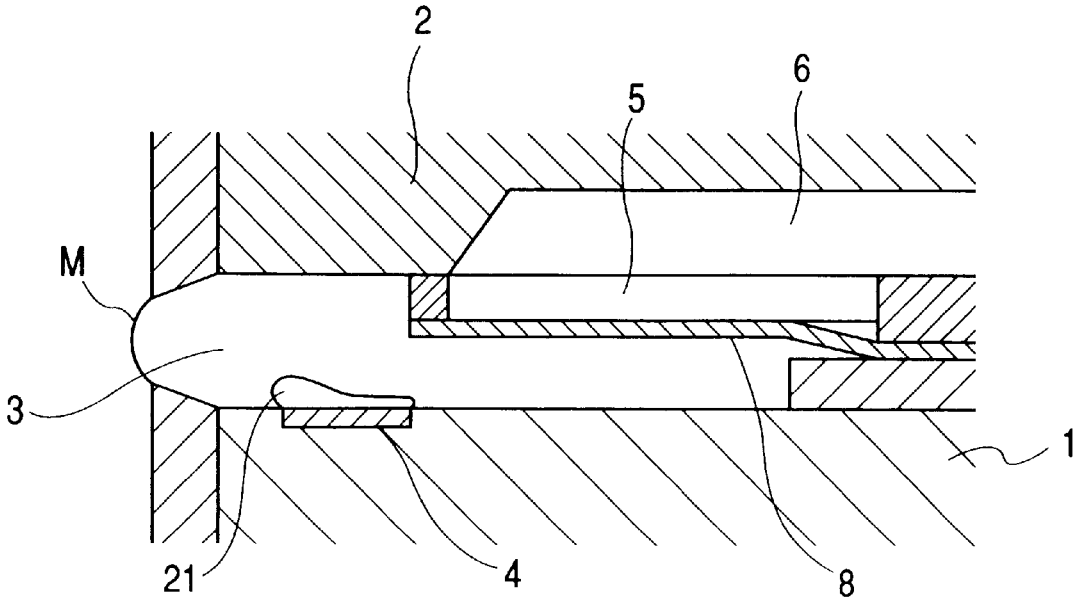

Besides, FIG. 126 serves to explain a correlation between the bubble growth and the behavior of a movable member in a form that a heat generating element is remote from the free end of a movable member, FIG. 11B shows the relevant form and FIG. 126 is a graph showing the correlation. When a movable member and a heat generating element are separated from each other like the form shown in FIG. 12B and FIG. 126, a movable member is least subject to a decrease in the volume of a bubble, so that opening start of the liquid supply port by this movable member is carried out quite later than the start of the period of partial growth and partial shrinkage as understood from the start point of the period (3) of FIG. 126. Namely, the opening timing of the movable member is later than in the form of FIG. 1. For a similar reason, the reason of the amplitude of the movable member decreases. Incidentally, the behavior of a movable member in each of the periods (1) to (6) in FIG. 126 is identical with the behavior described referring to FIG. 124.

Meanwhile, the positional relation between the movable member 8 and the heat generating element 4 is helpful for the description of a general operation and individual operations depend upon the position of the free end of the movable member, the rigidity thereof and the like.

Besides, letting Vf and Vr be the volume of a growing bubble at the maximum at the side of the discharge port 7 (bubble of Area A) in the bubble generating area 11 and that of a growing bubble at the maximum at the side of the liquid supply port 5 (bubble of Area B) in the bubble generating area 11, respectively, the relation of Vf>Vr holds true permanently for a head according to the present invention as evident from FIGS. 124 to 126. Furthermore, letting Tf and Tr be the life time (time from the appearance of a bubble to the disappearance of the bubble) of a growing bubble at the side of the discharge port 7 (bubble of Area A) in the bubble generating area 11 and that of a growing bubble at the side of the liquid supply port 5 (bubble of Area B) in the bubble generating area 11, respectively, the relation of Tf>Tr holds true permanently for a head according to the present invention. And, from a relation as mentioned above, it follows that the disappearing point of a bubble is situated at the side of the discharge port 7 rather than near the center of the bubble generating area 11.

Furthermore, with the present configuration of a head, as understood also from FIGS. 5B and 7B, there is a relation that the maximum displacement h2 of the free end of a movable member 8 toward the side of the bubble generator means 4 along with the disappearance of a bubble is greater than the maximum displacement h1 of the fulcrum vicinity of the movable member 8 toward the side of the liquid supply port 5 at the initial generation of the bubble (h1<h2). For example, h1 is 2 $\mu$m and h2 is 10 $\mu$m. Validity of this relation can suppress the growth of a bubble toward behind a heat generating element (opposite the discharge port) at the initial generation of the bubble and can enhance that of a bubble toward the front of the heat generating element (toward the discharge port). Thereby, the efficiency of converting the bubbling energy generated on the heat generating element into the kinetic energy of a droplet of a liquid flying from the discharge port can be raised.

The head configuration and the liquid discharge operation in this embodiment was described, but according to such an embodiment, the growth component to the downstream side and the growth component to the upstream side of a bubble are unequal, the upstream component nearly vanishes and the move of a liquid toward the upstream side is suppressed. Since the move of the liquid toward the upstream side is suppressed, most of the bubble growth is directed toward the discharge port without loss of the growth component to the upstream side and the discharge power is improved in leaps and bounds. Furthermore, the retreat of a meniscus after the discharge decreases and its protrusion from the orifice surface during the refill decreases correspondingly. Accordingly, the meniscus vibration is suppressed and a stable discharge becomes performable at all driving frequencies from a low frequency to a high frequency.

In a liquid discharge head according to the first embodiment, as described in all these, at least the free end of a movable member 8 is in contact with the stopper part 5*b* of a supply part forming member 5A in a standstill state of the movable member 8. Thereby, during a period ranging from the appearance of a bubble till the liquid flow path 3 is brought into an almost sealed state by blocking the liquid supply port 5 with the movable member 8, the move of ink from the liquid flow path 3 to the liquid supply port 5 is suppressed at the greatest possible. As a result, loss of the discharge power due to the move of ink from the liquid flow path 3 to the liquid supply port 5 decreases in the ink discharge operation and the discharge efficiency of the liquid discharge head is improved. Besides, together with this, a rapid transit from the isotropic growth of a bubble to the partial growth and partial shrinkage period while the portion at the side of the discharge port 7 of the bubble 21 grows and the portion at the side of the liquid supply port 5 thereof shrinks can be achieved.

Furthermore, since the vibration of the movable member 8 belongs to a second or higher vibrational mode, the natural frequency of the movable member 8 is large, the movable member 8 rapidly opens and closes and moreover the downward displacement is also great. As a result, a great amount of refill in a short time is enabled.

[First Variation]

Figure 12:
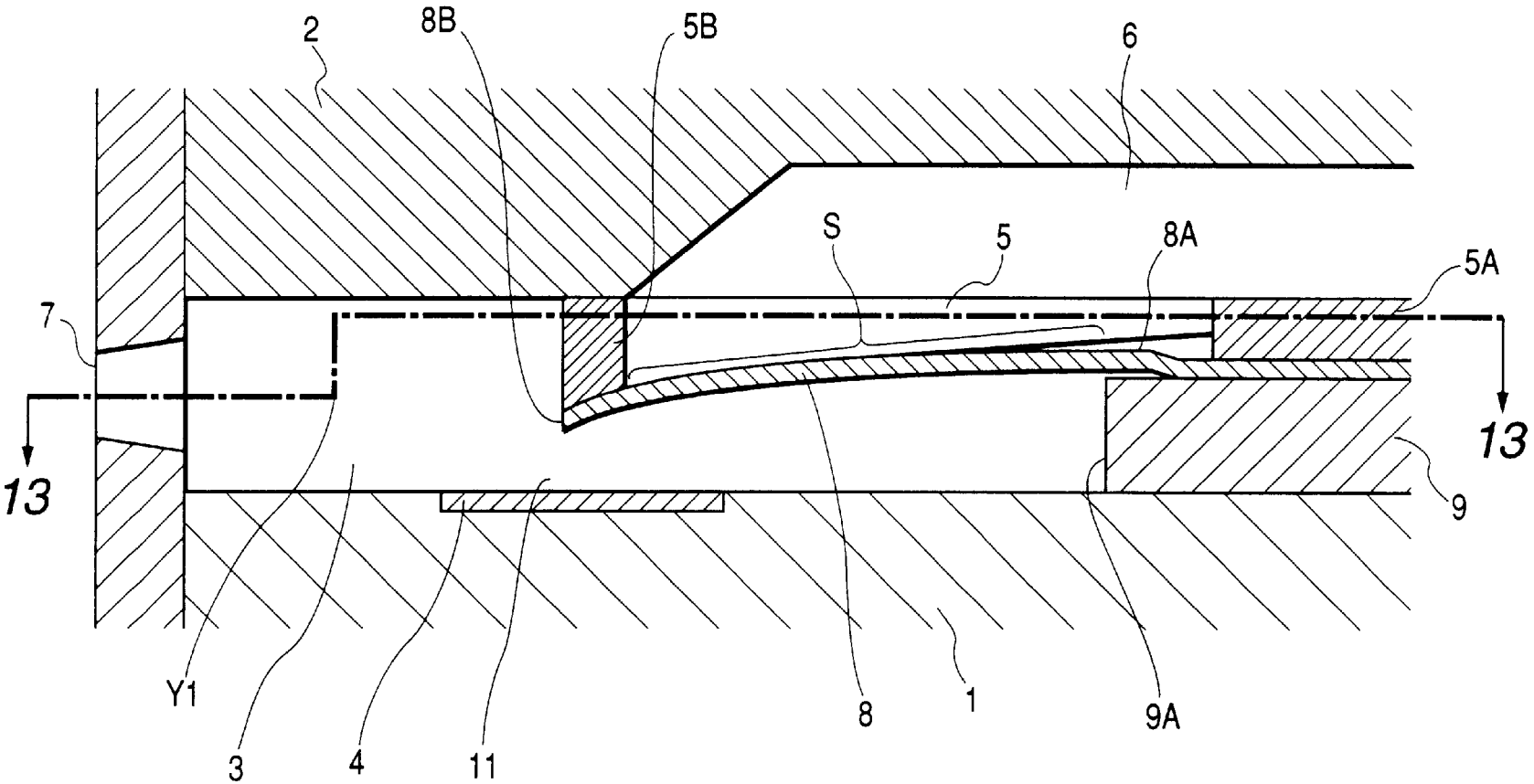
FIG. 12 is a sectional view taken along the direction of one liquid flow path of a liquid discharge head according to the first variation of the first embodiment of the present invention.
Figure 13:
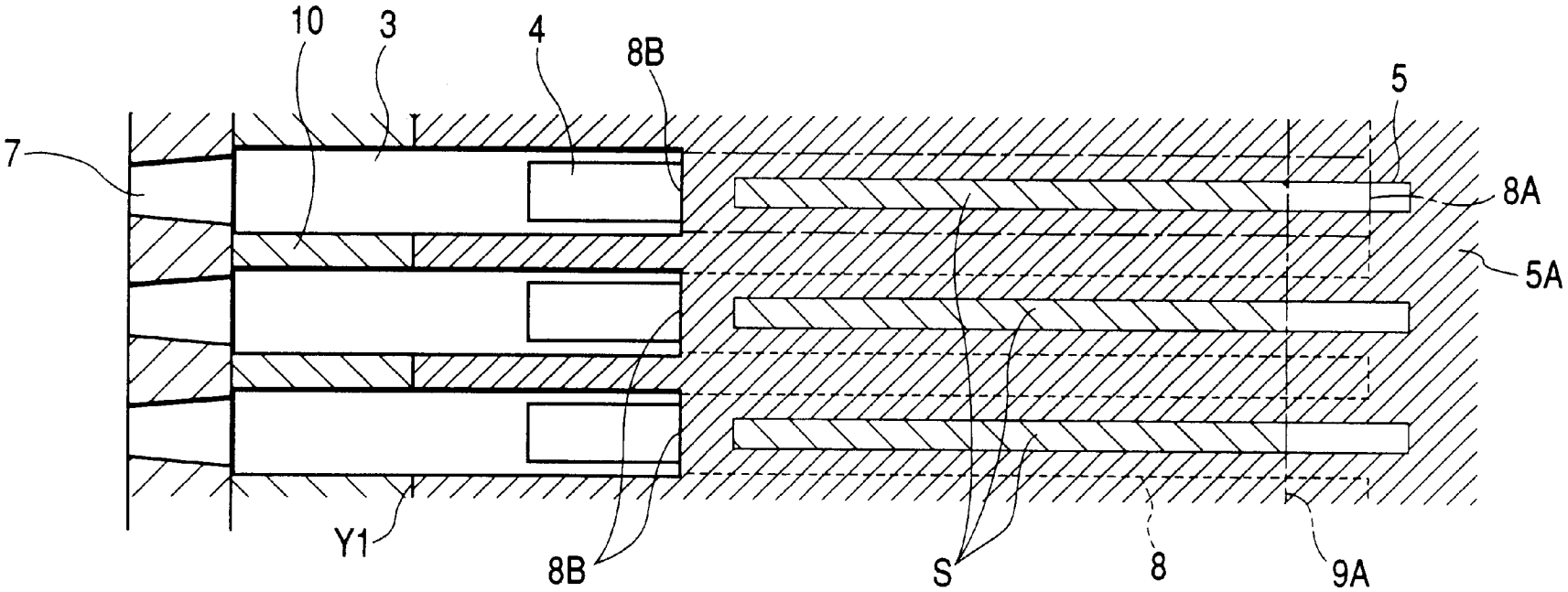
FIG. 13 is a sectional view taken on line 13—13 of FIG. 12.

FIG. 12 is a sectional view taken along one liquid flow path of a liquid discharge head according to The first variation of the first embodiment and FIG. 13 is a sectional view taken along line Y–Y' shifted to the side of the top board 2 at the point Y1 from the discharge port center of FIG. 1. A liquid discharge head according to this variation differs from the first embodiment chiefly in that, at the initial state of a movable member being at rest, the end of the movable member at the side of the free end presses the peripheral portion of a liquid supply port to bend the movable member. In FIGS. 12 and 13, like symbols are attached to constituents similar to those of the first embodiment and hereinafter a description will be made while centering on points different from the first embodiment.

At the initial state of a movable member 8 being at rest in a liquid discharge head according to this modification, as shown in FIG. 12, the tip end of the movable member 8 at the side of the free end 8B is in contact with the supply part forming member 5A to press the supply part forming member 5A and moreover the movable member 8 is elastically bent convexly toward the side of the liquid supply port 5 and is retained so as to charge a stress. Namely, even at rest, the movable member 8 applies a force to the supply part forming member 5A with the aid of its elastic force and in particular the tip end of the movable member 8 at the side of the free end 8B is elastically bent convexly toward the side of the liquid supply port 5.

With ink discharge operation in this liquid discharge head, the movable member 8 is further bent convexly toward the side of the liquid supply port 5 in the case where film boiling occurs on the heat generating element 4 and a bubble grows isotropically. With a further bending of the movable member 8, an extent of the moving member 8 between the portion in contact with the stopper part 5*b* and the portion near the fulcrum 8A is displaced upward and the movable member 8 comes into close contact with the peripheral portion of the liquid support port 5. Thereby, the opening area S of the liquid supply port 5 is blocked with the movable member 8 and the interior of the liquid flow path 3 substantially comes into a sealed state except the discharge port 7. At this time, since the movable member 8 is convexly bent elastically toward the upstream side before a bubble grows to a maximum, dispersion in bubbling state due to dispersion in heating characteristics of the heat generating element 4, a change in ambient temperature or the like is absorbed by the bending of the movable member B. As a result, dispersion in the discharge amount of ink originating from dispersion in bubbling state caused by the heat generating element 4, a change in ambient temperature or the like is suppressed.

In the case of a liquid discharge head according to this variation, no change but a convex bending of the movable member 8 is made at the time of bubbling. Accordingly, during the refill of ink into the liquid flow path 3, a disappearing force of a bubble is added to a recovering force of the movable member 31 as energy for the downward displacement of the movable member 8.

Furthermore, since the upward displacement of the center part of the movable member 8 during the isotropic growth of a bubble is greater than in the first embodiment, the movable member 8 is displaced at a higher vibrational mode than that of the first embodiment. Accordingly, shortening the refill time is enabled.

By these, the liquid flow to the upstream side is regulated greatly not only to prevent the reverse current or the pressure vibration of a liquid in the supply path system as prohibiting the liquid cross talk to an adjacent nozzle or a high-speed refill into the liquid flow path 3 but to suppress the fluctuation of a discharge amount also.

In the case of a liquid discharge head in such an arrangement, the downward displacement of a movable member 8 is small and the movable member 8 rapidly transits to the stationary state position even if a normal discharge operation of ink is carried out. Thus, the amount of ink to be refilled into the liquid flow path 3 is small, but the refill of ink into the liquid flow path 3 is completed. Thereby, an arrangement that a movable member 8 is elastically bent in a standstill state can be effective for a liquid discharge head for discharging an infinitesimal discharge amount of ink.

[Second Variation]

Figure 14:
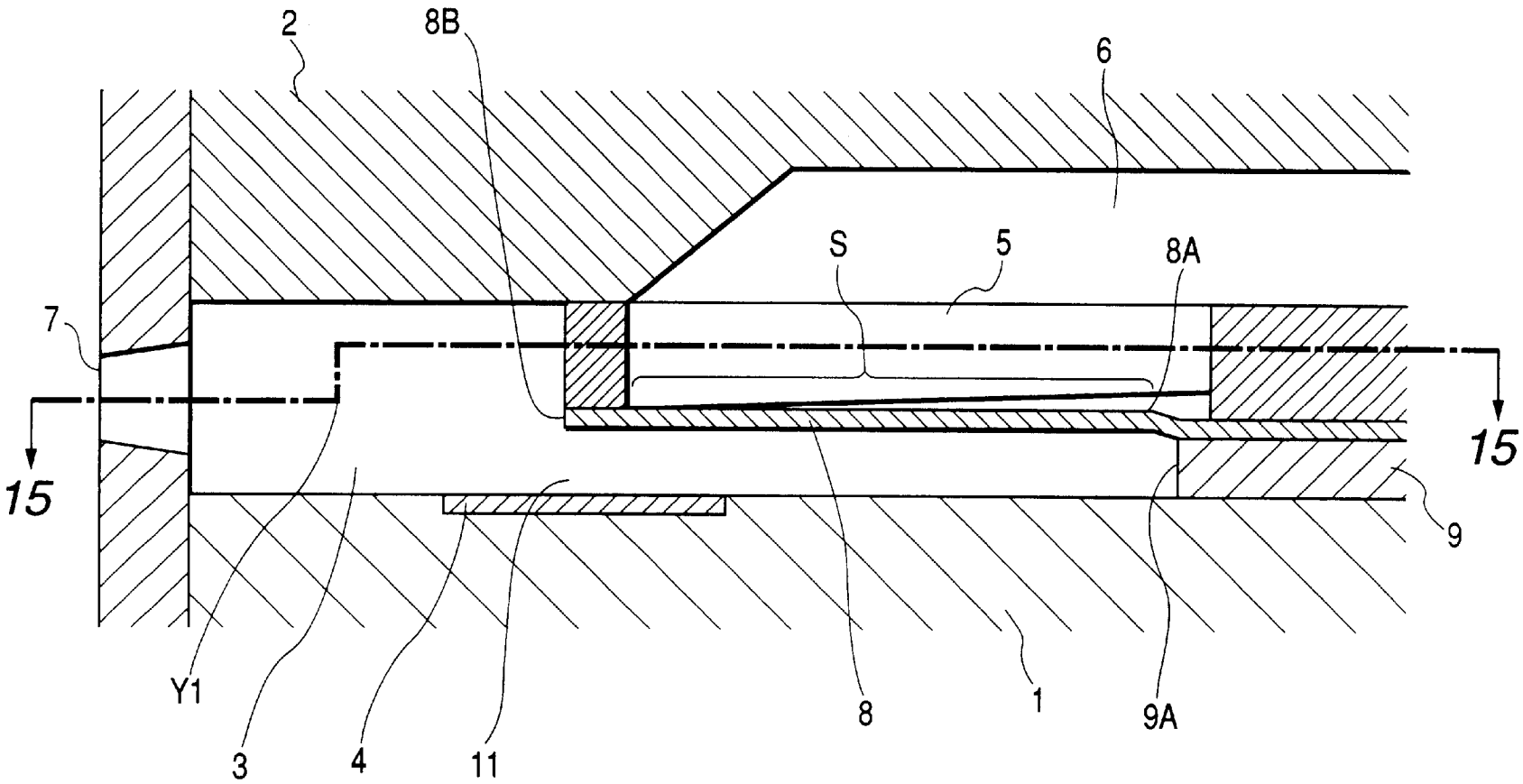
FIG. 14 is a sectional view taken along the direction of one liquid flow path of a liquid discharge head according to the second variation of the first embodiment of the present invention.
Figure 15:
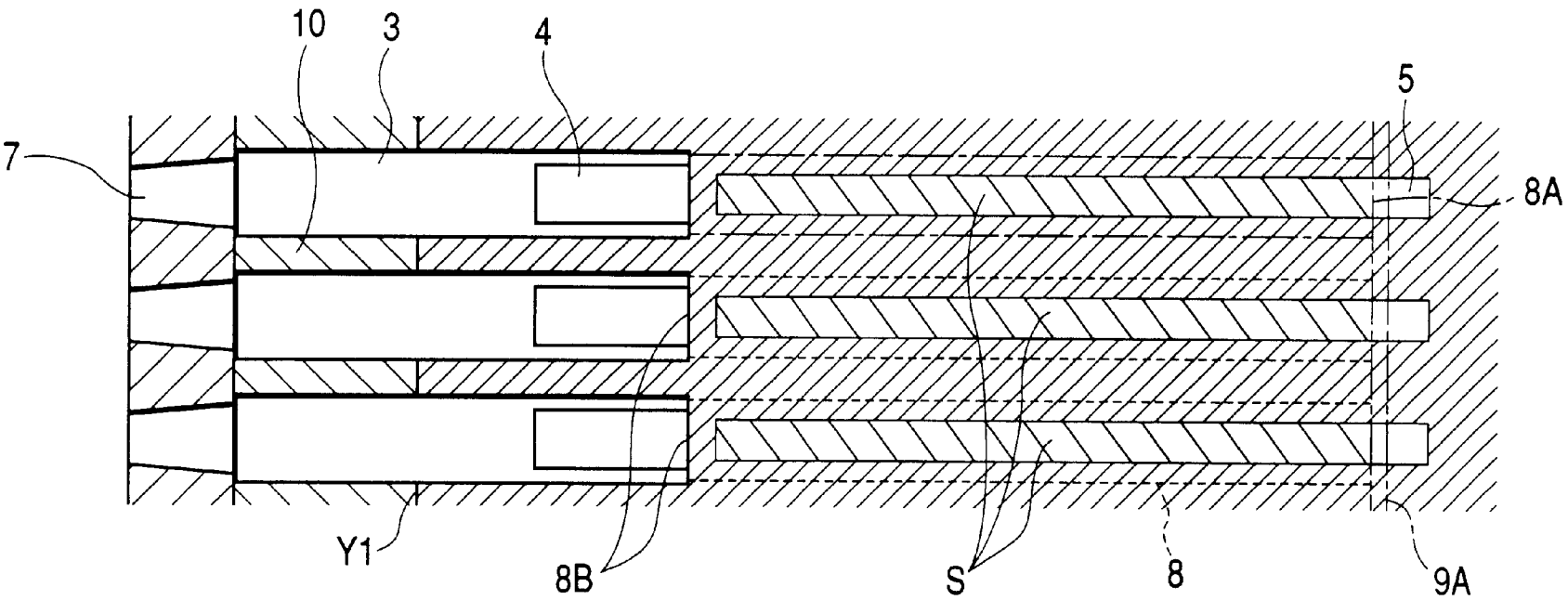
FIG. 15 is a sectional view taken on line 15—15 of FIG. 14.

In a head structure according to the first embodiment, since a position of the movable member 8 remaining unjoined to the fixed member 9 (i.e., bent and rising) was not the same as the end part 9A of the fixed member 9 as shown in FIGS. 1 and 3, the opening area S comprised an area enclosed with three sides of the liquid supply port 5 and the end part 9A of the fixed member 9, but the bent rising position of the movable member 8 from the fixed member 9 may be set to the end part 9A of the fixed member 9 as shown in FIGS. 14 and 15. In the case of this structure, as shown in FIGS. 14 and 15, the opening area S comprises an area enclosed with three sides of the liquid supply port 5 and the fulcrum part 8A of the movable member 8.

Figure 16:
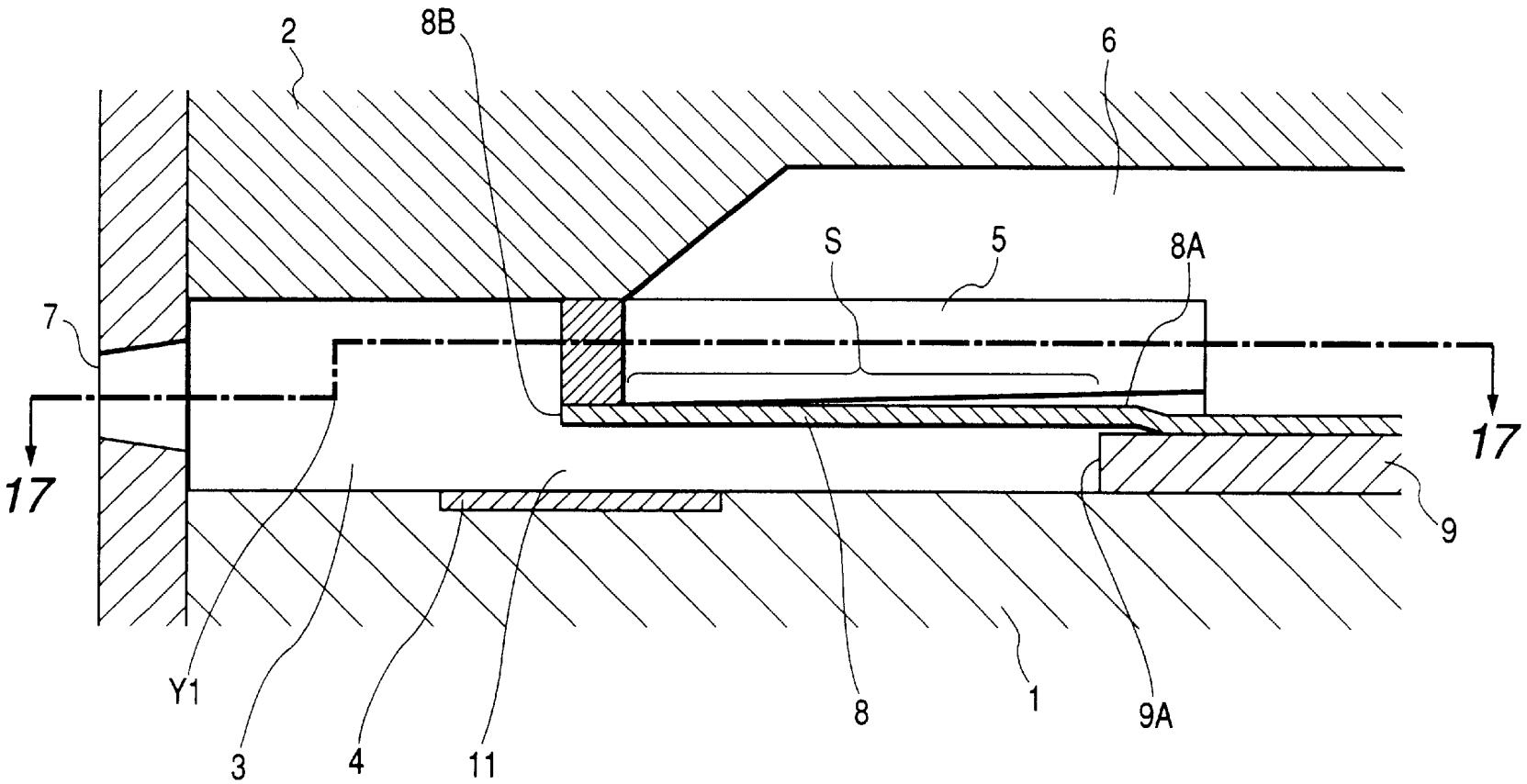
FIG. 16 is a sectional view taken along the direction of one liquid flow path of a liquid discharge head according to the second variation of the first embodiment of the present invention.

Besides, in a head structure according to the first embodiment, the liquid support port 5 was set to an opening enclosed with four wall surfaces as shown in FIG. 3, but the wall surface at the side of the liquid supply chamber 6 opposed to the side of the discharge port 7 may be opened among the supply part forming member 5A (See FIG. 1) like the structure shown in FIGS. 14 and 16. In the case of this structure, as shown in FIGS. 16 and 17, the opening area S comprises an area enclosed with three sides of the liquid supply port 5 and the end part 9A of the fixed member 9 as with the first embodiment.

Also in liquid discharge heads of these arrangements, as shown in FIGS. 14 and 16, the tip end of the movable member 8 at the side of the free end 8B is in contact with the stopper part 5*b* of the supply part forming member 5A with the aid of its elastic force in a standstill state. Thereby, in the discharge operation of ink, the move of ink from the liquid flow path 3 to the liquid supply port 5 is suppressed at the greatest possible, so that loss of the discharge power due to the move of ink from the liquid flow path 3 to the liquid supply port 5 decreases and the discharge efficiency of the liquid discharge head is improved. Besides, together with this, a rapid transit from the isotropic growth of a bubble to the period of partial growth and partial shrinkage while the portion at the side of the discharge port 7 of the bubble 21 grows and the portion at the side of the liquid supply port 5 thereof shrinks can be achieved.

Figure 17:
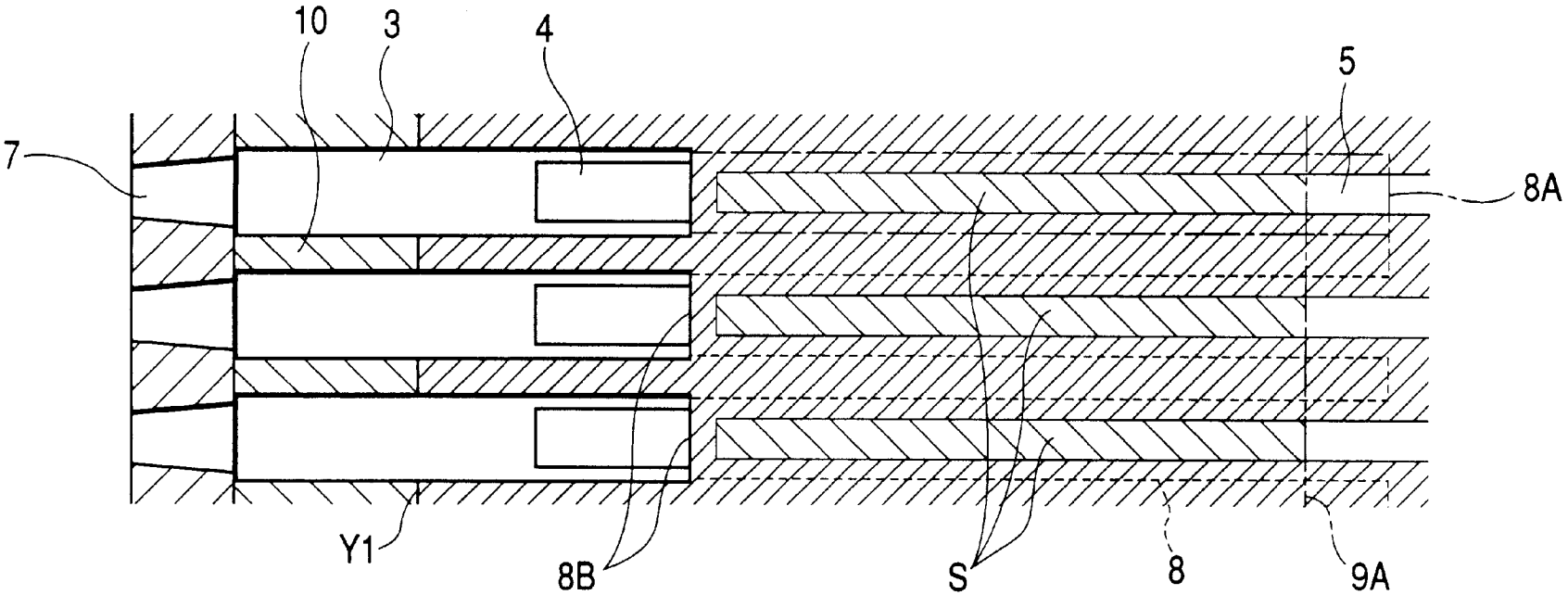
FIG. 17 is a sectional view taken on line 17—17 of FIG. 16.
Figure 18:
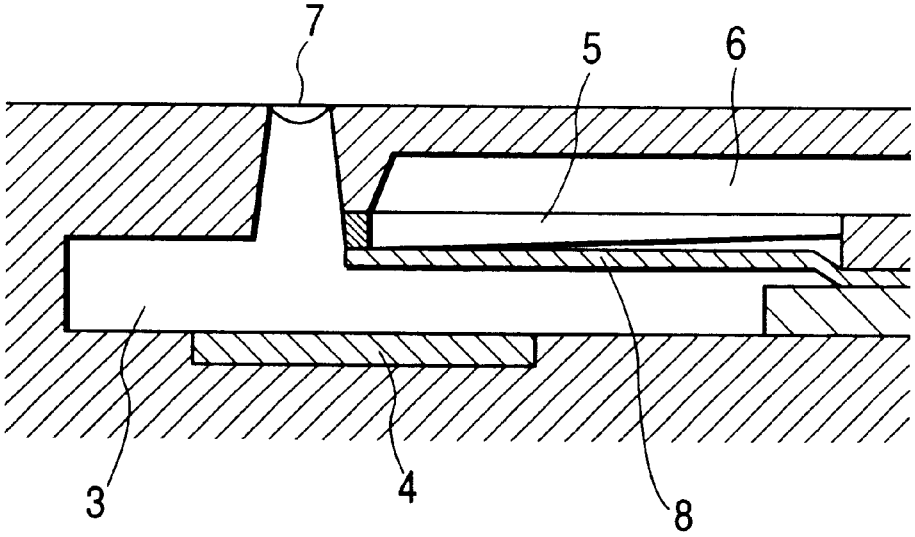
FIG. 18 is an illustration of an example of side-shooter type liquid discharge head corresponding to the configuration of a liquid discharge head according to the first embodiment of the present invention.
Figure 19A:
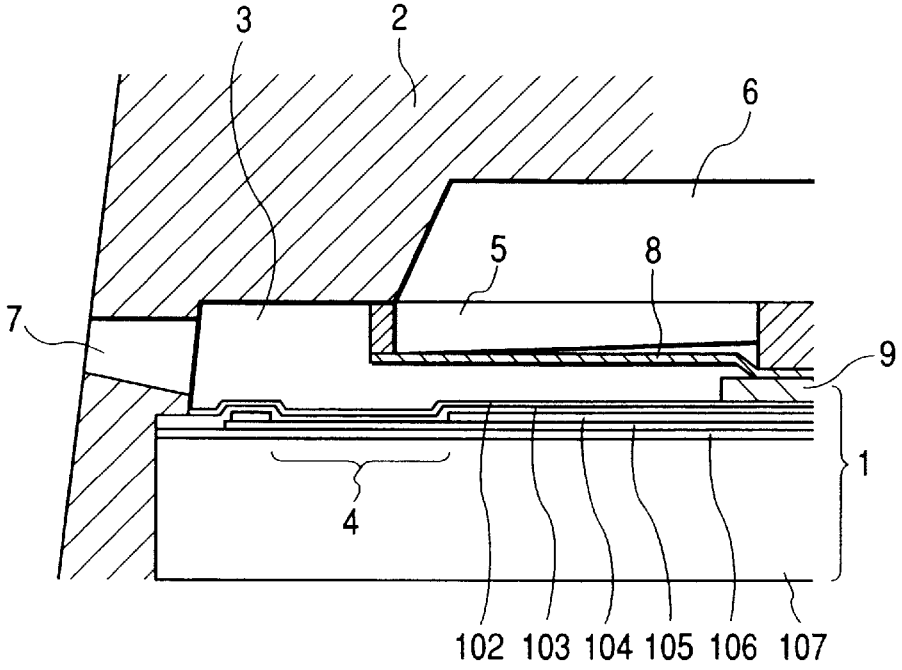
FIGS. 19A and 19B are vertically sectional views of a liquid discharge head according to the first embodiment of the present invention, where FIG. 19A relates to an example with a protective film and FIG. 19B relates to an example without a protective film.
Figure 19B:
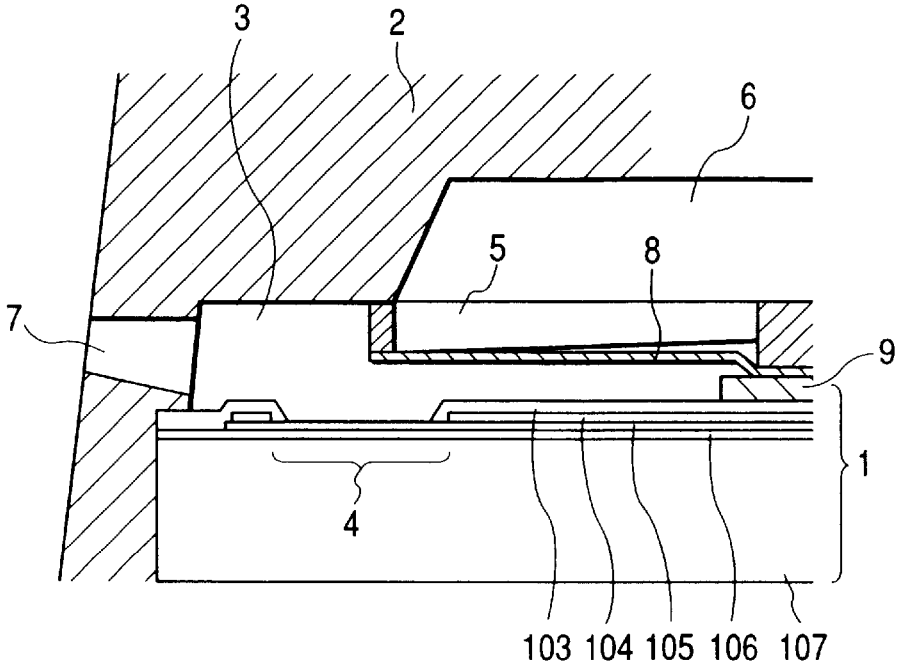

Besides, to the liquid discharge head shown in FIGS. 14 and 15 or to that shown in FIGS. 16 and 17, an arrangement that a movable member 8 is elastically bent in the first variation of the first embodiment may be applied. By arranging in such a manner, dispersion in the discharge amount of ink originating from dispersion in bubbling state caused by the heat generating element 4, a change in ambient temperature or the like is suppressed. Besides, even if the amount of ink to be refilled into the liquid flow path 3 is small, ink can be refilled into the liquid flow path 3 in a short time and a liquid discharge head for discharging an infinitesimal discharge amount of ink can be constructed.

Second Embodiment

Figure 20:
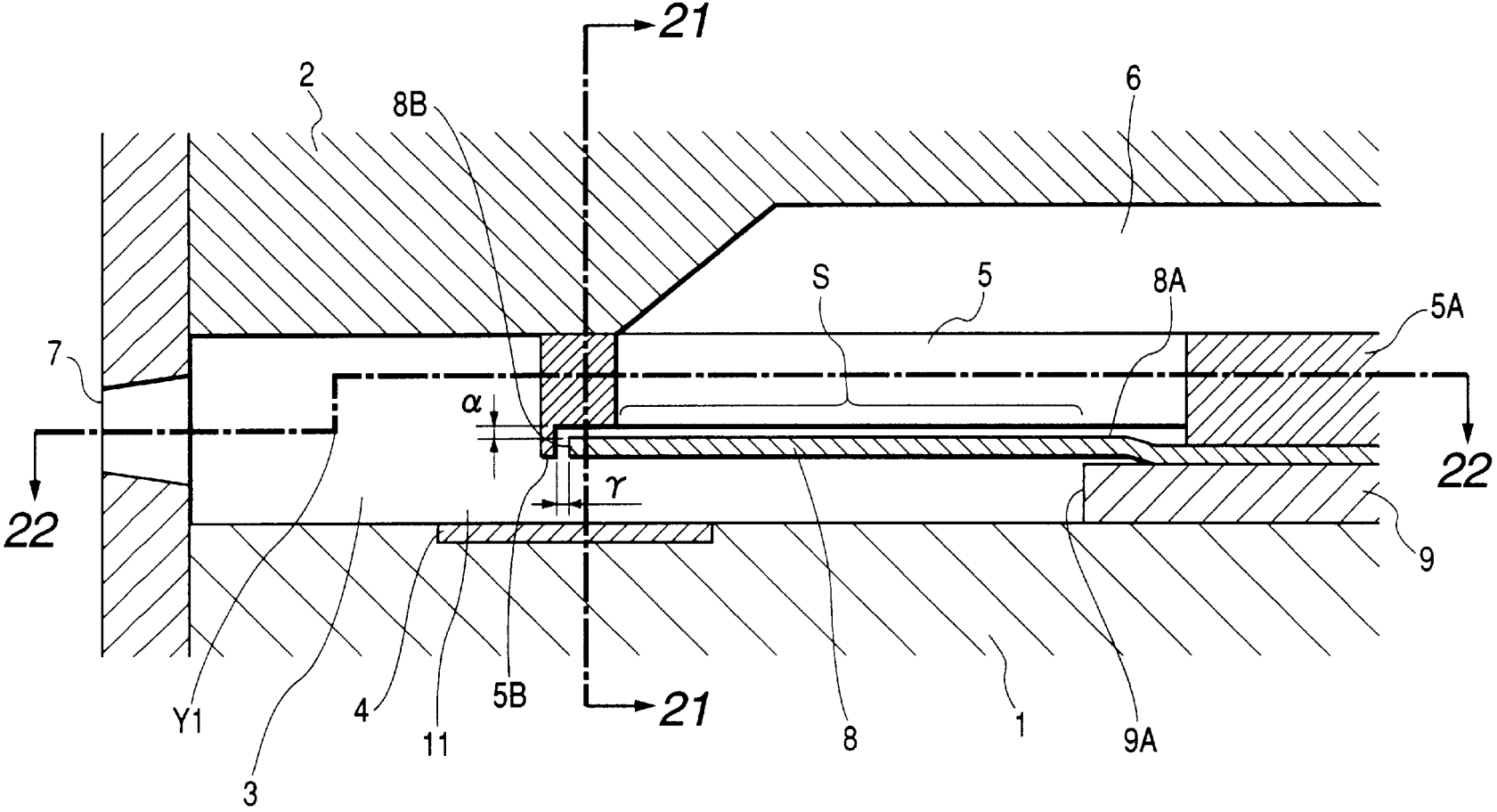
FIG. 20 is a sectional view taken along the direction of one liquid flow path of a liquid discharge head according to the second embodiment of the present invention.
Figure 21:
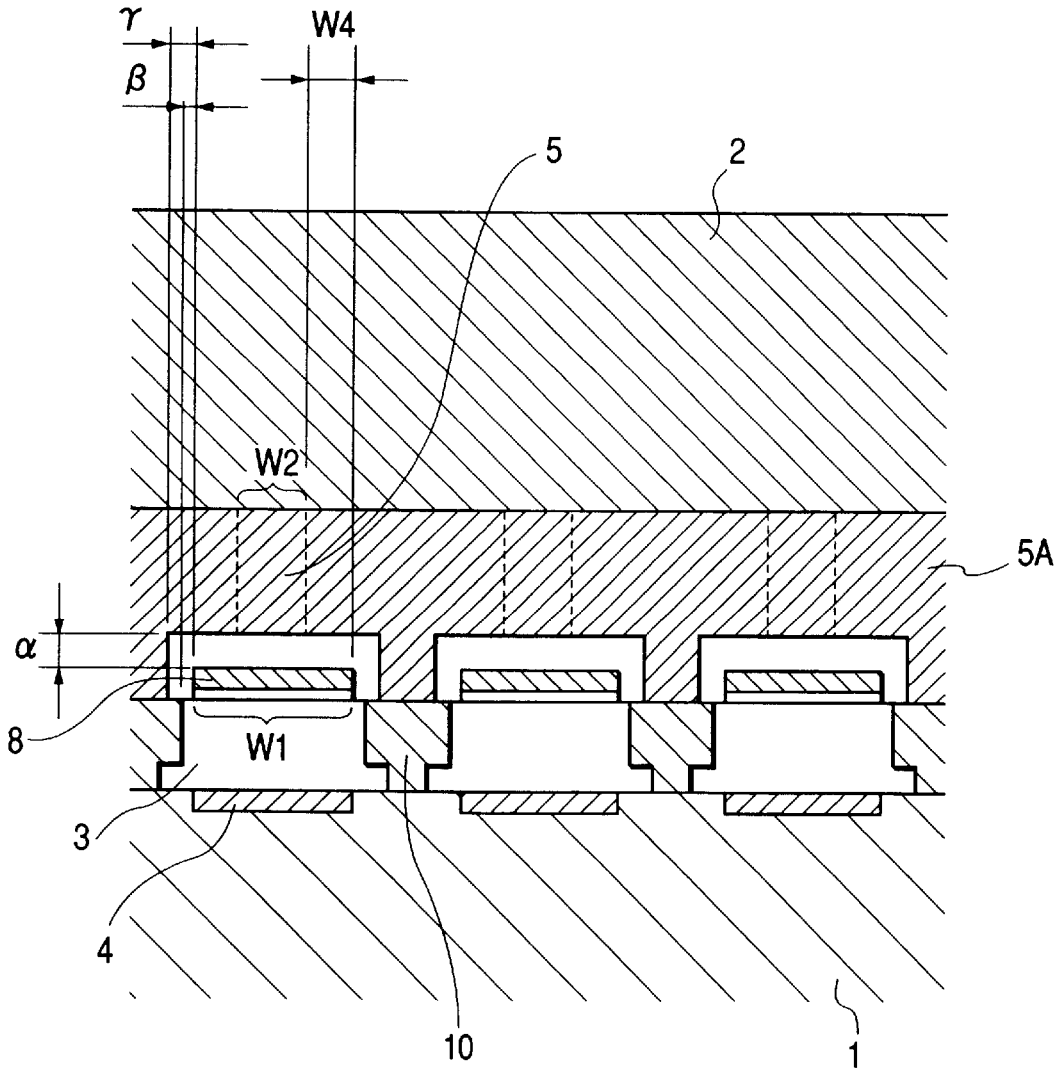
FIG. 21 is a sectional view taken on line 21—21 of FIG. 20.

FIG. 20 is a sectional view taken along one liquid flow path of a liquid discharge head according to the second embodiment of the present invention; FIG. 21 is a sectional view taken along line 21—21 of FIG. 20; and FIG. 22 is a sectional view taken along line 22—22 shifted to the side of a top board 2 at the point Y1 from the discharge port of FIG. 20.

Figure 22:
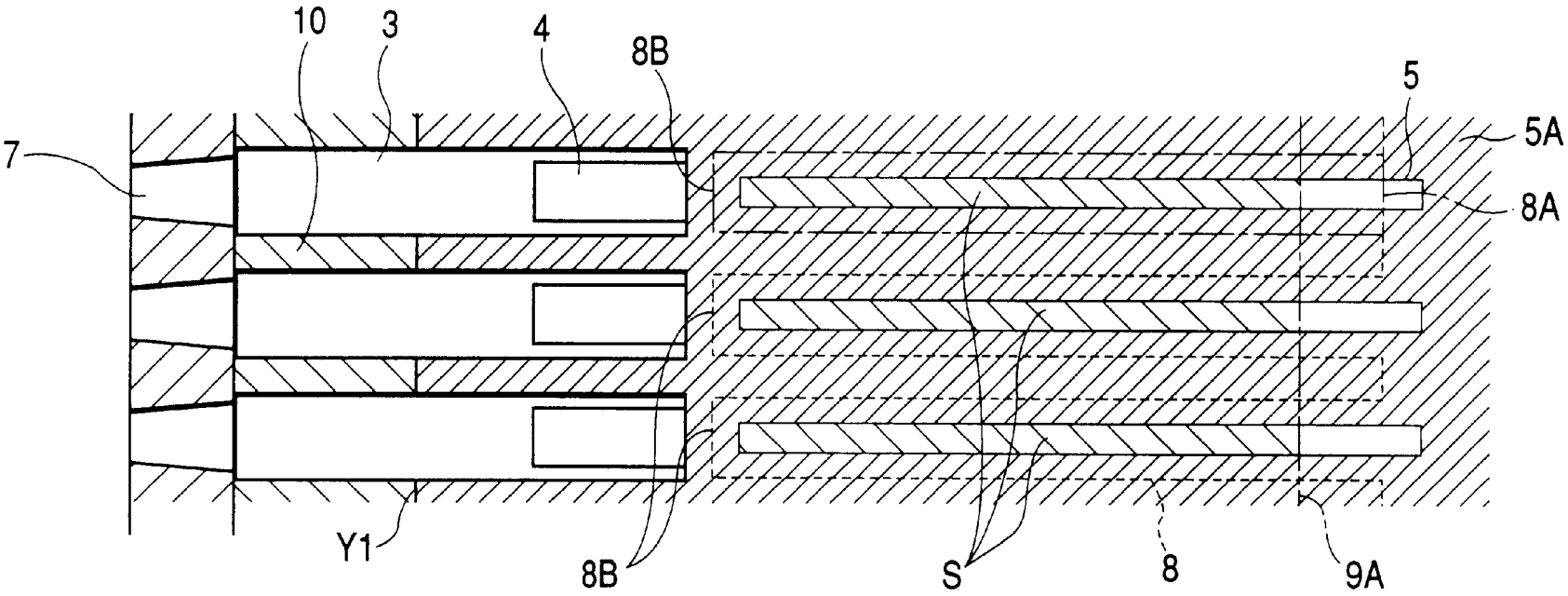
FIG. 22 is a sectional view taken on line 22—22 of FIG. 20.

In the liquid discharge head of the form of liquid paths-a common chamber shown in FIGS. 20 to 22, an element substrate 1 and a top board 2 are fastened via a liquid path side wall 10 in a stacked state and a liquid flow path 3 communicating to a discharge port 7 at one end and closed at the other end is formed between both plates 1 and 2. A great number of such liquid flow paths 3 are provided at one head. Besides, in the element substrate 1, heat generating elements 4 such as electro-thermal converter elements as bubble generator means for generating bubble in liquids filled up at liquid flow paths 3 are disposed to individual liquid flow paths 3. In the vicinity area at the contact surface between a heat generating element 4 and a discharge liquid, there is present a bubble generating area 11 where a heat generating element 4 is rapidly heated to generate bubble in a discharge liquid.

In each of many liquid flow paths 3, a liquid supply port 5 formed at a supply part forming member 5A is disposed and a common liquid supply chamber 6 of large volume, simultaneously communicating to all individual liquid supply ports 5, is provided. In other words, a form of being branched from a single common liquid supply chamber 6 into many liquid flow paths 3 is formed and the amount of liquid corresponding to that of liquid discharged from the discharge port 7 communicating to each liquid flow path 3 is received from this common liquid supply chamber 6. Between a liquid supply port 5 and a liquid flow path 3, a movable member 8, larger than the opening area S of the liquid supply port 5, is provided in nearly parallel with the opening area S of the liquid supply port 5. On the lower surface (surface facing a movable member 8) of the supply part forming member 5A, the convex part 5B opposed to the free end of the movable member 8 is provided. Between the free end of the movable member 8 and both lateral ends adjacent thereto and the supply part forming member 5, an infinitesimal gap is present and the size of the gap is a (e.g., not greater than 10 $\mu$m) around the liquid supply port 5, i.e. between the upper surface of the movable member 8 and the lower surface of the supply part forming member 5 and $\gamma$ between the free end of the movable member 8 and the convex part 5B and between both lateral ends of the movable member 8 and a side wall of the supply part forming member 5A as shown in FIGS. 20 and 21. By these gaps, the flow path passing from the liquid supply port 5 to the liquid flow path 3 is formed, which assumes a crooked form because the convex part 5B is formed on the supply part forming member 5A.

Besides, as shown in FIG. 21, an infinitesimal gap $\beta$ is present also between the side of the movable member 8 and the flow path side walls 10 of both sides.

The gaps $\beta$ and $\gamma$ vary depending on the pitch of the flow path, a greater gap $\gamma$ makes it easy for the movable member 8 to shut off the opening area S and a greater gap $\beta$ makes it easy for the movable member 8 to move to the side of the element substrate 1 with the disappearance of a bubble in contrast to its stationary state of being situated via the gap $\alpha$. In this embodiment, the gap a was set to 3 $\mu$m, the gap $\beta$ was set to 3 $\mu$m and the gap $\gamma$ was set to 4 $\mu$m. Besides, the movable member 8 has a larger width W1 in the width direction between both flow path side walls 10 than that W2 of the above opening area S, which width is enough to seal the opening area S. The fulcrum 8A of the movable member 8 regulates the upstream end part in the opening area S of the liquid supply port 5 on an extension of the end part of the free end side of the continuous part continuous concerning the crossing direction of movable members across liquid paths (See FIG. 22). In this embodiment, as shown in FIGS. 21 and 22, the portion along the movable member 8 of the supply part forming member 5A is set smaller in thickness than the liquid flow path side wall 10 itself and the supply part forming member 5A is stacked on the flow path wall 10. Incidentally, the side of the discharge port 7 from the free end 8B of the movable member 8 in the supply part forming member 5A is set equal in thickness to the liquid flow path side wall 10 itself as shown in FIG. 3. By these, whereas the movable member 8 can be made movable without frictional resistance in the liquid flow path 3, its displacement to the side of the opening area S can be regulated by the peripheral part of the opening area S. Thereby, the opening area S is substantially blocked, enabling the liquid current from the interior of the liquid flow path 3 to a common liquid supply chamber 6 to be prevented, whereas transit from the substantially sealed state at the side of the liquid flow path to a refillable state is enabled with the disappearance of a bubble. Besides, in this embodiment, the movable member 8 is situated also in parallel with the element substrate 1. And, the free end 8B of the movable member 8 is situated at the side of the heat generating element 4 in the element substrate 1 and the other end is supported by the fixed member 9. Besides, the end opposed to the discharge port 7 in the liquid flow path 3 is closed by this fixed member 9.

Incidentally, the opening area S is a substantial area for supplying a liquid from the liquid supply port to the liquid flow path 3 and is an area enclosed with three sides of the liquid supply port 5 and the end part 9A of the fixed member 9 in this embodiment as shown in FIGS. 20 and 22.

Figure 23:
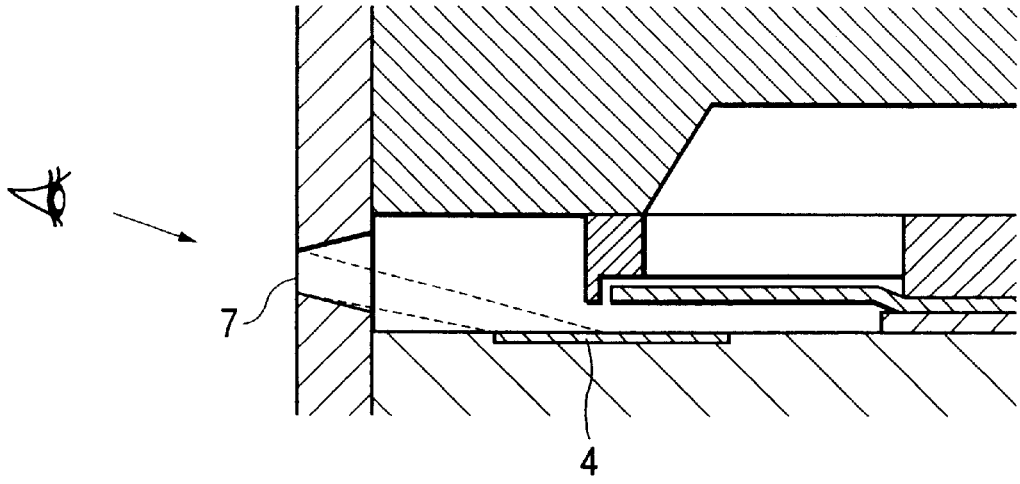
FIG. 23 is a sectional view of a flow path for explaining the "linear communication state"

Besides, as shown in FIG. 23, this embodiment, having no such an obstacle as valve between the heat generating element 4 as an electro-thermal converter and the discharge port 7, is in a "straight communicable state" with the structure of a straight flow path kept to a liquid flow. This becomes well preferable if an ideal state of stabilizing the discharge conditions such as discharge direction and discharge velocity of discharge drops at an extremely high level is formed by matching the propagating direction of a pressure wave occurring at the generation of bubble with the accompanying flow direction and the discharge direction of the liquid straightly. In this present invention, it is only necessary as one definition for attaining or approaching to this ideal state to choose a construction of directly combining the discharge port 7 with the side of the discharge port 7 (downstream side) of a heat generating element 4, in particular, the heat generating element influential to the side of the discharge port of bubble, by using a straight line, which means an observable state of the heat generating element, in particular, the side of the downstream side thereof, when viewed from the exterior of the discharge port in absence of a liquid in the liquid flow path (See FIG. 23).

Next, the discharge operation of a liquid discharge head according to the present invention will be described in detail. FIGS. 24A and 24B to 26A and 26B show not only a liquid discharge head in a sectional view taken along a liquid flow path to illustrate the discharge operation of a liquid discharge head of such a structure as shown in FIGS. 20 to 22, but a characteristic phenomenon divided in 6 steps of FIGS.

24A and 24B to 26A and 26B. Besides, in FIGS. 24A and 24B to 26A and 26B, reference character M denotes a meniscus formed by the discharge liquid.

Figure 24A:
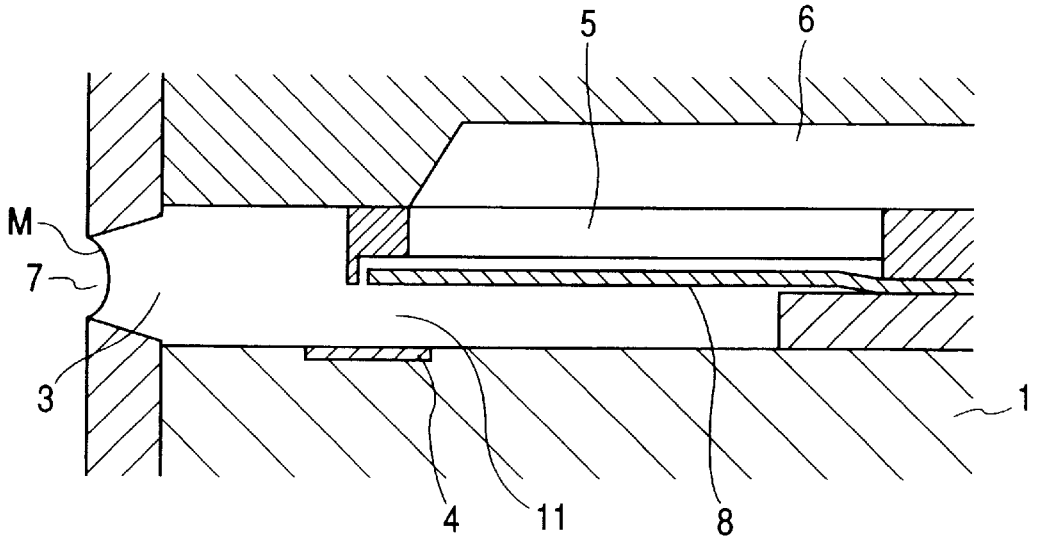
FIGS. 24A and 24B are illustrations of the discharge operation of the liquid discharge head of the structure shown in FIGS. 20 to 22, expressed in terms of sectional views taken along the direction of one liquid flow path and divided into characteristic phenomena.

FIG. 24A shows a state prior to the application of an energy such as electric energy to a heat generating element 4 and before the heat generating element 4 generates heat. In this state, an infinitesimal gap (not greater than 10 $\mu$m) is present between the free end of the movable member 8 as well as both lateral ends adjacent thereto and the liquid supply part forming member 5A.

Figure 24B:
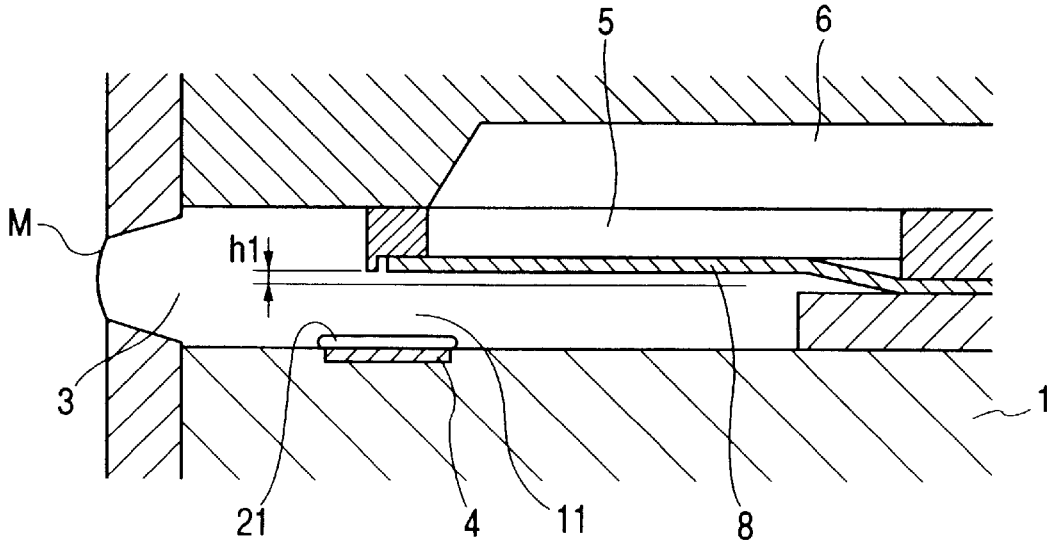

FIG. 24B shows a state that part of the liquid filling the liquid flow path 3 is heated by a heat generating element 4, film boiling occurs on the heat generating element 4 and bubble 21 grow isotropically. Here, the phrase "the growth of a bubble is isotropic" means a state that the growing rate of a bubble toward the normal of a bubble surface is almost equal in positions of the bubble surface.

In an isotropic growth process of a bubble 21 at this initial stage of bubble generation, the movable member 8 comes into close contact with the peripheral portion of a liquid supply port 5 to block up the liquid supply port 5, so that the interior of the liquid flow path 3 turns substantially into a sealed state except the discharge port 7. By the way, a period while the sealing state is established and maintained may lie within period from the application of a driving voltage to a heat generating element 4 to the completion of an isotropic growth of a bubble 21. Besides, in this sealed state, the inertance (difficulty in moving when a still water begins to move suddenly) from the center of the heat generating element 4 to the side of the liquid supply port amounts substantially to an infinity in the liquid flow path 3. At this time, the inertance from the heat generating element 4 to the side of the liquid supply port approaches more to an infinity the greater distance is taken between the heat generating element 4 and the movable member 8. Furthermore, at this time, h1 is let to be a maximum displacement of the free end of the movable member 8 to the side of the liquid supply port 5.

Figure 25A:
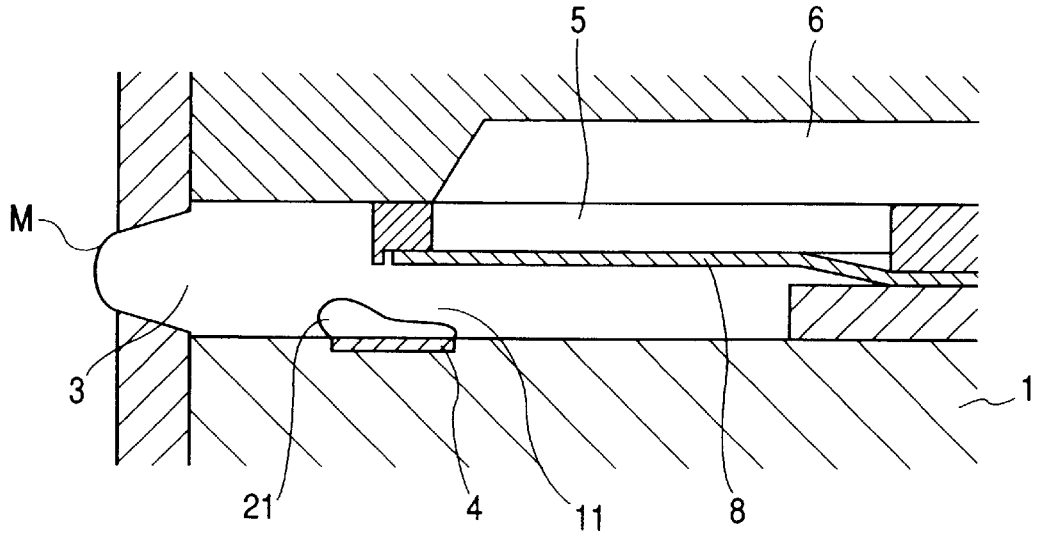
FIGS. 25A and 25B are illustrations of the discharge operation subsequent to that of FIGS. 24A and 24B, expressed in terms of sectional views taken along the direction of one liquid flow path of a liquid discharge head.

FIG. 25A shows a state of a bubble 21 keeping to grow. In this state, since the interior of the liquid flow path 3 is substantially in a sealed state except the discharge port 7 in the bubble generating area 11, the flow of a liquid does not reach the side of the liquid supply port 5 in the bubble generating area 11. Accordingly, the bubble 21 can expand greatly to the side of the discharge port 7, but does not so much to that of the liquid supply port 5. And, at the side of the discharge port 7 in the bubble generating area 11, the bubble growth continues, but by contraries, the bubble growth stops at that of the liquid supply port 5 in the bubble generating area 11. In brief, this bubble growth stop state becomes a maximum bubbling state at the side of the liquid supply port 5 in the bubble generating area 11. Vr is let to be the bubbling volume of this time.

Here, referring to FIGS. 123A–123E, the growing process of a bubble 21 in this embodiment, shown in FIGS. 24A, 24B and 25A, will be described in detail as with the growing steps of a bubble in the first embodiment. On heating a heat generating element 4, as shown in FIG. 123A, an initial boiling takes place on the heat generating element 4, then changing into a film boiling in which a filmy bubble covers over the heat generating element 4 as shown in FIG. 123B. And, the bubble of a film boiling state keeps growing isotropically as shown in FIGS. 123B and 123C (such an isotropically growing state of a bubble is referred to as semi-pillow state). When the interior of the liquid flow path 3 turns substantially into a sealed state except the discharge port 7 as shown in FIG. 24B, however, the move of a liquid toward the upstream side is disabled, so that part of a bubble in the semi-pillow state at the upstream side (side of the liquid supply port 5) becomes unable to grow so much and the rest portion of downstream side (side of the discharge port 7) grows greatly. This state is shown in FIG. 25A or FIGS. 123D and 123E.

Here, for the convenience of explanation, an area in which no bubble 21 grows on the heat generating element 4 and an area at the side of the discharge port 7 in which a bubble 21 grows when heating the heat generating element 4 are designated with Area B and Area A, respectively. Incidentally, in Area B shown in FIG. 123E, the bubbling volume reaches a maximum and Vr is let to be the bubbling volume of this time.

Figure 25B:
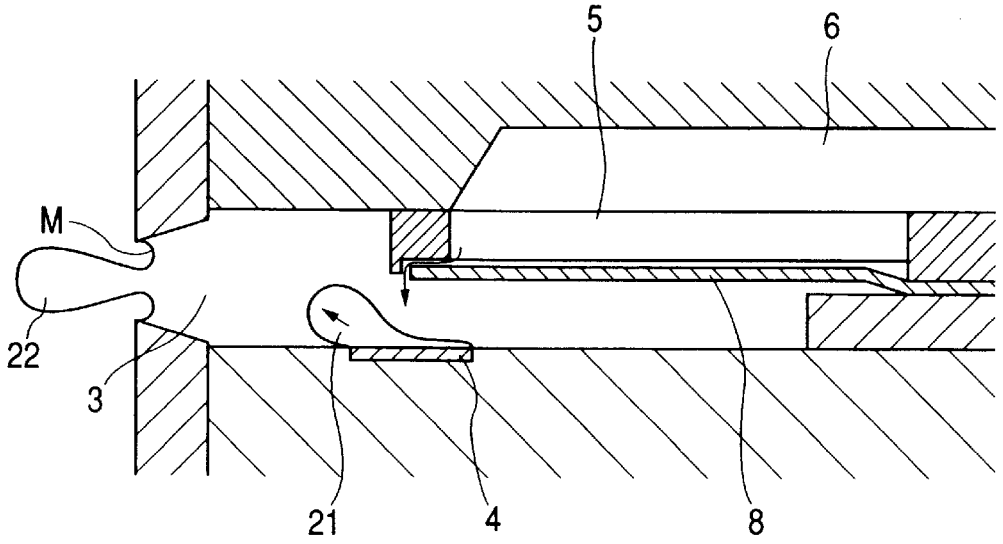

Next, FIG. 25B shows a state at which the growth of a bubble continues in Area A and the shrinkage of a bubble has begun in Area B (period of partial growth and partial shrinkage (See FIG. 124)). In this state, a bubble 21 grows greatly toward the side of the discharge port in Area A and the volume of a bubble 21 begins to decrease in Area B. Thereby, a free end of the movable member 8 begins to be displaced downward to the stationary state position under action of the recovering force due to its rigidity and the extinction force of a bubble 21 in Area B. Besides, since a crooked flow path passing from the liquid supply port 5 to the liquid flow path 3 at the free end of the movable member 8 causes a liquid current toward the heat generating element 4 from the liquid supply port 5 to the liquid flow path 3 as indicated by an arrow in FIG. 25B as described above, thus enabling downward displacement of the movable member 8 to be enhanced. As a result, the liquid supply port 5 opens, and the common liquid supply chamber 6 and the liquid flow path 3 turn into a communicable state.

Figure 26A:
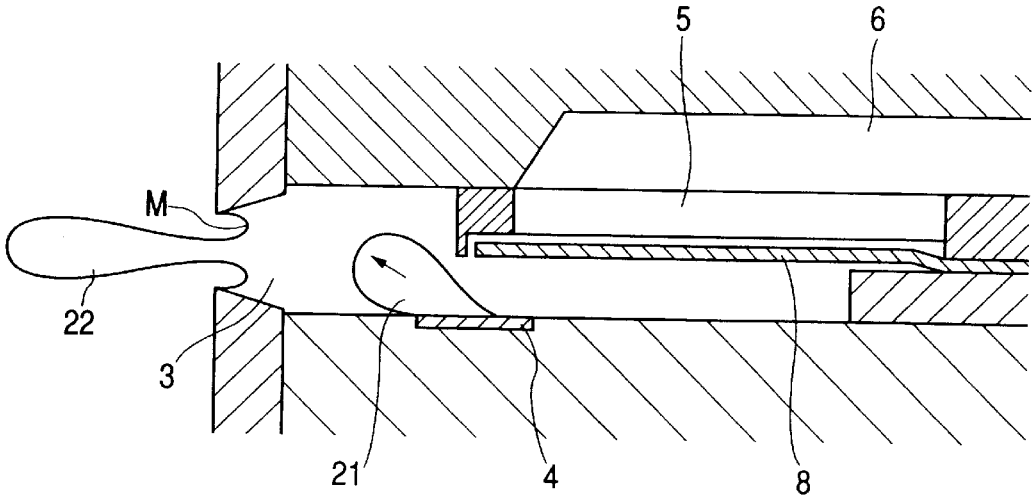
FIGS. 26A and 26B are illustrations of the discharge operation subsequent to that of FIGS. 25A and 25B, expressed in terms of sectional views taken along the direction of one liquid flow path of a liquid discharge head.

FIG. 26A shows a state that the bubble 21 has grown almost to a maximum. In this state, a bubble 21 in Area A has grown to a maximum and almost all bubbles 21 in Area B disappear accompanying this. Vf is let to be a maximum bubble volume in Area A at this time. Besides, the discharge droplet 22 under discharge from the discharge port 7 is still tied to a meniscus M with a long tail drawn.

Figure 26B:
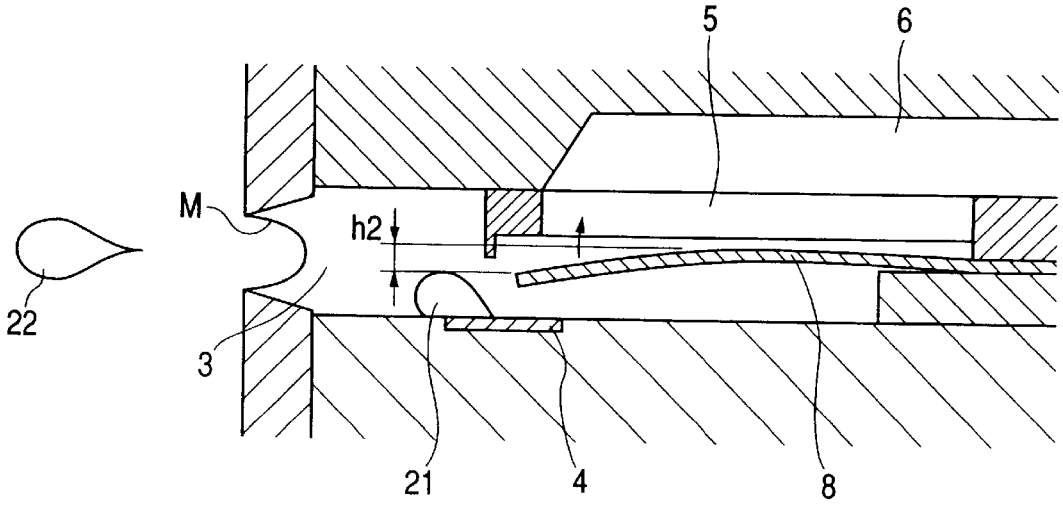
Figure 27A:
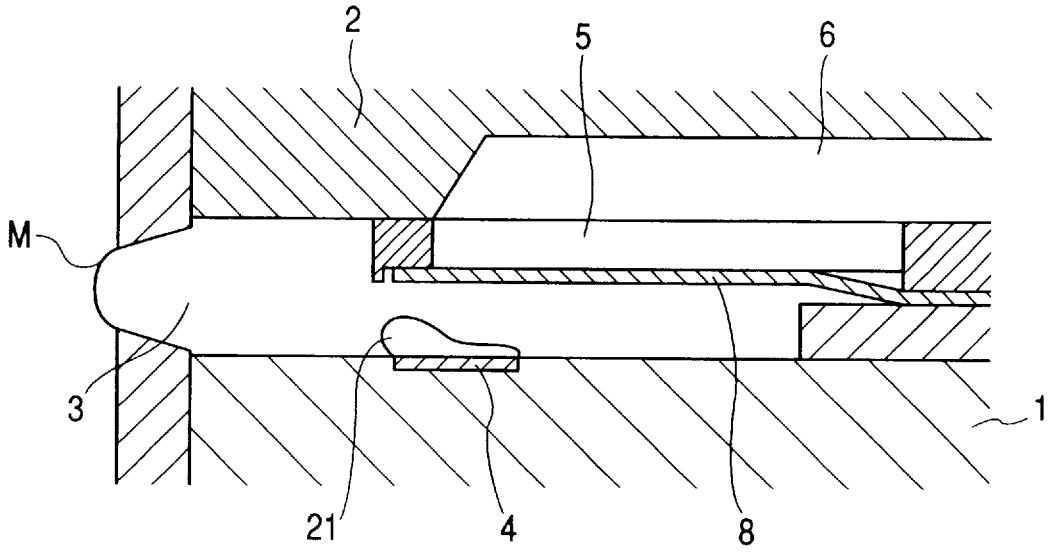
FIGS. 27A and 27B are sectional views taken along the direction of one liquid flow path of a liquid discharge head according to the second embodiment of the present invention, where FIG. 27A relates to a configuration of covering the whole heat generating element with the free end of a movable member and FIG. 27B relates to a configuration of separating a heat generating element from a movable member.
Figure 27B:
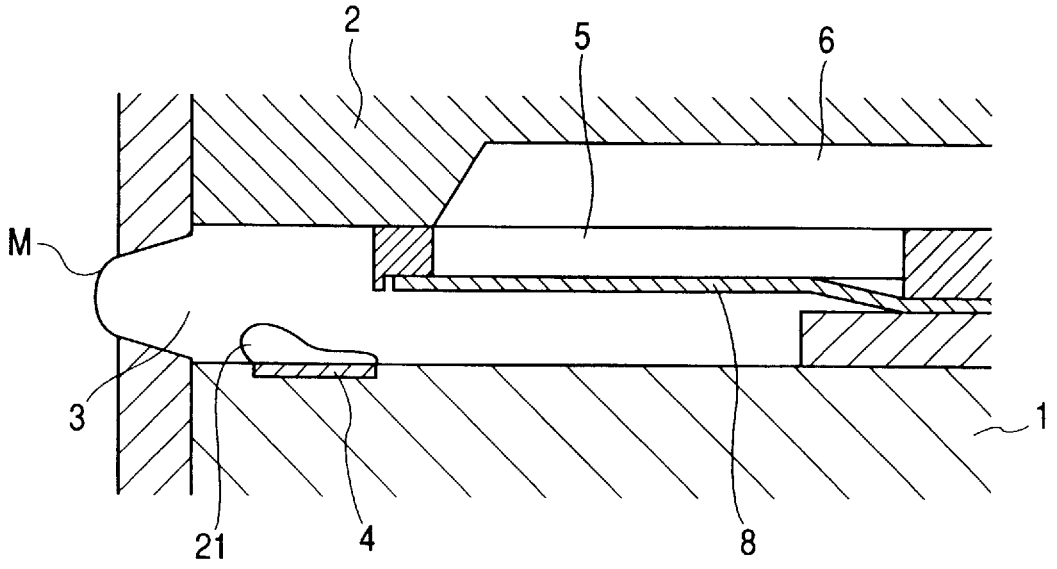

FIG. 26B corresponds to a stage of bubble disappearing step alone at which the growth of the bubble 21 stops and shows a state that a discharge droplet 22 and the meniscus M are separated. Right after the bubble growth changes into the bubble disappearance in Area A, the shrinking energy of the bubble 21 acts as a force of moving the liquid near the discharge port 7 toward the upstream direction as a result of total balance. Thus, the meniscus M is pulled into the liquid flow path 3 from the discharge port 7 at this point, thus cuts off the liquid pole combined with the discharge liquid droplet 22 swiftly by a strong force. On the other hand, along with the shrinkage of a bubble 21, a liquid flows rapidly from the common liquid supply chamber 6 via the liquid supply port 5 into the liquid flow path 3 in a large current. Thereby, the flow rapidly pulling the meniscus M into the liquid flow path 3 lowers abruptly, so that the meniscus M begins to return to the position prior to the bubbling at a relatively low speed and therefore the convergency of vibration of the meniscus M is very good in comparison with the liquid discharge scheme equipped with no movable member 8 according to the present invention. Incidentally, h2 is let to be a maximum displacement of the free end of the movable member 8 to the side of the bubble generation area 11.

Finally, when the bubble 21 completely disappears, the movable member 8 also recovers to the stationary state position shown in FIG. 24A. Toward this state, the movable member 8 is displaced upward under action of its elastic force (along Arrowhead of solid line in FIG. 26B). Besides, in this state, the meniscus M has already recovered near the discharge port 7.

Next, a correlation between the time volume change of a bubble in Area A as well as Area B shown in FIGS. 24A and 24B to 26A and 26B and the behavior of a movable member 8 (See FIG. 126) and a correlation between the bubble growth in a liquid discharge head equipped with a movable member and a heat generating element different in relative positions from those of this embodiment and the behavior of a movable member (See FIGS. 27A and 27B, FIG. 125 and FIG. 126), either of them has a correlation similar to that of the first embodiment.

Besides, also in this embodiment, letting Vf and Vr be the volume of a growing bubble at the maximum at the side of the discharge port 7 (bubble of Area A) in the bubble generating area 11 and that of a growing bubble at the maximum at the side of the liquid supply port 5 (bubble of Area B) in the bubble generating area 11, respectively as with the first embodiment, the relation of Vf>Vr holds true permanently for a head according to the present invention as evident from FIGS. 124 to 126. Furthermore, letting Tf and Tr be the life time (time from the appearance of a bubble to the disappearance of the bubble) of a growing bubble at the side of the discharge port 7 (bubble of Area A) in the bubble generating area 11 and that of a growing bubble at the side of the liquid supply port 5 (bubble of Area B) in the bubble generating area 11, respectively, the relation of Tf>Tr holds true permanently for a head according to the present invention. And, from a relation as mentioned above, it follows that the disappearing point of a bubble is situated at the side of the discharge port 7 rather than near the center of the bubble generating area 11.

Furthermore, with the present configuration of a head, as understood also from FIGS. 24B and 26B, there is a relation that the maximum displacement h2 of the free end of a movable member 8 toward the side of the bubble generator means 4 along with the disappearance of a bubble 21 is greater than the maximum displacement h1 of the fulcrum vicinity of the movable member 8 toward the side of the liquid supply port 5 at the initial generation of the bubble 21 (h1<h2). For example, h1 is 2 $\mu$m and h2 is 10 $\mu$m. Validity of this relation can suppress the growth of a bubble toward behind a heat generating element (opposite the discharge port 7) at the initial generation of the bubble and can enhance that of a bubble toward the front of the heat generating element (toward the discharge port 7). Thereby, the efficiency of converting the bubbling energy generated on the heat generating element 4 into the kinetic energy of a droplet of a liquid flying from the discharge port 7 can be improved.

Like these, the head configuration and the liquid discharge operation in this embodiment was described, but according to such an aspect, the growth component to the downstream side and the growth component to the upstream side of a bubble 21 are unequal, the upstream component nearly vanishes and the move of a liquid toward the upstream side is suppressed. Since the move of the liquid toward the upstream side is suppressed, most of the bubble growth is directed toward the discharge port 7 without loss of the growth component to the upstream side and the discharge power is improved in leaps and bounds. What is more, since the flow path passing from the liquid supply port 5 to the liquid flow path 3 is crooked at the tip end of the movable member 8 by the convex part 5B formed on the supply part forming member 5A, the flow of a liquid from the liquid flow path 3 to the liquid supply port 5 at the initial period of bubbling is fully suppressed. As a result, the growth pressure of a bubble is securely conducted to the movable member 8 and a substantially sealed state is securely produced in the liquid flow path 3, thus enabling discharge characteristics to be improved.

Furthermore, the retreat of a meniscus after the discharge decreases and its protrusion from the orifice surface during the refill decreases correspondingly. Accordingly, the meniscus vibration is suppressed and a stable discharge becomes performable at all driving frequencies from a low frequency to a high frequency.

[First Variation]

Figure 28:
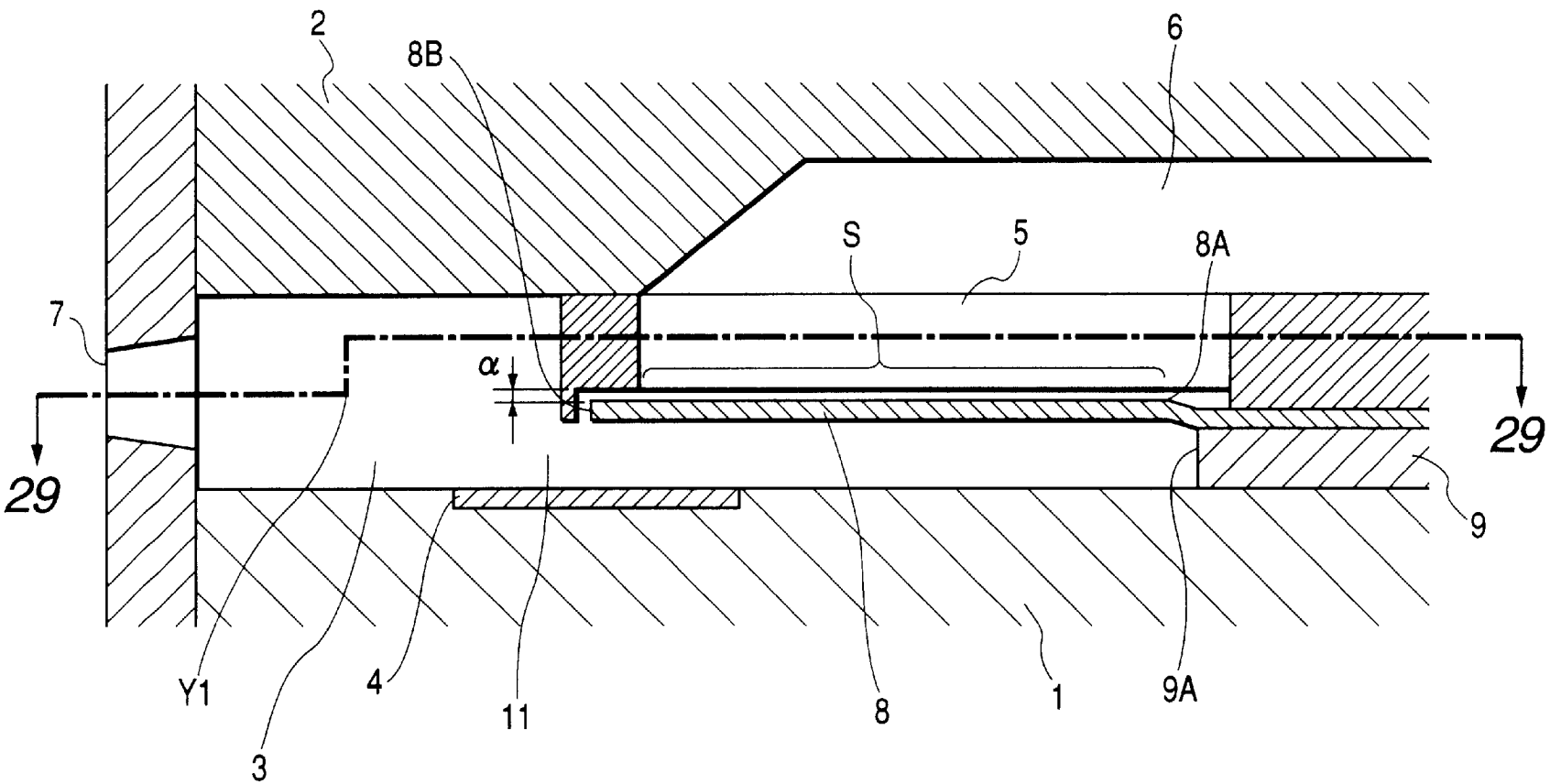
FIG. 28 is a sectional view taken along the direction of one liquid flow path of a liquid discharge head according to the first variation of the second embodiment of the present invention.
Figure 29:
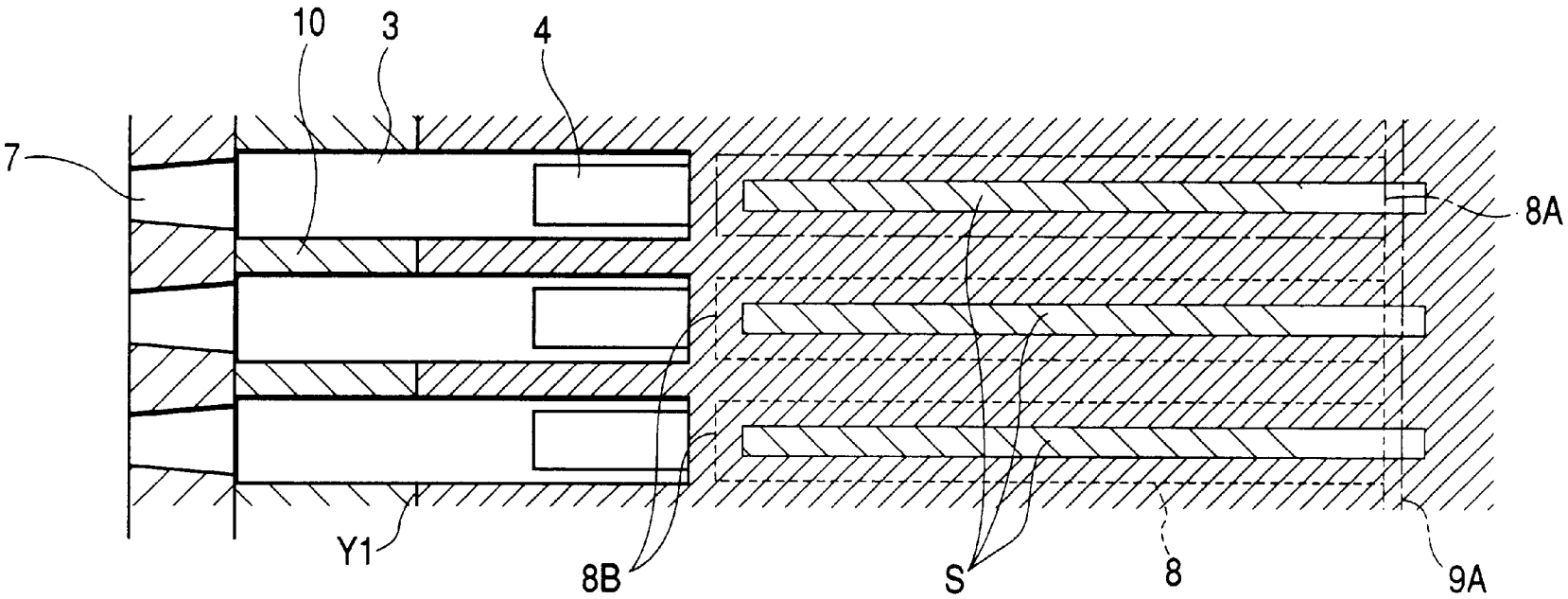
FIG. 29 is a sectional view taken on line 29—29 of FIG. 28.

In a head structure according to this variation, since a position of the movable member 8 remaining unjoined to the fixed member 9 (i.e., bent and rising) was not the same as the end part 9A of the fixed member 9 as shown in FIGS. 20 and 22, the opening area S comprised an area enclosed with three sides of the liquid supply port 5 and the end part 9A of the fixed member 9, but the bent rising position of the movable member 8 from the fixed member 9 may be set to the end part 9A of the fixed member 9 as shown in FIGS. 28 and 29. In the case of this structure, as shown in FIGS. 28 and 29, the opening area S comprises an area enclosed with three sides of the liquid supply port 5 and the fulcrum part 8A of the movable member 8.

Figure 30:
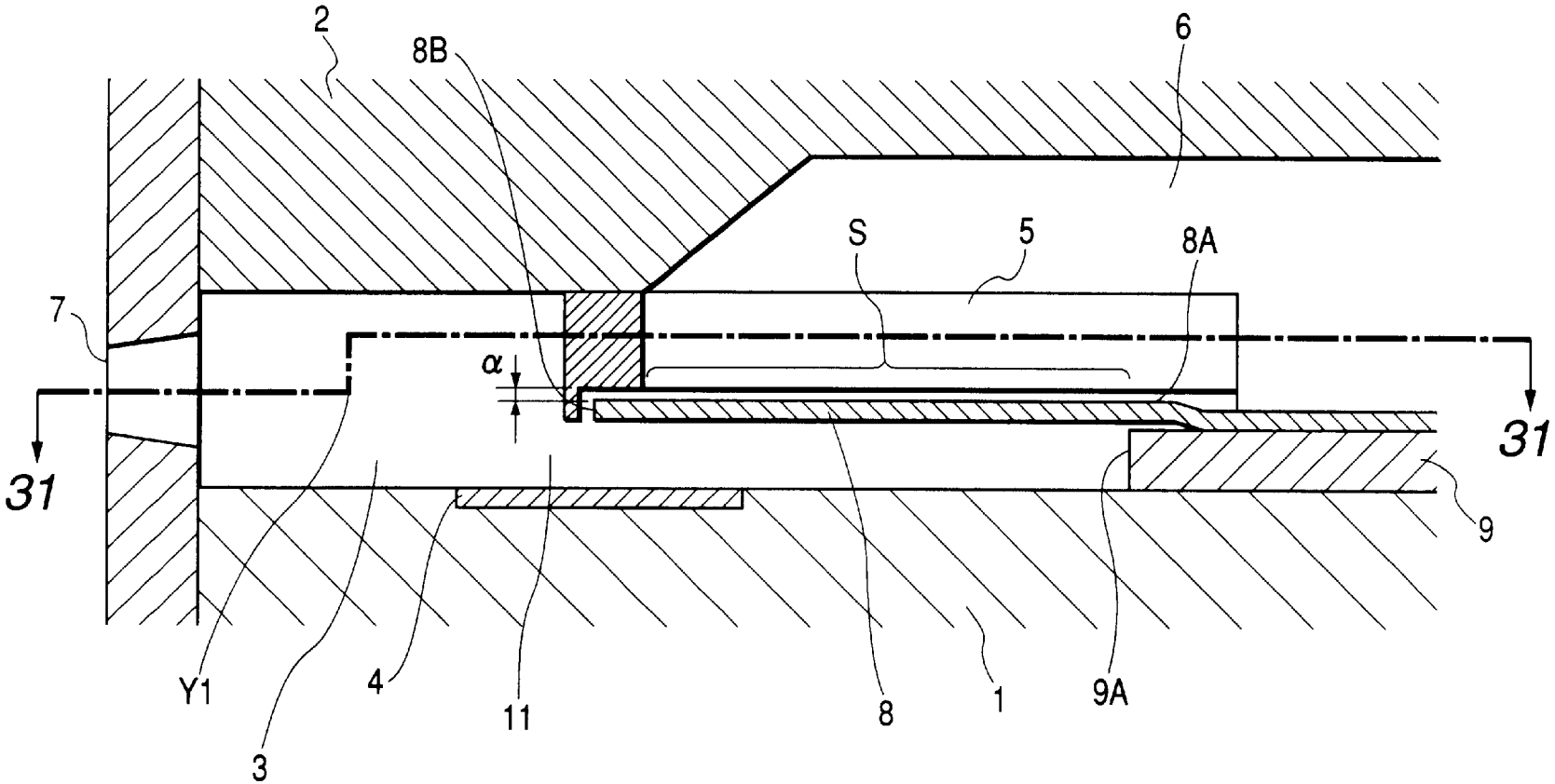
FIG. 30 is a sectional view taken along the direction of one liquid flow path of a liquid discharge head according to the first variation of the second embodiment of the present invention.
Figure 31:
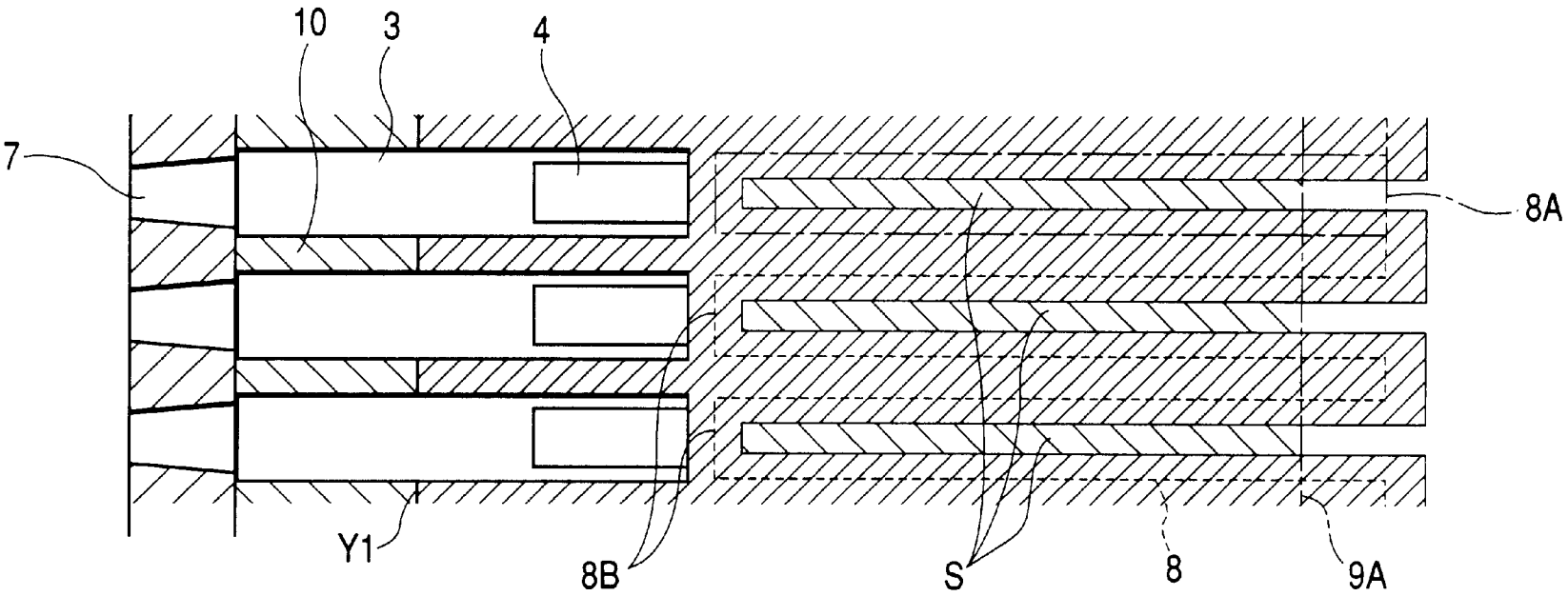
FIG. 31 is a sectional view taken on line 31—31 of FIG. 30.
Figure 32D:
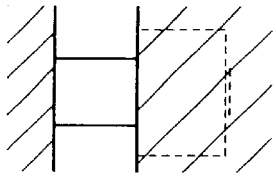
FIGS. 32A, 32B, 32C and 32D are illustrations of individual parts of a liquid discharge head according to the second variation of the second embodiment of the present invention.
Figure 32C:
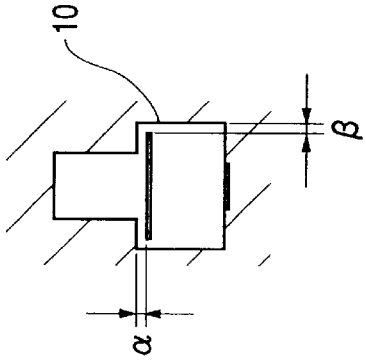
Figure 32A:
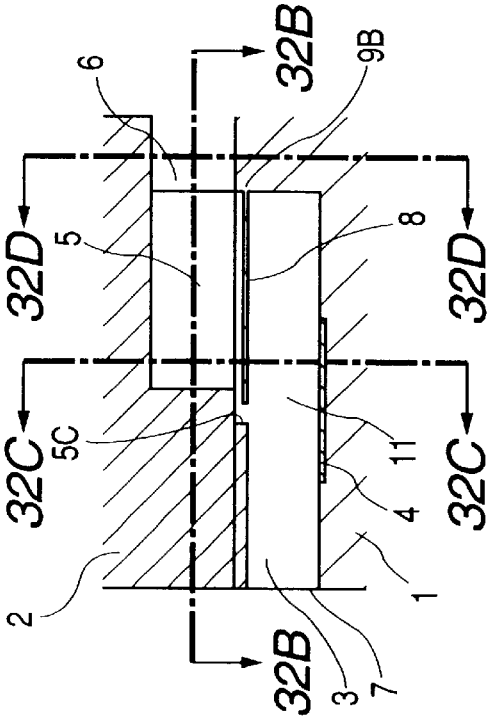
Figure 32B:
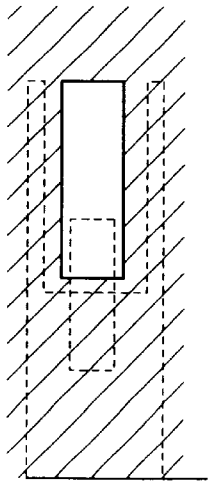

Besides, in the head structure shown in FIG. 22, the liquid supply port 5 was set to an opening enclosed with four sides, but the wall surface at the side of the liquid supply chamber 6 opposed to the side of the discharge port 7 may be opened among the supply part forming member 5A (See FIG. 20) like the structure shown in FIGS. 30 and 31. In the case of this structure, as shown in FIGS. 30 and 31, the opening area S comprises an area enclosed with three sides of the liquid supply port 5 and the end part 9A of the fixed member 9 as shown in FIGS. 30 and 31 like the structure shown in FIGS. 20 and 22.

Also in this case, by forming a convex part 5B opposed to the free end of the movable member 8 in the supply part forming member 5A to crook the flow path passing from the liquid supply port 5 to the liquid flow path 3 at the tip end of the movable member 8 like the head structure shown in FIGS. 20 and 22, the flow of a liquid from the liquid flow path 3 to the liquid supply port 5 at the initial period of bubbling can be suppressed and discharge characteristics can be further improved, and moreover the flow of a liquid toward a heat generating element 4 occurs at the free end of the movable member 8 during the downward displacement of the movable member 8 accompanying a partial disappearance of a bubble, thus enabling downward displacement of the movable member 8 to be enhanced.

[Second Variation]

Next, referring to FIGS. 32A to 32D, the second variation of a liquid discharge head according to the second embodiment will be described.

In the liquid discharge head of the structure shown in FIGS. 32A–32D, an element substrate 1 and a top board 2 are joined to each other, between both of which a liquid flow path 3 with one end communicating with a discharge port 7 and the other end closed is formed.

At the liquid flow path 3, a liquid supply port 5 is disposed and a common liquid supply chamber 6 communicating with the liquid supply port 5 is provided.

Between the liquid supply port 5 and the liquid flow path 3, a movable member 8 with one end facing toward the side of the discharge port 7 made a free end and the other end supported by the support part 9B at the upstream end of the liquid flow path 3 is provided in nearly parallel with an opening area of the liquid supply port 5. The size of the movable member 8 is larger than that of the opening area of the liquid supply port 5 and an infinitesimal gap is present between the upper surface (surface facing to the heat generating element 4) of the liquid flow path 3 and that of the movable member 8. Provided on the upper surface of the liquid flow path 3 is a step difference part 5C with a wall surface facing to the free end of the movable member 8 via an infinitesimal gap. Thereby, the flow path passing from the liquid supply port 5 to the liquid flow path 3 is crooked at the free end of the movable member 8.

By these, whereas the movable member 8 is movable without frictional resistance in the liquid flow path 3, its displacement to the side of the opening area S is not only regulated by the peripheral part of the opening area S but the flow of a liquid from the liquid flow path 3 to the liquid supply port 5 at the initial period of bubbling is suppressed. As a result, a substantially sealed state of the liquid supply port 5 can be made out and discharge characteristics are improved more. Besides, since a crooked flow path passing from the liquid supply port 5 to the liquid flow path 3 at the free end of the movable member 8 causes a liquid current toward the heat generating element 4 at the free end part of the movable member 8 at the downward displacement of the movable member 8 accompanying the partial disappearance of a bubble, the downward displacement of the movable member 8 can be improved.

[Third Variation]

The third variation of a liquid discharge head according to the second embodiment of the present invention shows the feature in form at the side of the free end of the movable member 8 in the supply part forming member 5A with a liquid supply port and to other constituents, a construction similar to that of the second embodiment is applicable.

Figure 33A:
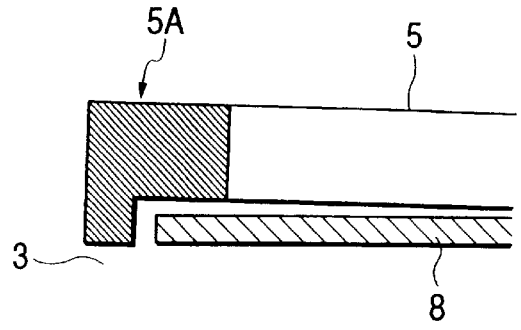
FIGS. 33A, 33B and 33C are illustrations of various examples of flow path structures passing from the liquid supply port to the liquid flow path in the free end part of a movable member of a liquid discharge head according to the third variation of the second embodiment of the present invention, expressed in terms of sectional views.
Figure 33B:
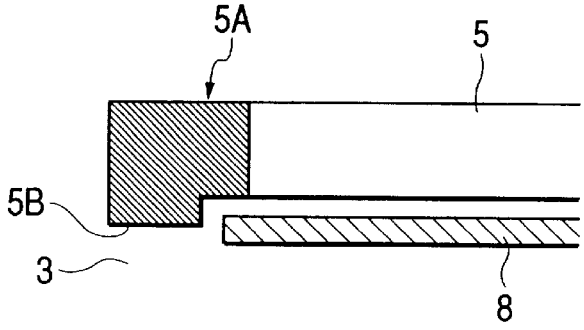
Figure 33C:
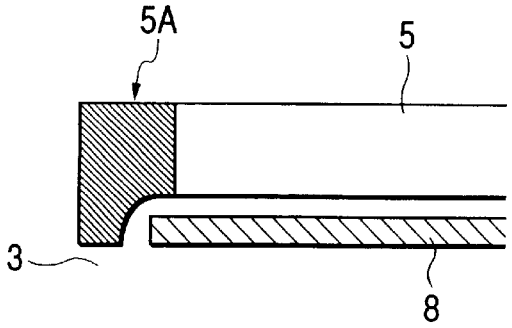
Figure 34:
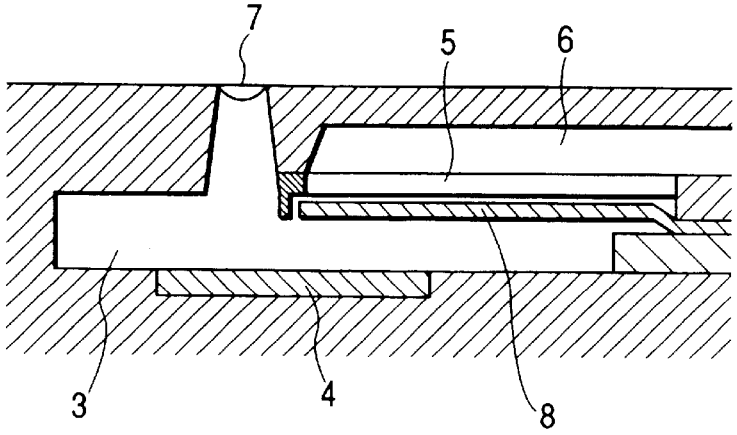
FIG. 34 is an illustration of an example of side-shooter type liquid discharge head corresponding to the configuration of a liquid discharge head according to the second embodiment of the present invention.
Figure 35A:
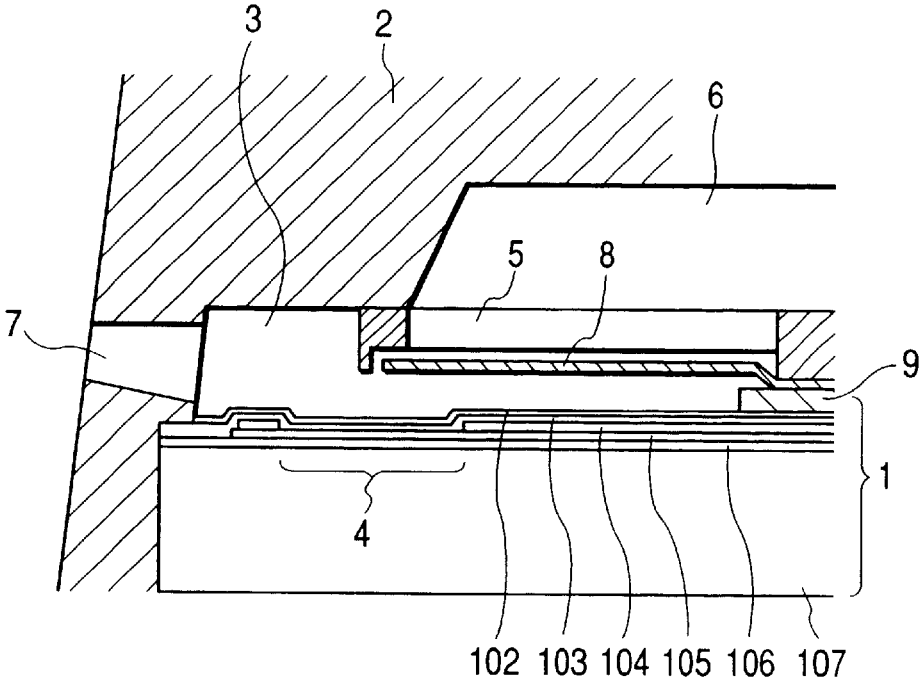
FIGS. 35A and 35B are vertically sectional views of a liquid discharge head according to the second embodiment of the present invention, where FIG. 35A relates to an example with a protective film and FIG. 35B relates to an example without a protective film.
Figure 35B:
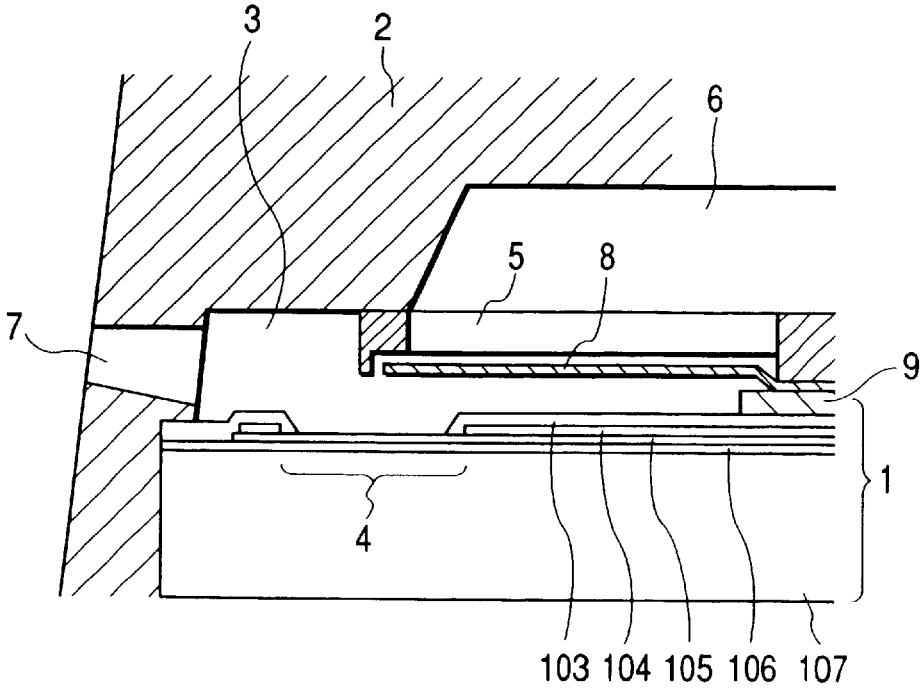

FIGS. 33A to 33C are sectional views showing various forms at the side of the free end of the movable member 8 in the supply part forming member 5A with a liquid supply port 5 for a liquid discharge head according to the third variation of the second embodiment.

FIG. 33A corresponds to an example in which the opening length of a liquid supply port 5 in length of a movable member 8 is made shorter and the facing area of the upper surface of the movable member 8 and a supply part forming member 5A is made larger than in the example shown in FIG. 20. Thereby, the flow path passing from the liquid supply port 5 to the liquid flow path 3 lengthens and the flow resistance increases, and accordingly the flow of a liquid from the liquid flow path 3 to the liquid supply port 5 at the initial period of bubbling can be suppressed better.

FIG. 33B corresponds to an example in which the protrusive height of the convex part 5B of a supply part forming member 5A is made smaller than in the example shown in FIG. 20 and is cut short to halfway in width of a movable member 8. Thereby, the flow path passing from the liquid supply port 5 to the liquid flow path 3 shortens but remains still in a crooked form and the flow of a liquid from the liquid flow path 3 to the liquid supply port 5 at the initial period of bubbling can be suppressed. Besides, since the overlapping amount in width of the movable member 8 between the movable member 8 and the supply part forming member 5A decreases, this example can form a straight flow path at a smaller displacement between the liquid supply port 5 and the liquid flow path 3 than the example shown in FIG. 20 when the movable member 8 completely in contact with the peripheral portion of the liquid supply port 5 is displaced downward due to the pressure of bubble. As a result, the refill of a liquid can be rapidly accomplished.

FIG. 33C corresponds to an example in which the surface facing the free end and that facing the upper surface of a movable member 8 in a supply part forming member 5A are combined using a curved surface. Even when the flow path passing from the liquid supply port to the liquid flow path 3 is made into a form crooked in a curve, the flow of a liquid from the liquid flow path 3 to the liquid supply port 5 at the initial period of bubbling can be suppressed and a substantial sealed state of the liquid flow path 3 can be securely produced as with the second embodiment. Besides, in this example, since the surface facing the free end and that facing the upper surface of a movable member 8 constitute a curved surface, the stagnation of a liquid in this portion also disappears during the refill of a liquid and the flow of a liquid to the liquid flow path 3 from the liquid supply port 5 can be efficiently actualized.

Incidentally, the examples shown in FIGS. 33A to 33C were described concerning a case of having a liquid supply port 5 provided on the supply part forming member 5A was described, but can be applied to such a configuration as the second variation of this embodiment (See FIG. 32) using no supply part forming member 5A.

Any of the embodiments described below is applicable to a liquid discharge head according to each of the embodiments mentioned above.

Third Embodiment

Figure 36:
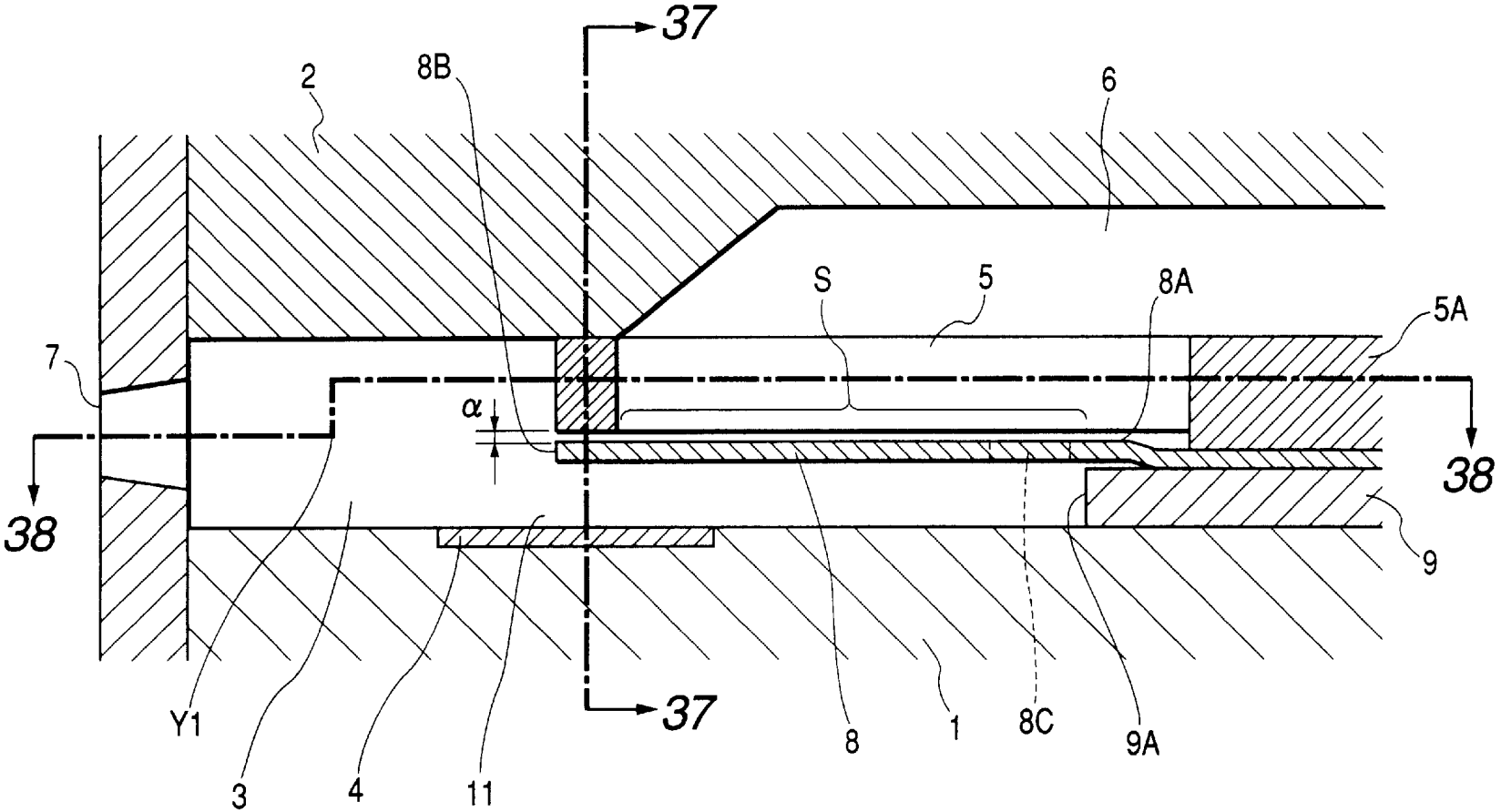
FIG. 36 is a sectional view taken along the direction of one liquid flow path of a liquid discharge head according to the third embodiment of the present invention.
Figure 37:
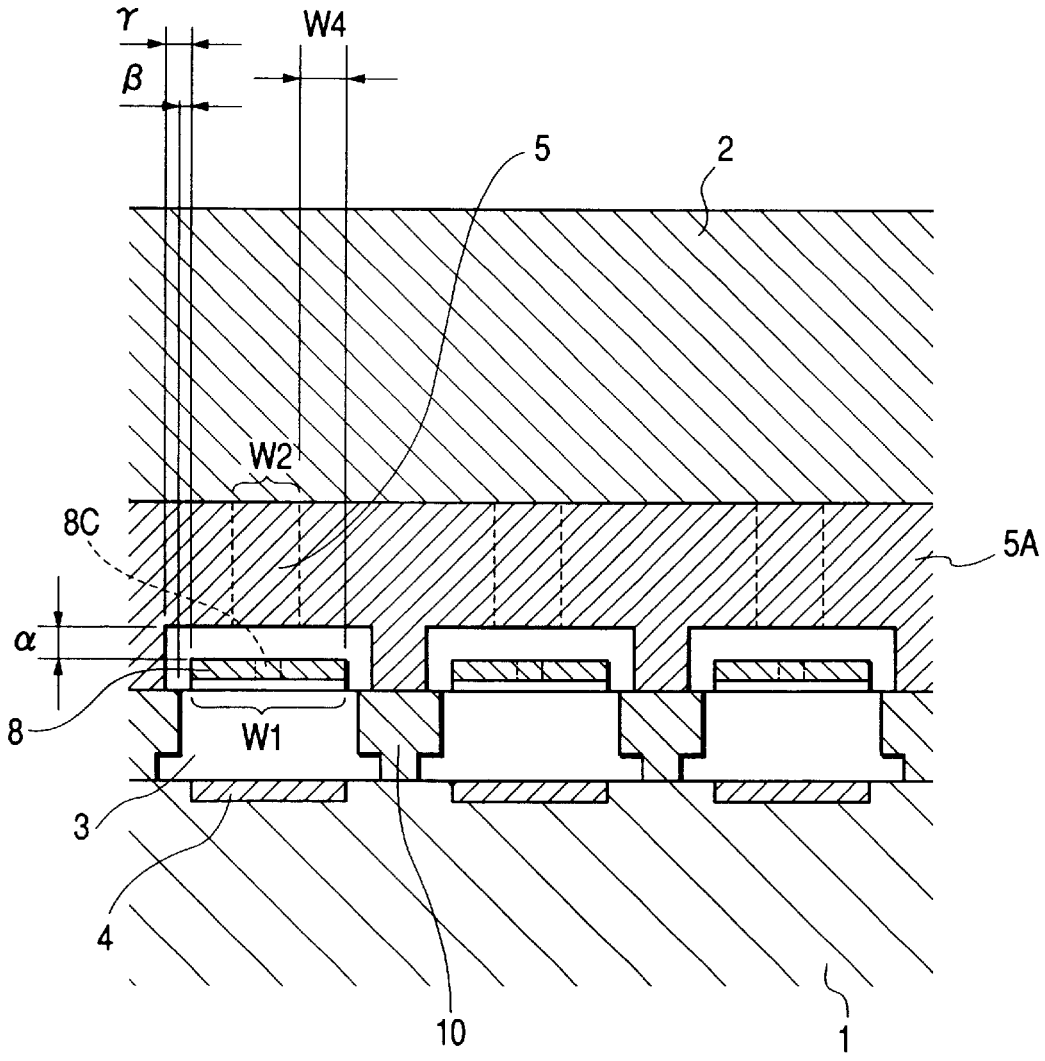
FIG. 37 is a sectional view taken on line 37—37 of FIG. 36.

FIG. 36 is a sectional view taken along one liquid flow path of a liquid discharge head according to the third embodiment of the present invention; FIG. 37 is a sectional view taken along line 37—37 of FIG. 36; and FIG. 38 is a sectional view taken along line 38—38 shifted to the side of a top board 2 at the point Y1 from the discharge port of FIG. 36.

Figure 38:
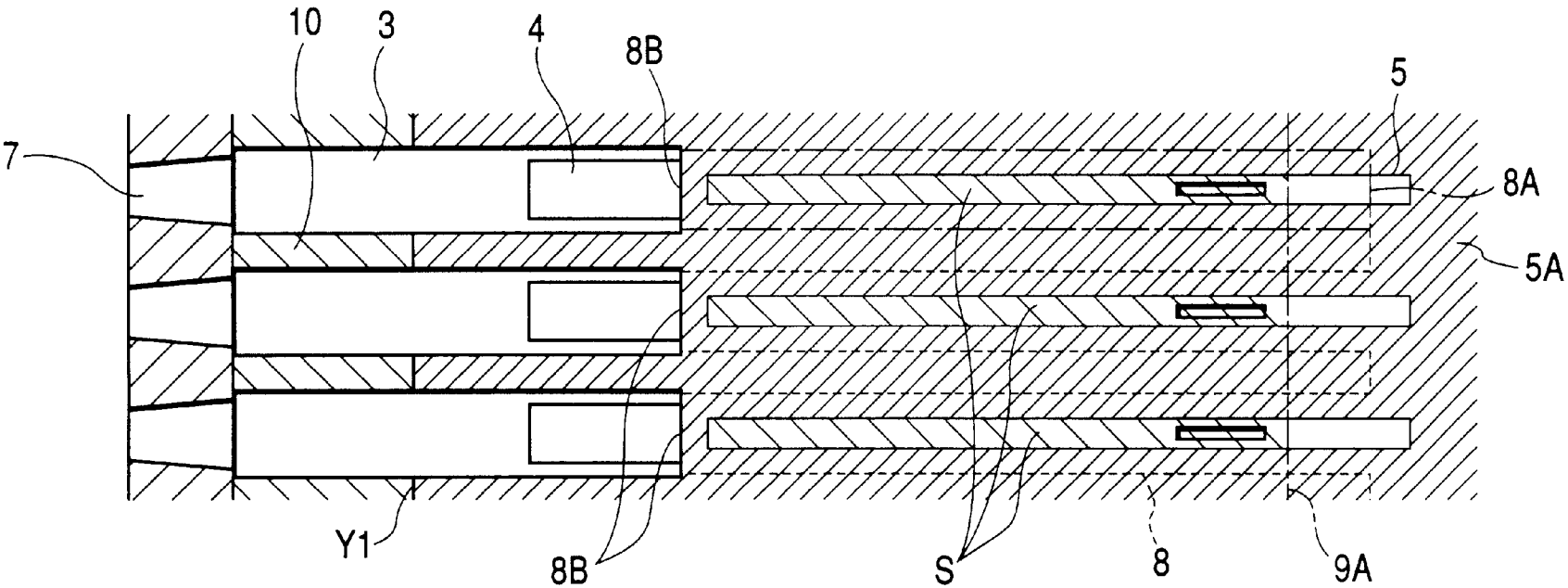
FIG. 38 is a sectional view taken on line 38—38 of FIG. 36.

In the liquid discharge head of the form of liquid paths-a common chamber shown in FIGS. 36 to 38, an element substrate 1 and a top board 2 are fastened via a liquid path side wall 10 in a stacked state and a liquid flow path 3 communicating to a discharge port 7 at one end and closed at the other end is formed between both plates 1 and 2. A great number of such liquid flow paths 3 are provided at one head. Besides, in the element substrate 1, heat generating elements 4 such as electro-thermal converter elements as bubble generator means for generating bubble in liquids filled up at liquid flow paths 3 are disposed to individual liquid flow paths 3. In the vicinity area at the contact surface between a heat generating element 4 and a discharge liquid, there is present a bubble generating area 11 where a heat generating element 4 is rapidly heated to generate bubble in a discharge liquid.

In each of many liquid flow paths 3, a liquid supply port 5 formed at a supply part forming member 5A is disposed and a common liquid supply chamber 6 communicating to all individual liquid supply ports 5 is provided. In other words, a form of being branched from a single common liquid supply chamber 6 into many liquid flow paths 3 is observed and an amount of liquid corresponding to that of liquid discharged from the discharge port 7 communicating to each liquid flow path 3 is received from this common liquid supply chamber 6.

Between a liquid supply port 5 and a liquid flow path 3, a movable member 8 is provided an infinitesimal gap $\alpha$ (e.g. not greater than 10 $\mu$m) apart from and in almost parallel with the opening area S of the liquid supply port 5. The area enclosed with at least the free end part 8B of the movable member 8 and the both lateral parts adjacent thereto becomes greater than the opening area S of the liquid supply port 5 (See FIG. 38) and an infinitesimal gap β is present between the lateral portions of the movable member 8 and the both respective flow path side walls 10 (See FIG. 37). The above supply part forming member 5A is apart via a gap γ from the movable member 8 as shown in FIG. 37. Gaps β and γ vary depending on the pitch of the flow path, but a great value of γ makes it easy for the movable member 8 to shut off the opening area S and a large value of β makes it easy for the movable member 8 to move to the side of the element substrate 1 with the disappearance of bubble rather than the stationary state of being situated via a gap α from the liquid supply port 5. With this embodiment, the gap α shown in FIG. 2 was set to 3 μm, the gap β was to 3 μm and the gap γ was to 4 μm. Besides, in width with the flow path side wall 10, the movable member 8 has a greater width W1 than the width W2 of the above opening area S, which is wide enough to seal the opening area S. On an extension of the end part at the side of the free end of the continuous part continuous concerning the crossing direction of movable members to flow paths, the fulcrum 8A of the movable member 8 prescribes the upstream side end part of the opening area S of the liquid supply port 5 (See FIG. 38). In this embodiment, as shown in FIGS. 37 and 38, the portion of the supply part forming member 5A along the movable member 8 is set less wide than the flow path side wall itself and the supply part forming member 5A is stacked on the flow path side wall 10. Incidentally, the supply part forming member 5A is set equal in width to the flow path side wall 10 at the side of discharge port 7 rather than at the side of the free end 8B of the movable member as shown in FIG. 38. By these, whereas the movable member 8 is movable without a frictional resistance in the liquid flow path 3, its displacement toward the side of the opening area S can be regulated by the peripheral part thereof. Thereby, the opening area S can be substantially blocked to prevent the liquid flow from inside the liquid flow path 3 to the common liquid supply chamber 6 from being reversed, while on the other hand, the movement from the substantially sealed state to the refillable state becomes possible to the liquid flow path side with the disappearance of bubble. Besides, in this embodiment, also regarding the element substrate 1, the movable member 8 is in parallel with the element substrate 1. And, the end part 8B of the movable member 8 is a free end situated at the side of the heat generating element 4 in the element substrate 1 and the other end side is supported by a fixed member 9. Besides, the opposite end to the discharge port 7 of the liquid flow path 3 is closed by this fixed member 9.

Figure 39:
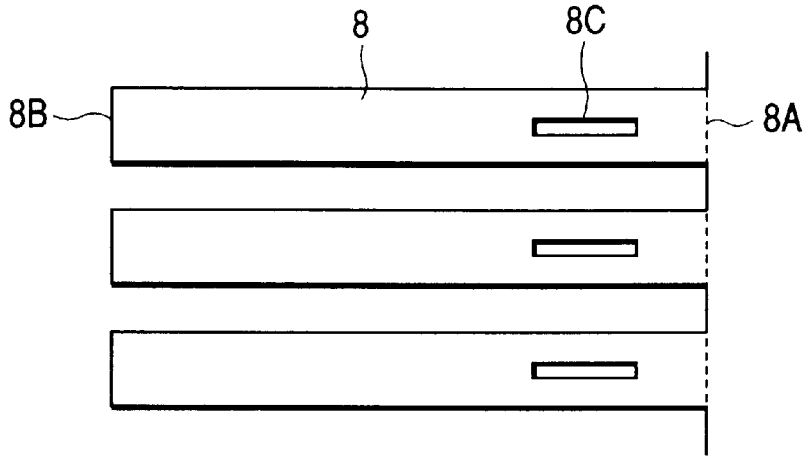
FIG. 39 is a plan view of a movable member in the liquid discharge head shown in FIGS. 36 to 38.

FIG. 39 is a plan view of a movable member in the liquid discharge head shown in FIG. 36 or the like. The movable member 8 in this embodiment has a communication port 8C for communicating the liquid supply port 5 with the liquid flow path 3 formed near the fulcrum 8A.

Figure 40A:
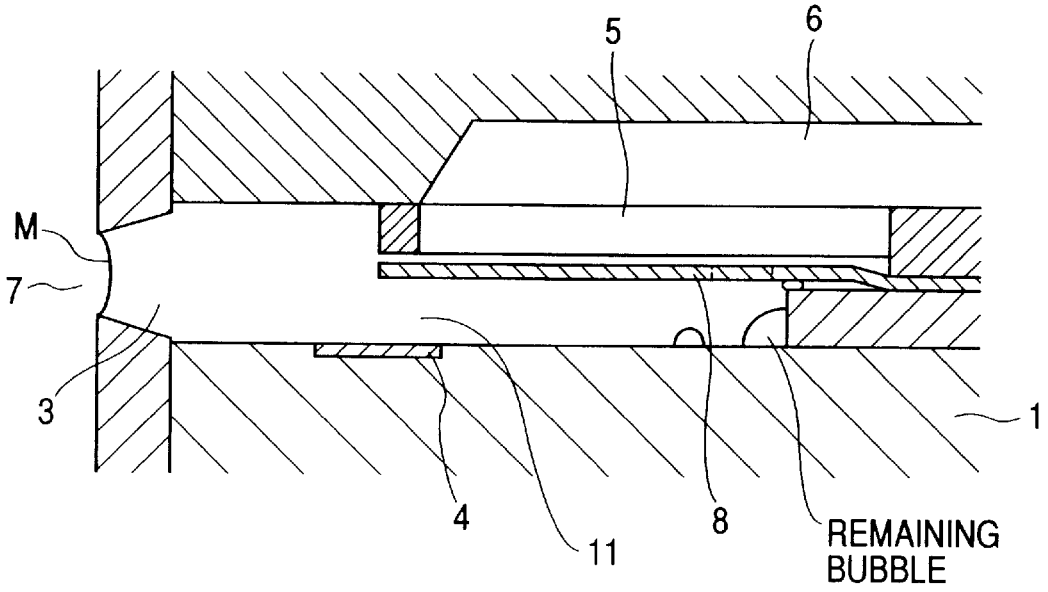
FIGS. 40A and 40B are manners of the liquid discharge head shown in FIGS. 36 to 38 in which remaining bubble staying in the liquid flow path under a movable member.
Figure 40B:
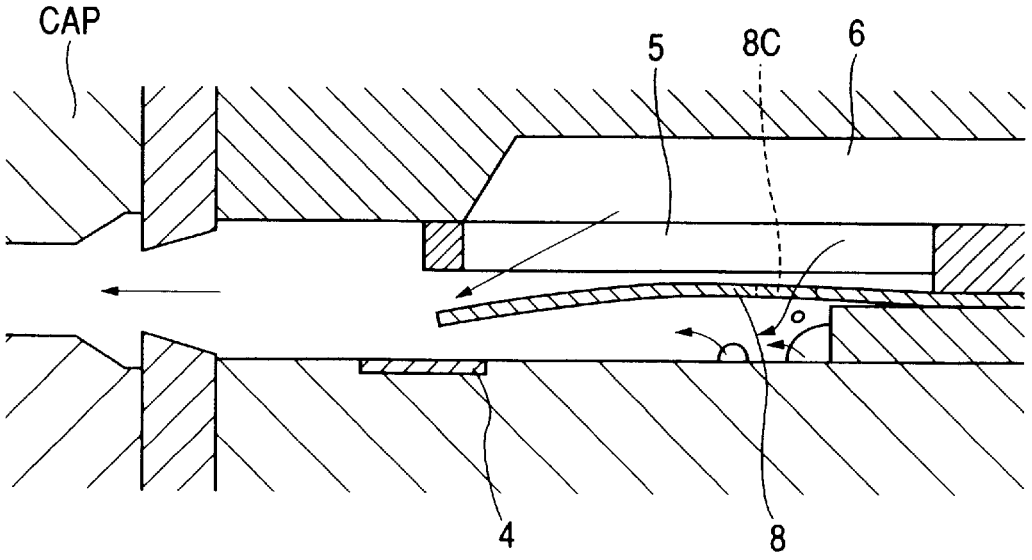

To illustrate the effect of this communication port 8C, first, FIG. 40A shows a state of remaining bubble stagnating on the lower surface near the fulcrum of the movable member 8. Remaining bubble perform a high frequency vibration and are likely to be generated when the heat generating element 4 rises in temperature. Namely, the heat generating element 4 rises in temperature, induces a nucleate boiling with a foreign matter such as scorch on the heat generating element 4 employed as the nucleus at a low temperature on the order of 100° C. and generates an infinitesimal bubble. If unable to disappear by the refill of a liquid and sticking to the lower part near the fulcrum of the movable member 8 in which a liquid hardly flows, this bubble becomes a remaining bubble. The bubble, sticking to the wall surface or the like once, hardly moves by any means partly because the flow of a liquid is unlikely to occur in its vicinity. In addition, the remaining bubble may serve as a buffer to absorb the propagation of the pressure wave at the time of discharging liquid for image recording, thereby causing instability in liquid discharge. Since the communication port 8C of this embodiment is a small port which has little effect on the discharge operation in the normal image recording, any liquid flow does not occur in the vicinity of the communication port 8C in the normal discharge operation. In a forced suction recovering operation performed through the discharge port 7 as shown in FIG. 40B, the flow of a liquid through the communication port 8C can be generated. As a result, the flow of a liquid occurs around the remaining bubble sticking the vicinity of the fulcrum of the movable member 8 and the remaining bubble becomes removal together with the liquid sucked.

Like this, in a liquid discharge head according to the present invention, since a communication port 8C is formed in the movable member 8, the flow of a liquid flowing from the liquid supply port 5 through the communication port 8C to the area below the movable member 8 occurs. Consequently, remaining bubble staying in the liquid flow path 3 below the movable member 8 are carried away over this flow and removed. Thus, provision of ink sucking means such as cap on a recorder equipped with a liquid discharge head according to the present invention is effective especially for the removal of remaining bubble in the liquid discharge head.

Incidentally, the opening area S is a substantial area for supplying a liquid from the liquid supply port toward the liquid flow path 3 and an area enclosed with the three sides of the liquid supply port 5 and the end part 9A of the fixed member 9 in this embodiment as shown in FIGS. 36 and 38.

Figure 41:
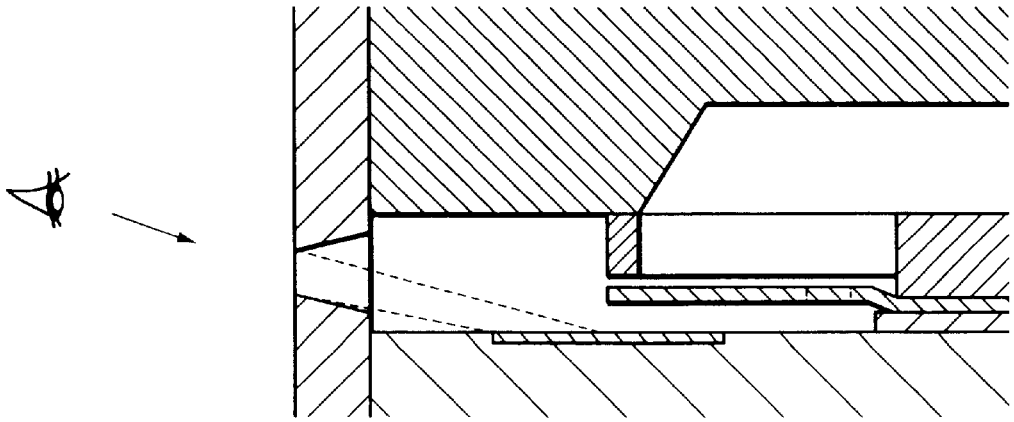
FIG. 41 is a sectional view of a flow path for explaining the "linear communication state"

Besides, as shown in FIG. 41, this embodiment, having no such an obstacle as valve between the heat generating element 4 as an electro-thermal converter and the discharge port 7, is in a "straight communicable state" with the structure of a straight flow path kept to a liquid flow. This becomes well preferable if an ideal state of stabilizing the discharge conditions such as discharge direction and discharge velocity of discharge drops at an extremely high level is formed by according the propagating direction of a pressure wave occurring at the generation of bubble with the accompanying flow direction and the discharge direction of the liquid straightly. In this present invention, it is only necessary as one definition for attaining or approaching to this ideal state to choice a construction of directly combining the discharge port 7 with the side of the discharge port 7 (downstream side) of a heat generating element 4, in particular, the heat generating element influential to the side of the discharge port 7 of bubble, by using a straight line, which means an observable state of the heat generating element 4, in particular, the downstream side thereof, when viewed from the exterior of the discharge port 7 in absence of a liquid in the liquid flow path 3 (See FIG. 41).

Next, the movement of the movable member 8 in a liquid discharge head according to the present invention will be described in details. FIGS. 42 to 44 show not only a liquid discharge head in a sectional view taken along a liquid flow path to illustrate the movement of a movable member in the liquid discharge head of such a structure as shown in FIGS. 36 to 38, but characteristic phenomena are divided in 6 steps of FIGS. 7 to 9 and shown. Besides, in FIGS. 42 to 44, Symbol M denotes a meniscus formed by the discharge liquid.

Figure 42A:
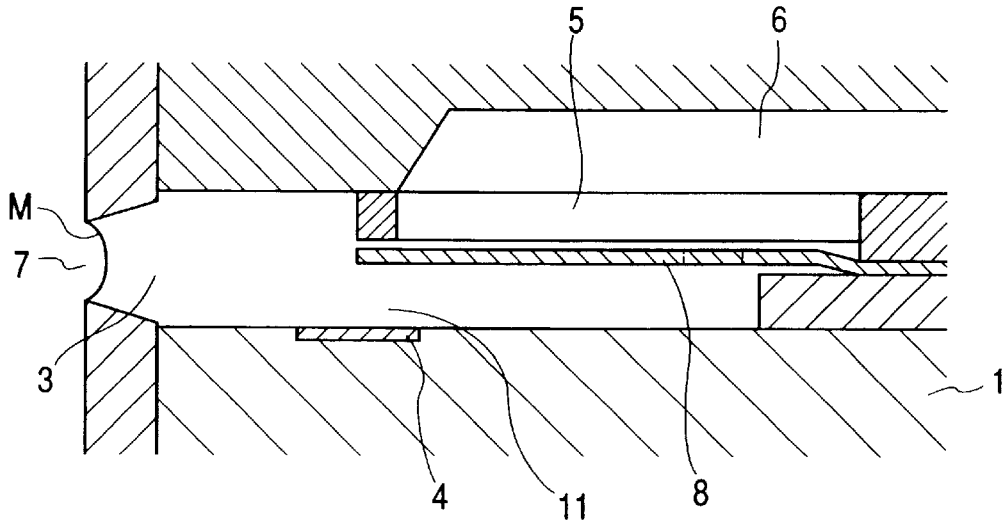
FIGS. 42A and 42B are illustrations of the discharge operation of the liquid discharge head of the structure shown in FIGS. 36 to 38, expressed in terms of sectional views taken along the direction of one liquid flow path and divided into characteristic phenomena.

FIG. 42A shows a state prior to the application of an energy such as electric energy to a heat generating element 4 and before the heat generating element 4 generates heat. In this state, an infinitesimal gap (below 10 $\mu$m) is present apart from the formed surface of the liquid supply port 5 over an extent from the center part to the fulcrum side in the movable member 8 provided between the liquid supply port 5 and the liquid flow path 3.

Figure 42B:
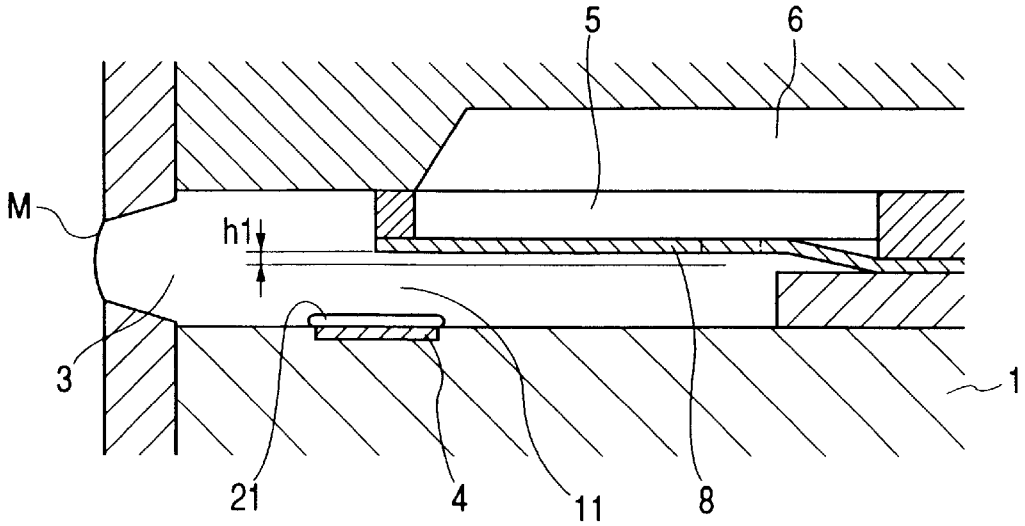

FIG. 42B shows a state that part of the liquid filling the liquid flow path 3 is heated by a heat generating element 4, film boiling occurs and bubble 21 grow isotropically. Here, the phrase "the growth of a bubble is isotropic" means a state that the growing rate of a bubble toward the normal of a bubble surface is almost equal in positions of the bubble surface.

In an isotropic growth process of a bubble 21 at this initial stage of bubble generation, the displacement an extent from a portion in contact with the stopper part 5*b* and a portion near the fulcrum 8A of a movable member 8 brings the movable member 8 into close contact with the peripheral portion of a liquid supply port 5 to block up the liquid supply port 5, so that the interior of the liquid flow path 3 turns substantially into a sealed state. By the way, a period that the sealing state is maintained after established may lie between the during from the application of a driving voltage to a heat generating element 4 to the completion of an isotropic growth of a bubble 21. Besides, in this sealed state, the inertance (difficulty in moving when a still liquid begins to move suddenly) from the center of the heat generating element 4 to the side of the liquid supply port is substantially infinite. The inertance approaches to infinity as the distance between the heat generating element 4 and the movable member 8 is increased. Furthermore, at this time, h1 is a maximum displacement of he free end of the movable member 8 toward the liquid supply port 5.

Figure 43A:
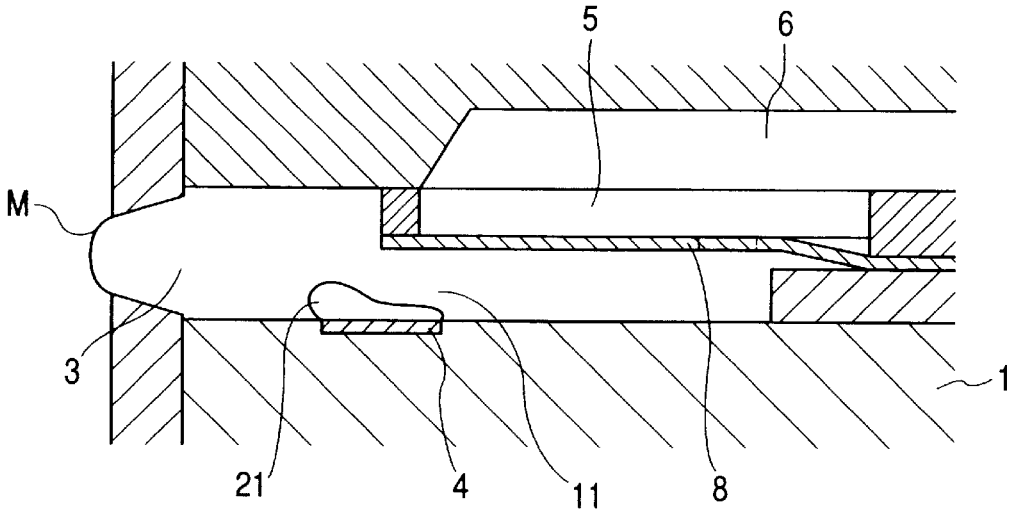
FIGS. 43A and 43B are illustrations of the discharge operation subsequent to that of FIGS. 42A and 42B, expressed in terms of sectional views taken along the direction of one liquid flow path of a liquid discharge head.

FIG. 43A shows a state of a bubble 21 keeping to grow. In this state, since the interior of the liquid flow path 3 is substantially in a sealed state except the discharge port 7, the flow of a liquid does not reach the side of the liquid supply port 5. Accordingly, the bubble can expand greatly to the side of the discharge port 7, but does not so much to that of the liquid supply port 5. And, at the side of the discharge port 7 of the bubble generating area 11, the bubble growth continues, but by contraries, the bubble growth stops at that of the liquid supply port 5 of the bubble generating area 11. In brief, this bubble growth stop state becomes a maximum bubbling state at the side of the liquid supply port 5 of the bubble generating area 11. Vr is let to be the bubbling volume of this time.

Incidentally, in this embodiment, since a communication port 8C is formed on the movable member 8, it is feared that the sealing degree when the movable member 8 is in close contact with the peripheral part of the liquid support port 5 lowers, a liquid moves from the liquid flow path 3 to the liquid supply port 5 during the growth of a bubble and the discharge efficiency ends a fall. If the size of the communication port 8C is set so as to keep the flow resistance at the communication port 8C sufficiently greater than that at the discharge port 7, the discharge efficiency is least possible to lowers because the move of a liquid from the liquid flow path 3 to the liquid supply port 5 can be suppressed to a negligible extent. Besides, with the configuration of this embodiment, the discharge port 7 is in a straight communication state from the heat generating element 4, whereas the communication port 8C is not in a straight communication state with the liquid supply port 5 concerning the growth direction of a bubble. Accordingly, the bubbling pressure wave of a bubble generated on the heat generating element 4 propagates stably to the side of the discharge port 7 but hardly propagate through the communication port 8C to the side of the liquid supply port 5. Also from this, it can be said that the flow of a liquid hardly occurs from the liquid flow path 3 to the liquid supply port 5 and the discharge efficiency is least possible to lowers.

Here, referring to FIGS. 123A–123E, the growing process of a bubble in FIGS. 42A, 42B and 43A will be described in details as with the bubble growing process of the first embodiment described above. On heating a heat generating element, as shown in FIG. 123A, an initial boiling takes place on the heat generating element, then changing to a film boiling in which a filmy bubble covers over the heat generating element as shown in FIG. 123B. And, the bubble of a boiling state keeps growing isotropically as shown in FIGS. 123B and 123C (such an isotropically growing state of a bubble is referred to as semi-pillow state). When the interior of the liquid flow path 3 turns substantially into a sealed state except the discharge port 7 as shown in FIG. 42B, however, the move of a liquid toward the upstream side is disabled, so that part of a bubble at the upstream side (side of the liquid supply port) becomes unable to grow so much and the rest portion of downstream side (side of the discharge port) grows greatly. This state is shown in FIG. 43A or FIGS. 123D and 123E.

Here, for the convenience of explanation, the area in which no bubble grows on the heat generating element 4 and the one of the side the discharge port 7 in which a bubble grows when heating a heat generating element 4 are designated with Area B and Area A, respectively. Incidentally, in Area B shown in FIG. 123E, the bubbling volume reaches a maximum and Vr is let to be the bubbling volume of this time.

Figure 43B:
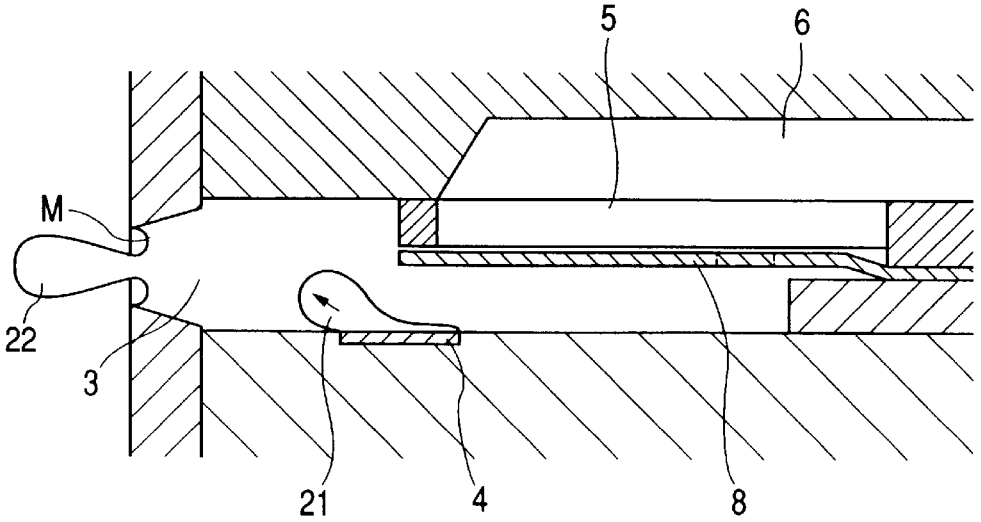

Next, FIG. 43B shows a state at which the growth of a bubble continues in Area A and the shrinkage of a bubble has begun in Area B (period of partial growth and partial shrinkage (See FIG. 124)).

In this state, a bubble grows greatly toward the side of the discharge port in Area A and the volume of a bubble begins to decrease in Area B. The free end of the movable member 8 begins to be displaced downward to the stationary state position under action of the recovering force due to its rigidity and the disappearing force of a bubble in Area B. When the movable member 8 is displaced downward, the liquid supply port 5 opens, thus leading to a substantial communicable state between the common liquid supply chamber 6 and the liquid flow path 3. Incidentally, since a communication port 8C is formed in the movable member 8 as mentioned above, the rigidity of the movable member 8 lowers only at the fulcrum part. Thus, even if formed of a strongly rigid material, the movable member 8 allows its great downward displacement. As a result, the refill speed can be improved.

Figure 44A:
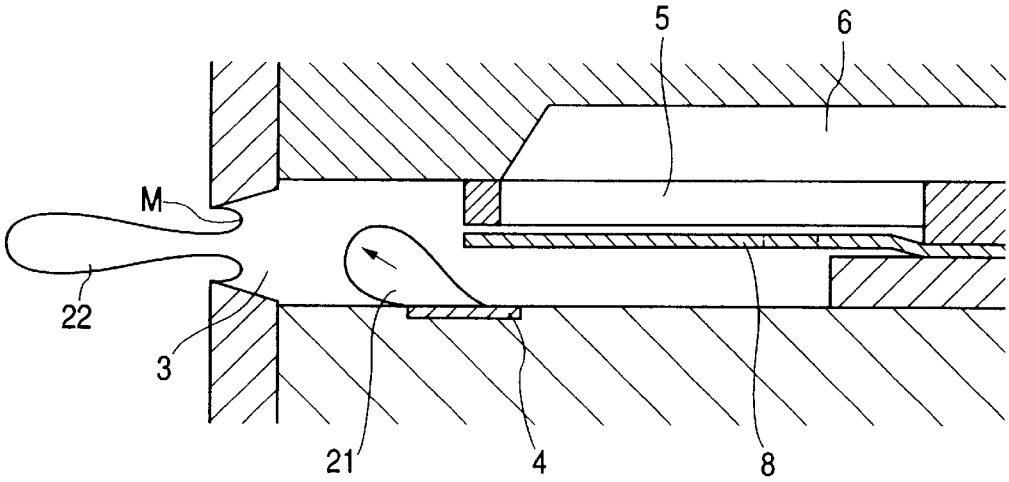
FIGS. 44A and 44B are illustrations of the discharge operation subsequent to that of FIGS. 43A and 43B, expressed in terms of sectional views taken along the direction of one liquid flow path of a liquid discharge head.

FIG. 44A shows a state that the bubble 21 has grown almost to a maximum. In this state, a bubble in Area A has grown to a maximum and almost all bubbles in Area B disappear as accompaniments of this. Vf is let to be a maximum bubble volume in Area A at this time. Besides, the discharge droplet 22 under discharge from the discharge port 7 is still tied to a meniscus M with a long tail drawn.

Figure 44B:
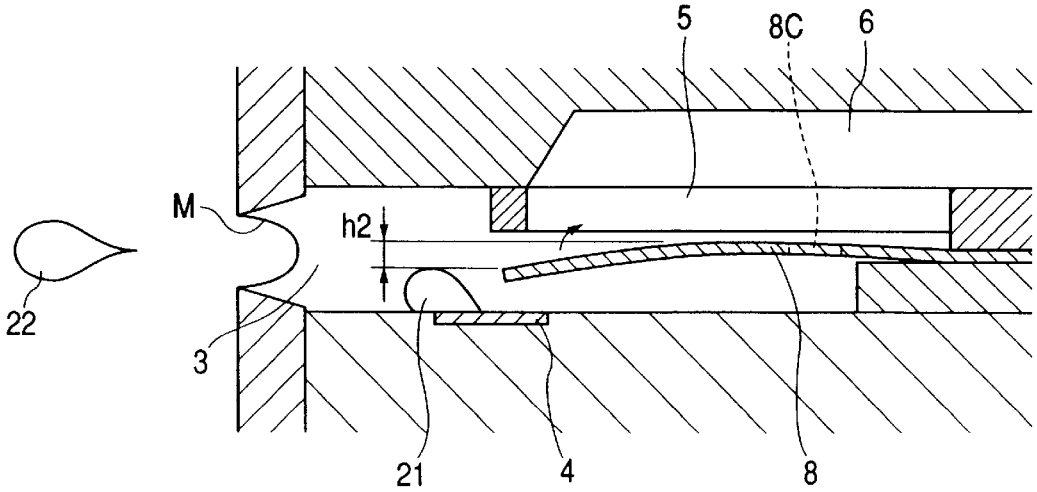
Figure 45A:
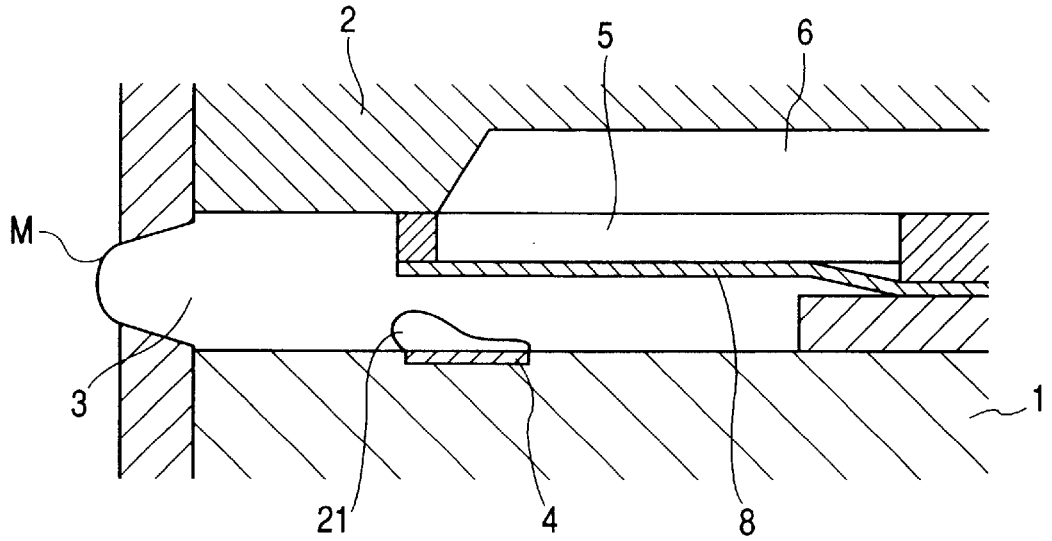
FIGS. 45A and 45B are sectional views taken along the direction of one liquid flow path of a liquid discharge head according to the third embodiment of the present invention, where (a) relates to a configuration of covering the whole heat generating element with the free end of a movable member and (b) relates to a configuration of separating a heat generating element from a movable member.
Figure 45B:
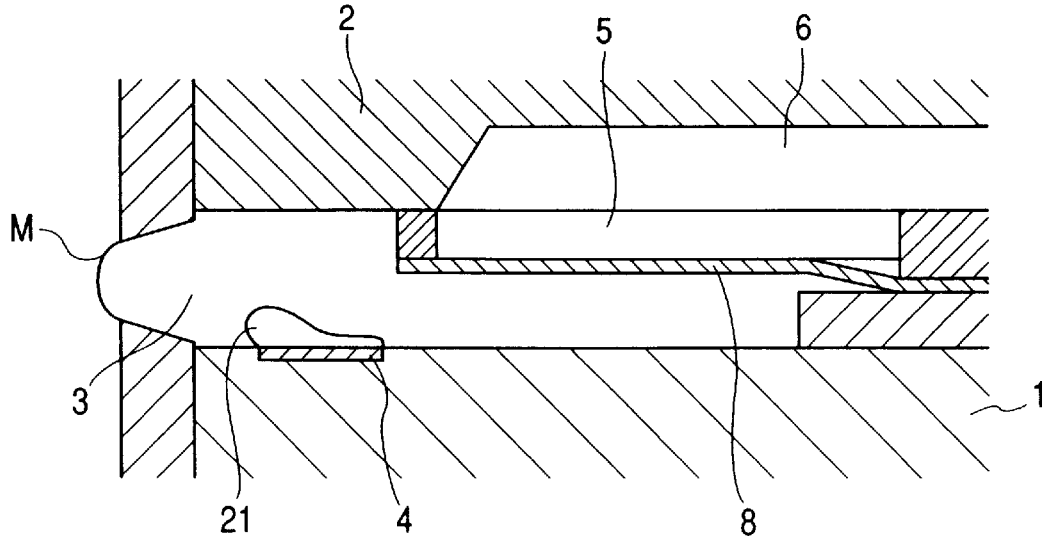

FIG. 44B corresponds to a stage of bubble disappearing step alone at which the growth of the bubble 21 stops and shows a state that a discharge droplet 22 and the meniscus M are separated. Right after the bubble growth changes into the bubble disappearance in Area A, the shrinking energy of the bubble 21 acts as a force of moving the liquid near the discharge port 7 toward the upstream direction as a result of total balance. Thus, the meniscus M is pulled into the liquid flow path 3 from the discharge port 7 at this point, thus cut off the liquid pole combined with the discharge droplet 22 swiftly by a strong force. On the other hand, along with the shrinkage of a bubble, a liquid flows rapidly from the common liquid supply chamber 6 via the liquid supply port 5 into the liquid flow path 3 in a large current. At this time, h2 is a maximum displacement of the free end of the movable member 8 toward the bubble generation area 11. Thereby, the flow rapidly pulling the meniscus M into the liquid flow path 3 lowers abruptly, so that the meniscus M begins to return to the position prior to the bubbling at a relatively low speed and therefore the convergency of vibration of the meniscus M is very good in comparison with the liquid discharge scheme equipped with no movable member according to the present invention.

In the movable member 8, the rigidity of the fulcrum 8A is reduced because the communication port 8C is provided in the vicinity of the fulcrum 8A. Therefore, even if the movable member 8 is formed of a material of high rigidity, the movable member 8 can allow its free end 8B to be considerably displaced. This ensures that the flow path for the liquid to flow into the liquid flow path 3 is larger, and the amount of the liquid supplied in one refill operation is increased, so that the refill operation can be faster.

Finally, when the bubble 21 completely disappears, the movable member 8 also recovers to the stationary state position shown in FIG. 42A. Toward this state, the movable member 8 is displaced upward under action of its elastic force (along Arrowhead A of solid line in FIG. 44B). Besides, in this state, the meniscus M has already recovered near the discharge port 7.

Next, a correlation between the time volume change of a bubble in Areas A as well as B shown in FIGS. 42 to 44 and the behavior of a movable member 8 (See FIG. 124) and a correlation between the bubble growth in a liquid discharge head equipped with a movable member and a heat generating element different in relative positions from those of this embodiment and the behavior of a movable member (See FIGS. 45A and 45B, FIG. 125 and FIG. 126), either of them has a correlation similar to that of the first embodiment.

Besides, also in this embodiment, letting Vf and Vr be the volume of a growing bubble at the maximum at the side of the discharge port 7 (bubble of Area A) in the bubble generating area 11 and that of a growing bubble at the maximum at the side of the liquid supply port 5 (bubble of Area B) in the bubble generating area 11, respectively as with the first embodiment, the relation of Vf>Vr holds true permanently for a head according to the present invention as evident from FIGS. 124 to 126. Furthermore, letting Tf and Tr be the life time (time from the appearance of a bubble to the disappearance of the bubble) of a growing bubble at the side of the discharge port 7 (bubble of Area A) in the bubble generating area 11 and that of a growing bubble at the side of the liquid supply port 5 (bubble of Area B) in the bubble generating area 11, respectively, the relation of Tf>Tr holds true permanently for a head according to the present invention. And, from a relation as mentioned above, it follows that the disappearing point of a bubble is situated to the side of the liquid supply port 7 rather than near the center of the bubble generating area 11.

Furthermore, with the present configuration of a head, as understood also from FIGS. 42B and 44B, there is a relation that the maximum displacement h2 of the free end of a movable member 8 toward the side of the bubble generator means 4 along with the disappearance of a bubble is greater than the maximum displacement h1 of the free end of the movable member 8 toward the side of the liquid supply port 5 at the initial generation of the bubble (h1<h2). For example, h1 is 2 $\mu$m and h2 is 10 $\mu$m. Validity of this relation can suppress the growth of a bubble toward behind a heat generating element (opposite the discharge port) at the initial generation of the bubble and can enhance that of a bubble growth toward the front of the heat generating element (toward the discharge port). Thereby, the efficiency of converting the bubbling energy generated on the heat generating element into the kinetic energy of a droplet of a liquid flying from the discharge port can be improved.

Like these, the head configuration and the liquid discharge operation in this embodiment was described, but according to such an aspect, the growth component to the downstream side and the growth component to the upstream side of a bubble are unequal, the upstream component nearly vanishes and the move of a liquid toward the upstream side is suppressed. Since the move of the liquid toward the upstream side is suppressed, most of the bubble growth is directed toward the upstream discharge port without loss of the growth component to the upstream side and the discharge power is improved in leaps and bounds. Furthermore, the retreat of a meniscus after the discharge decreases and its protrusion from the orifice surface during the refill decreases correspondingly. Accordingly, the meniscus vibration is suppressed and a stable discharge becomes performable at all driving frequencies from a low frequency to a high frequency. Especially, in this embodiment, a communication port for communicating the liquid supply port with the liquid flow path is formed near the support end opposed to the free end of the movable member, so that the rigidity of the fulcrum in the movable member decreases. Therefore, even if the movable member 8 is formed of a material of high rigidity, the movable member 8 can allow its free end 8B to be considerably displaced. In consequence, the flow path of a liquid to flow into the liquid flow path is secured greater and a greater amount of liquid is supplied at one time of refill operation, so that the refill is accomplished at high speed.

[First Variation]

Figure 46:
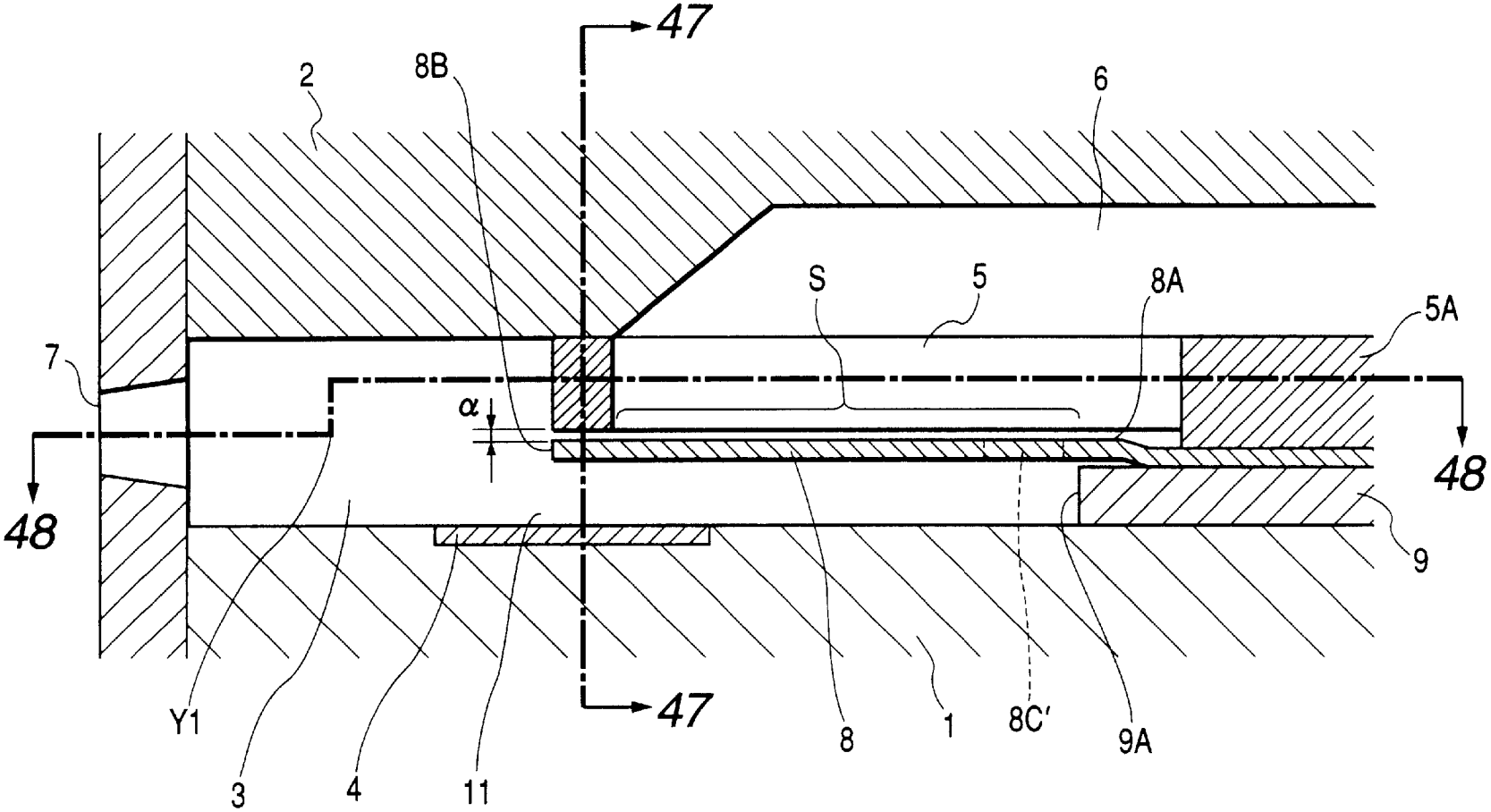
FIG. 46 is a sectional view taken along the direction of one liquid flow path of a liquid discharge head according to the first variation of the third embodiment of the present invention.
Figure 47:
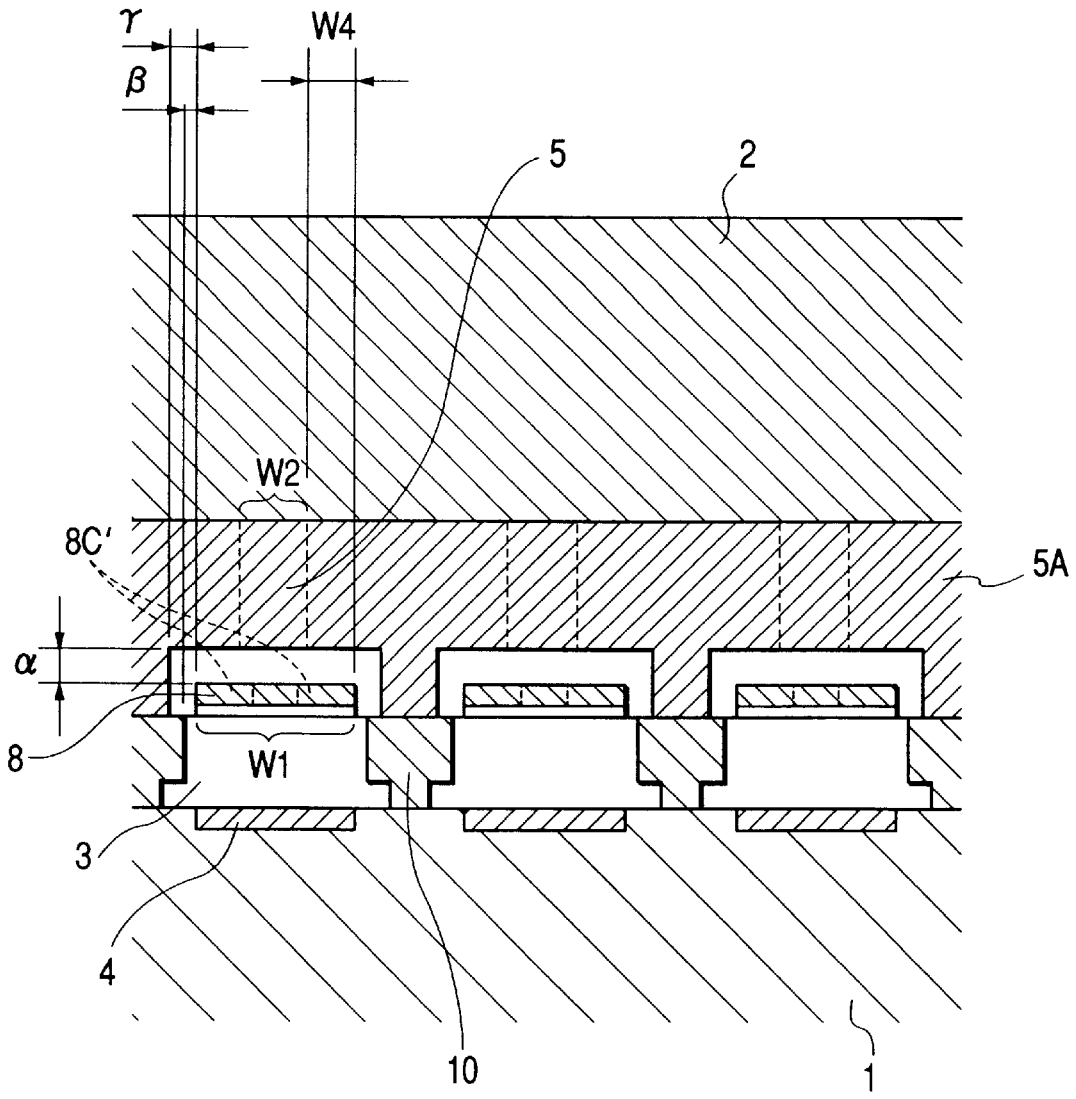
FIG. 47 is a sectional view taken on line 47—47 of FIG. 46.
Figure 48:
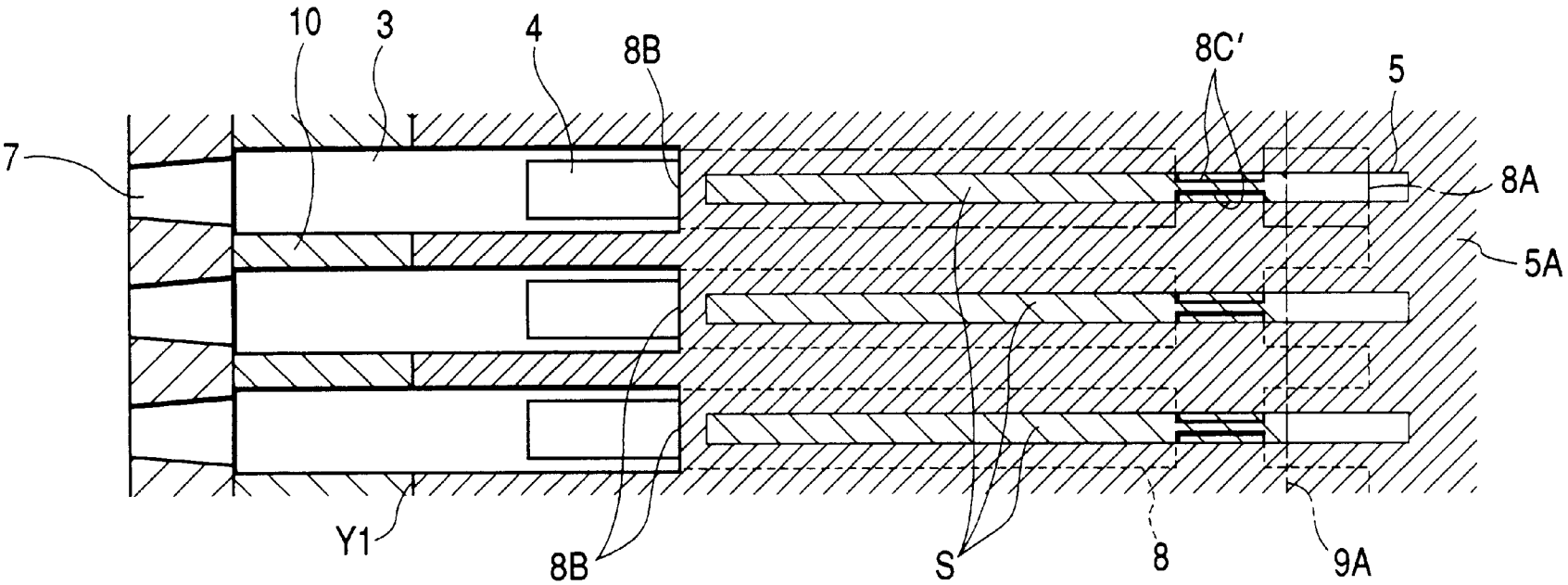
FIG. 48 is a sectional view taken on line of 48—48 shifted to the side of a top board 2 at the point Y1 from the discharge port center of FIG. 46.
Figure 49:
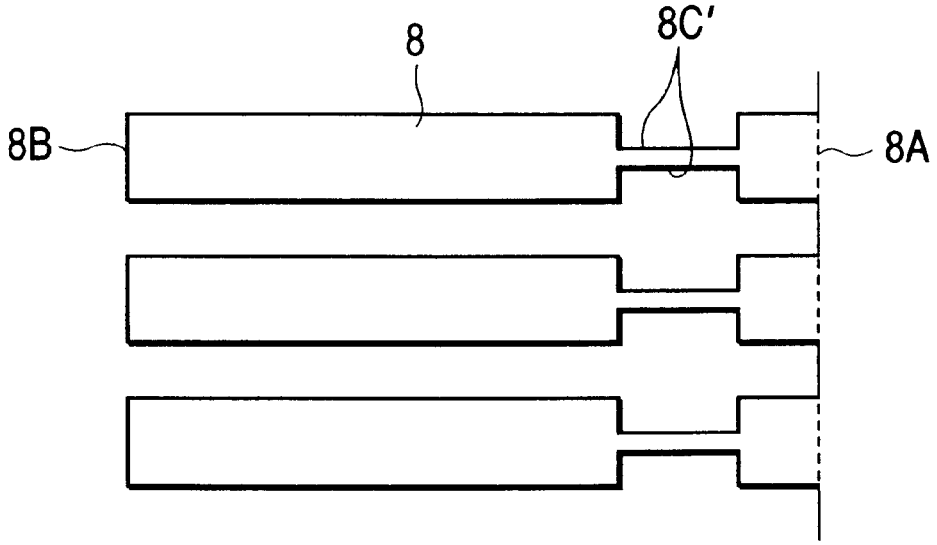
FIG. 49 is a plan view of a movable member in the liquid discharge head shown in FIGS. 46 to 48.

FIG. 46 is a sectional view taken along one liquid flow path of a liquid discharge head according to the first variation of the first embodiment, FIG. 47 is a sectional view taken along line 47—47 and FIG. 48 is a sectional view taken along line 48—48 shifted to the side of a top board 2 at the point Y1 from the discharge port center. Besides, FIG. 49 is a plan view of a movable member in the liquid discharge head shown in FIG. 46 and suchlike others.

A liquid discharge head according to this variation differs from the liquid discharge head shown in FIG. 36 in that the communication port 8C' is formed at both lateral surface parts, but not at the center part of a movable member 8. The flow resistance in the communication port 8C' is also on the same order as that in the one 8C of FIG. 36. Incidentally, other constituents of a liquid discharge head according to this variation are the same as those shown in FIG. 36.

Also with a liquid discharge head according to this variation, the refill rate can be improved by decreasing the rigidity of the fulcrum part of the movable member 8 as with the liquid discharge head shown in FIG. 36.

Besides, during the forced suction recovering operation through the discharge port 7, the flow of a liquid occurs through the discharge port 7, then the remaining bubble staying on the wall surface or the like near the fulcrum of the movable member 8 on which hardly any flow of a liquid occurs during a normal discharge begin to move and are removed through the discharge port 7 together with the sucked liquid. As a result, a normal discharge during the image recording is also stable and image recording can be well carried out.

[Second Variation]

Figure 50:
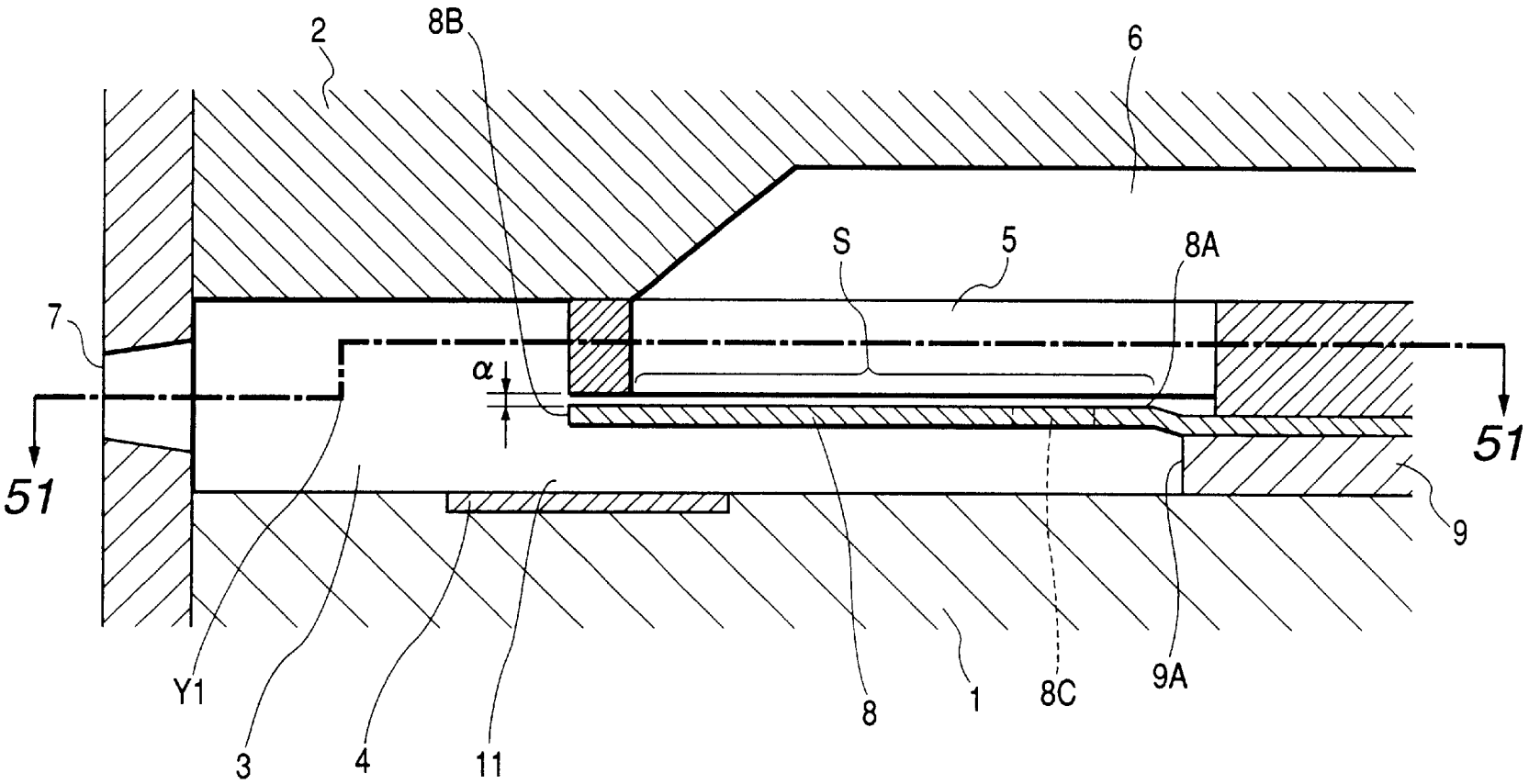
FIG. 50 is a sectional view taken along the direction of one liquid flow path of a liquid discharge head according to the second variation of the third embodiment of the present invention.
Figure 51:
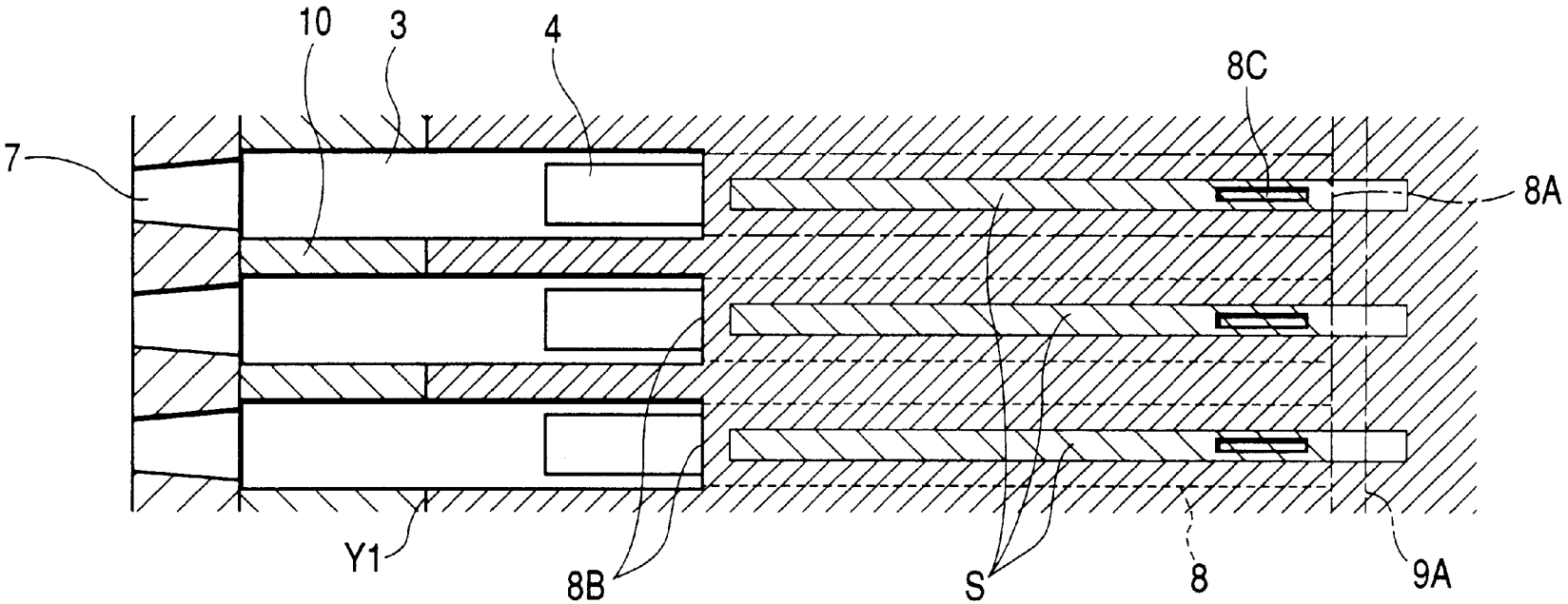
FIG. 51 is a sectional view taken on line 51—51 of FIG. 50.

In a head structure according to the second embodiment, since a position of the movable member 8 which remained unjoined to the fixed member 9 (i.e., bent and rising) was not the same as the end part 9A of the fixed member 9 as shown in FIGS. 36 and 38, the opening area S constituted an area enclosed with three sides of the liquid supply port 5 and the end part 9A of the fixed member 9, but the bent rising position of the movable member 8 from the fixed member 9 may be set to the end part 9A of the fixed member 9 like the structure shown in FIGS. 50 and 51 as one of the second variation of this embodiment. In the case of this aspect, as shown in FIGS. 50 and 51, the opening area S constituted an area enclosed with three sides of the liquid supply port 5 and the fulcrum part 8A of the movable member 8.

Figure 52:
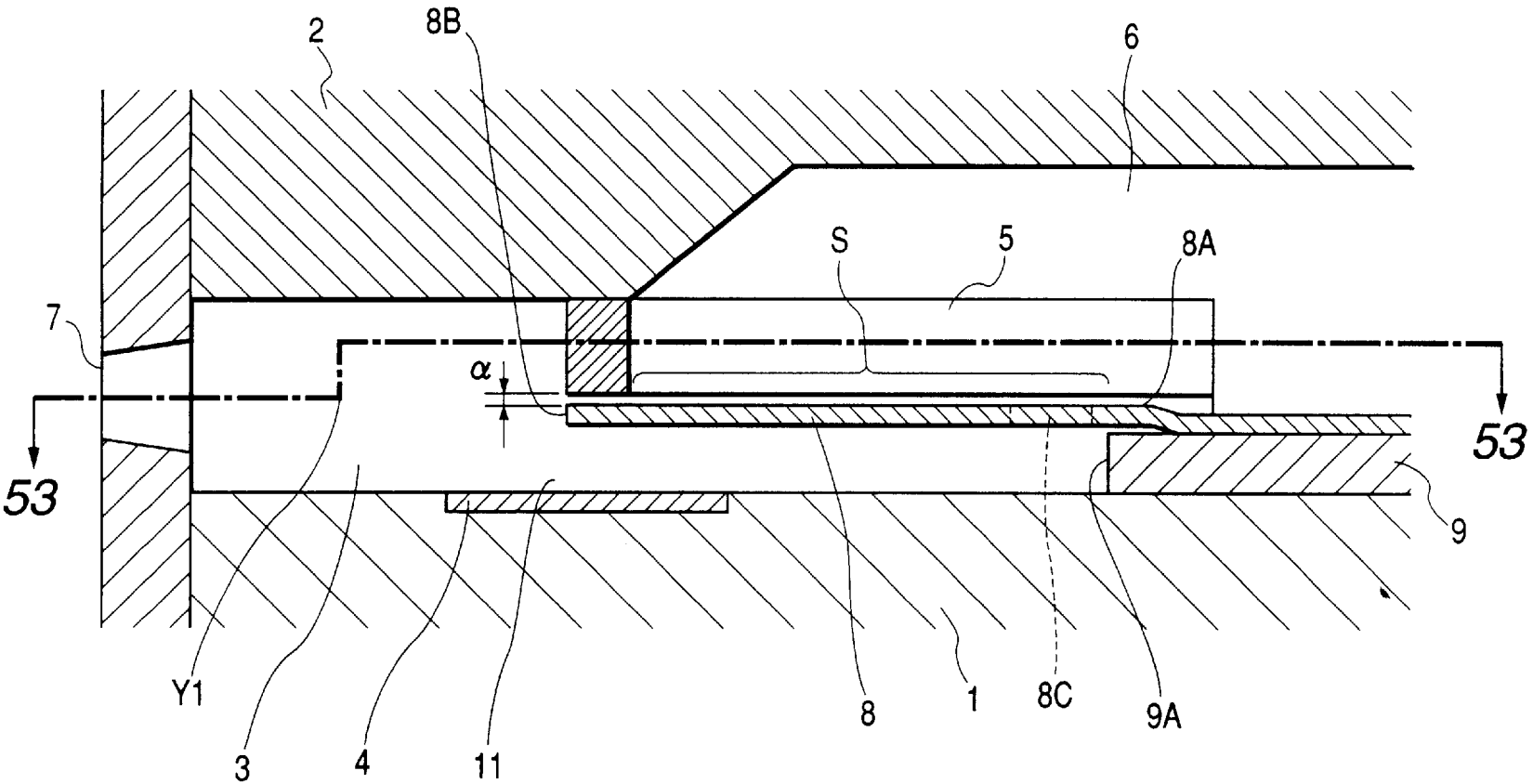
FIG. 52 is a sectional view taken along the direction of one liquid flow path of a liquid discharge head according to the second variation of the third embodiment of the present invention.
Figure 53:
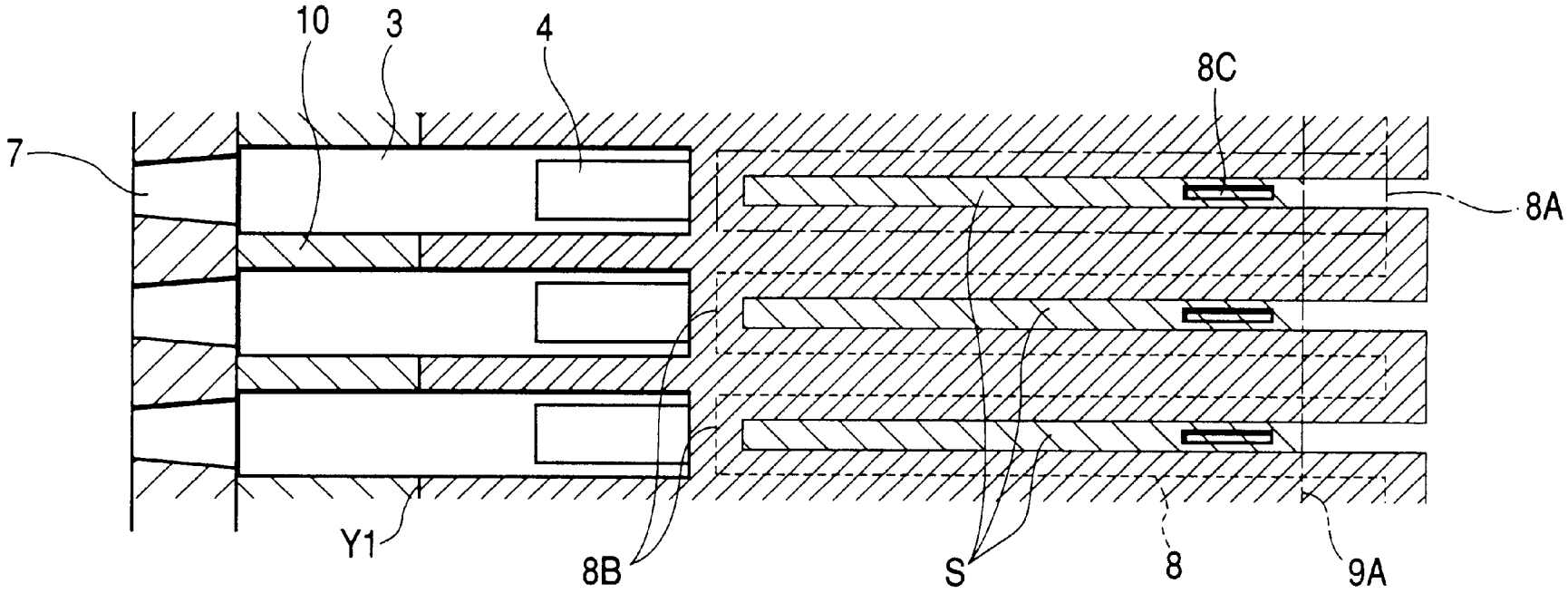
FIG. 53 is a sectional view taken on line 53—53 of FIG. 52.
Figure 54D:
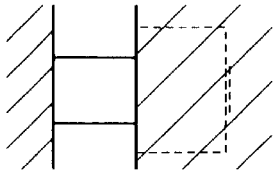
FIGS. 54A, 54B, 54C and 54D are illustrations of a liquid discharge head according to the third variation of the third embodiment of the present invention.
Figure 54C:
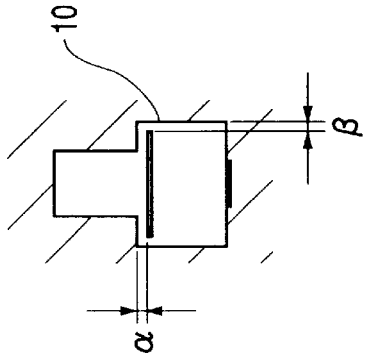
Figure 54A:
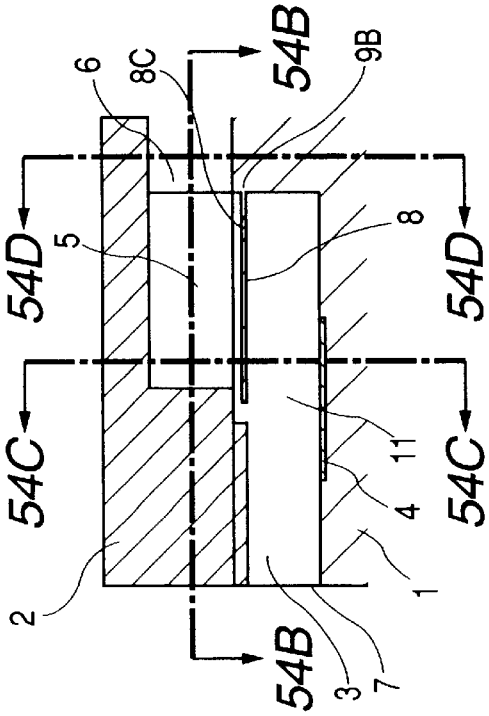
Figure 54B:
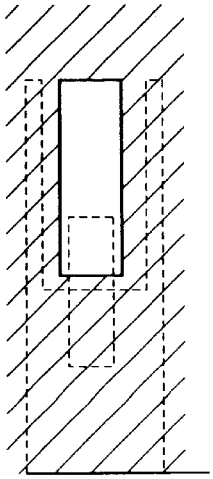

Besides, in a head structure according to this embodiment, the liquid support port 5 was set to an opening enclosed with four wall sides as shown in FIG. 38, but the wall surface at the side of the liquid supply chamber 6 opposed to the side of the discharge port 7 may be opened among the supply part forming member 5A (See FIG. 36) like the structure shown in FIGS. 52 and 53 as one of the second variation of this embodiment. In the case of this structure, as with the second embodiment, the opening area S constitutes an area enclosed with three sides of the liquid supply port 5 and the end part 9A of the fixed member 9 as shown in FIGS. 52 and 53.

[Third Variation]

Next, referring to FIG. 54, a liquid discharge head according to the third variation of this embodiment will be described. In the liquid discharge head of the aspect shown in FIG. 54, an element substrate 1 and a top board 2 are joined to each other, between both of which a liquid flow path 3 with one end communicating with a discharge port 7 and the other end closed is formed.

At the liquid flow path 3, a liquid supply port 5 is disposed and a common liquid supply chamber 6 communicating with the liquid supply port 5 is provided.

Between the liquid supply port 5 and the liquid flow path 3, a movable member 8 is provided an infinitesimal gap $\alpha$ (e.g. not greater than 10 $\mu$m) and in nearly parallel with an opening area of the liquid supply port 5. The size of the area enclosed with at least the free end part and both lateral parts adjacent thereto of the movable member 8 is larger than that of the opening area S of the liquid supply port 5 and an infinitesimal gap $\beta$ is present between the lateral parts of the movable member 8 and the liquid flow path side walls 10. Thereby, whereas the movable member 8 is movable without frictional resistance in the liquid flow path 3, its displacement to the side of the opening area S is regulated by the peripheral part of the opening area S and the liquid supply port 5 is substantially blocked, thus enabling the reverse current from the liquid flow path 3 to the common liquid support chamber 6 to be prevented. Besides, in this variation, the movable member 8 is situated facing the element substrate 1. And, one end of the movable member 8 is a free end to be displaced to the side of the heat generating element 4 in the element substrate 1 and the other end side is supported by the support part 9B.

Fourth Embodiment

Figure 55:
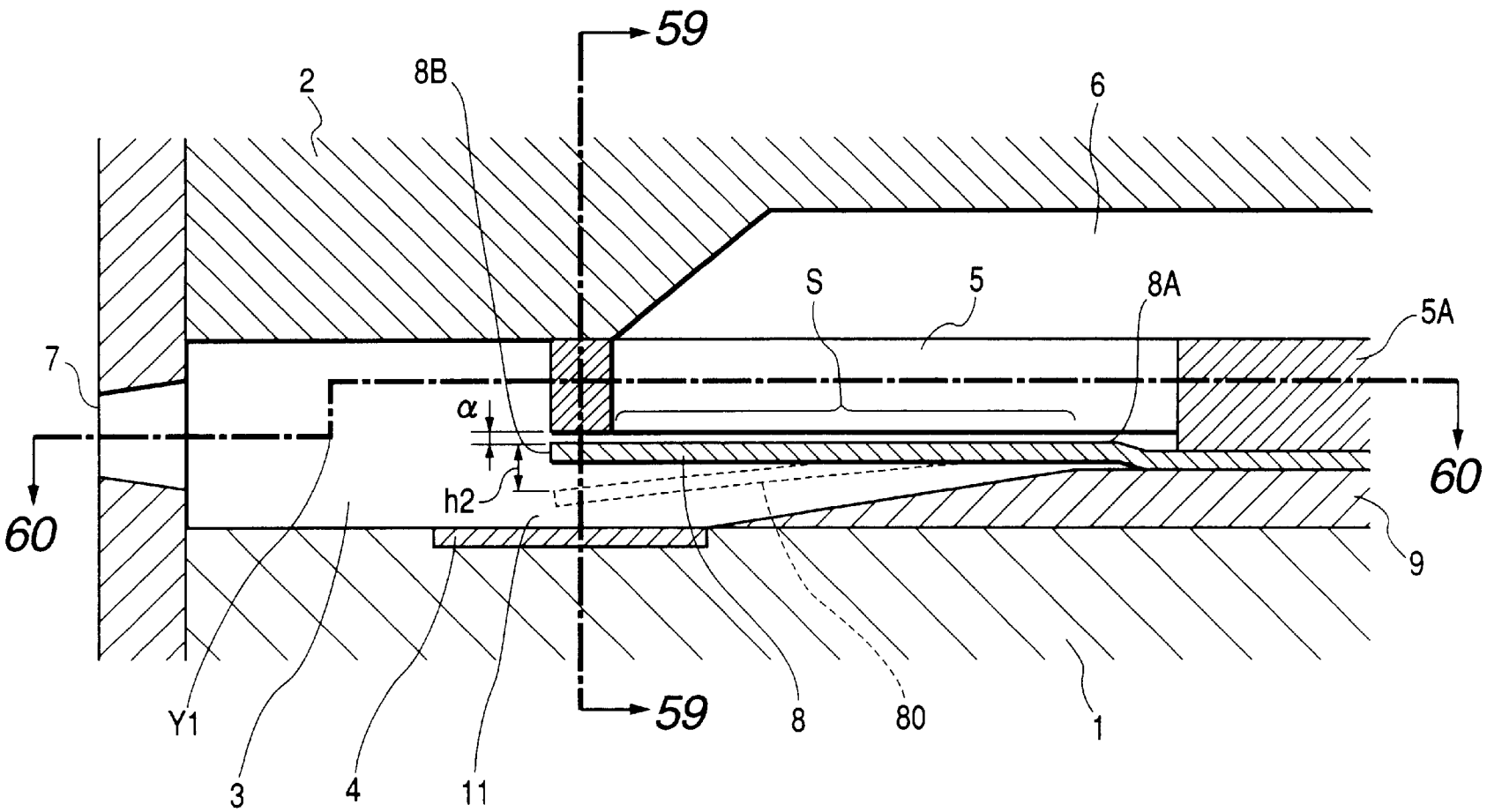
FIG. 55 is a sectional view taken along the direction of one liquid flow path of a liquid discharge head according to the fourth embodiment of the present invention.

Referring to FIG. 55, a liquid discharge head according to the fourth embodiment of the present invention will be described.

By making such an arrangement that hardly any remaining bubble remains in a liquid flow path, it is one object of the present invention to provide a liquid discharge head capable of discharging a liquid stably to obtain a good image record.

Here, remaining bubble means part of the bubble generated in the discharge operation concerned that remain in the liquid flow path without disappearing. Remaining bubble are apt to appear when a high frequency vibration is caused to raise the temperature. Namely, a heat generating element 4 rises in temperature to cause a nucleate boiling with a foreign matter such as scorch on the heat generating element employed as the nucleus, so that a minute bubble is generated. This bubble can be vanished by the refill, stays in a gap where no large flow of a liquid is present and changes into a remaining bubble.

In this embodiment, as shown in FIG. 55, a liquid discharge head according to this embodiment differs from ones according to other embodiments in that the bottom surface of the liquid flow path 3 from near the end part of the heat generating element 4 at the side of the liquid supply port 5 to near the fulcrum 8A of the movable member 8 form a slope. When displaced downward to a maximum from a stationary state during the liquid sucking operation, the bottom of this fluid flow path 3 becomes a slope in a degree of not being in contact with the movable member 8. By forming such a slope structure, the gap except the displacement gap of the movable member is scarce in volume among the liquid flow path gap enclosed from the end part opposed to the discharge port 7 of the heat generating element 4 with the movable member 8 and a remaining bubble becomes hardly likely to stay. Besides, even if remaining bubble stay in this gap, their amount is scarce and not so much as influential to the discharge operation. In FIG. 55, 80 shows a position of the movable member 8 when refilling.

Besides, in this embodiment, since the gap in which the remaining bubble stays is also close to the gap in which the movable member 8 is displaced or the heat generating element 4, the flow of a liquid is likely to occur on the bottom surface or along the wall surface. As a result, the remaining bubble having stayed there moves also by a normal discharge operation and does not stay for a long period.

Figure 57:
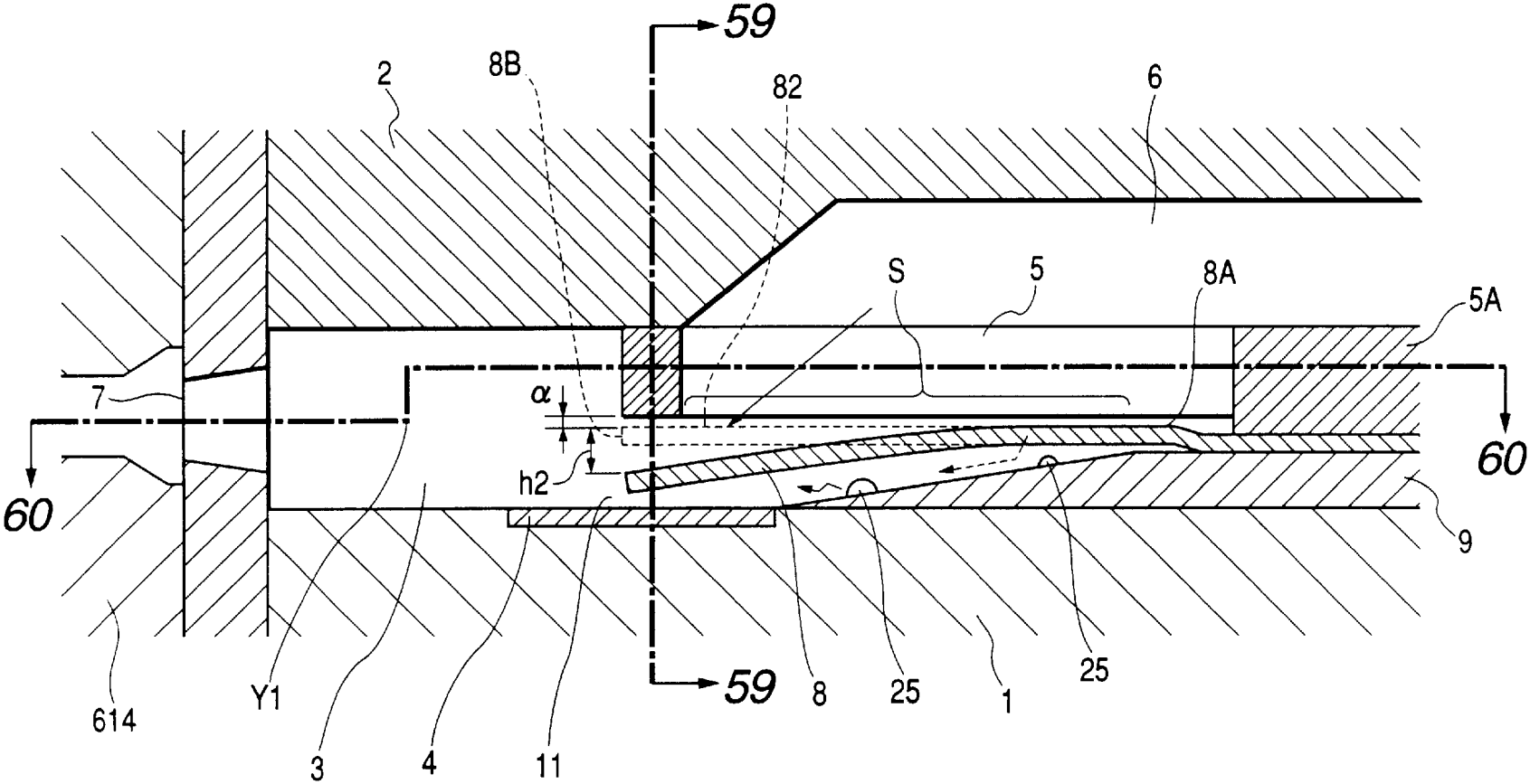
FIG. 57 is a sectional view taken along the direction of one liquid flow path of a liquid discharge head according to the present invention for the explanation of a forcible suction recovering operation.

Furthermore, FIG. 57 shows a forced suction recovery through the discharge port 7, performed when any abnormal discharge occurs. In this case, the liquid in the liquid flow path is forcibly exhausted from the discharge port 7. This time differs from the refill of a liquid in a normal discharge operation and the flow of a liquid occurs also from the lateral surface near the fulcrum 8A of the movable member 8. In a liquid discharge head according to this embodiment, the flow of a liquid near the fulcrum 8A of the movable member 8 during the suction recovery coincides with the slope structure of the bottom surface, the flow resistance of a liquid is small and a strong current occurs also near the bottom surface and the wall surface. As a result, remaining bubble 23 becomes likely to be removed.

As described like these, in a liquid discharge head according to this embodiment, since hardly any remaining bubble stays in the area behind the bubble 23 generating area 11 viewed from the discharge port 7 by setting the bottom of the liquid flow path 3 from near the end part of the movable member 8 at the side of the heat generating element 4 toward the fulcrum 8A of the movable member 8 to a slope, a stable discharge of a liquid can be accomplished.

Besides, in a forcible suction recovery operation through the discharge port 7, the above-mentioned slope of the bottom surface of the liquid flow path 3 allows the flow of a liquid from near the fulcrum 8A of the movable member 8 toward the discharge port 7 to extend over the bottom surface or the lateral surface and enables the remaining bubble 23 to be effectively removed in a short time, so that the suction recovery time can be shortened. In FIG. 57, 82 shows a position of the movable member 8 when the movable member 8 is in a stationary position.

[Variation]

Figure 56:
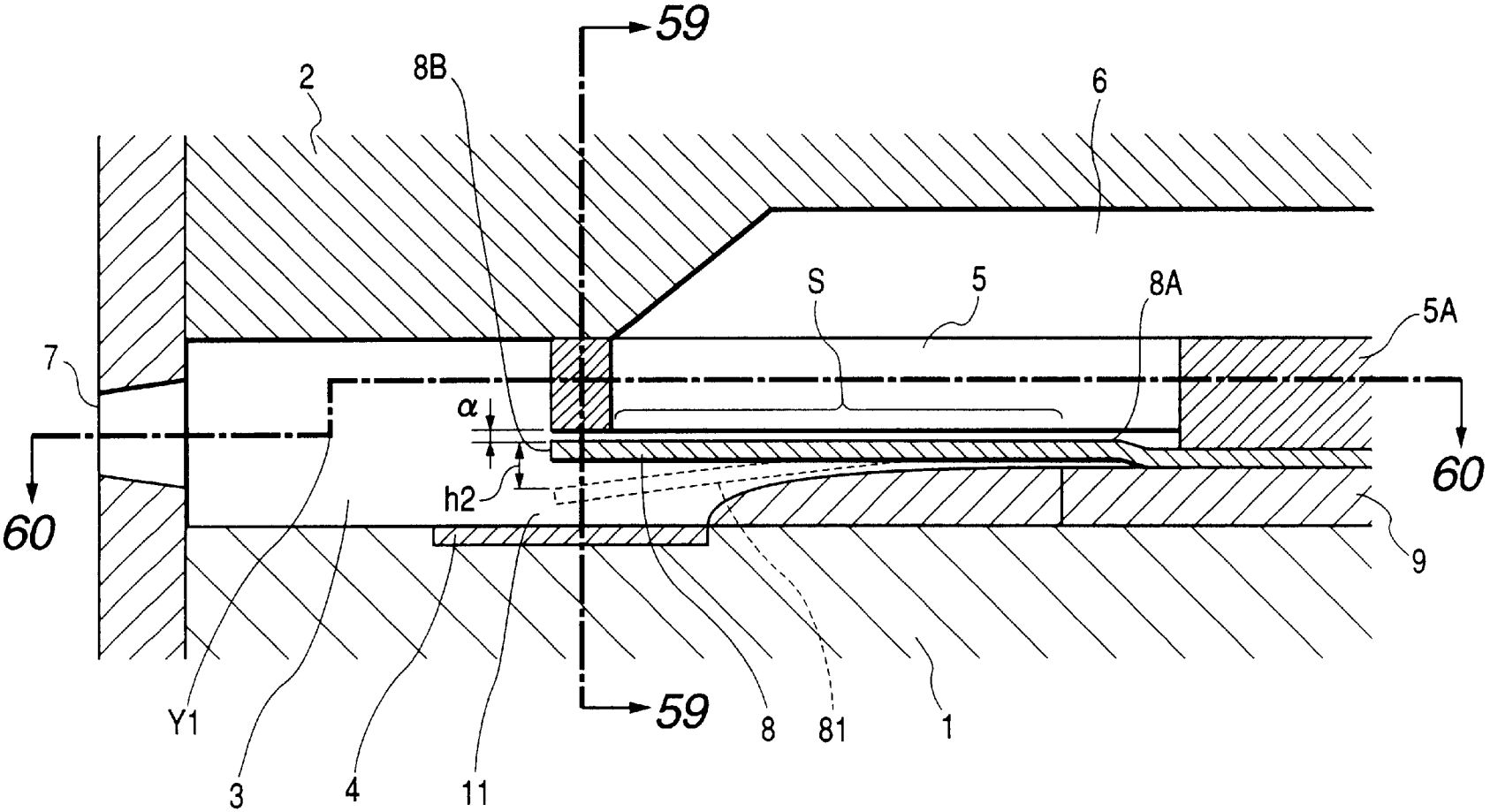
FIG. 56 is a sectional view taken along the direction of one liquid flow path of a liquid discharge head according to a fourth embodiment of the present invention.

Next, referring to FIG. 56, a liquid discharge head according to variation of this embodiment will be described. The structure of a liquid discharge head according to this variation differs from that of the liquid discharge head shown in FIG. 55 in that the bottom of the liquid flow path from near the end part of the movable member 8 at the side of the heat generating element 4 toward the fulcrum 8A of the movable member 8 forms a convex curved surface.

Incidentally, as with the liquid discharge head shown in FIG. 55, the bottom surface of this liquid flow path 3 is in such a form as not being in contact with the movable member 8 when the movable member 8 is displaced downward to a maximum from a stationary state during the liquid sucking operation. In FIG. 56, 81 shows a position of the movable member 8 when refilling.

In a liquid discharge head according to this variation, the area behind the bubble generating area 11 viewed from the discharge port 7 in the liquid flow path 3 can be made narrower than in that of FIG. 55 and therefore the possibility of remaining bubble staying there decreases and a stable discharge of a liquid can be carried out.

Fifth Embodiment

Figure 58:
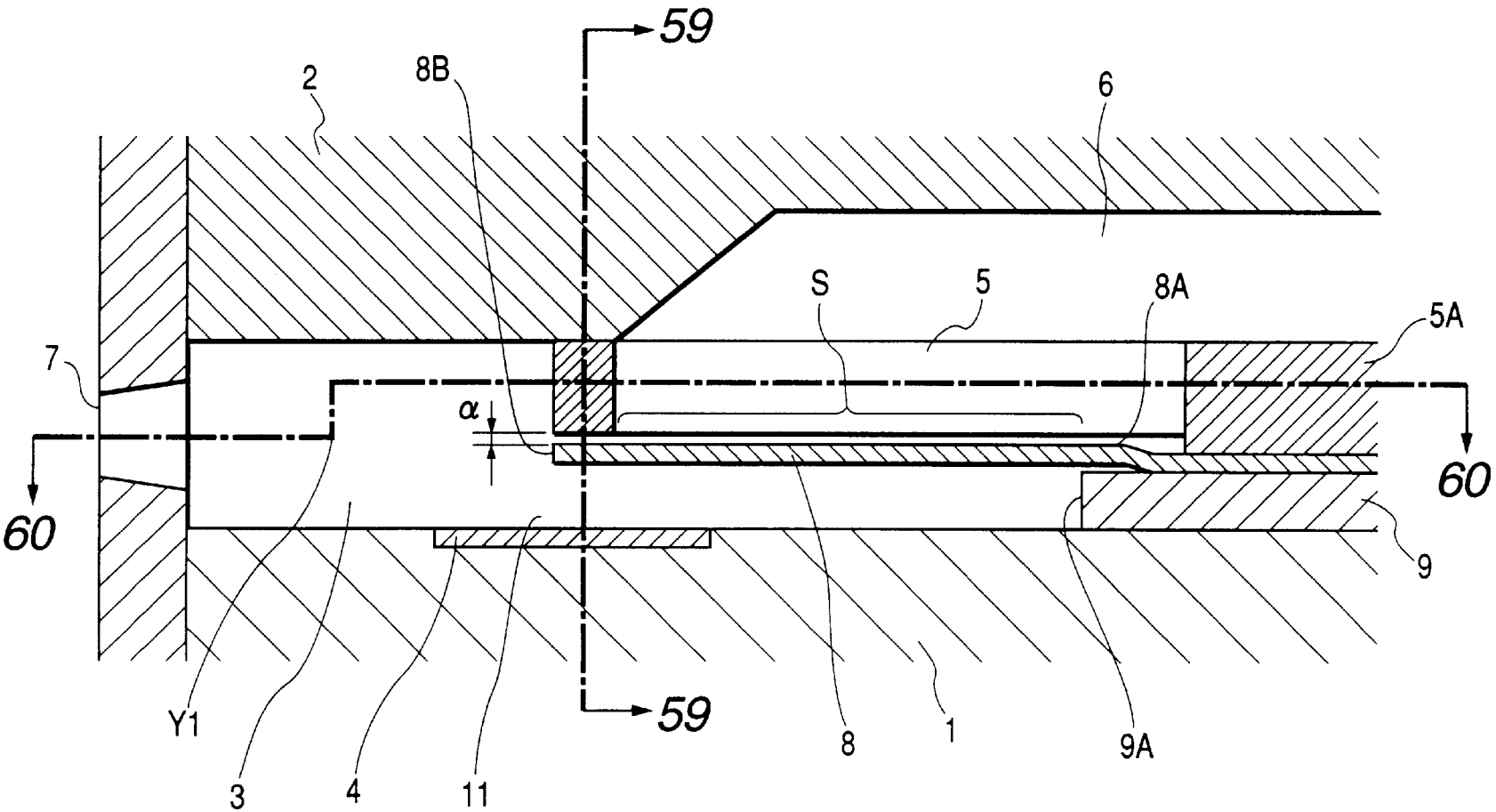
FIG. 58 is a sectional view taken along the direction of one liquid flow path of a liquid discharge head according to the fifth embodiment of the present invention.
Figure 59:
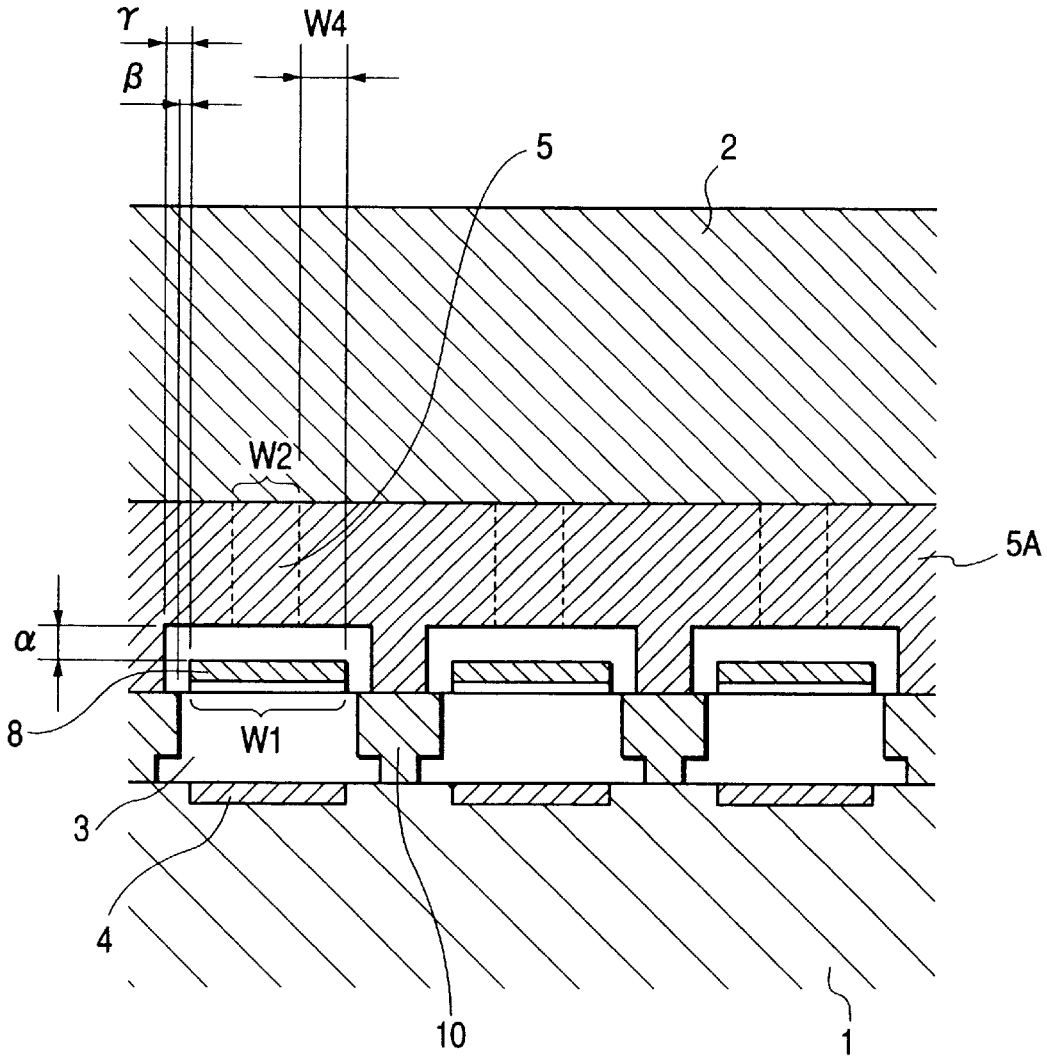
FIG. 59 is a sectional view taken on line 59—59 of FIG. 58.
Figure 60:
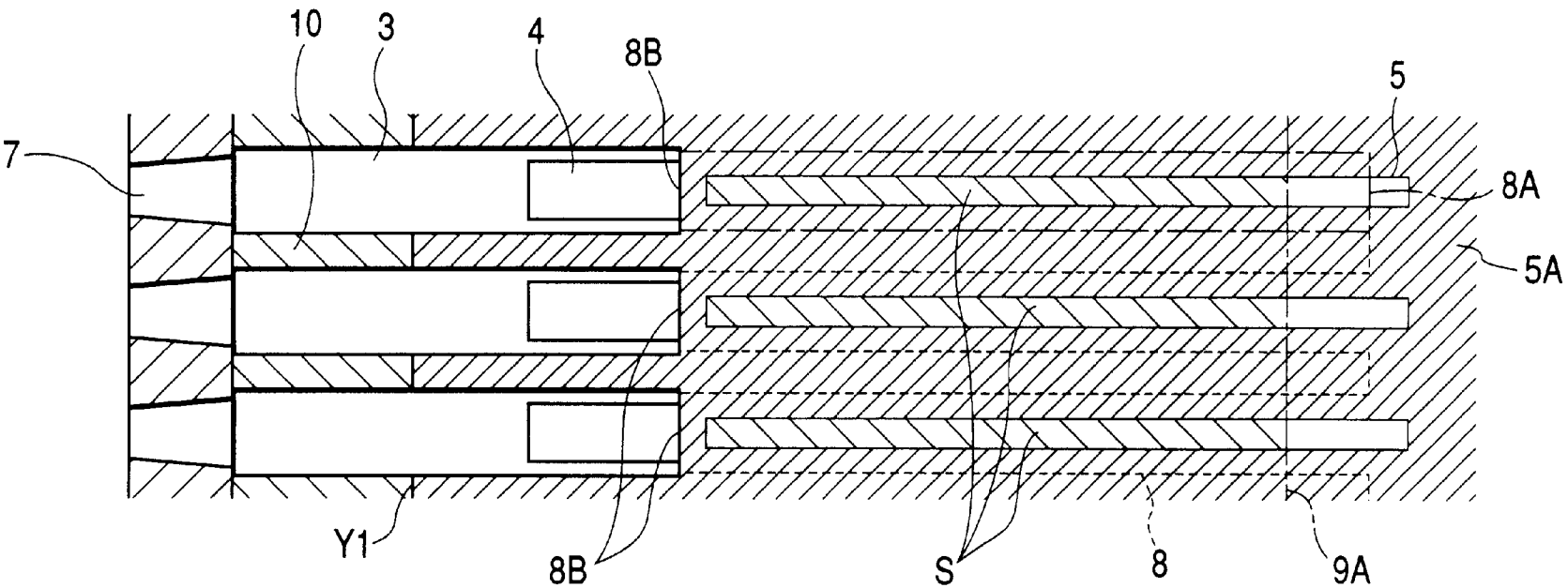
FIG. 60 is a sectional view taken on line 60—60 of FIG. 58.

FIG. 58 is a view in section along one of the liquid flow paths showing the liquid discharge head in accordance with the fifth embodiment of the present invention, FIG. 59 a cross-sectional view of the liquid discharge head of FIG. 58 taken along the line 59—59, and FIG. 60 a cross-sectional view of the liquid discharge head of FIG. 58 taken along the line 60—60, running from the center of the discharge port to 60, through a point Y1, where it shifts on the top board 2 side relative to the line Y1.

In the liquid discharge head in the form of multiple liquid paths-common liquid chamber shown FIGS. 58 to 60, an element substrate 1 and a top board 2 are fixed on each other via liquid path sidewalls 10 in the stacked state, and between the two boards 1, 2 formed are liquid flow paths 3 of which one end is in communication with the discharge port 7 and other end is closed. Each liquid discharge head is provided with multiple liquid flow paths 3. On the element substrate 1, heat generating members 4, such as electrothermal converting element, as bubble forming means for bubbling the liquid refilled in the liquid flow paths 3 are disposed for respective liquid flow paths 3. And near the contact surface of each heat generating member 4 with the discharging liquid, there exists a bubble generating area 11 where the discharging liquid is bubbled by rapidly heating the heat generating member 4.

A liquid supply port 5 having been formed on a supply portion forming member 5A is disposed in each of the multiple liquid flow paths 3 and a common liquid supply chamber 6 is provided in the same which has a large capacity and communicates with each liquid supply port 5 simultaneously. In other words, the liquid supply ports 5 are configured in such a manner as to branch from a single common liquid supply chamber 6 into multiple liquid flow paths 3, and they receive liquid from the common liquid supply chamber 6 in the amount which offsets the amount of liquid having been discharged from the discharge ports 7, which are in communication with respective liquid flow paths 3.

Between each liquid supply port 5 and liquid flow path 3, a movable member 8 is provided almost parallel to an opening area S of the liquid supply port 5 while allowing an infinitesimal clearance $\alpha$ (for example, 10 $\mu$m or less) between them. The area surrounded by at least the free end portion of the movable member 8 and both side portions, which is the continuation of the free end portion, is larger than the opening area S of the liquid supply port 5 (refer to FIG. 60), and an infinitesimal clearance $\beta$ is allowed between each of the side portions of the movable member 8 and each of the flow path sidewalls 10 sandwiching the movable member (refer to FIG. 59). The above-described supply portion forming member 5A is disposed $\gamma$ apart from the movable member 8 as shown in FIG. 59. The clearances $\beta$, $\gamma$ vary depending on the pitch of the flow path; however, if the clearance $\gamma$ is large, the movable member 8 is likely to block up the opening area S, on the other hand, if the clearance $\beta$ is large, with the disappearance of bubble, the movable member 8 is likely to move downward from the position a apart from the opening area S, where it is in a steady state, toward the element substrate 1 side. In this embodiment, the clearances a, $\beta$ and $\gamma$ are set at values of 3 $\mu$m, 3 $\mu$m and 4 $\mu$m, respectively. Each movable member 8 is W1 wide laterally between the two adjacent flow path sidewalls 10, the width W1 being larger than the width W2 of the above opening area S and sufficient to fully seal the same. A fulcrum 8A of each movable member 8 specifies the upstream end of the opening area S of each liquid supply port 5 on the extension, on the free end side, of the continuous portion of the multiple movable members perpendicular to the multiple liquid paths (refer to FIG. 60). In this embodiment, for the portions of the supply portion forming member 5A which lie along the movable members 8, their thickness is set at a smaller value than that of the flow path sidewalls 10 themselves and the supply portion forming member 5A is superposed on the flow path sidewalls 10, as shown in FIGS. 59 and 60. For the portions of the supply portion forming member 5A which lie on the discharge port 7 side relative to the free ends 8B of the movable members, their thickness is set at the same value as that of the flow path sidewalls 10 themselves, as shown FIG. 60. Setting the thickness of the supply portion forming member 5A as described above allows the movable members 8 to move in respective liquid flow paths 3 without frictional resistance thereto, and at the same time, it enables regulating the displacement of the movable members 8 toward the opening area S side near the same area. This in turn enables preventing liquid from flowing from the inside of each liquid flow path 3 to the common liquid supply chamber 6, because the opening area S is substantially blocked up, while allowing each movable member 8 to move toward the liquid flow path side with the disappearance of bubble, that is, allowing the state of each liquid flow path to shift from a substantially sealed state to a refillable state. Further, in this embodiment, the movable member 8 is positioned parallel to the element substrate 1. The end 8B of each movable member 8 is a free end positioned on the heat generating member 4 side of the element substrate 1 and the end opposite to the end 8B is supported with a fixed member 9. This fixed member 9 serves to close the end on the side opposite to the discharge port 7 of each liquid flow path 3.

The opening area S is a substantial area for supplying liquid from the liquid supply port 5 toward the liquid flow path 3, and in this embodiment it is the area surrounded by three sides of the liquid supply port 5 and an end portion 9A of the fixed member 8, as shown in FIGS. 58 and 60.

Figure 61:
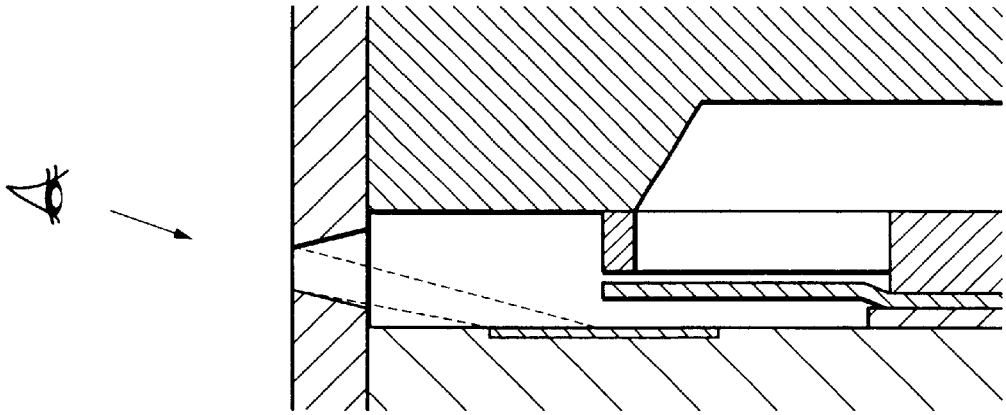
FIG. 61 is a sectional view of a flow path for explaining the "linear communication state"

And as shown in FIG. 61, in this embodiment, there exist no obstacles such as valves between the heat generating member 4, as an electrothermal converting element, and the discharge port 7, and the liquid flow path 3 is "in the linearly communicating state" in which its structure allows liquid to flow linearly. More preferably, an ideal state, in which the discharge conditions such as liquid droplets discharging direction and velocity are stabilized at an extremely high level, is created by allowing the direction of propagating pressure waves produced when bubbling and the direction of the associated liquid flow and liquid discharge to linearly correspond to each other. In the present invention, in order to achieve the ideal state or almost the ideal state, the discharge port 7 and the heat generating member 4, in particular, the heat generating member 4 on the discharge port side (downstream side) which affects bubbling on the discharge port side may be arranged in a straight line, the arrangement being such that it enables the observation of the heat generating member, in particular, the heat generating member on the downstream side from the outside of the discharge port when there is no liquid in the flow path (refer to FIG. 61).

Now the discharge operation of the liquid discharge head in accordance with this embodiment will be described taking the case where ordinary image recording is performed. FIGS. 62A and 62B to 64A and 64B are views in section along the liquid flow path of the liquid discharge head having a structure shown in FIGS. 58 to 60 illustrating the discharge operation of the liquid discharge head when performing ordinary image recording and showing the characteristic phenomena associated with the operation by dividing the operation into 6 steps shown in FIGS. 62A and 62B to 64A and 64B. In FIGS. 62A and 62B to 64A and 64B, reference character M denotes a meniscus formed by the discharge liquid.

Figure 62A:
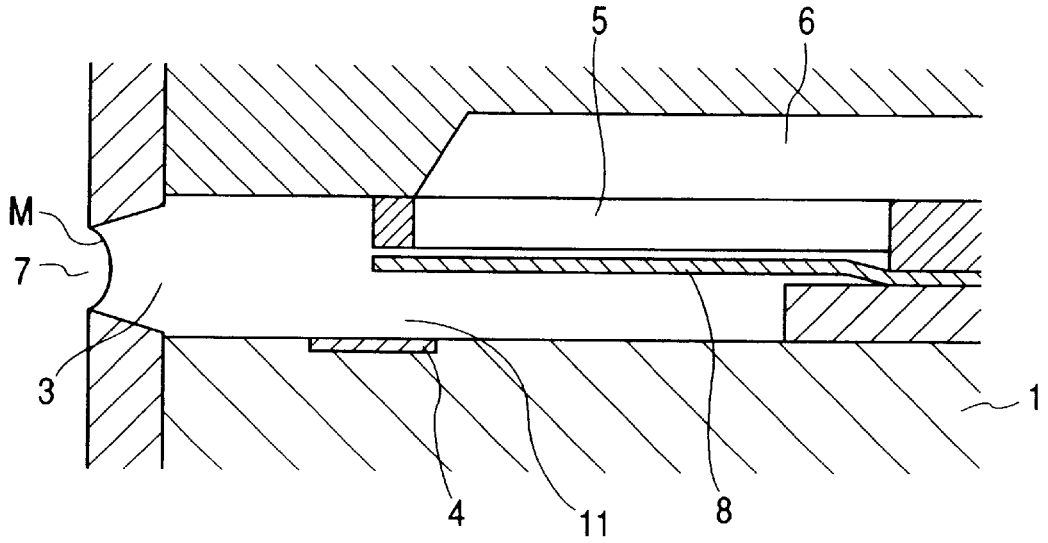
FIGS. 62A and 62B are illustrations of the discharge operation of the liquid discharge head of the structure shown in FIGS. 58 to 60, expressed in terms of sectional views taken along the direction of one liquid flow path and divided into characteristic phenomena.

In FIG. 62A, a state is shown in which energy such as electrical energy has not been applied to the heat generating member 4 yet and the heat generating member has not generated heat yet. In this state, there exists an infinitesimal clearance a (10 $\mu$m or less) between the movable member 8, which is provided between the liquid supply port 5 and the liquid flow path 3, and the surface forming the liquid supply port 5.

Figure 62B:
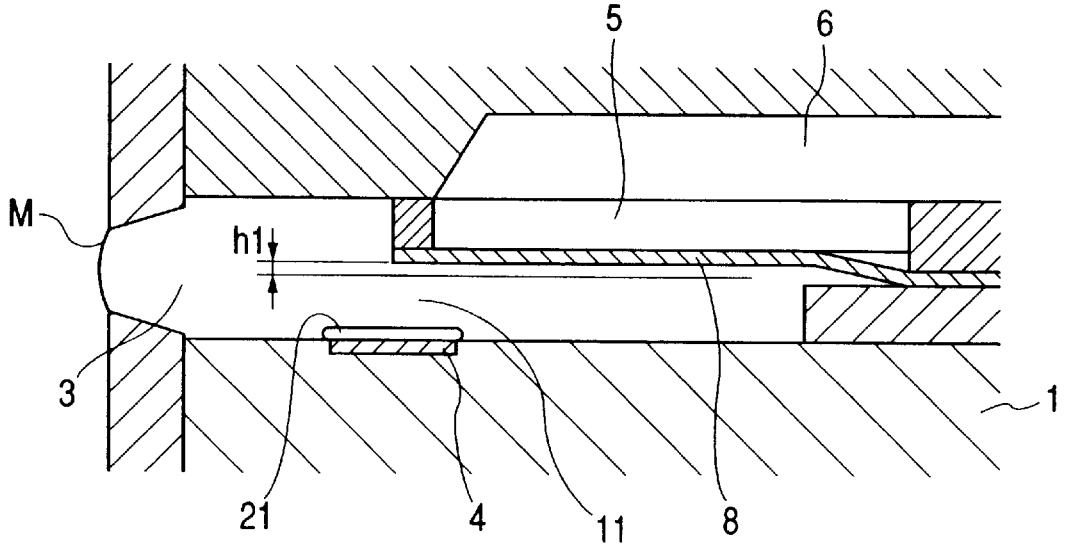

In FIG. 62B, a state is shown in which part of the liquid filling the liquid flow path 3 has been heated with the heat generating member 4, film boiling has occurred on the same, and a bubble 21 has isotropically grown. The terms "a bubble isotropically grows" herein used mean that in spots of the bubble surface, the growing speed in the direction perpendicular to the surface is almost the same.

During the process of the isotropical growth of the bubble 21 at the beginning of the bubble formation, the movable member 8 and the peripheral portion of the liquid supply port 5 closely touch with each other to block up the liquid supply port 5, and the liquid flow path 3 is brought to the substantially sealed state except at the discharge port 7. The duration that the sealed state is kept may be within a period from the application of driving voltage to the heat generating member 4 to the completion of the isotropical growth of the bubble 21. In this sealed state, the inertance (the degree to which still liquid is hard to move when it rapidly starts to move) from the center of the heat generating member 4 toward the liquid supply port side is substantially infinite in the liquid flow path 3. And the larger the spacing between the heat generating member 4 and the movable member 8 becomes, the closer the inertance from the heat generating member 4 toward the liquid supply port side gets to infinity. Here the maximum displacement of the free end of the movable member 8 toward the liquid supply port 5 side is denoted with h1.

Figure 63A:
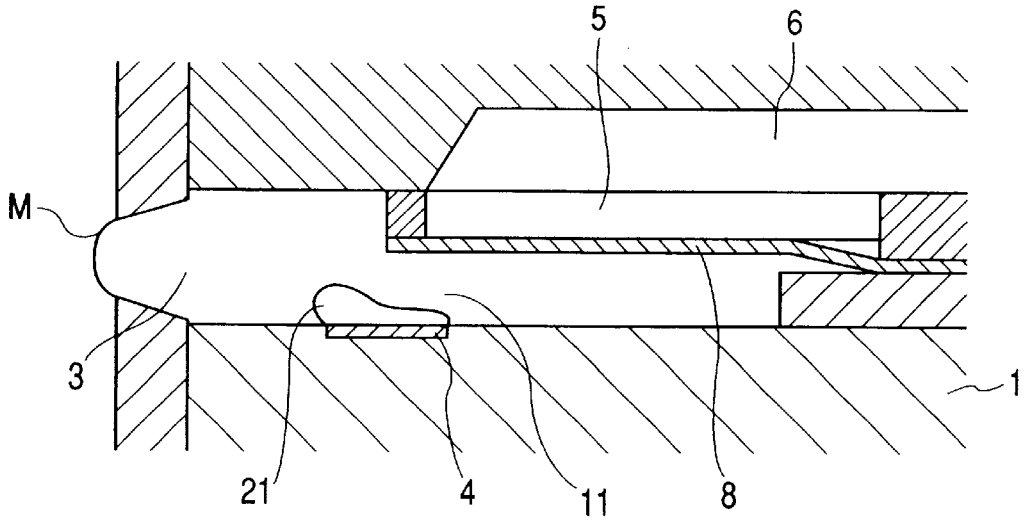
FIGS. 63A and 63B are illustrations of the discharge operation subsequent to that of FIGS. 62A and 62B, expressed in terms of sectional views taken along the direction of one liquid flow path of a liquid discharge head.

In FIG. 63A, a state is shown in which the bubble 21 continues to grow. In this state, since the liquid flow path 3 is in the substantially sealed state except at the discharge port 7, as described above, the liquid does not flow toward the liquid supply port 5 side. Thus, the bubble can expand further toward the discharge port 7 side, but does not expand toward the liquid supply port 5 side very much. And the bubble continues to grow on the discharge port 7 side of the bubble generating area 11, on the other hand, it stops growing on the liquid supply port 5 side of the same. This bubble-growth stopping state means the maximum bubbling state on the liquid supply port 5 side of the bubble generating area 11. The volume of the bubble at this point is denoted with Vr.

Figure 66A:
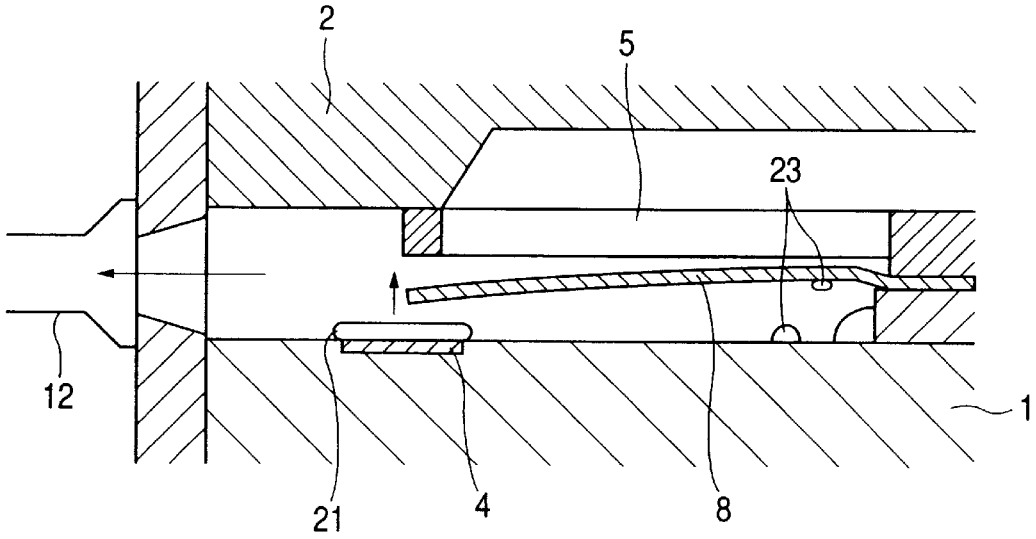
FIGS. 66A and 66B are illustrations of a suction recovery operation of the liquid discharge head of the structure shown in FIGS. 58 to 60, expressed in terms of sectional views taken along the direction of one liquid flow path.
Figure 66B:
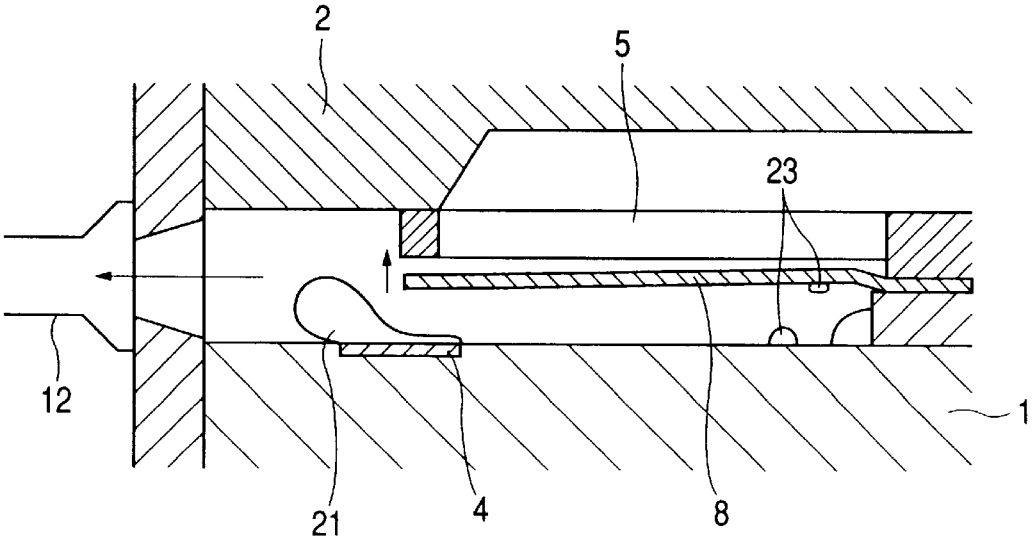

Now the bubble growing process in this embodiment, as shown in FIGS. 62A, 62B and 63A, will be described in further detail with reference to FIGS. 123A to 123E, like the bubble growing process in the first embodiment. As shown in FIG. 123A, when applying heat to the heat generating member, initial ebullition occurs on the heat generating member, then it changes to film boiling, in which the bubble covers the surface of the heat generating member, as shown in FIG. 123B. The bubble in the film boiling state continues to isotropically grow (the state in which a bubble continues to isotropically grow is referred to as semi-pillow state), as shown in FIGS. 123B and 123C. However, when the liquid flow path 3 is in the substantially sealed state except at the discharge port 7, as shown in FIG. 62B, the liquid cannot flow toward the upstream side; as a result, in the bubble in the semi-pillow state, its part on the upstream side (liquid supply port side) cannot grow very much and the rest on the downstream side (discharge port side) grows lot. This state is shown in FIGS. 63A, 66A and 66B.

Hereinafter the area of the heat generating member 4 where the bubble does not grow when heat is applied thereto is referred to as area B and the area on the discharge port side 7 of the heat generating member 4 where the bubble grows is referred to as area A, for convenience's sake. In the area B shown in FIG. 123E, the volume of the bubble reaches the maximum and the volume at this point is denoted with Vr.

Figure 63B:
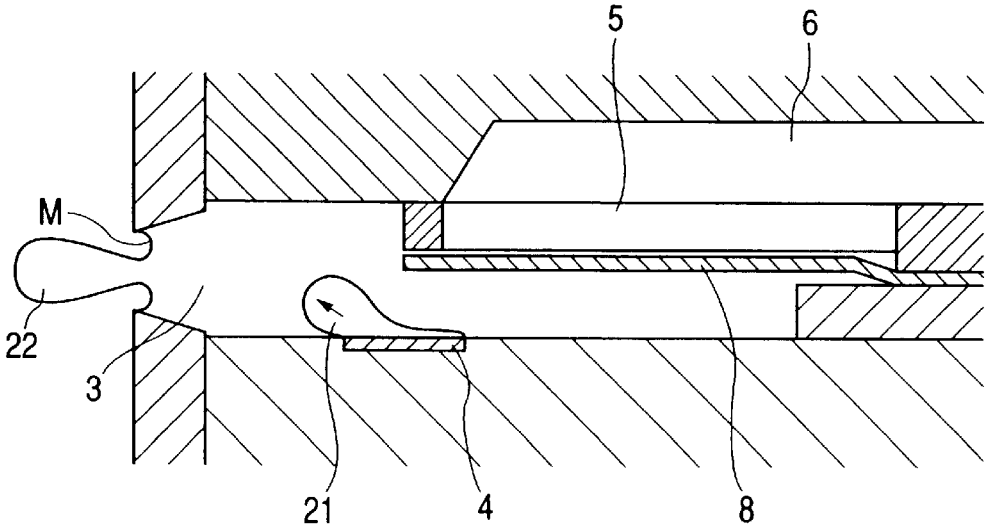

In FIG. 63B, a state is shown in which the bubble continues to grow in the area A and starts to shrink in the area B. In this state, in the area A the bubble continues to grow lot toward the discharge port side. On the other hand, in the area B the volume of the bubble starts to decrease. And the free end of the movable member 8 starts to be displaced downwardly to such a position that it is allowed to be in a steady state by the restoring force due to its rigidity and the disappearing force of the bubble in the area B. As a result, the liquid supply port 5 is opened, and the common liquid supply chamber 6 and the liquid flow path 3 are in communication with each other.

Figure 64A:
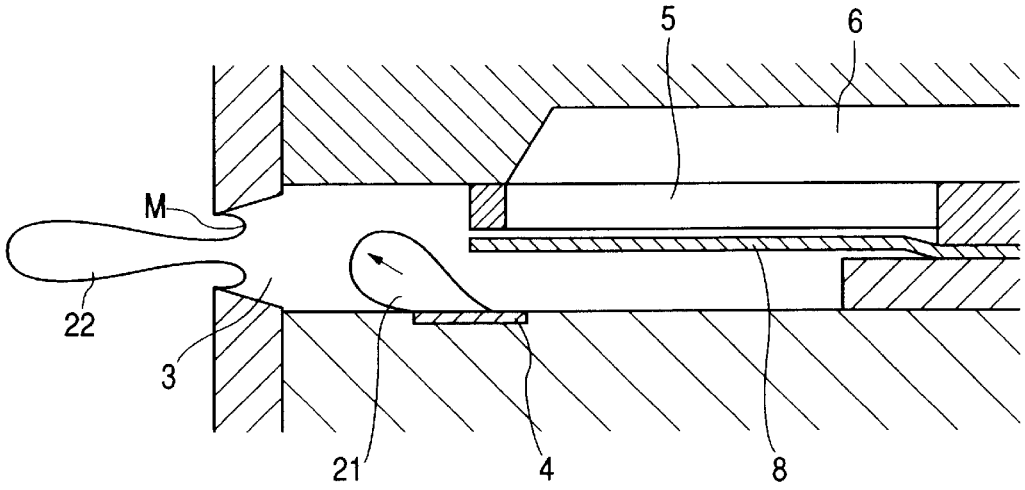
FIGS. 64A and 64B are illustrations of the discharge operation subsequent to that of FIGS. 63A and 63B, expressed in terms of sectional views taken along the direction of one liquid flow path of a liquid discharge head.

In FIG. 64A, a state is shown in which the bubble 21 has almost grown to be the maximum size. In this state, in the area A the bubble has grown to be the maximum size, and with this, the bubble almost disappears in the area B. The maximum volume of the bubble in the area A at this point is denoted with Vf. A discharge droplet 22 being discharged from the discharge port 7 is still continuous with the meniscus M with its long tail left behind.

Figure 64B:
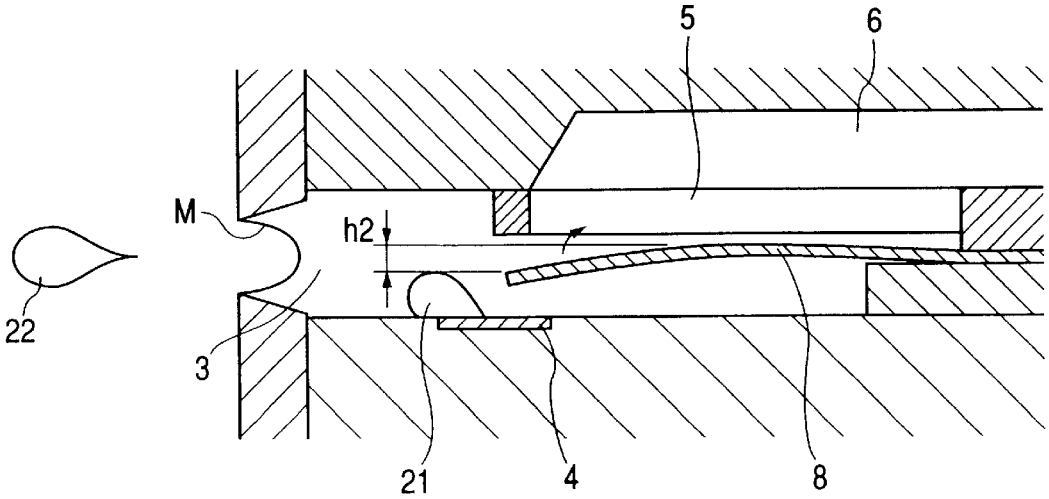
Figure 65A:
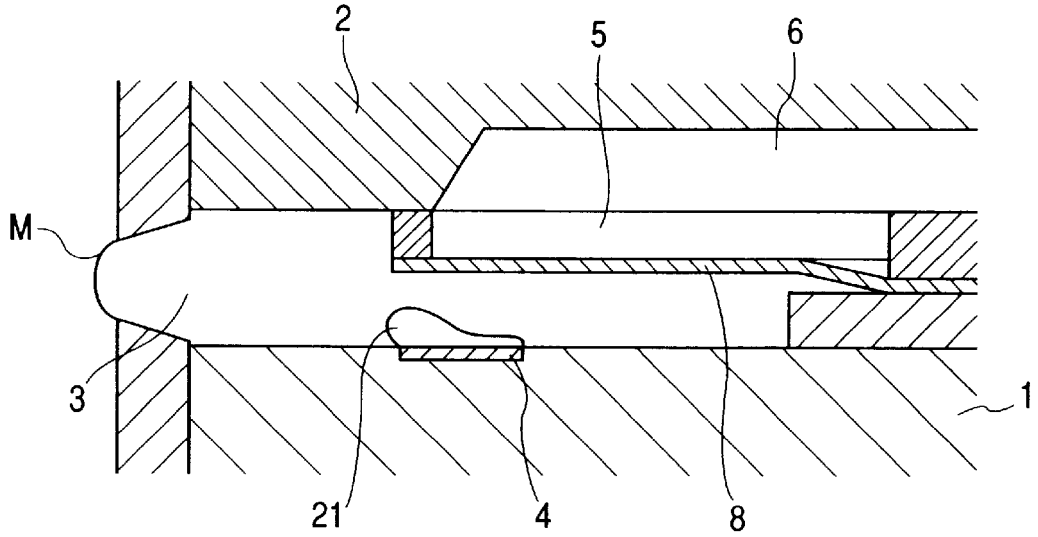
FIGS. 65A and 65B are sectional views taken along the direction of one liquid flow path of a liquid discharge head according to the fifth embodiment of the present invention, where (a) relates to a configuration of covering the whole heat generating element with the free end of a movable member and (b) relates to a configuration of separating a heat generating element from a movable member.
Figure 65B:
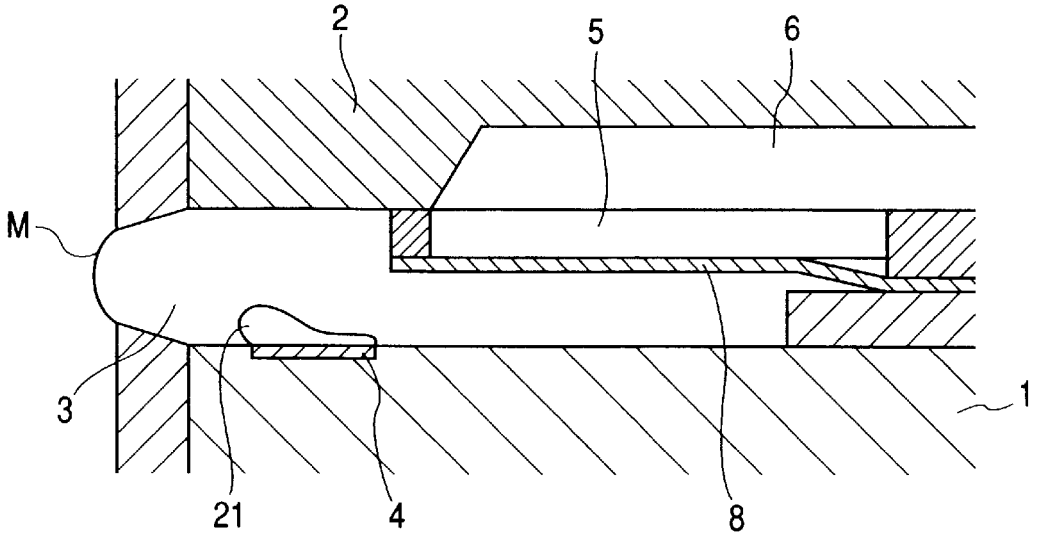

In FIG. 64B, a state is shown in which the bubble 21 is disappearing while stopping growing and the discharge droplet 22 and the meniscus M have been separated from each other. Immediately after the bubble stops growing and starts to disappear in the area A, the shrinkage energy of the bubble 21 acts as the force moving the liquid near the discharge port 7 in the upstream direction so as to keep the entire balance. Accordingly, the meniscus M at the discharge port 7 is pulled into the liquid flow path 3 at this point and the liquid column via which the continuity between the meniscus M and the discharge droplet 22 has been kept is quickly separated therefrom by the strong force. On the other hand, with the shrinkage of the bubble, a large flow of liquid rapidly flows into the liquid flow path 3 from the common liquid supply chamber 6 via the liquid supply port 5. This in turn causes a rapid decrease in the liquid flow which pulls the meniscus M rapidly into the liquid flow path 3, and the meniscus M starts to return to its original position before the bubble formation at a relatively low speed. Thus, the liquid discharge method using the movable member according to the present invention is highly excellent in the converging characteristics of the vibration of the meniscus M compared with the other liquid discharge methods which do not use the movable member according to the present invention. The maximum displacement of the free end of the movable member 8 toward the bubble generating area 11 side is denoted with h2.

Finally when the bubble 21 has completely disappeared, the movable member 8 returns to the position where it is allowed to be in a steady state, as shown in FIG. 62A. The movable member 8 is displaced upwardly (in the direction shown by a solid arrow in FIG. 64B) due to its own elastic force and returns to the steady state. In such a state, the meniscus M has already returned to the neighborhood of the discharge port 7.

The correlation between the change in the volume of bubble with time and the behavior of the movable member in both areas A and B shown in FIGS. 62A and 62B to 64A and 64B (refer to FIG. 124) and the correlation between the bubble growth and the behavior of movable member in liquid discharge heads provided with a movable member and a heat generating member of which relative position is different from that of this embodiment (refer to FIGS. 65A and 65B, and FIGS. 125 and 126) are both similar to that of the first embodiment.

Further, as can be seen from FIGS. 124 to 126, in the liquid discharge head in accordance with this embodiment, like the liquid discharge head of the first embodiment, the following relation holds, $$Vf>Vr$$

where Vf is the maximum volume of the bubble growing on the discharge port 7 side of the bubble generating area 11 (bubble in the area A) and Vr is the maximum volume of the bubble growing on the liquid supply port 5 side of the bubble generating area 11 (bubble in the area B). This relation always holds in the liquid discharge heads of the present invention. Further, in the liquid discharge heads of the present invention, the following relation permanently holds, $$Tf>Tr$$

where Tf is the lifetime (period between formation of bubble and disappearance of the same) of the bubble growing on the discharge port 7 side of the bubble generating area 11 (bubble in the area A) and Tr is the lifetime of the bubble growing on the liquid supply port 5 side of the bubble generating area 11 (bubble in the area B). Because of the relation described above, the point of the bubble's disappearing is located on the discharge port 7 side relative to the center portion of the bubble generating area 11. Further, in the construction of the liquid discharge head in accordance with this embodiment, the relation holds that the maximum displacement h2 of the free end of the movable member 8 toward the bubble forming means 4 side with the disappearance of bubble is larger than the maximum displacement h1 of the free end of the movable member 8 toward the liquid supply port 5 side at the beginning of the bubble formation (h1<h2) as can be seen from FIGS. 62B and 64B. For example, h1 is 2 $\mu$m and h2 is 10 $\mu$m. Because of this relation, the bubble growth in the rear of the heat generating member (in the direction opposite to the discharge port) at the beginning of the bubble formation can be restricted and the bubble growth in the front of the heat generating member (toward the discharge port) at the beginning of the bubble formation can be further promoted. This in turn enables the promotion of efficiency in converting the bubbling power produced on the heat generating member into the kinetic energy of the liquid droplet flying from the discharge port.

In general, in the liquid discharge head, bubble are sometimes not allowed to completely disappear by refilling liquid and are sometimes left as remaining bubble. And if there exists contamination caused by, for example, char on the heat generating member 4, nucleate boiling occurs on the contamination as a nucleus. This nucleate boiling occurs at as low as 100° C., and the bubble are sometimes not allowed to disappear because the internal pressure of the bubble is 1 atom. All of these phenomena often occur when driving and heating the heat generating member 4 at a high frequency. And the bubble caused as above sometimes adhere to the surfaces of the bottom and sides of the movable member 8 to become remaining bubble. These remaining bubble absorb the propagation of pressure wave produced when discharging ink for image recording, just like buffers, sometimes resulting in unstable liquid discharge.

For the reasons above, discharge operation for suction recovery is performed in addition to the ordinary discharge operation.

In the following the suction recovery operation of the liquid discharge head in accordance with this embodiment will be described. FIGS. 66A and 66B and 67A and 67B are views in section along the liquid flow path of the liquid discharge head having a structure shown in FIGS. 58 to 60 illustrating the discharge operation for suction recovery and showing the characteristic phenomena associated with the operation by dividing the operation into 4 steps shown in FIGS. 66A and 66B and 67A and 67B.

In FIG. 66A, a state is shown in which a bubble is formed by applying heat to the heat generating element 4 during a forcible suction recovery operation through the discharge port 7. At this point, the movable member 8 having been displaced downwardly due to the suction recovery operation starts to be displaced upwardly due to the pressure wave produced by the film boiling of the liquid on the heat generating member 4.

In FIG. 66B, a state is shown in which the movable member 8 has almost returned to the position where it is allowed to be in a steady state. At this point, the liquid is likely to move in the downstream direction because of the suction operation through the discharge port 7, in addition, the resistance to the liquid movement from the liquid supply port 5 is high because the movable member 8 is about to block up the opening area of the liquid supply port 5. Thus, the bubble rapidly grows toward the discharge port.

Figure 67A:
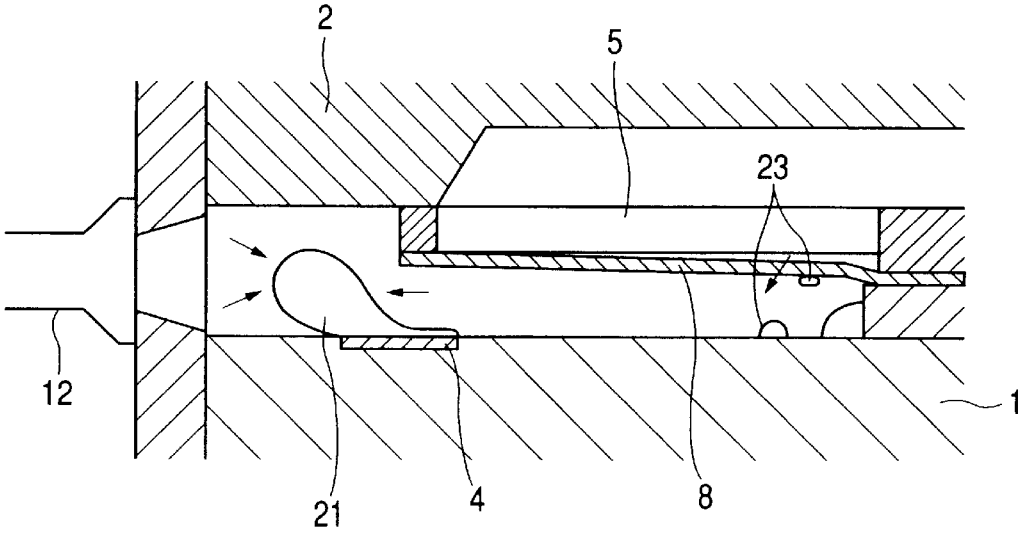
FIGS. 67A and 67B are illustrations of the recovery operation subsequent to that of FIGS. 66A and 66B, expressed in terms of sectional views taken along the direction of one liquid flow path of a liquid discharge head.
Figure 67B:
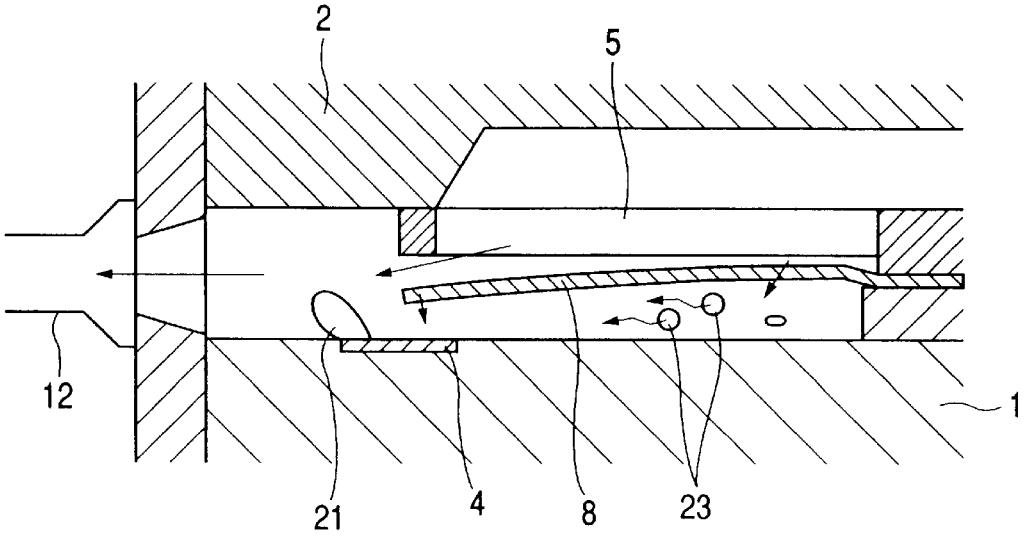

In FIG. 67A, a state is shown in which the movable member 8 has been completely in contact with the liquid supply port 5. At this point, the bubble having grown to be the maximum size starts to shrink, so as to disappear, and the suction pressure through the discharge port 7 and the pressure associated with the shrinkage of the bubble compete against each other. However, the suction operation is performed in the other liquid paths arranged in parallel (not shown in the figures) simultaneously, and even if the resistance to the suction in this liquid path becomes high, the suction is performed in the other liquid paths. Thus, the shrinkage pressure of the bubble becomes higher than the suction pressure, and with the beginning of the bubble's shrinkage, the suction is gradually weakened. However, as the bubble starts to disappear, the suction starts again.

Although the liquid movement associated with this bubble shrinkage starts from the liquid supply port 5, the timing for the movement of the movable member 8 and the growth/shrinkage of the bubble is different from that of the ordinary discharge operation. Specifically, when the bubble is starting to shrink, the movable member 8 is still near the position where it is allowed to be in a steady state, and the resistance to the liquid movement from the liquid supply port 5 is high. Therefore, the liquid starts to flow in the neighborhood of the fulcrum of the movable member 8, at which the liquid flow does not occur in the ordinary discharge operation. As a result, the liquid flow occurs near the remaining bubble having been stayed near the fulcrum of the movable member 8 and allows the same to move.

In FIG. 67A, a state is shown in which the remaining bubble are moving.

As described above, heating the heat generating member 4 during the suction recovery operation allows the timing for the growth/shrinkage of the bubble and the displacement of the movable member 8 to be different from that of the ordinary discharge operation, which in turn allows liquid flow to occur near the supporting member of the movable member, where liquid flow does not occur in the ordinary discharge operation and by the ordinary recovery method, and makes easier the movement of the remaining bubble having been stayed near the fulcrum of the movable member, and finally the remaining bubble in the above state can be eliminated by the suction recovery. With this operation, the ordinary discharge operation can be stabilized when performing image recording on a recording medium.

[First Variation]

Figure 68:
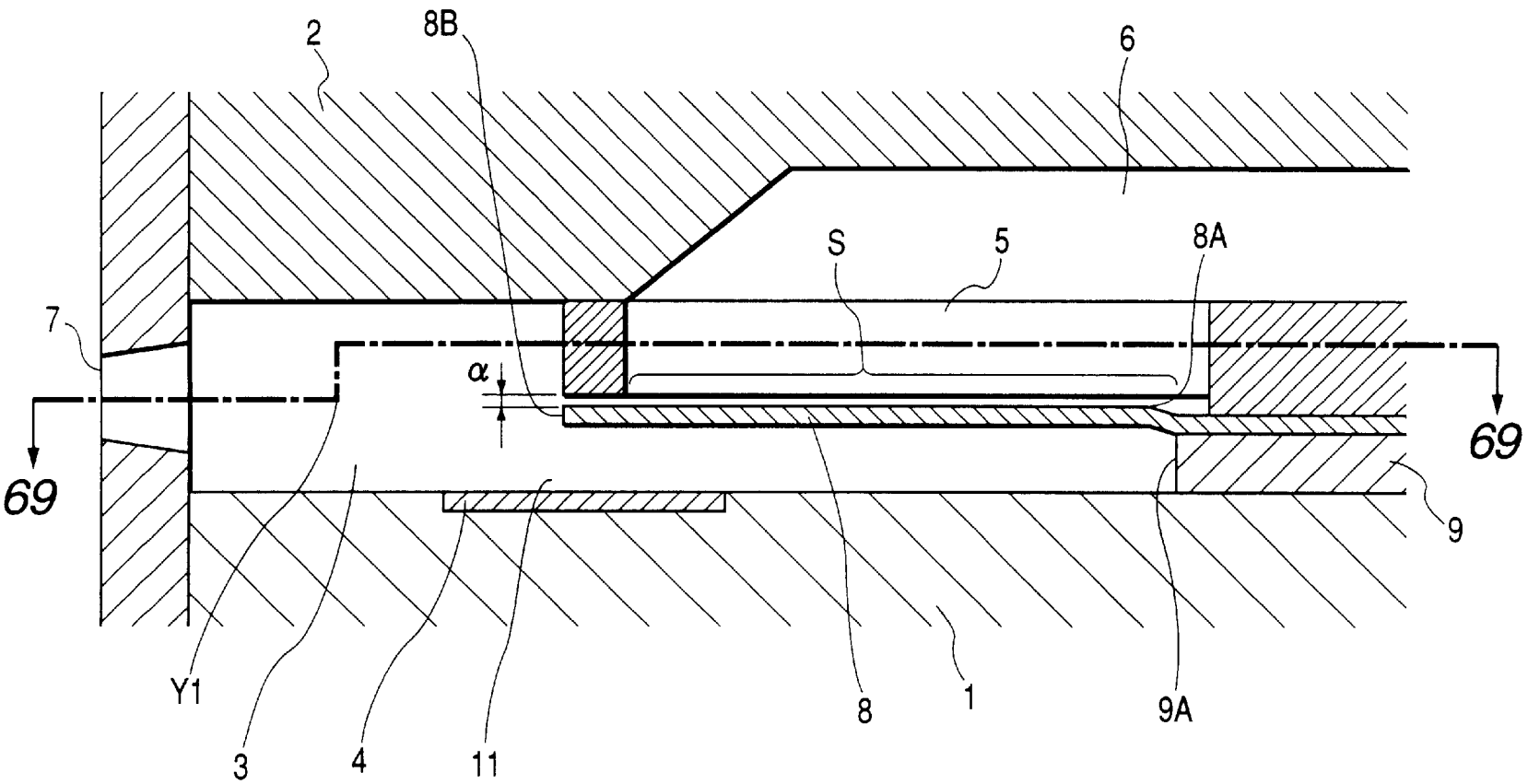
FIG. 68 is a sectional view taken along the direction of one liquid flow path of a liquid discharge head according to the first variation of the fifth embodiment of the present invention.
Figure 69:
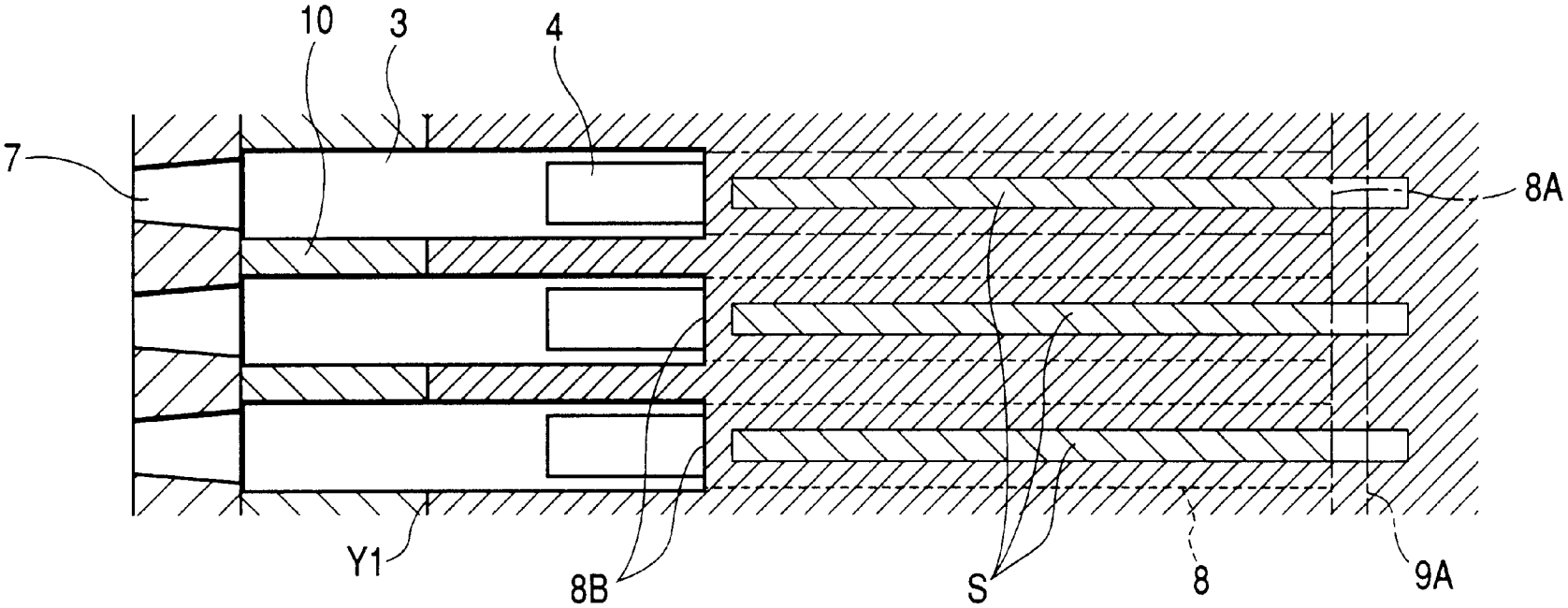
FIG. 69 is a sectional view taken on line 69—69 of FIG. 68.

In the structure of the liquid discharge head in accordance with this embodiment, the very end of the movable member 8-fixed member 9 junction (that is, the point at which the movable member 8 is bent and raised) does not correspond to the end portion 9A of the fixed member 9; accordingly, the opening area S is defined as the area surrounded by three sides of the liquid supply port 5 and the end portion 9A of the fixed member 9, as shown in FIGS. 58 and 60. However, as one of the first variations of this embodiment, the point at which the movable member 8 is bent and raised may correspond to the end portion 9A of the fixed member 9, as shown in FIGS. 68 and 69. In this variation, the opening area S is defined as the area surrounded by three sides of the liquid supply port 5 and the fulcrum 8A of the movable member 8, as shown in FIGS. 68 and 69.

Figure 70:
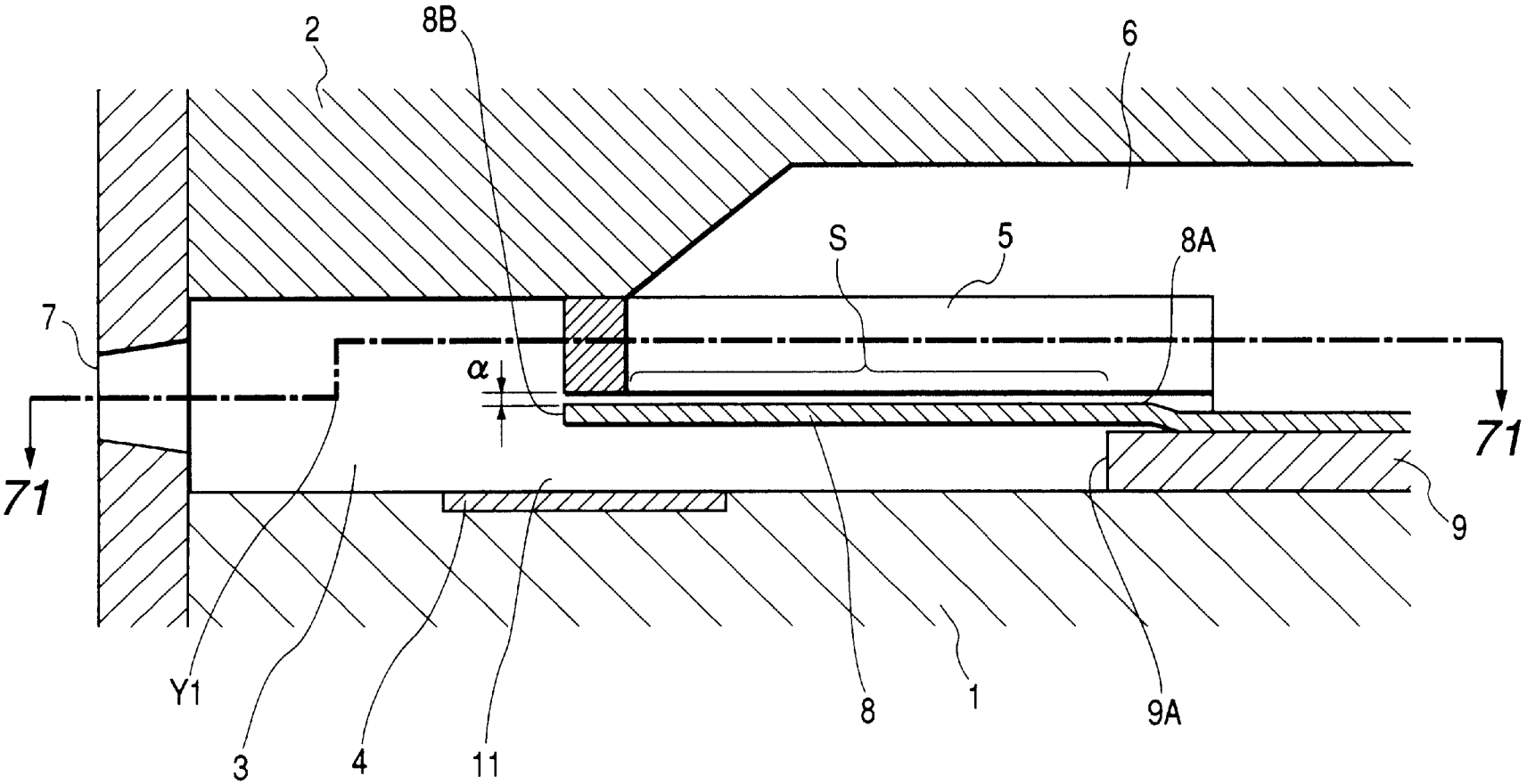
FIG. 70 is a sectional view taken along the direction of one liquid flow path of a liquid discharge head according to the first variation of the fifth embodiment of the present invention.
Figure 71:
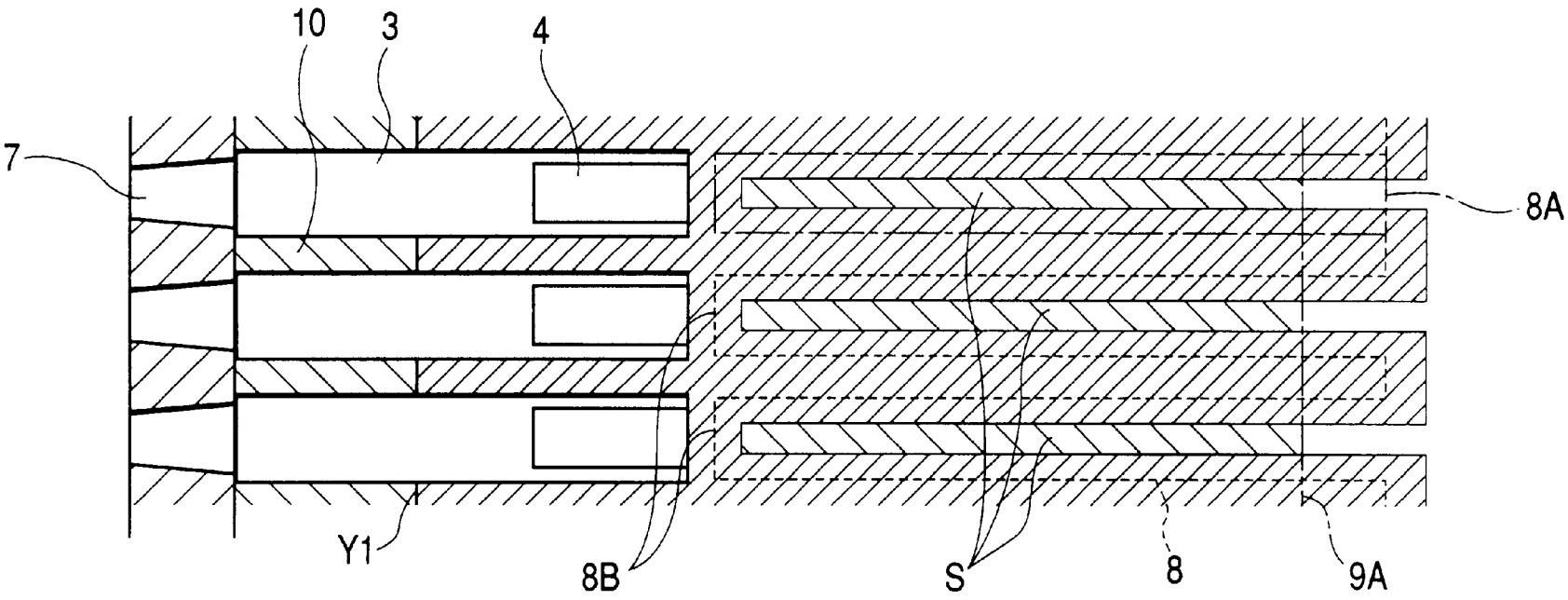
FIG. 71 is a sectional view taken on line 71—71 of FIG. 70.
Figure 72D:
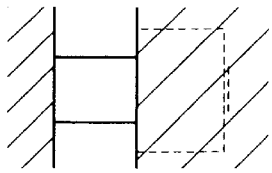
FIGS. 72A, 72B, 72C and 72D are illustrations of individual parts of a liquid discharge head according to the third variation of the fifth embodiment of the present invention.
Figure 72C:
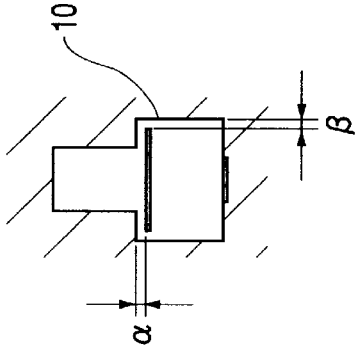
Figure 72A:
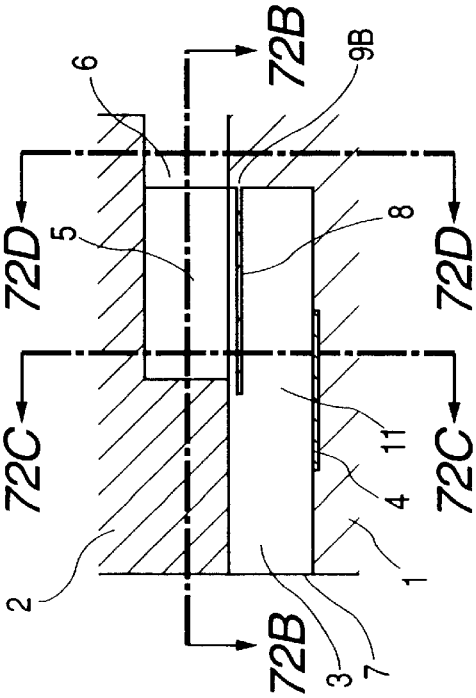
Figure 72B:
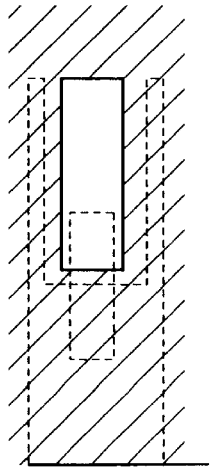
Figure 73:
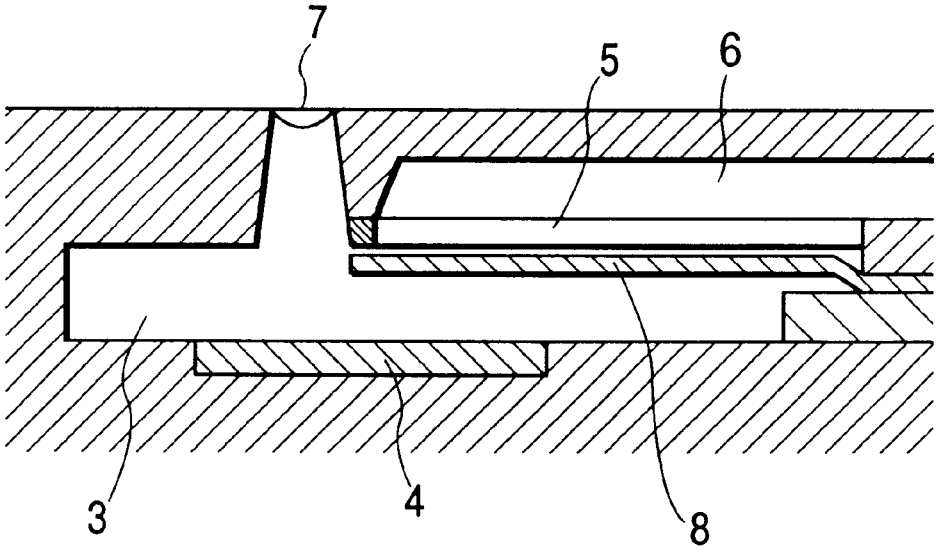
FIG. 73 is an illustration of an example of side-shooter type liquid discharge head corresponding to the configuration of a liquid discharge head according to the fifth embodiment of the present invention.
Figure 74A:
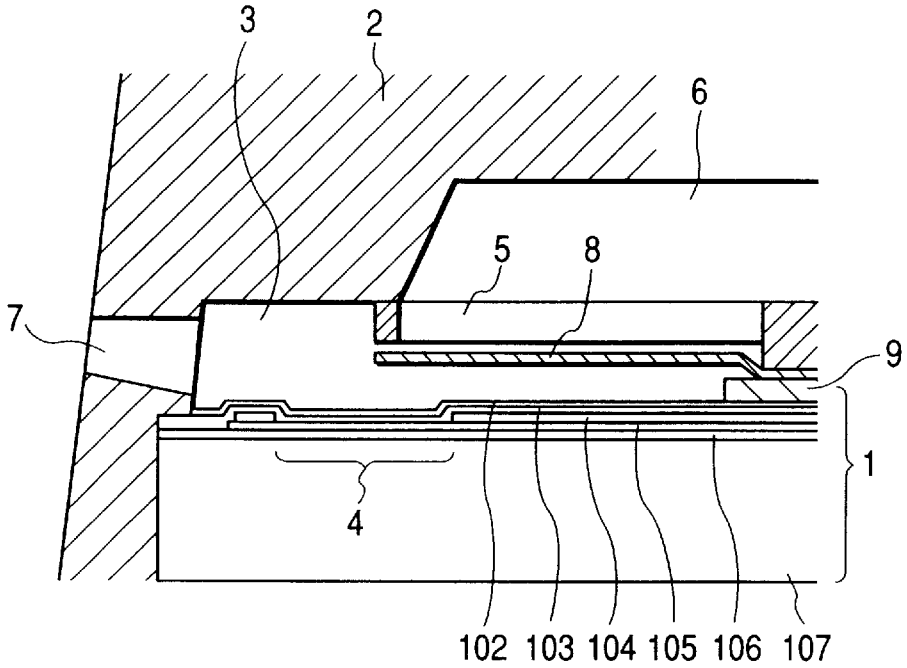
FIG. 74A is a vertically sectional view of a liquid discharge head according to the fifth embodiment with a protective film.
Figure 74B:
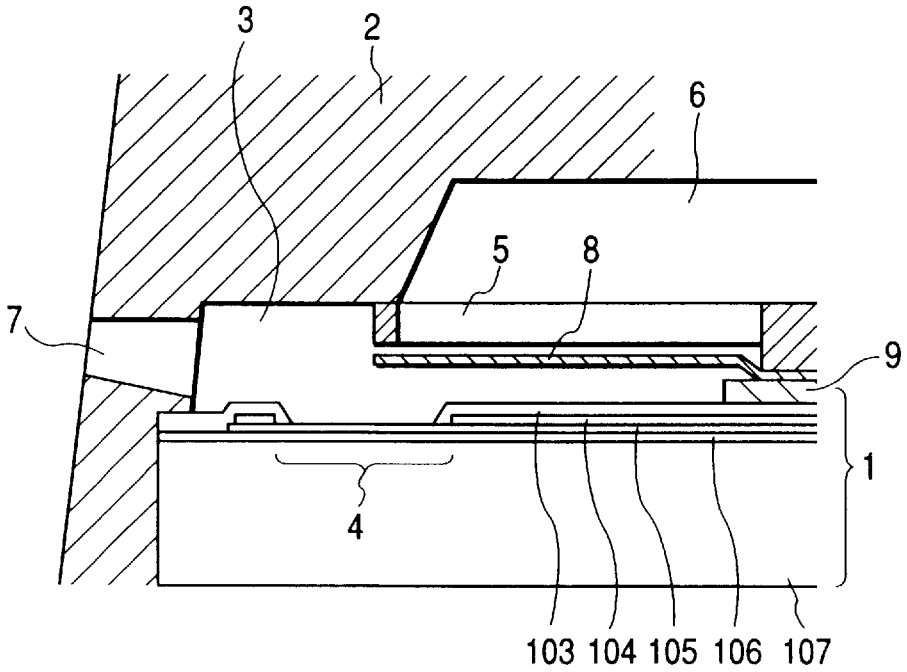
FIG. 74B is a vertically sectional view of a liquid discharge head according to the fifth embodiment without a protective film.

In the structure of the liquid discharge head in accordance with this embodiment, the liquid supply port is defined as the opening surrounded by four walls, as shown in FIG. 60; however, as one of the first variations of this embodiment, the wall on the common liquid supply chamber 6 side, which is opposite to a discharge port 7 side, of a supply portion forming member 5A (refer to FIG. 58) may be opened, as shown in FIGS. 70 and 71. In this variation, the opening area S is defined as the area surrounded by three sides of the liquid supply port 5 and the end portion 9A of a fixed member 9, like this embodiment, as shown in FIGS. 70 and 71.

In such variation, the discharge operation for recovery also allows a large liquid flow to occur by causing the movable member to vibrate, which in turn allows remaining bubble to move in the downstream direction, and the remaining bubble having moved downstream can be eliminated by the suction operation.

[Second Variation]

In the following the liquid discharge head in accordance with the second variation of this embodiment will be described with reference to FIGS. 72A to 72D.

In the liquid discharge head, as the second variation of this embodiment, shown in FIGS. 72A to 72D, the element substrate 1 and the top board 2 are joined to each other, and between the two boards the liquid flow path 3 is formed with its one end in communication with the discharge port 7 and the other closed.

The liquid supply port 5 is disposed on the liquid flow path 3 and the common liquid supply chamber 6 is provided which is in communication with the liquid supply port 5.

Between the liquid supply port 5 and the flow path 3, the movable member 8 is provided almost parallel to the opening area S of the liquid supply port 5 while allowing an infinitesimal clearance a (for example, 10 $\mu$m or less) between them. The area of the movable member 8 surrounded by at least its free end portion as well as either side portion, which is the continuation of the free end portion, is larger than the opening area S of the liquid supply port 5, which is facing the liquid flow path, and an infinitesimal clearance $\beta$ is allowed between each of the side portions of the movable member 8 and each of the flow path sidewalls 10 sandwiching the movable member. Thus, the movable members 8 can move in the liquid flow path 3 without frictional resistance thereto, and at the same time, the displacement of the movable members 8 toward the opening area S side can be regulated near the same area. This in turn enables preventing liquid flow from the liquid flow path 3 to the common liquid supply chamber 6, because the liquid supply port 5 is substantially blocked up with the movable member. In this variation, the movable member 8 is positioned in such a manner as to face the element substrate 1. And one and of the movable member 8 is a free end which is displaced toward the heat generating member 4 side of the element substrate 1 and the other end is supported with a supporting portion 9B.

In this variation, remaining bubble can also be eliminated, like the other embodiments and variations thereof.

Sixth Embodiment

Figure 75:
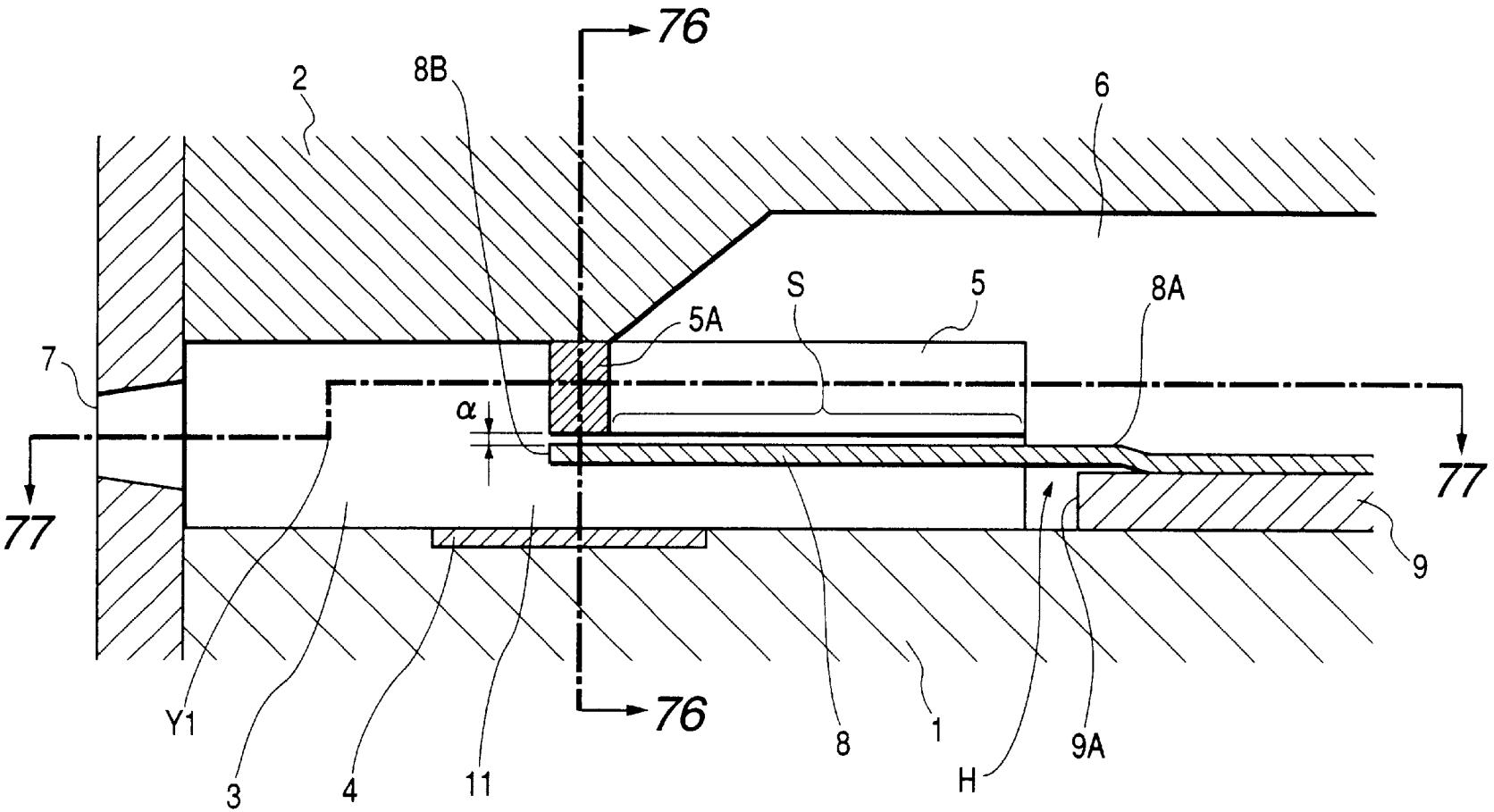
FIG. 75 is a sectional view taken along the direction of one liquid flow path of a liquid discharge head according to the sixth embodiment of the present invention.
Figure 76:
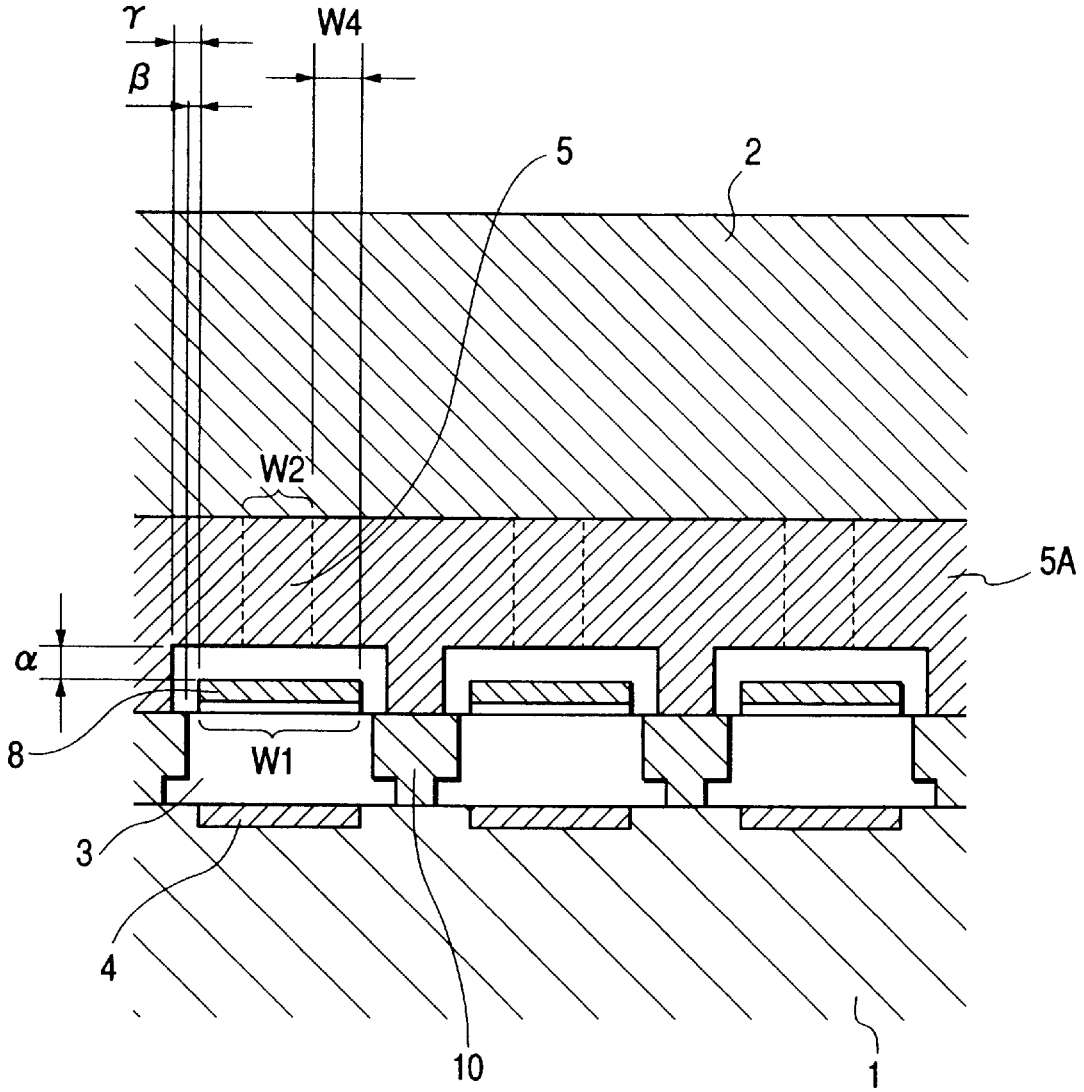
FIG. 76 is a sectional view taken on line 76—76 of FIG. 75.
Figure 77:
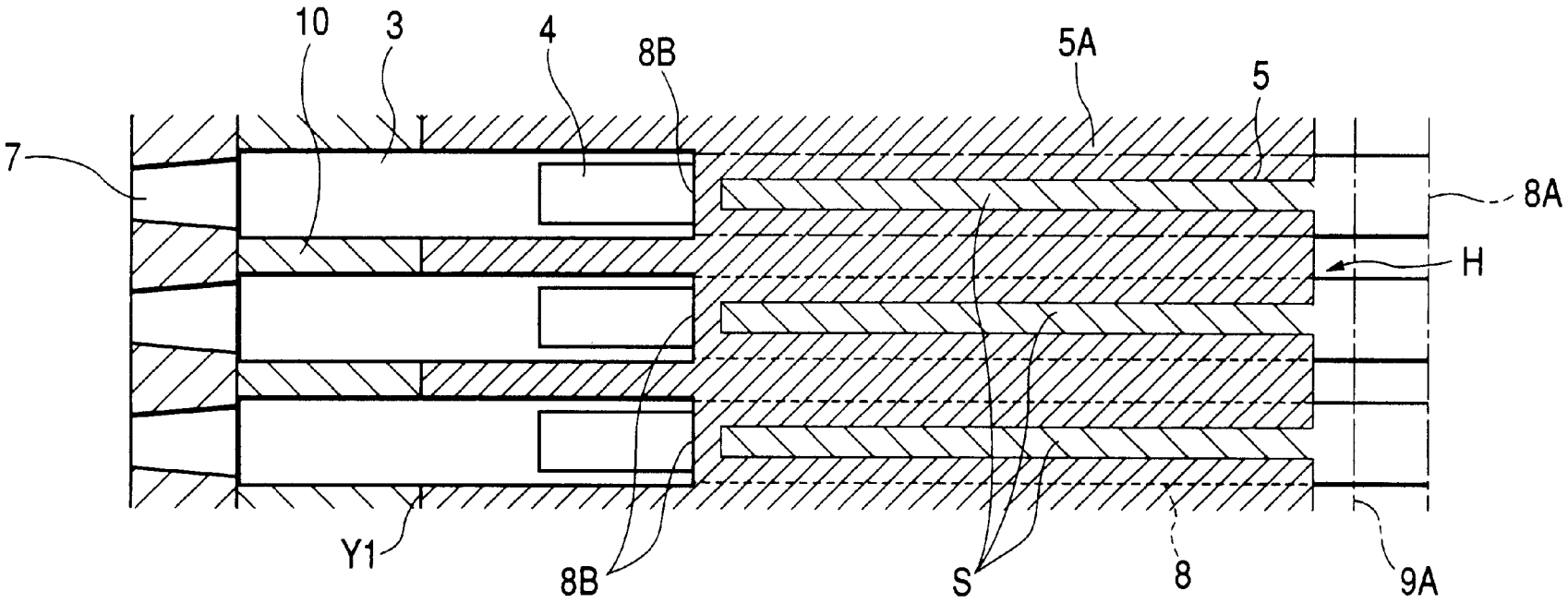
FIG. 77 is a sectional view taken on line 77—77 of FIG. 75.

FIG. 75 is a view in section along one of the liquid flow paths showing the liquid discharge head in accordance with the sixth embodiment of the present invention, FIG. 76 is a cross-sectional view of the liquid discharge head of FIG. 75 taken along the line 76—76, and FIG. 77 is a cross-sectional view of the liquid discharge head of FIG. 75 taken along the line 77—77, which is shifted from the center line of the discharge port toward the top board 2 at a point Y1.

In the liquid discharge head in the form of multiple liquid paths-common liquid chamber shown in FIGS. 75 to 77, an element substrate 1 and a top board 2 are fixed on each other via liquid path sidewalls 10 in the stacked state, and between the two boards 1, 2 formed are liquid flow paths 3 of which one end is in communication with the discharge port 7 and other end is closed. Each liquid discharge head is provided with multiple liquid flow paths 3. On the element substrate 1, heat generating members 4, such as electrothermal converting element, as bubble forming means for bubbling the liquid refilled in the liquid flow paths 3 are disposed for respective liquid flow paths 3. And near the contact surface of each heat generating member 4 with the discharging liquid, there exists a bubble generating area 11 where the discharging liquid is bubbled by rapidly heating the heat generating member 4.

A liquid supply port 5 having been formed on a supply portion forming member 5A is disposed in each of the multiple liquid flow paths 3 and a common liquid supply chamber 6 is provided in the same which is in communication with each liquid supply port 5. In other words, the liquid supply ports 5 are configured in such a manner as to branch from a single common liquid supply chamber 6 into multiple liquid flow paths 3, and they receive liquid from the common liquid supply chamber 6 in the amount which offsets the amount of liquid having been discharged from the discharge ports 7, which are in communication with respective liquid flow paths 3.

Between each liquid supply port 5 and liquid flow path 3, a movable member 8 is provided almost parallel to an opening area S of the liquid supply port 5 while allowing an infinitesimal clearance $\alpha$ (for example, 10 $\mu$m or less) between them. The area of the movable member 8 surrounded by at least its free end portion as well as either side portion, which is the continuation of the free end portion, is larger than the opening area S of the liquid supply port 5 (refer to FIG. 77), and an infinitesimal clearance $\beta$ is allowed between each of the side portions of the movable member 8 and each of the flow path sidewalls 10 sandwiching the movable member 8 (refer to FIG. 76). The above-described supply portion forming member 5A is disposed $\gamma$ apart from the movable member 8 as shown in FIG. 76. The clearances $\beta$, $\gamma$ vary depending on the pitch of the liquid path; however, if the clearance $\gamma$ is large, the movable member 8 is likely to block up the opening area S, on the other hand, if the clearance $\beta$ is large, with the disappearance of bubble, the movable member 8 is likely to move downward from the position $\alpha$ apart from the opening area S, where it is in a steady state, toward the element substrate 1 side. In this embodiment, the clearances $\alpha$, $\beta$ and $\gamma$ are set at values of 3 $\mu$m, 3 $\mu$m and 4 $\mu$m, respectively. Each movable member 8 is W1 wide laterally between the two adjacent flow path sidewalls 10, the width W1 being larger than the width W2 of the above opening area S and sufficient to fully seal the same. In this embodiment, for the portions of the supply portion forming member 5A which lie along the movable members 8, their thickness is set at a smaller value than that of the flow path sidewalls themselves and the supply portion forming member 5A is superposed on the flow path sidewalls 10, as shown in FIGS. 76 and 77. For the portions of the supply portion forming member 5A which lie on the discharge port 7 side relative to the free ends 8B of the movable members, their thickness is set at the same value as that of the flow path sidewalls 10 themselves, as shown FIG. 77. Setting the thickness of the supply portion forming member 5A as described above allows the movable members 8 to move in respective liquid flow paths 3 without frictional resistance thereto, and at the same time, it enables regulating the displacement of the movable members 8 toward the opening area S side near the same area. This in turn enables preventing liquid flow from the inside of each liquid flow path 3 to the common liquid supply chamber 6, because the opening area S is substantially blocked up, while allowing each movable member 8 to move toward the liquid flow path side with the disappearance of bubble, that is, allowing the state of each liquid flow path to shift from a substantially sealed state to a refillable state. Further, in this embodiment, each movable member 8 is positioned parallel to the element substrate 1. And the end portion 8B of each movable member 8 is a free end positioned on the heat generating member 4 side of the element substrate 1 and the fulcrum 8A opposite to the end 8B is supported with a fixed member 9. This fixed member 9 serves to close the end on the side opposite to the discharge port 7 of each liquid flow path 3.

In the liquid discharge head of this embodiment, one of the walls of the supply portion forming member 5A, which is on the common liquid supply chamber 6 side opposite to the discharge port 7, is opened. And the supply portion forming member 5A is constructed in such a manner that the wall on the common liquid supply chamber 6 side is positioned on the downstream side (discharge port 7 side), relative to the fulcrum 8A of the movable member 8, of the liquid flow direction.

Therefore, the fulcrum 8A of the movable member 8 is arranged within the common liquid supply chamber 6 and a communication portion H, which allows the common liquid supply chamber 6 and the area of the liquid flow path 3 covered with the movable member 8 to communicate with each other, is formed near the fulcrum 8A of the movable member 8.

Figure 78:
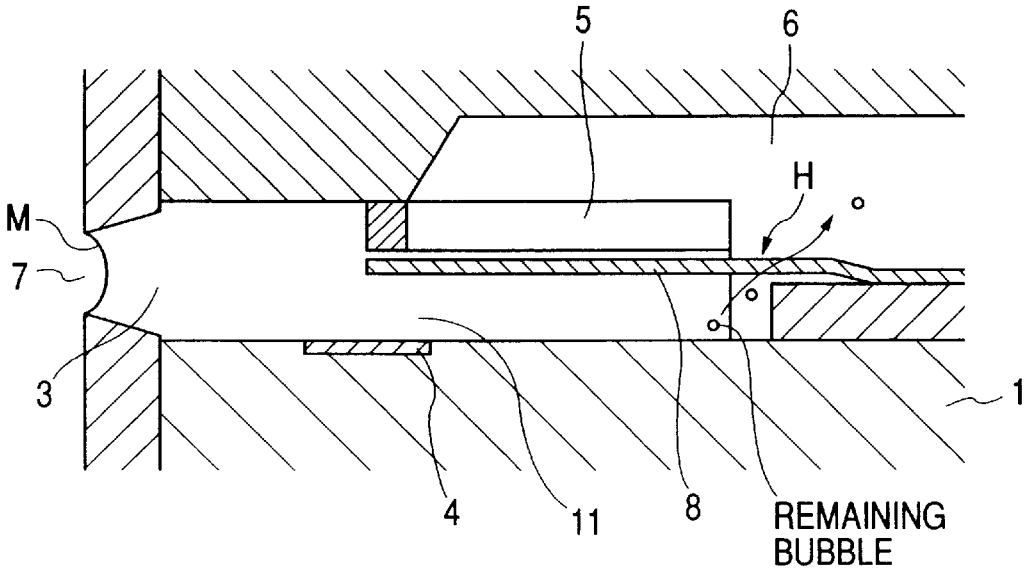
FIG. 78 is a manner of the liquid discharge head shown in FIGS. 75 to 77 in which remaining bubble staying in the liquid flow path under a movable member moves to the side of a common liquid supply chamber through the communication part H.

This communication portion H serves to produce liquid flow, when refilling the liquid flow path with liquid, from the common liquid supply chamber 6, through the communication portion H, to the portion under the movable member 8. Accordingly, the remaining bubble having been stayed in the liquid flow path 3 under the movable member 8 are carried away by this liquid flow and eliminated. Further, the remaining bubble having been stayed in the liquid flow path 3 under the movable member 8 are allowed to move toward the common liquid supply chamber 6 side through the communication portion H, thereby they can also be eliminated from the portion under the movable member 8 (refer to FIG. 78).

The opening area S is a substantial area for supplying liquid from the liquid supply port 5 toward the liquid flow path 3, and in this embodiment it is the area surrounded by three sides of the liquid supply port 5, as shown in FIGS. 75 and 77.

Figure 79:
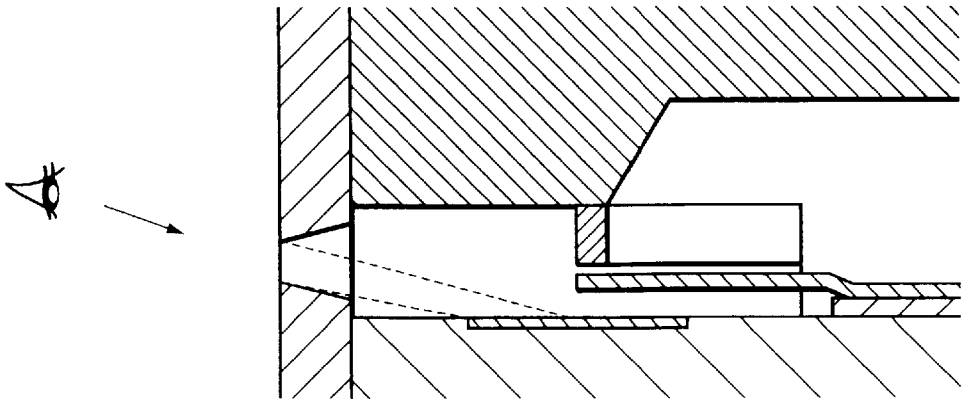
FIG. 79 is a sectional view of a flow path for explaining the "linear communication state"

And as shown in FIG. 79, in this embodiment, there exist no obstacles such as valves between the heat generating member 4, as an electrothermal converting element, and the discharge port 7, and the liquid flow path 3 is "in the linearly communicating state" in which its structure allows liquid to flow linearly. More preferably, an ideal state, in which the discharge conditions such as liquid droplets discharging direction and velocity are stabilized at an extremely high level, is created by allowing the direction of propagating pressure waves produced when bubbling and the direction of the associated liquid flow and liquid discharge to linearly correspond to each other. In the present invention, in order to achieve the ideal state or the almost ideal state, the liquid flow path is defined by the construction in which the discharge portion 7 and the heat generating member 4, in particular, the heat generating member 4 on the discharge port side (downstream side) which affects bubbling on the discharge port side are in a straight line, the construction being such that it enables the observation of the heat generating member, in particular, the heat generating member on the downstream side from the outside of the discharge port when there is no liquid in the flow path (refer to FIG. 79).

Now the discharging operation of the liquid discharge head in accordance with this embodiment will be described in detail. FIGS. 80 to 82A and 82B are views in section along the liquid flow path of the liquid discharge head having a structure shown in FIGS. 75 to 77 illustrating the discharge operation of the liquid discharge head and showing the characteristic phenomena associated with the operation by dividing the operation into 6 steps shown in FIGS. 80 to 82A and 82B. In FIGS. 80 to 82A and 82B, reference letter M denotes a meniscus formed by the discharge liquid.

Figure 80A:
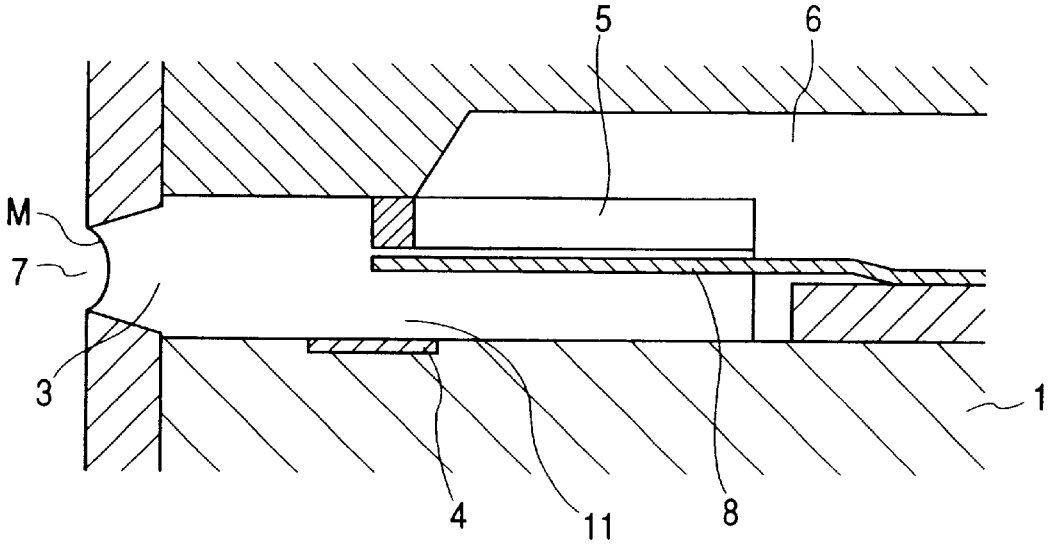
FIGS. 80A and 80B are illustrations of the discharge operation of the liquid discharge head of the structure shown in FIGS. 75 to 77, expressed in terms of sectional views taken along the direction of one liquid flow path and divided into characteristic phenomena.

In FIG. 80A, a state is shown in which energy such as electrical energy has not been applied to the heat generating member 4 yet and the heat generating member has not generated heat yet. In this state, there exists an infinitesimal clearance $\alpha$ (10 $\mu$m or less) between the movable member 8, which is provided between the liquid supply port 5 and the liquid flow path 3, and the surface forming the liquid supply port 5.

Figure 80B:
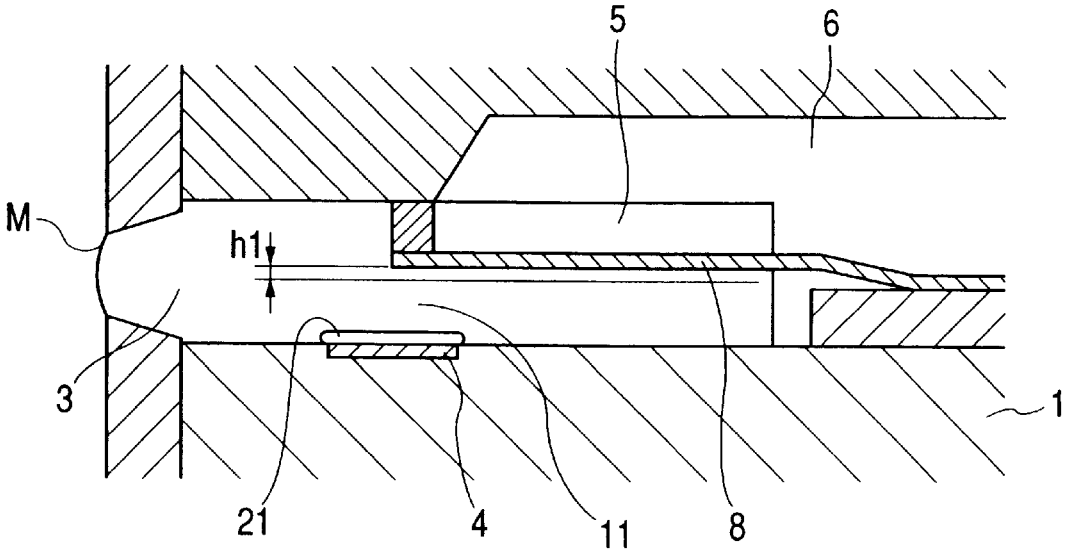

In FIG. 80B, a state is shown in which part of the liquid filling the liquid flow path 3 has been heated with the heat generating member 4, film boiling has occurred on the same, and a bubble 21 has isotropically grown. The terms "a bubble isotropically grows" herein used mean that in spots of the bubble surface, the growing speed in the direction perpendicular to the surface is almost the same.

During the process of the isotropical growth of the bubble 21 at the beginning of the bubble formation, the movable member 8 and the peripheral portion of the liquid supply port 5 closely touch with each other to block up the liquid supply port 5, and the liquid flow path 3 is brought to the substantially sealed state except at the discharge port 7. The duration that the sealed state is kept may be within a period from the application of driving voltage to the heat generating member 4 to the completion of the isotropical growth of the bubble 21. In this sealed state, the inertance (the degree to which still liquid is hard to move when it rapidly starts to move) from the center of the heat generating member 4 toward the liquid supply port side is substantially infinite in the liquid flow path 3. And the larger the spacing between the heat generating member 4 and the movable member 8 becomes, the closer the inertance from the heat generating member 4 toward the liquid supply port side gets to infinity. Here the maximum displacement of the free end of the movable member 8 toward the liquid supply port 5 side is denoted with h1.

Figure 81A:
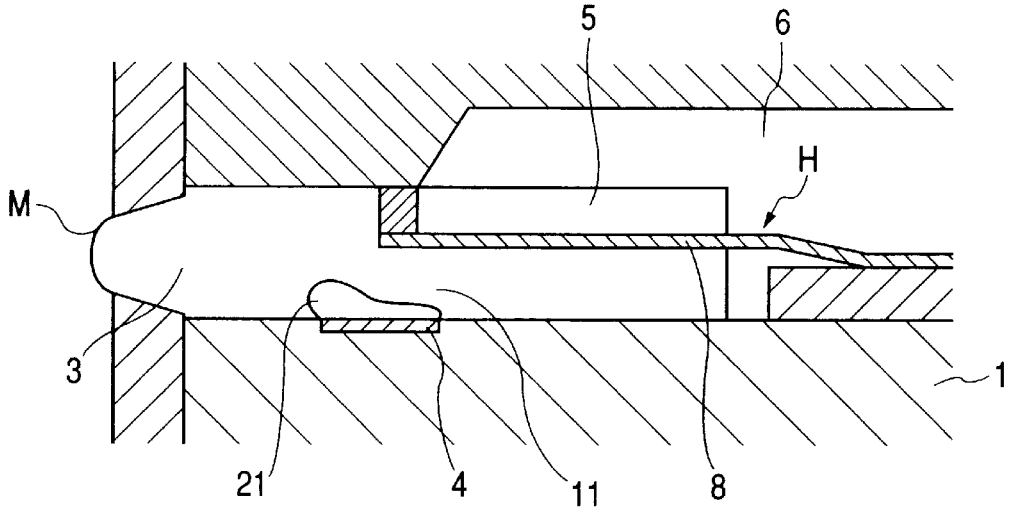
FIGS. 81A and 81B are illustrations of the discharge operation subsequent to that of FIGS. 80A and 80B, expressed in terms of sectional views taken along the direction of one liquid flow path of a liquid discharge head.

In FIG. 81A, a state is shown in which the bubble 21 continues to grow. In this state, since the liquid flow path 3 is in the substantially sealed state except at the discharge port 7, as described above, the liquid hardly flows toward the liquid supply port 5 side. Thus, the bubble can expand further toward the discharge port 7 side, but does not expand toward the liquid supply port 5 side very much. And the bubble continues to grow on the discharge port 7 side of the bubble generating area 11, on the other hand, it stops growing on the liquid supply port 5 side of the same. This bubble-growth stopping state means the maximum bubbling state on the liquid supply port 5 side of the bubble generating area 11. The volume of the bubble at this point is denoted with Vr.

In this embodiment, since the communication portion H is formed near the fulcrum 8A of the movable member 8, there is some fear that the sealing of the liquid flow path 3 and the common liquid supply chamber 6 is lowered when the movable member 8 and the periphery portion of the liquid supply port 5 closely touch with each other, and the liquid moves from the liquid flow path 3, through the communication portion H, to the common liquid supply chamber 6, thereby discharge efficiency is decreased. However, if the size of the communication portion H is set in such a manner as to allow the flow resistance at the communication portion H to be sufficiently larger than that of the discharge port 7, the liquid movement from the liquid flow path 3 to the liquid supply port 5 can be restricted to a degree that it can be neglected; thus, the discharge efficiency is not decreased. Further, in the configuration of the liquid discharge head in accordance with this embodiment, while the discharge port 7 and the heat generating member 4 are in a linearly communicating state, the communication portion H and the common liquid supply chamber 6 are not in a linearly communicating state in the bubble's growing direction. Accordingly, the bubbling pressure wave of the bubble formed on the heat generating member 4 is propagated stably to the discharge port 7 side, but hardly propagated through the communication portion H to the common liquid supply chamber 6 side. For the above reasons, the liquid flow from the liquid flow path 3 to the common liquid supply chamber 6 hardly occurs, and the discharge efficiency is not decreased.

Now the bubble growing process in this embodiment, as shown in FIGS. 80A, 80B and 81A, will be described in further detail with reference to FIGS. 123A to 123E, like the bubble growing process in the first embodiment. As shown in FIG. 123A, when applying heat to the heat generating member, initial ebullition occurs on the heat generating member, then it changes to film boiling, in which the bubble covers the surface of the heat generating member, as shown in FIG. 123B. The bubble in the film boiling state continues to isotropically grow (the state in which a bubble continues to isotropically grow is referred to as semi-pillow state), as shown in FIGS. 123B and 123C. However, when the liquid flow path 3 is in the substantially sealed state except at the discharge port 7, as shown in FIG. 80B, the liquid cannot flow toward the upstream side; as a result, in the bubble in the semi-pillow state, its part on the upstream side (liquid supply port side) cannot grow very much and the rest on the downstream side (discharge port side) grows lot. This state is shown in FIG. 81A, and FIGS. 123D and 123E.

Hereinafter the area of the heat generating member 4 where the bubble does not grow when heat is applied thereto is referred to as area B and the area on the discharge port side 7 of the heat generating member 4 where the bubble grows is referred to as area A, for convenience's sake. In the area B shown in FIG. 123E, the volume of the bubble reaches the maximum and the volume at this point is denoted with Vr.

Figure 81B:
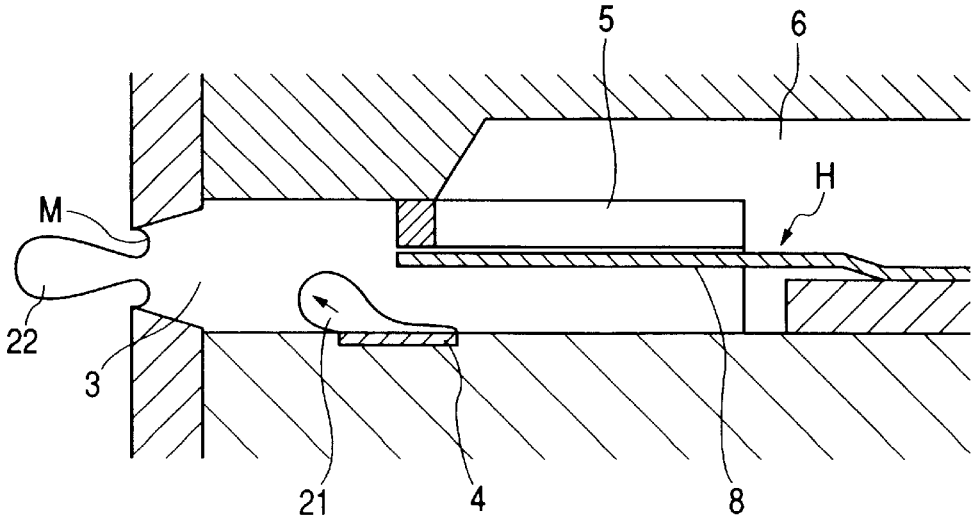

In FIG. 81B, a state is shown in which the bubble continues to grow in the area A and starts to shrink in the area B (period of partial growth and partial shrinkage (refer to FIG. 124)). In this state, in the area A the bubble continues to grow lot toward the discharge port side. On the other hand, in the area B the volume of the bubble starts to decrease. Thus, at the beginning of the period of partial growth and partial shrinkage, liquid flow from the common liquid supply chamber 6, through the communication portion H, to the portion under the movable member 8 starts to occur, while allowing the free end of the movable member 8 to block up the liquid supply port 5. Then the free end of the movable member 8 starts to be displaced downwardly to such a position that it is allowed to be in a steady state by the restoring force due to its rigidity and the disappearing force of the bubble in the area B. Once the movable member 8 has been displaced downwardly, the liquid supply port 5 is opened, and the common liquid supply chamber 6 and the liquid flow path 3 are substantially in a communicating state. As described above, since the liquid flow passing through the communication portion H has already occurred, if the inertia force of the liquid flow is utilized, the displacement of the movable member 8 can be started earlier than that of the liquid discharge head in which no communication portion H is formed near the fulcrum 8A of the movable member 8, resulting in the improvement in refilling speed.

Figure 82A:
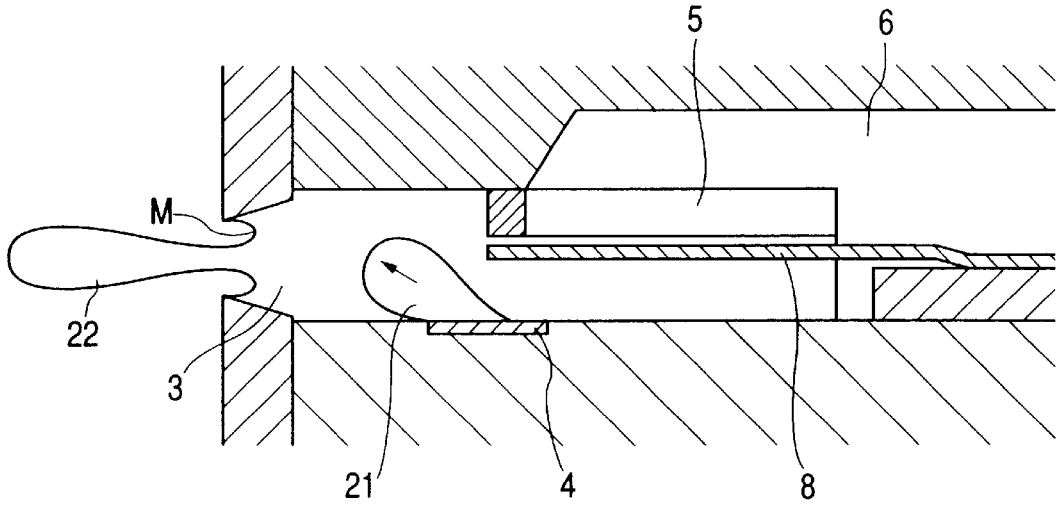
FIGS. 82A and 82B are illustrations of the discharge operation subsequent to that of FIGS. 81A and 81B, expressed in terms of sectional views taken along the direction of one liquid flow path of a liquid discharge head.

In FIG. 82A, a state is shown in which the bubble 21 has almost grown to be the maximum size. In this state, in the area A the bubble has grown to be the maximum size, and with this, the bubble almost disappears in the area B. The maximum volume of the bubble in the area A at this point is denoted with Vf. A discharge droplet 22 being discharged from the discharge port 7 is still continuous with the meniscus M with its long tail left behind.

Figure 82B:
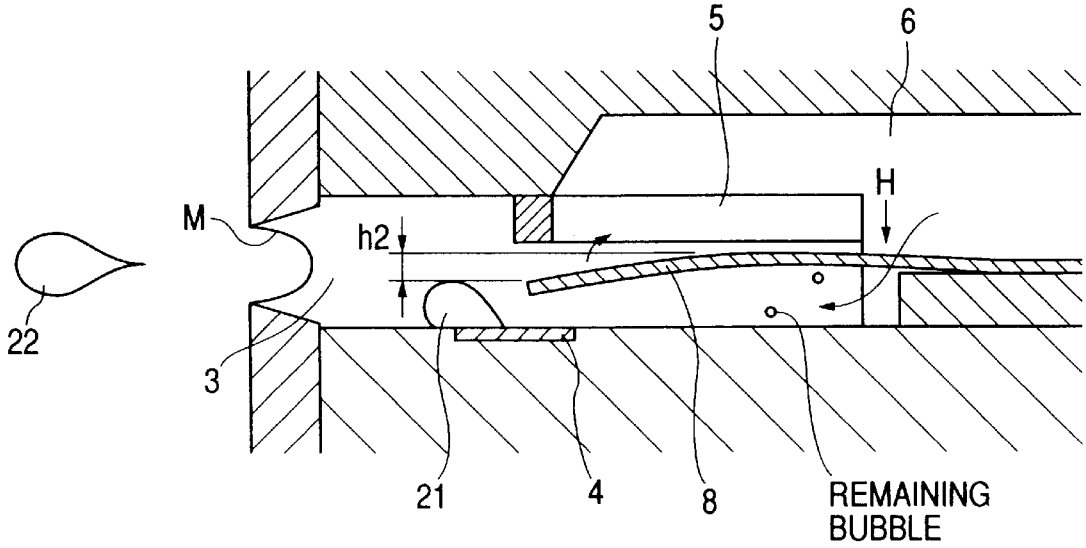
Figure 83A:
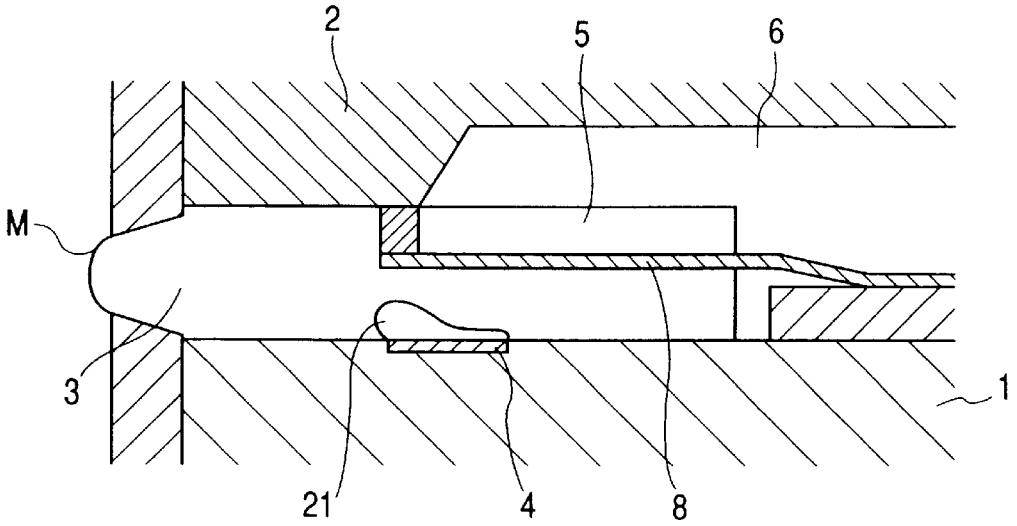
FIGS. 83A and 83B are sectional views taken along the direction of one liquid flow path of a liquid discharge head according to the sixth embodiment of the present invention, where FIG. 83A relates to a configuration of covering the whole heat generating element with the free end of a movable member and FIG. 83B relates to a configuration of separating a heat generating element from a movable member.
Figure 83B:
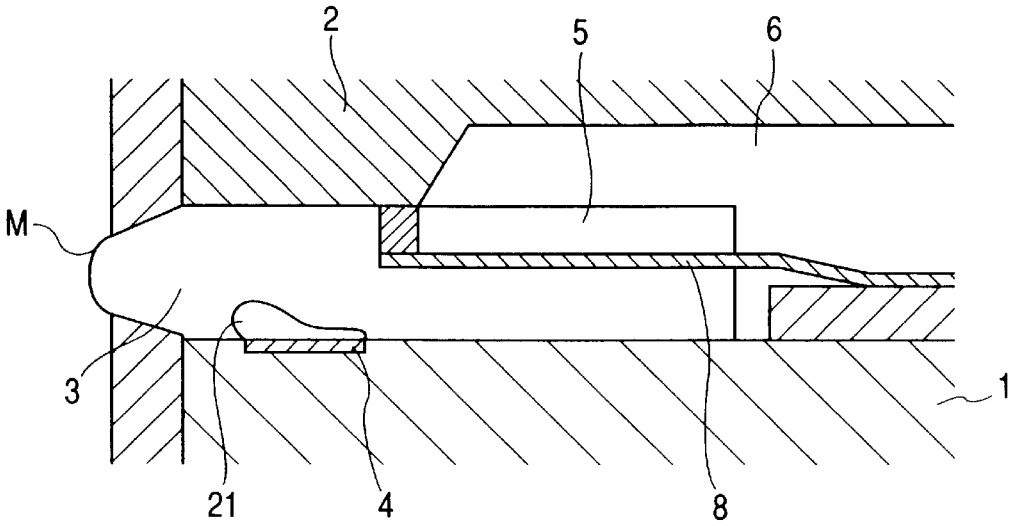

In FIG. 82B, a state is shown in which the bubble 21 is disappearing while stopping growing and the discharge droplet 22 and the meniscus M have been separated from each other. Immediately after the bubble stops growing and starts to disappear in the area A, the shrinkage energy of the bubble 21 acts as the force moving the liquid near the discharge port 7 in the upstream direction so as to keep the entire balance. Accordingly, the meniscus M at the discharge port 7 is pulled into the liquid flow path 3 at this point and the liquid column via which the continuity between the meniscus M and the discharge droplet 22 has been kept is quickly separated therefrom by the strong force. On the other hand, with the shrinkage of the bubble, a large flow of liquid rapidly flows into the liquid flow path 3 from the common liquid supply chamber 6 via the liquid supply port 5. The maximum displacement of the free end of the movable member 8 toward the bubble generating area 11 side at this point is denoted with h2. This displacement in turn causes a rapid decrease in the liquid flow which pulls the meniscus M rapidly into the liquid flow path 3, and the meniscus M starts to return to its original position before the bubble formation at s relatively low speed. Thus, the liquid discharge method using the movable member in according with the present invention is highly excellent in the vibration-converging characteristics of the meniscus M, compared with the other liquid discharge methods which do not use the movable member in according with the present invention.

Further, in accordance with this embodiment, at the beginning of the period of partial growth and partial shrinkage, the liquid flow path 3 has already started to be refilled little by little with the liquid flowing from the common liquid supply chamber 6, through the communication portion H formed near the fulcrum 8A of the movable member 8, to the liquid flow path 3; therefore, the backup of the meniscus M after the discharging droplet 22 is separated therefrom can be reduced. This provides more excellent vibration-converging characteristics of the meniscus M, resulting in improvement in refill frequency.

Further, when refilling the liquid flow path with liquid, the liquid flows in not only through the clearance made between the movable member 8 and the liquid supply port 5 by the downward displacement of the movable member 8, but also through the communication portion H; thus, refilling operation can be performed at a higher-speed.

At this point, the remaining bubble staying at the portion of the liquid flow path 3 under the movable member 8 are carried away on the flow of the liquid flowing from the common liquid supply chamber 6, through the communication portion H, to the portion under the movable member 8 and eliminated. If there stay bubble in the flow path of the liquid discharge head, in particular, in the area of the liquid flow path 3 under the movable member 8, the bubbling power produced on the heat generating member 4 is spent for compressing the remaining bubble, the liquid-droplet discharge efficiency is thereby decreased. However, in accordance with this embodiment, the remaining bubble can be eliminated at the time of liquid refilling. Accordingly, even when a lot of remaining bubble are produced due to the increase in temperature of the liquid discharge head after continuous high-speed printing, the bubble are promptly eliminated and stable liquid discharging operation is ensured.

Finally when the bubble 21 has completely disappeared, the movable member 8 returns to the position where it is allowed to be in a steady state, as shown in FIG. 80A. The movable member 8 is displaced upwardly (in the direction shown by a solid arrow in FIG. 82B) due to its own elastic force and return to the steady state. In such a state, the meniscus M has already returned to the neighborhood of the discharge port 7.

The correlation between the change in the volume of bubble with time and the behavior of the movable member in both areas A and B shown in FIGS. 80 to 82A and 82B (refer to FIG. 126) and the correlation between the bubble growth and the behavior of movable member in liquid discharge heads provided with a movable member and a heat generating member of which relative position is different from that of this embodiment (refer to FIGS. 83A and 83B, and FIGS. 125 and 126) are both similar to that of the first embodiment described above.

Further, as can be seen from FIGS. 124 to 126, in the liquid discharge head in accordance with this embodiment, like the liquid discharge head of the first embodiment, the following relation holds, $$Vf>Vr$$

where Vf is the maximum volume of the bubble growing on the discharge port 7 side of the bubble generating area 11 (bubble in the area A) and Vr is the maximum volume of the bubble growing on the liquid supply port 5 side of the bubble generating area 11 (bubble in the area B). This relation permanently holds in the liquid discharge heads of the present invention. Further, in the liquid discharge heads of the present invention, the following relation permanently holds, $$Tf>Tr$$

where Tf is the lifetime (period between formation of bubble and disappearance of the same) of the bubble growing on the discharge port 7 side of the bubble generating area 11 (bubble in the area A) and Tr is the lifetime of the bubble growing on the liquid supply port 5 side of the bubble generating area 11 (bubble in the area B). Because of the relation described above, the point of the bubble's disappearing is located on the discharge port 7 side relative to the center portion of the bubble generating area 11.

Further, in the configuration of the liquid discharge head in accordance with this embodiment, the relation holds that the maximum displacement h2 of the free end of the movable member 8 toward the bubble forming means 4 side with the disappearance of bubble is larger than the maximum displacement h1 of the free end of the movable member 8 toward the liquid supply port 5 side at the beginning of the bubble formation (h1<h2), as can be seen from FIGS. 80B and 82B. For example, h1 is 2 μm and h2 is 10 μm. Because of this relation, the bubble growth in the rear of the heat generating member (in the direction opposite to the discharge port) can be restricted and the bubble growth in the front of the heat generating member (toward the discharge port) can be further promoted. This in turn enables the promotion of efficiency in converting the bubbling power produced on the heat generating member into the kinetic energy of the liquid droplet flying from the discharge port.

As is apparent from the description of the configuration and liquid discharge operation of the liquid discharge head in accordance with this embodiment so far, in accordance with this embodiment, the growth components of a bubble in the downstream direction and in the upstream direction are not equal. And when the growth component in the upstream direction is almost null, the liquid movement in the upstream direction is restricted. Because of the restriction of the liquid flow in the upstream direction, the growth component of a bubble is not lost in the upstream direction, and almost all the growth component is allowed to be in the discharge port direction; thus the discharge power of the liquid discharge head is markedly improved. Further, the backup of the meniscus M after discharging a liquid droplet is reduced, as a result of which the projection of the meniscus from the orifice at the time of liquid refilling is also reduced. Thus, the vibration of the meniscus is restricted, enabling a stable discharge operation at every driving frequency, including both low frequency and high frequency.

[First Variation]

Figure 84:
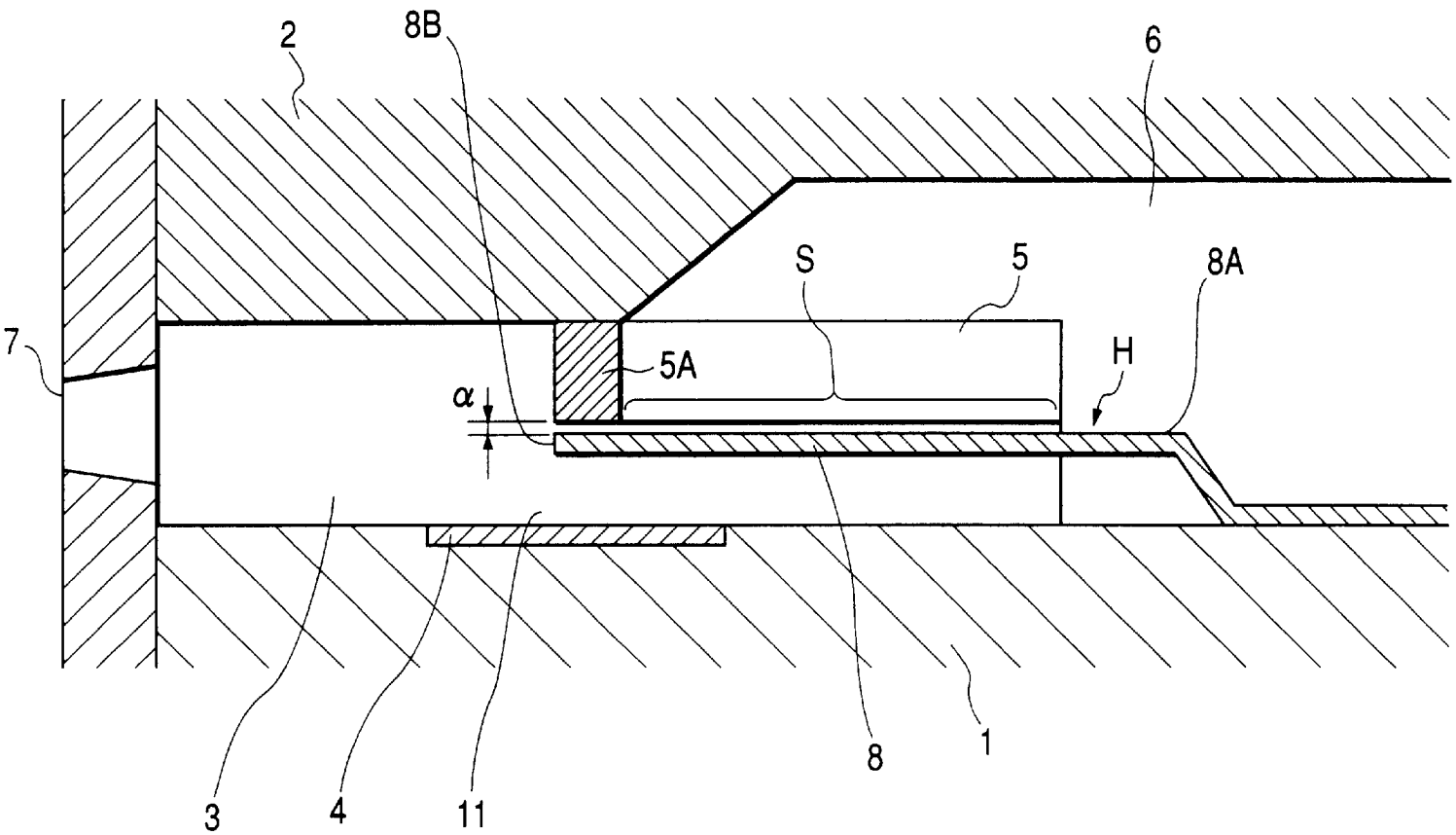
FIG. 84 is a sectional view taken along the direction of one liquid flow path of a liquid discharge head according to the first variation of the sixth embodiment of the present invention.

FIG. 84 is a view in section along one of the liquid flow paths of the liquid discharge head in accordance with a first variation of this embodiment.

The liquid discharge head in accordance with the first variation is different from the liquid discharge head shown in FIG. 75 in that the movable member 8 is provided directly on the element substrate 1, not via the fixed member. The other configuration of the liquid discharge head in accordance with this variation is the same as that of FIG. 75. The liquid discharge head in accordance with this variation has the advantage over that of FIG. 75 that its manufacturing process can be simplified because it requires no fixed member to be formed on its element substrate 1.

Just like the liquid discharge head of FIG. 75, the liquid discharge head of this variation allows the timing for the movable member 8 to start displacement to be earlier, thereby the refilling speed can be improved, in addition, it allows the backup of the meniscus M after discharging a liquid droplet to be smaller, thereby the vibration-converging characteristics of the meniscus M become more excellent, resulting in improvement in the refill frequency.

Further, when refilling the liquid flow path with liquid, the liquid flows in not only through the clearance made between the movable member 8 and the liquid supply port 5 by the downward displacement of the movable member 8, but also through the communication portion H; thus, refilling operation can be performed at a higher-speed.

At this point, the remaining bubble staying at the portion of the liquid flow path 3 under the movable member 8 are carried away on the flow of the liquid flowing from the common liquid supply chamber 6, through the communication portion H, to the portion under the movable member 8 and eliminated. Accordingly, even when a lot of remaining bubbles are produced due to the increase in temperature of the liquid discharge head after continuous high-speed printing, since the bubbles are promptly eliminated, the absorption of bubbling power by the remaining bubble can be prevented, and stable liquid discharging operation is ensured.

[Second Variation]

Figure 85:
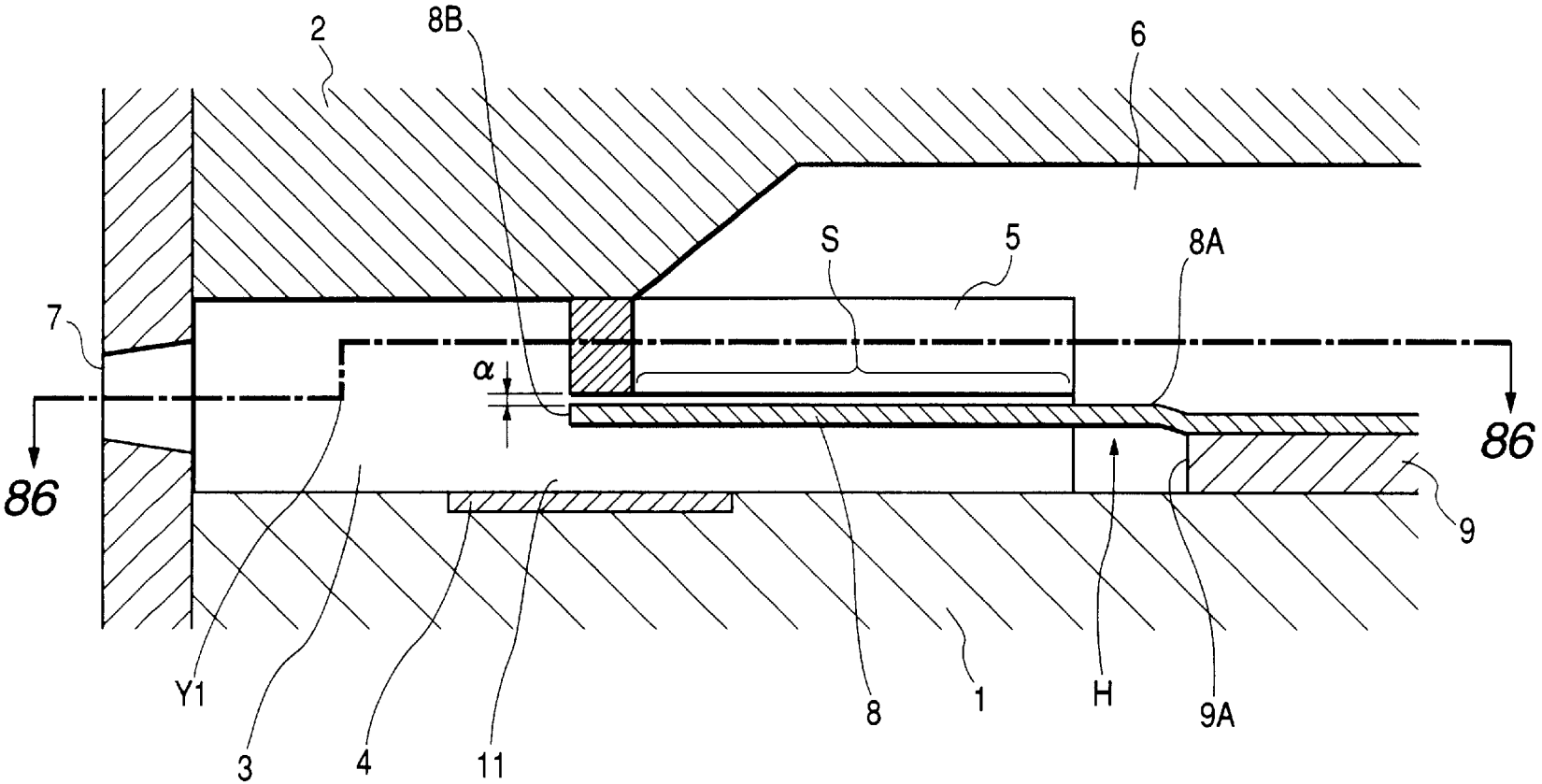
FIG. 85 is a sectional view taken along the direction of one liquid flow path of a liquid discharge head according to the second variation of the sixth embodiment of the present invention.
Figure 86:
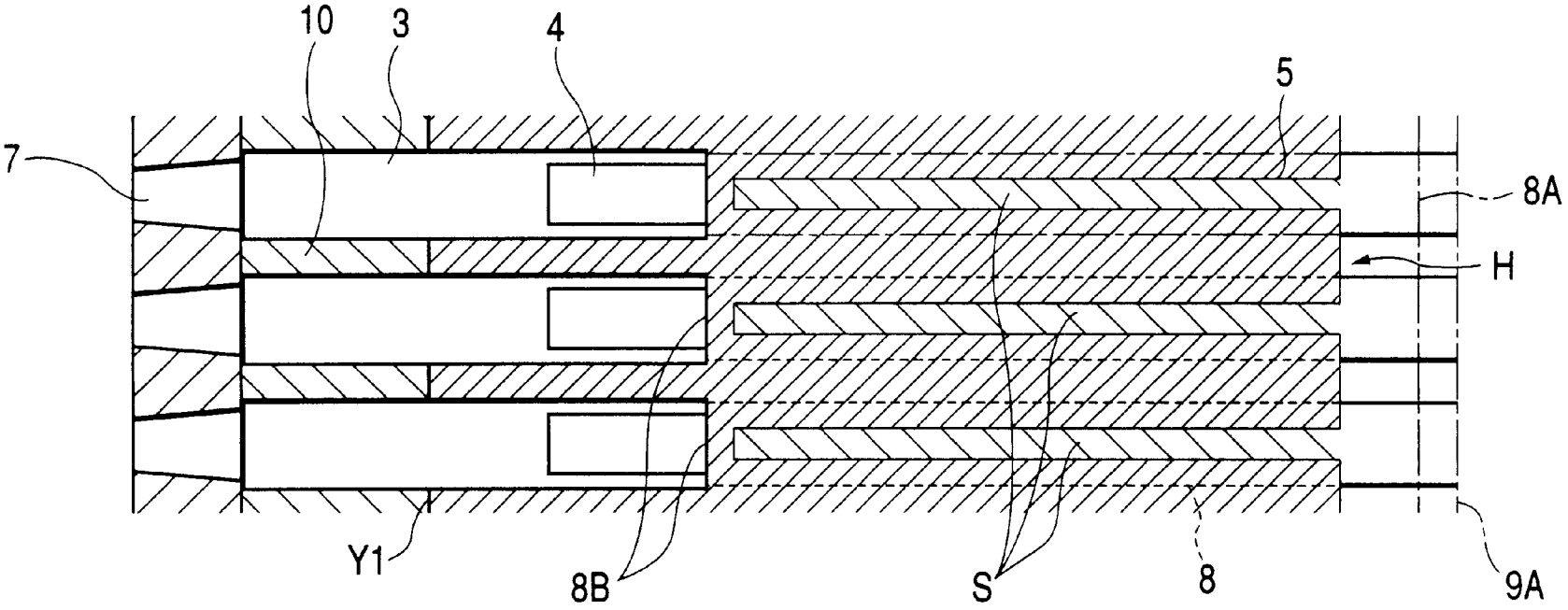
FIG. 86 is a sectional view taken on line 86—86 of FIG. 85.
Figure 87D:
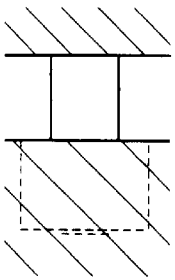
FIG. 87D is a sectional view taken on line 87C—87C of FIG. 87A.
Figure 87C:
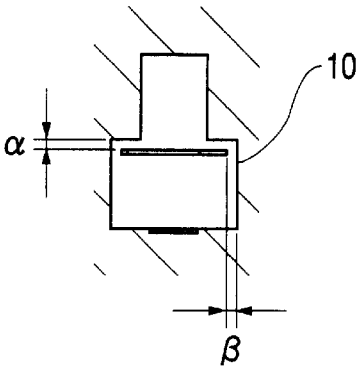
FIG. 87C is a sectional view taken on line 87B—87B of FIG. 87A.
Figure 87A:
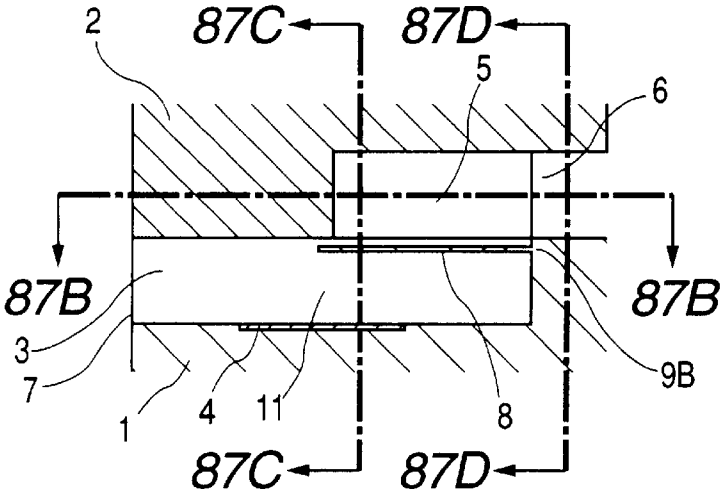
FIG. 87A is a view of a liquid discharge head according to the third variation of the sixth embodiment of the present invention.
Figure 87B:
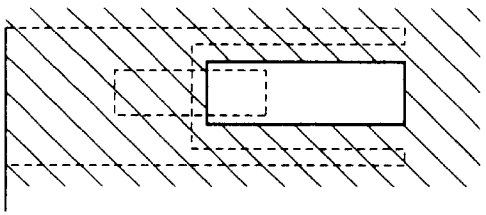
FIG. 87B is a sectional view taken on line 87B—87B of FIG. 87A.
Figure 88:
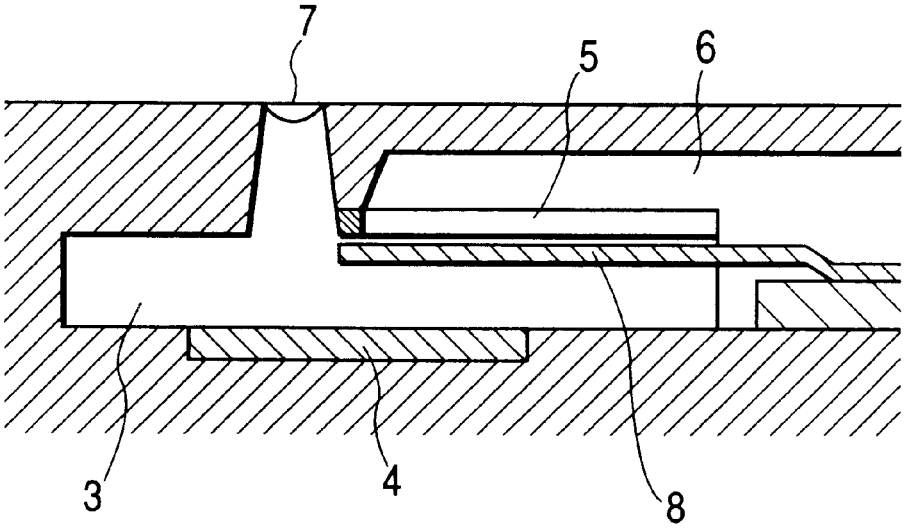
FIG. 88 is an illustration of an example of side-shooter type liquid discharge head corresponding to the configuration of a liquid discharge head according to the sixth embodiment of the present invention.
Figure 89A:
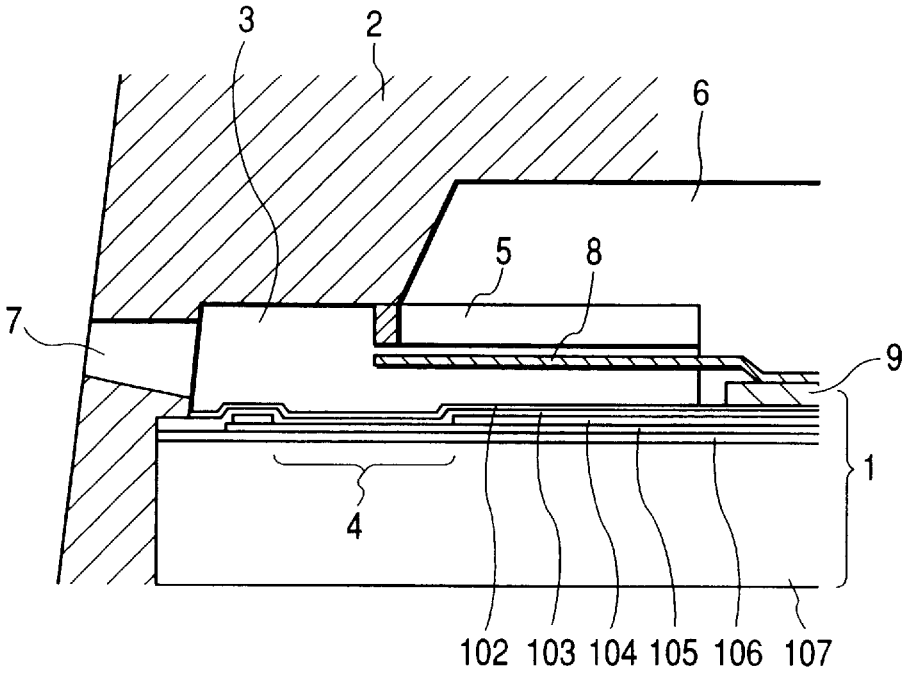
FIG. 89A is a vertically sectional view of a liquid discharge head according to the present invention with a protective film.
Figure 89B:
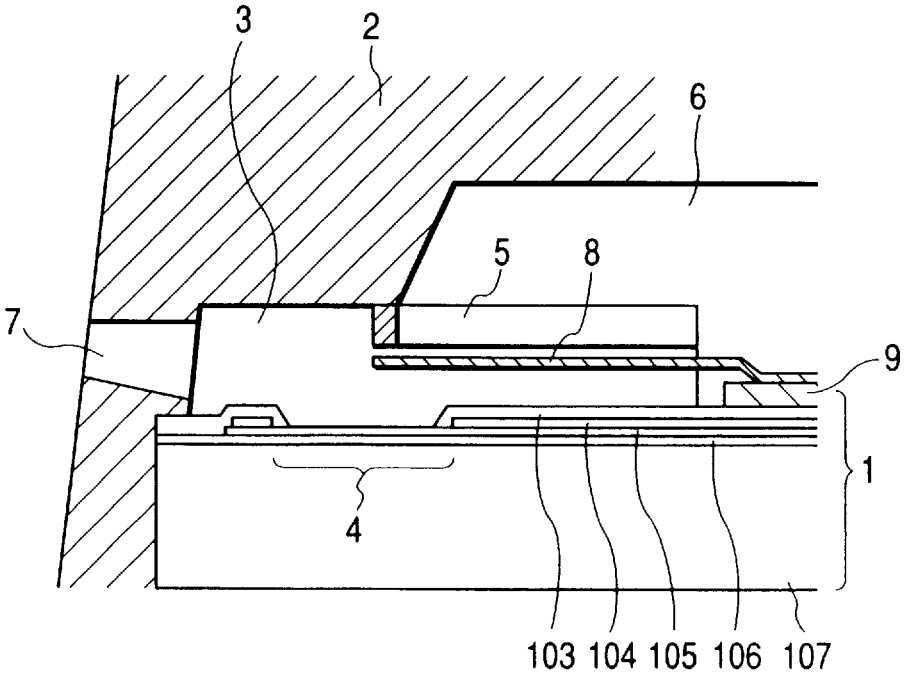
FIG. 89B is a vertically sectional view of a liquid discharge head according to the present invention without a protective film.

In the structure of the liquid discharge head in accordance with this embodiment, the very end of the movable member 8–fixed member 9 junction (that is, the point at which the movable member 8 is bent and raised) does not correspond to the end portion 9A of the fixed member 9, as shown in FIGS. 75 and 77. However, as one of the second variations of this embodiment, the point at which the movable member 8 is bent and raised may correspond to the end portion 9A of a fixed member 9, as shown in FIGS. 85 and 86. In this variation, a larger opening area of the communication portion H can be ensured compared with the embodiment shown in FIGS. 75 and 77.

[Third Variation]

In the following, the liquid discharge head in accordance with a third variation of this embodiment will be described with reference to FIGS. 87A–87D.

In the liquid discharge head in accordance with the third variation of this embodiment shown in FIGS. 87A–87D, the element substrate 1 and the top board 2 are joined to each other, and between the two boards the liquid flow path 3 is formed with its one end in communication with the discharge port 7 and the other closed.

The liquid supply port 5 is disposed on the liquid flow path 3 and the common liquid supply chamber 6 is provided which is in communication with the liquid supply port 5.

Between the liquid supply port 5 and the flow path 3, the movable member 8 is provided almost parallel to the opening area S of the liquid supply port 5 while allowing an infinitesimal clearance α (for example, 10 μm or less) between them. The area of the movable member 8 surrounded by at least its free end portion as well as either side portion, which is the continuation of the free end portion, is larger than the opening area S of the liquid supply port 5, which is facing the liquid flow path, and an infinitesimal clearance β is allowed between each of the side portions of the movable member 8 and each of the flow path sidewalls 10 sandwiching the movable member. Thus, the movable members 8 can move in the liquid flow path 3 without frictional resistance thereto, and at the same time, the displacement of the movable members 8 toward the opening area S side can be regulated near the same area. This in turn enables preventing liquid flow from the liquid flow path 3 to the common liquid supply chamber 6, because the liquid supply port 5 is substantially blocked up with the movable member. In this variation, the movable member 8 is positioned in such a manner as to face the element substrate 1. And one end of the movable member 8 is a free end which is displaced toward the heat generating member 4 side of the element substrate 1 and the other end is supported with a supporting portion 9B.

Seventh Embodiment

Figure 90:
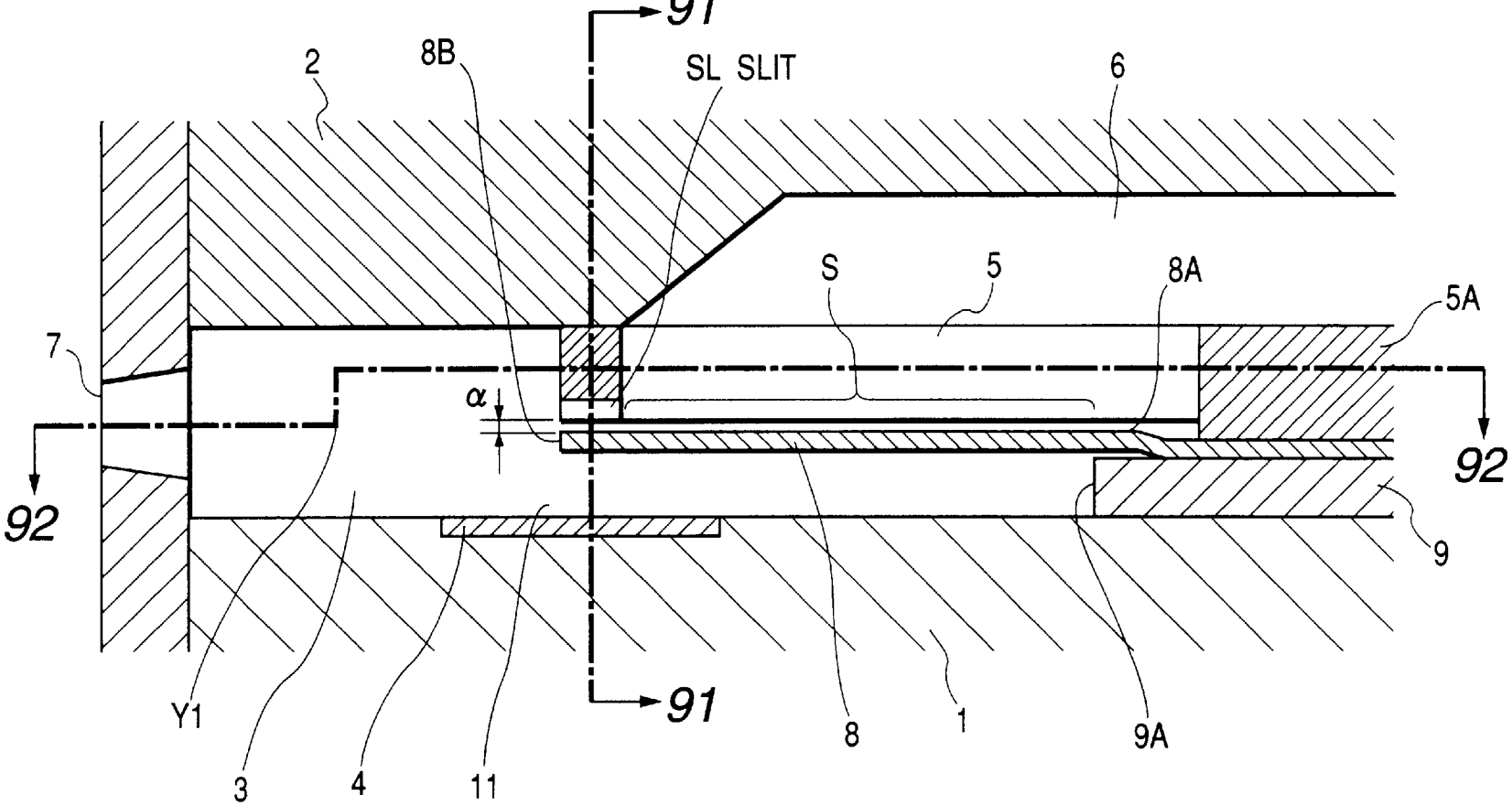
FIG. 90 is a sectional view taken along the direction of one liquid flow path of a liquid discharge head according to the seventh embodiment of the present invention.
Figure 91:
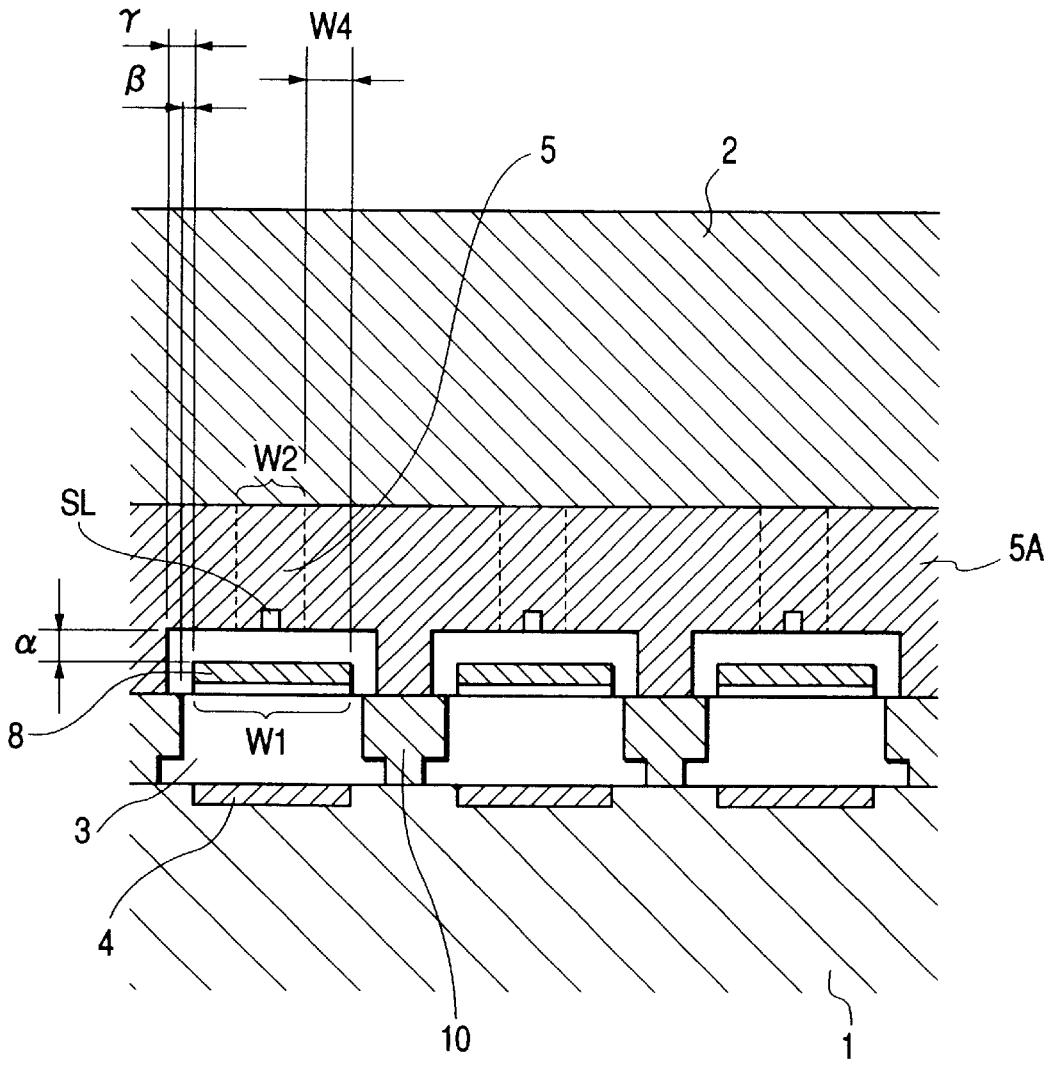
FIG. 91 is a sectional view taken on line 91—91 of FIG. 90.
Figure 92:
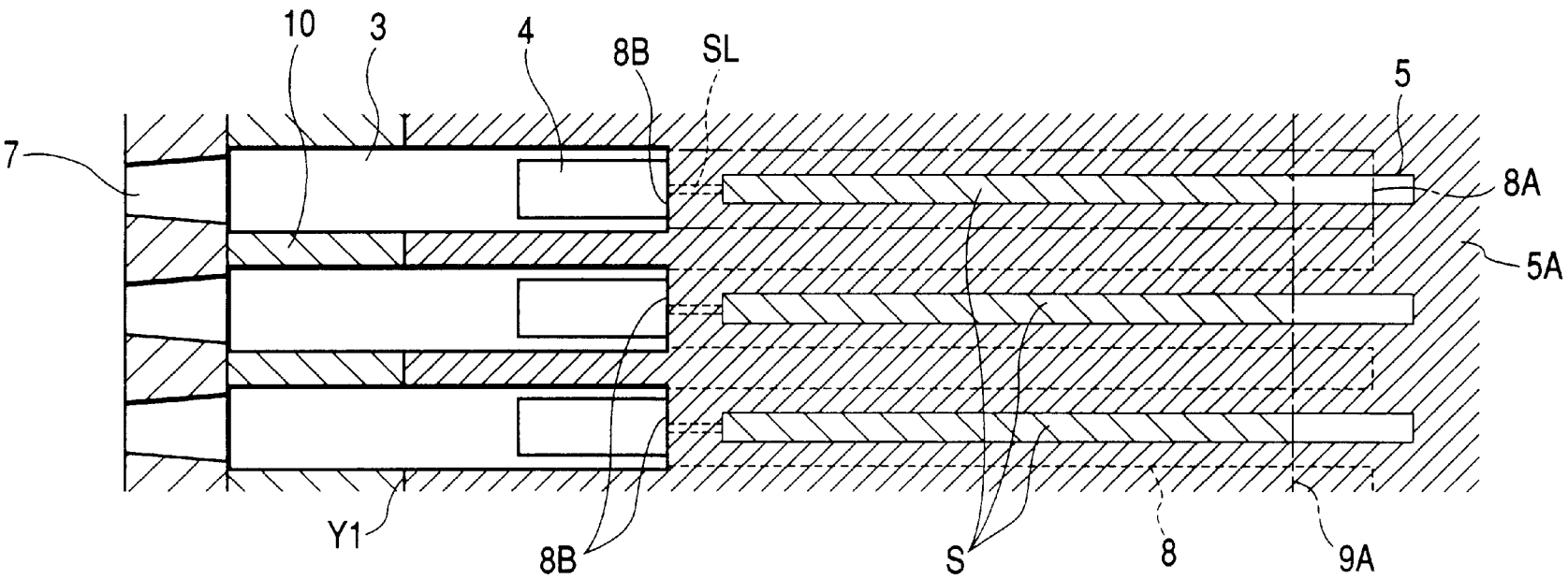
FIG. 92 is a sectional view taken on line 92—92 of FIG. 90.

FIG. 90 is a view in section along one of the liquid flow paths showing the liquid discharge head in accordance with the seventh embodiment of the present invention, FIG. 91 is a cross-sectional view of the liquid discharge head of FIG. 90 taken along the line 91—91, and FIG. 92 is a cross-sectional view of the liquid discharge head of FIG. 90 taken along the line 92—92, which is shifted from the center line of the discharge port toward the top board 2 at a point Y1.

In the liquid discharge head in the form of multiple liquid paths-common liquid chamber shown in FIGS. 90 to 92, an element substrate 1 and a top board 2 are fixed on each other via liquid path sidewalls 10 in the stacked state, and between the two boards 1, 2 formed are liquid flow paths 3 of which one end is in communication with the discharge port 7. Each liquid discharge head is provided with multiple liquid flow paths 3. On the element substrate 1, heat generating members 4, such as electrothermal converting element, as bubble forming means for bubbling the liquid refilled in the liquid flow paths 3 are disposed for respective liquid flow paths 3. And near the contact surface of each heat generating member 4 with the discharging liquid, there exists a bubble generating area 11 where the discharging liquid is bubbled by rapidly heating the heat generating member 4.

A liquid supply port 5 having been formed on a supply portion forming member 5A is disposed in each of the multiple liquid flow paths 3 and a common liquid supply chamber 6 is provided in the same which is in communication with each liquid supply port 5. In other words, the liquid supply ports 5 are configured in such a manner as to branch from a single common liquid supply chamber 6 into multiple liquid flow paths 3, and they receive liquid from the common liquid supply chamber 6 in the amount which offsets the amount of liquid having been discharged from the discharge ports 7, which are in communication with respective liquid flow paths 3.

Between each liquid supply port 5 and liquid flow path 3, a movable member 8 is provided almost parallel to an opening area S of the liquid supply port 5 while allowing an infinitesimal clearance $\alpha$ (for example, 10 $\mu$m or less) between them. The area of the movable member 8 surrounded by at least its free end portion as well as either side portion, which is the continuation of the free end portion, is larger than the opening area S of the liquid supply port 5 (refer to FIG. 92), and an infinitesimal clearance $\beta$ is allowed between each of the side portions of the movable member and each of the flow path sidewalls 10 sandwiching the movable member (refer to FIG. 91). The above-described supply portion forming member 5A is disposed $\gamma$ apart from the movable member 8 as shown in FIG. 91. The clearances $\beta$, $\gamma$ vary depending on the pitch of the liquid path; however, if the clearance $\gamma$ is large, the movable member 8 is likely to block up the opening area S, on the other hand, if the clearance $\beta$ is large, with the disappearance of bubble, the movable member 8 is likely to move downward from the position $\alpha$ apart from the opening area S, where it is in a steady state, toward the element substrate 1 side. In this embodiment, the clearances $\alpha$, $\beta$ and $\gamma$ are set at values of 3 $\mu$m, 3 $\mu$m and 4 $\mu$m, respectively. Each movable member 8 is W1 wide laterally between the two adjacent flow path sidewalls 10, the width W1 being larger than the width W2 of the above opening area S and sufficient to fully seal the same. A supporting end 8A of each movable member 8 specifies the upstream end of the opening area S of each liquid supply port 5 on the extension, on the free end side, of the continuous portion of the multiple movable members perpendicular to the multiple liquid paths (refer to FIG. 92). In this embodiment, for the portions of the supply portion forming member 5A which lie along the movable members 8, their thickness is set at a smaller value than that of the flow path sidewalls 10 themselves and the supply portion forming member 5A is superposed on the flow path sidewalls 10, as shown in FIGS. 91 and 92. For the portions of the supply portion forming member 5A which lie on the discharge port 7 side relative to the free ends 8B of the movable members, their thickness is set at the same value as that of the flow path sidewalls 10 themselves, as shown FIG. 92. Setting the thickness of the supply portion forming member 5A as described above allows the movable members 8 to move in respective liquid flow paths 3 without frictional resistance thereto, and at the same time, it enables regulating the displacement of the movable members 8 toward the opening area S side near the same area. This in turn enables preventing liquid flow from the inside of each liquid flow path 3 to the common liquid supply chamber 6, because the opening area S is substantially blocked up, while allowing each movable member 8 to move toward the liquid flow path side with the disappearance of bubble, that is, allowing the state of each liquid flow path to shift from a substantially sealed state to a refillable state. Further, in this embodiment, each movable member 8 is positioned parallel to the element substrate 1. And the end portion 8B of each movable member 8 is a free end positioned on the heat generating member 4 side of the element substrate 1 and the end opposite to the end 8B is supported with a fixed member 9. This fixed member 9 serves to close the end on the side opposite to the discharge port 7 of each liquid flow path 3.

In this embodiment, an SL slit is formed on the side surface on the discharge port 7 side of the supply portion forming member 5A which forms the liquid supply port 5. This slit forms an infinitesimal clearance which allows the liquid supply port 5 and the liquid flow path 3 to be in communication with each other even when the free end 8B of the movable member 8 is in contact with the edge of the supply portion forming member 5A.

The opening area S is a substantial area for supplying liquid from the liquid supply port 5 toward the liquid flow path 3 , and in this embodiment it is the area surrounded by three sides of the liquid supply port 5 and the end portion 9A of the fixed member 9, as shown in FIGS. 90 and 92.

Figure 93:
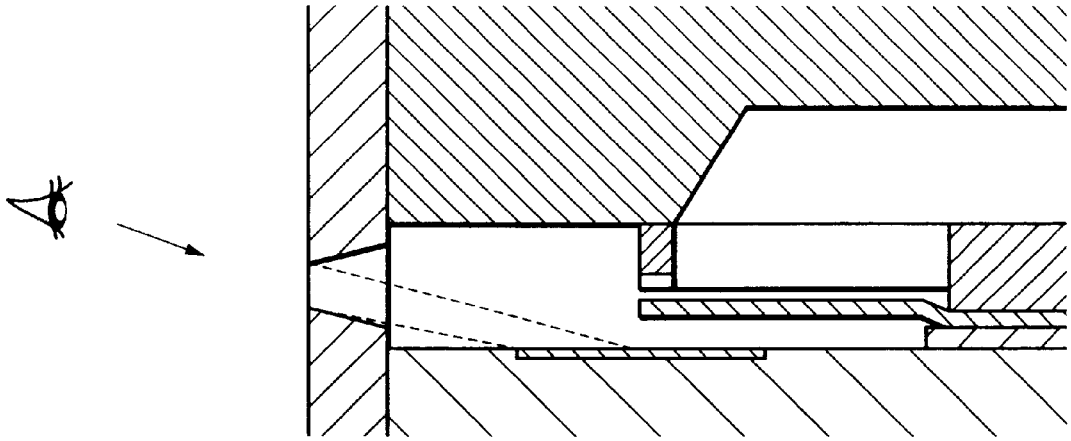
FIG. 93 is a sectional view of a flow path for explaining the "linear communication state"

And as shown in FIG. 93, in this embodiment, there exist no obstacles such as valves between the heat generating member 4, as an electrothermal converting element, and the discharge port 7, and the liquid flow path 3 is "in the linearly communicating state" in which its structure allows liquid to flow linearly. More preferably, an ideal state, in which the discharge conditions such as liquid droplets discharging direction and velocity are stabilized at an extremely high level, is created by all owing the direction of propagating pressure waves produced when bubbling and the direction of the associated liquid flow and liquid discharge to linearly correspond to each other. In the present invention, in order to achieve the ideal state or the almost ideal state, the liquid flow path is defined by the construction in which the discharge portion 7 and the heat generating member 4, in particular, the heat generating member 4 on the discharge port side (downstream side) which affects bubbling on the discharge port side are in a straight line, the construction being such that it enables the observation of the heat generating member, in particular, the heat generating member on the downstream side from the outside of the discharge port when there is no liquid in the flow path (refer to FIG. 93).

Now the discharging operation of the liquid discharge head in accordance with this embodiment will be described in detail. FIGS. 94A and 94B to 96A and 96B are views in section along the liquid flow path of the liquid discharge head having a structure shown in FIGS. 90 to 92 illustrating the discharge operation of the liquid discharge head and showing the characteristic phenomena associated with the operation by dividing the operation into 6 steps shown in FIGS. 94A and 94B to 96A and 96B. In FIGS. 94A and 94B to 96A and 96B, reference letter M denotes a meniscus formed by the discharge liquid.

Figure 94A:
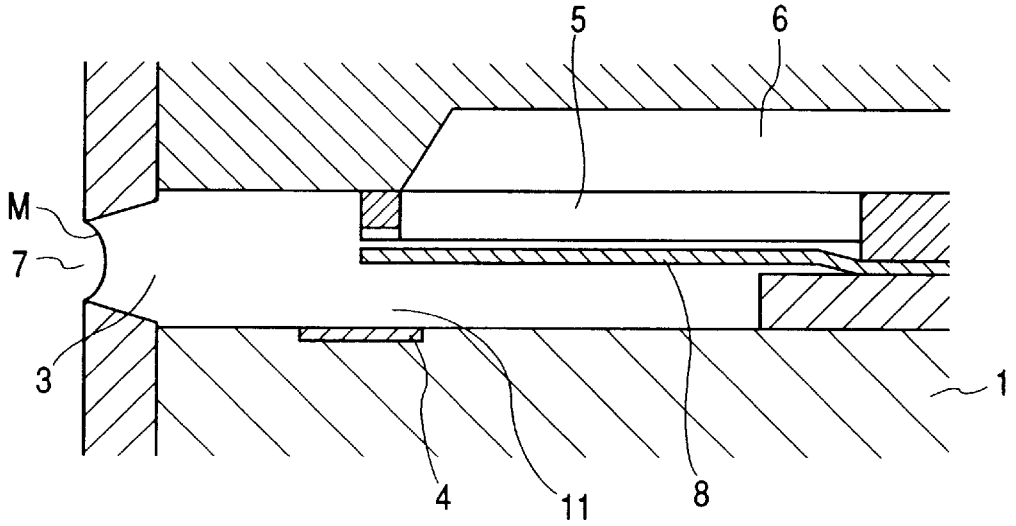
FIGS. 94A and 94B are illustrations of the discharge operation of the liquid discharge head of the structure shown in FIGS. 90 to 92, expressed in terms of sectional views taken along the direction of one liquid flow path and divided into characteristic phenomena.

In FIG. 94A, a state is shown in which energy such as electrical energy has not been applied to the heat generating member 4 yet and the heat generating member has not generated heat yet. In this state, there exists an infinitesimal clearance (10 μm or less) between the movable member 8, which is provided between the liquid supply port 5 and the liquid flow path 3, and the surface forming the liquid supply port 5.

Figure 94B:
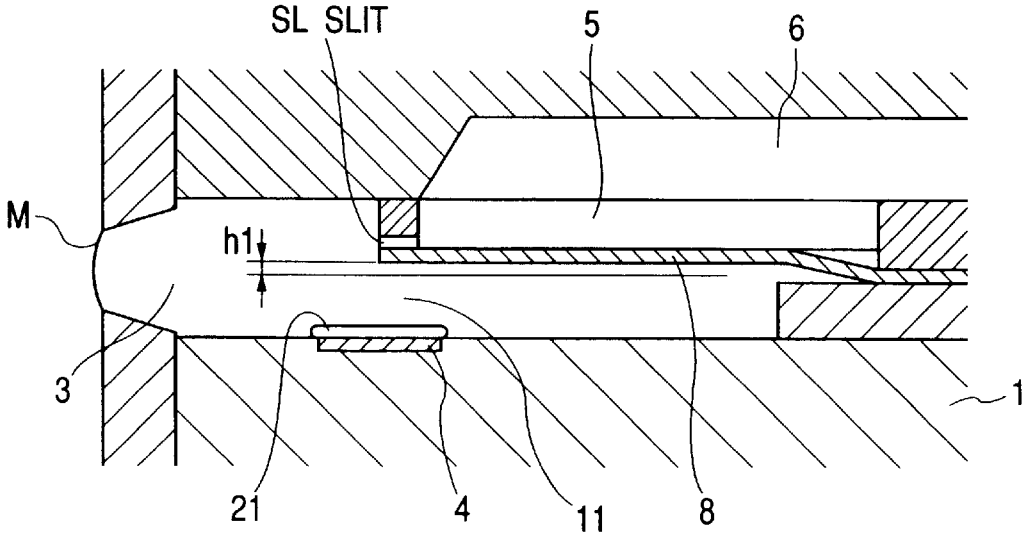

In FIG. 94B, a state is shown in which part of the liquid filling the liquid flow path 3 has been heated with the heat generating member 4, film boiling has occurred on the same, and a bubble 21 has isotropically grown. The terms "a bubble isotropically grows" herein used mean that in spots of the bubble surface, the bubble growing speed in the direction perpendicular to the surface is almost the same.

During the process of the isotropical growth of the bubble 21 at the beginning of the bubble formation, the movable member 8 and the peripheral portion of the liquid supply port 5 closely touch with each other to block up the liquid supply port 5, and the liquid flow path 3 is brought to the substantially sealed state except at the discharge port 7. The duration that the sealed state is kept may be within a period from the application of driving voltage to the heat generating member 4 to the completion of the isotropical growth of the bubble 21. In this sealed state, the inertance (the degree to which still liquid is hard to move when it rapidly starts to move) from the center of the heat generating member 4 toward the liquid supply port side is substantially infinite in the liquid flow path 3. And the larger the spacing between the heat generating member 4 and the movable member 8 becomes, the closer the inertance from the heat generating member 4 toward the liquid supply port side gets to infinity. Here the maximum displacement of the free end of the movable member 8 toward the liquid supply port 5 side is denoted with h1.

Figure 95A:
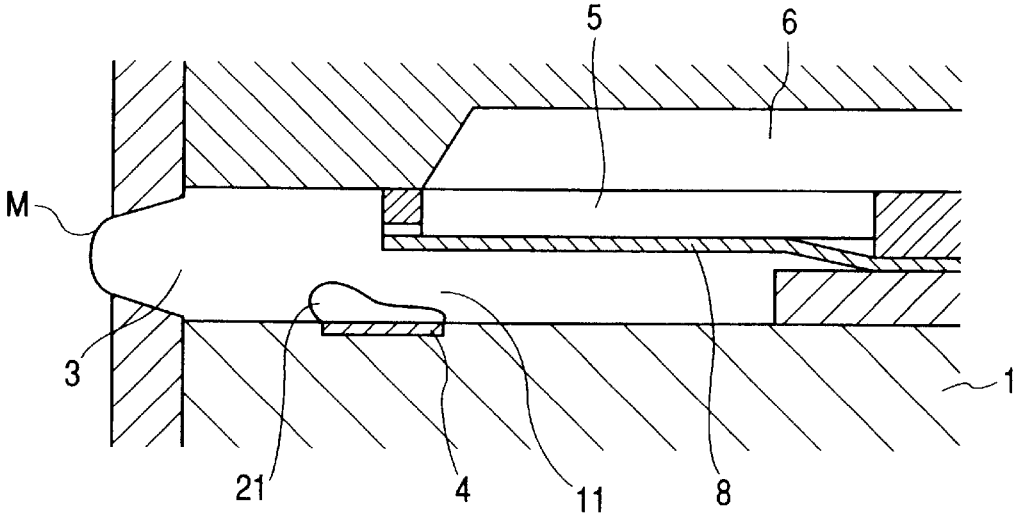
FIGS. 95A and 95B are illustrations of the discharge operation subsequent to that of FIGS. 94A and 94B, expressed in terms of sectional views taken along the direction of one liquid flow path of a liquid discharge head.

In FIG. 95A, a state is shown in which the bubble 21 continues to grow. In this state, since the liquid flow path 3 is in the substantially sealed state except at the discharge port 7, as described above, the liquid hardly flow toward the liquid supply port 5 side. Thus, the bubble can expand further toward the discharge port 7 side, but does not expand toward the liquid supply port 5 side very much. And the bubble continues to grow on the discharge port 7 side of the bubble generating area 11, on the other hand, it stops growing on the liquid supply port 5 side of the same. This bubble-growth stopping state means the maximum bubbling state on the liquid supply port 5 side of the bubble generating area 11. The volume of the bubble at this point is denoted with Vr.

In this embodiment, since the slit is formed on the side surface on the discharge port 7 side of the supply portion forming member 5A, there is some fear that, when the movable member 8 and the liquid supply port 5 closely touch with each other and the liquid flow path 3 is almost in a closed state, the sealing of the liquid flow path 3 is lowered and the liquid moves from the liquid flow path 3 to the liquid supply port 5 while the bubble is growing, and discharge efficiency is decreased. However, if the size (width and length) of the slit is set in such a manner as to allow the flow resistance at the slit to be sufficiently larger than that of the discharge port 7, the liquid movement from the liquid flow path 3 to the liquid supply port 5 can be restricted to a degree that it can be neglected; thus, the discharge efficiency is not decreased. Further, in the configuration of the liquid discharge head in accordance with this embodiment, while the discharge port 7 and the heat generating member 4 are in a linearly communicating state, the slit and the liquid supply port 5 are not in a linearly communicating state in the bubble's growing direction. Accordingly, the bubbling pressure wave of the bubble formed on the heat generating member 4 is propagated stably to the discharge port 7 side, but hardly propagated through the slit to the liquid supply port 5 side. For the above reasons, the liquid flow from the liquid flow path 3 to the liquid supply port 5 hardly occurs, and the discharge efficiency is not decreased.

Now the bubble growing process in this embodiment, as shown in FIGS. 94A, 94B and 95A, will be described in detail with reference to FIGS. 123A to 123E, like the bubble growing process in the first embodiment. As shown in FIG. 123A, when applying heat to the heat generating member, initial ebullition occurs on the heat generating member, then it changes to film boiling, in which the bubble covers the surface of the heat generating member, as shown in FIG. 123B. The bubble in the film boiling state continues to isotropically grow (the state in which a bubble continues to isotropically grow is referred to as semi-pillow state), as shown in FIGS. 123B and 123C. However, when the liquid flow path 3 is in the substantially sealed state except at the discharge port 7, as shown in FIG. 94B, the liquid cannot flow toward the upstream side; as a result, in the bubble in the semi-pillow state, its part on the upstream side (liquid supply port side) cannot grow very much and the rest on the downstream side (discharge port side) grows lot. This state is shown in FIG. 95A, and FIGS. 123D and 123E.

Hereinafter the area of the heat generating member 4 where the bubble does not grow when heat is applied thereto is referred to as area B and the area on the discharge port side 7 of the heat generating member 4 where the bubble grows is referred to as area A, for convenience's sake. In the area B shown in FIG. 123E, the volume of the bubble reaches the maximum and the volume at this point is denoted with Vr.

Figure 95B:
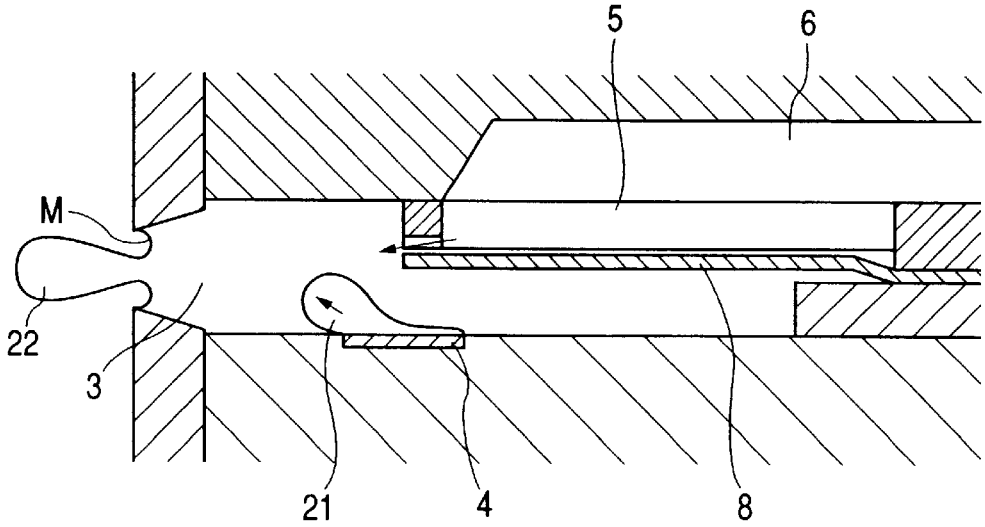

In FIG. 95B, a state is shown in which the bubble continues to grow in the area A and starts to shrink in the area B (period of partial growth and partial shrinkage (refer to FIG. 124)). In this state, in the area A the bubble continues to grow lot toward the discharge port side. On the other hand, in the area B the volume of the bubble starts to decrease. And the free end of the movable member 8 starts to be displaced downwardly to such a position that it is allowed to be in a steady state by the restoring force due to its rigidity and the disappearing force of the bubble in the area B. Thus, at the beginning of the period of partial growth and partial shrinkage, the free end of the movable member 8 is displaced downwardly a little from the liquid supply port 5, and liquid flow starts to occur first near the slit portion. As described above, the liquid discharge head of this embodiment allows the liquid flow to occur at the slit portion and utilizes the inertia force of the liquid flow; consequently, it allows the displacement of the movable member 8 to start early compared with the liquid discharge head in which no slit is formed, resulting in the improvement in refilling speed.

In the following, the liquid flow mentioned above will be described in further detail.

In state where the movable member 8 is displaced so as to allow it to be in contact with some other member (member with what is called a stopper function) (the meaning of the term "contact" herein used includes the state where the liquid intervening between the two members is immovable), and the liquid flow path is in the almost sealed state where no liquid flow occurs, the portion of the member in contact with the movable member 8 which is near the free end 8B of the same includes: a portion which is in contact with the movable member 8 and in a closed state (contact portion) and a portion which has an infinitesimal void (void portion).

In state where the movable member 8 is in contact with the member at the contact portion described above, the size of the void portion is so infinitesimal that liquid flow does not occur (for example, 2 $\mu m^2$ or less). And even if the movable member 8 is displaced and shifts to a non-contact state, in which an infinitesimal clearance is left between the movable member 8 and the member having been in contact with the same, the liquid flow does not occur because the clearance between the two members is too infinitesimal. However, the clearance between the void portion and the movable member 8 becomes larger than the clearance between the contact portion and the movable member 8, the liquid starts to flow from that portion. Once the liquid starts to flow, the displacement speed of the movable member is increased due to the inertia force of the liquid, causing further liquid flow.

In other words, when creating an almost sealed state, in which liquid flow does not occur, by displacing the movable member 8 so as to allow it to be in contact with some other member, if contact and void portions are created in the portion which the free end 8B of the movable member 8 comes in contact with, the time can be reduced which is needed to allow the liquid flow to occur by displacing the movable member 8 so as to create a non-contact state from an almost sealed state.

Figure 96A:
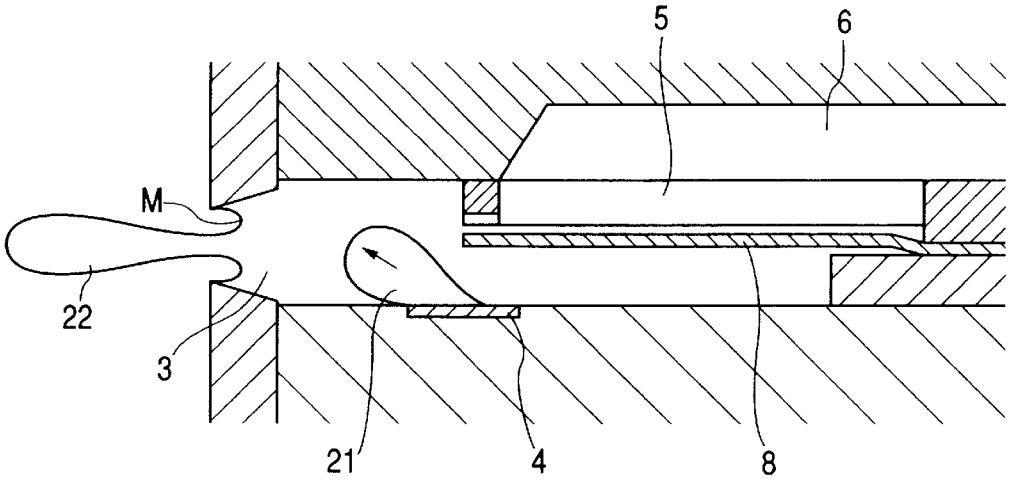
FIGS. 96A and 96B are illustrations of the discharge operation subsequent to that of FIGS. 95A and 95B, expressed in terms of sectional views of a liquid discharge head taken along the direction of one liquid flow path.

In FIG. 96A, a state is shown in which the bubble 21 has almost grown to be the maximum size. In this state, in the area A the bubble has grown to be the maximum size, and with this, the bubble almost disappears in the area B. The maximum volume of the bubble in the area A at this point is denoted with Vf. A discharge droplet 22 being discharged from the discharge port 7 is still continuous with the meniscus M with its long tail left behind.

Figure 96B:
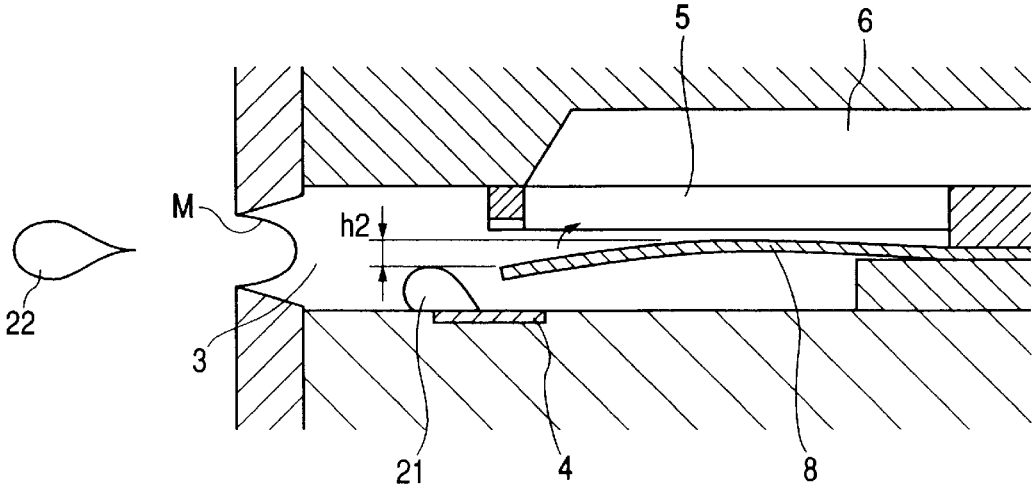
Figure 97A:
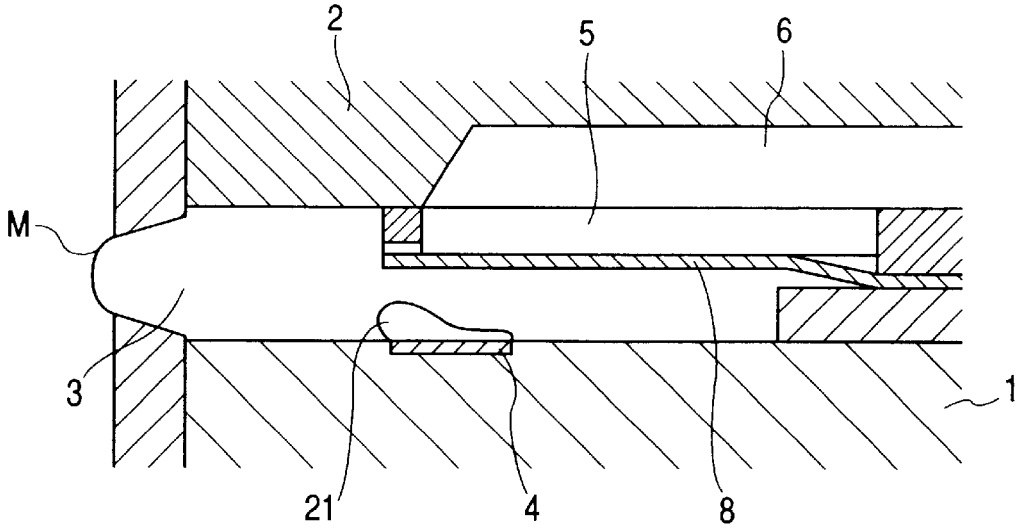
FIG. 97A is a sectional view taken along the direction of one liquid flow path of a liquid discharge head according to the seventh embodiment of the present invention, where the whole heat generating element is covered with the free end of a movable member.
Figure 97B:
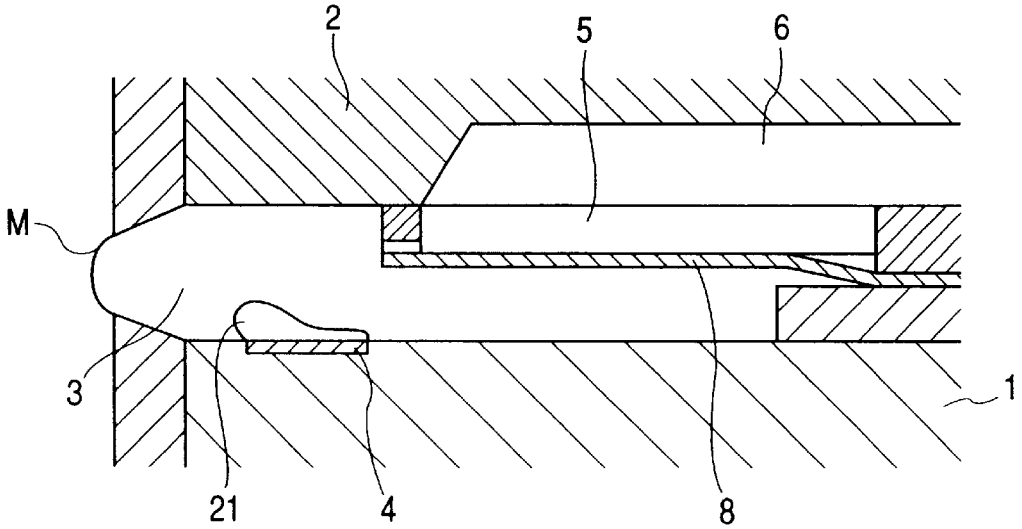
FIG. 97B is a sectional view taken along the direction of one liquid flow path of a liquid discharge head according to the seventh embodiment of the present invention, where the heat generating element is separated from a movable member.

In FIG. 96B, a state is shown in which the bubble 21 is disappearing while stopping growing and the discharge droplet 22 and the meniscus M have been separated from each other. Immediately after the bubble stops growing and starts to disappear in the area A, the shrinkage energy of the bubble 21 acts as the force moving the liquid near the discharge port 7 in the upstream direction so as to keep the entire balance. Accordingly, the meniscus M at the discharge port 7 is pulled into the liquid flow path 3 at this point and the liquid column via which the continuity between the meniscus M and the discharge droplet 22 has been kept is quickly separated therefrom by the strong force. On the other hand, with the shrinkage of the bubble, a large flow of liquid rapidly flows into the liquid flow path 3 from the common liquid supply chamber 6 via the liquid supply port 5. The maximum displacement of the free end of the movable member 8 toward the bubble generating area 11 side at this point is denoted with h2. This displacement in turn causes a rapid decrease in the liquid flow which pulls the meniscus M rapidly into the liquid flow path 3, and the meniscus M starts to return to its original position before the bubble formation at s relatively low speed. Thus, the liquid discharge method using the movable member in according with the present invention is highly excellent in the vibration-converging characteristics of the meniscus M, compared with the other liquid discharge methods which do not use the movable member in according with the present invention. Further, in accordance with this embodiment, at the beginning of the period of partial growth and partial shrinkage, the liquid flow path 3 has already started to be refilled little by little with the liquid flowing from the liquid supply port 5, through the slit formed on the side surface on the discharge port 7 side of the supplying portion forming member 5A, to the liquid flow path 3; therefore, the backup of the meniscus M after the discharging droplet 22 is separated therefrom can be reduced. This provides more excellent vibration-converging characteristics of the meniscus M, resulting in improvement in refill frequency.

Finally when the bubble 21 has completely disappeared, the movable member 8 returns to the position where it is allowed to be in a steady state, as shown in FIG. 94A. The movable member 8 is displaced upwardly (in the direction shown by a solid arrow in FIG. 96B) due to its own elastic force and return to the steady state. In such a state, the meniscus M has already returned to the neighborhood of the discharge port 7.

The correlation between the change in the volume of bubble with time and the behavior of the movable member in both areas A and B shown in FIGS. 94A and 94B to 96A and 96B (refer to FIG. 124) and the correlation between the bubble growth and the behavior of movable member in liquid discharge heads provided with a movable member and a heat generating member of which relative position is different from that of this embodiment (refer to FIGS. 97A and 97B, and FIGS. 125 and 126) are both similar to that of the first embodiment described above.

Further, as can be seen from FIGS. 124 to 126, in the liquid discharge head in accordance with this embodiment, like the liquid discharge head of the first embodiment, the following relation holds, $$Vf > Vr$$

where Vf is the maximum volume of the bubble growing on the discharge port 7 side of the bubble generating area 11 (bubble in the area A) and Vr is the maximum volume of the bubble growing on the liquid supply port 5 side of the bubble generating area 11 (bubble in the area B). This relation permanently holds in the liquid discharge heads of the present invention. Further, in the liquid discharge heads of the present invention, the following relation permanently holds, $$Tf > Tr$$

where Tf is the lifetime (period between formation of bubble and disappearance of the same) of the bubble growing on the discharge port 7 side of the bubble generating area 11 (bubble in the area A) and Tr is the lifetime of the bubble growing on the liquid supply port 5 side of the bubble generating area 11 (bubble in the area B). Because of the relation described above, the point of the bubble's disappearing is located on the discharge port 7 side relative to the center portion of the bubble generating area 11.

Further, in the configuration of the liquid discharge head in accordance with this embodiment, the relation holds that the maximum displacement h2 of the free end of the movable member 8 toward the bubble forming means 4 side with the disappearance of bubble is larger than the maximum displacement h1 of the free end of the movable member 8 toward the liquid supply port 5 side at the beginning of the bubble formation (h1<h2), as can be seen from FIGS. 94B and 96B. For example, h1 is 2 $\mu m$ and h2 is 10 $\mu m$. Because of this relation, the bubble growth in the rear of the heat generating member (in the direction opposite to the discharge port) can be restricted and the bubble growth in the front of the heat generating member (toward the discharge port) can be further promoted. This in turn enables the promotion of efficiency in converting the bubbling power produced on the heat generating member into the kinetic energy of the liquid droplet flying from the discharge port.

As is apparent from the description of the configuration and liquid discharge operation of the liquid discharge head in accordance with this embodiment so far, in accordance with this embodiment, the growth components of a bubble in the downstream direction and in the upstream direction are not equal. And when the growth component in the upstream direction is almost null, the liquid movement in the upstream direction is restricted. Because of the restriction of the liquid flow in the upstream direction, the growth component of a bubble is not lost in the upstream direction, and almost all the growth component is allowed to be in the discharge port direction; thus the discharge power of the liquid discharge head is markedly improved. Further, the backup of the meniscus M after discharging a liquid droplet is reduced, as a result of which the projection of the meniscus from the orifice at the time of liquid refilling is also reduced. Thus, the vibration of the meniscus is restricted, enabling a stable discharge operation at every driving frequency, including both low frequency and high frequency.

[First Variation]

Figure 98:
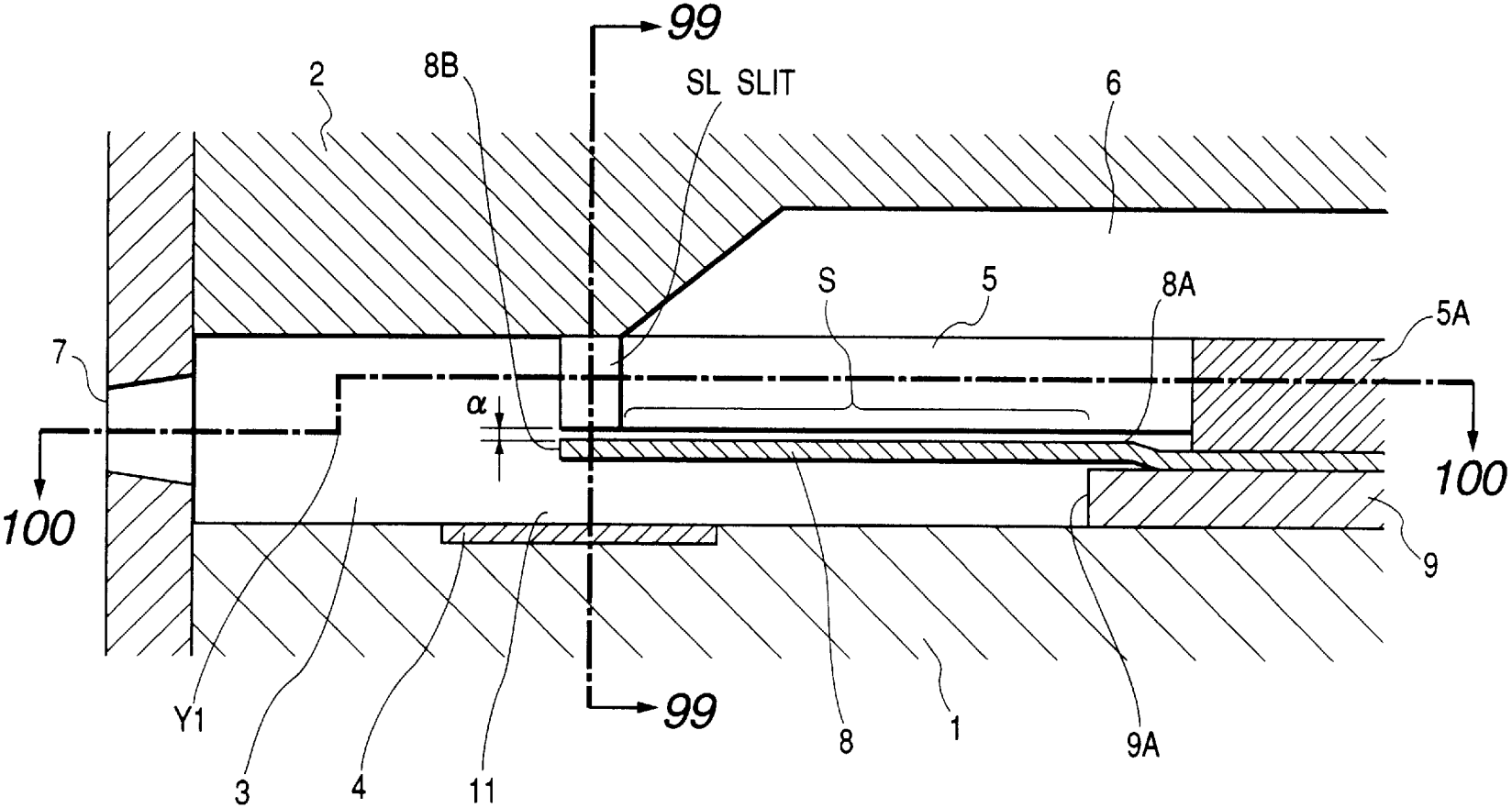
FIG. 98 is a sectional view taken along the direction of one liquid flow path of a liquid discharge head according to the first variation of the seventh embodiment of the present invention.
Figure 99:
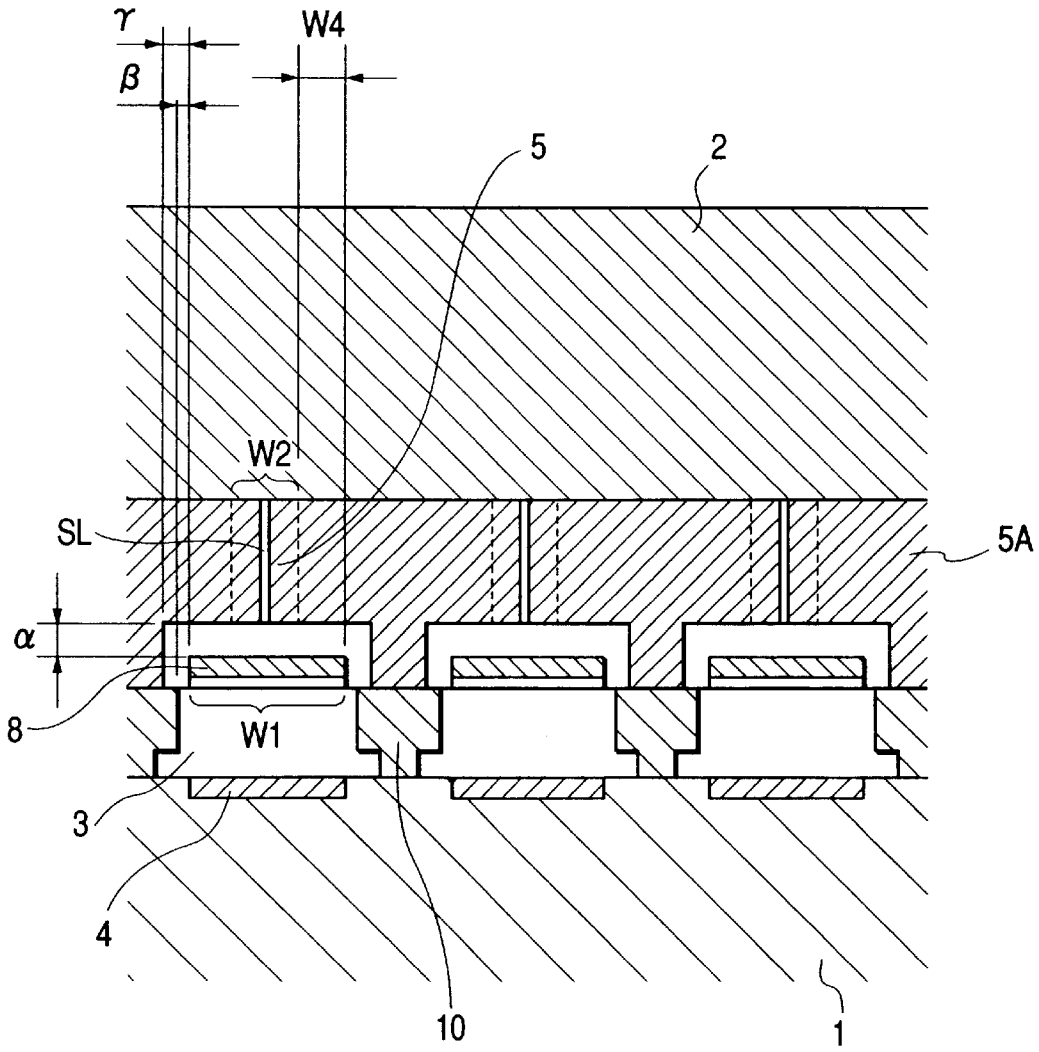
FIG. 99 is a sectional view taken on line 99—99 of FIG. 98.
Figure 100:
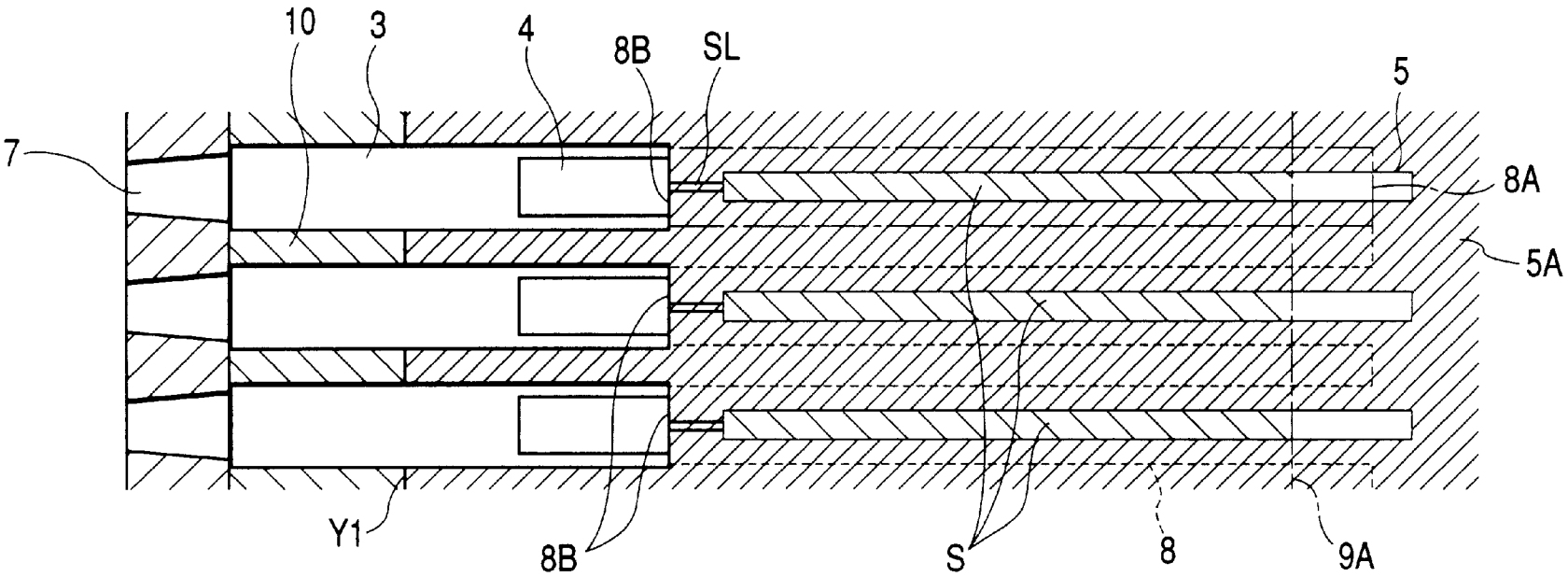
FIG. 100 is a sectional view taken on line of 100—100 shifted to the side of a top board 2 at the point Y1 from the discharge port center of FIG. 98.

FIG. 98 is a view in section along one of the liquid flow paths of the liquid discharge head in accordance with a first variation of this embodiment, FIG. 99 is a cross-sectional view of the liquid discharge head of FIG. 98 taken along the line 99—99, and FIG. 100 is a cross-sectional view of the liquid discharge head of FIG. 98 taken along the line 100—100, which is shifted from the center line of the discharge port toward the top board 2 at a point Y1.

In the liquid discharge head in accordance with this variation, the slit formed on the side surface on the discharge port 7 side of the supply portion forming member 5A is different in size from that of the liquid discharge head shown in FIG. 90. In this variation, the slit is formed in such a manner that it goes through the supply portion forming member 5A from the bottom to the top vertically (in the 99—99 direction shown in FIG. 98), and its vertical dimension is larger than that of the slit in the liquid discharge head shown in FIG. 90. On the other hand, its width is smaller than that of the slit shown in FIG. 90. Accordingly, the flow resistance at the slit of this variation and that of the slit in the liquid discharge head shown in FIG. 90 are almost the same. The other configuration of the liquid discharge head of this variation is the same as that of the liquid discharge head shown in FIG. 90.

Just like the liquid discharge head of FIG. 90, the liquid discharge head of this variation allows the timing for the movable member 8 to start displacement to be earlier, thereby the refilling speed can be improved, in addition, it allows the backup of the meniscus M after discharging a liquid droplet to be smaller, thereby the vibration-converging characteristics of the meniscus M become more excellent, resulting in improvement in the refill frequency.

The slit in accordance with this variation is formed in such a manner that it goes through the supply portion forming member 5A from the bottom to the top vertically. Accordingly, in the process of manufacturing the slit, the vertical dimension need not be controlled. Thus, the liquid discharge head in accordance with this variation has the advantage of simplifying the manufacturing process over the liquid discharge head shown in FIG. 90 etc. in which their slit need to be controlled so as to have a given dimension.

[Second Variations]

Figure 101:
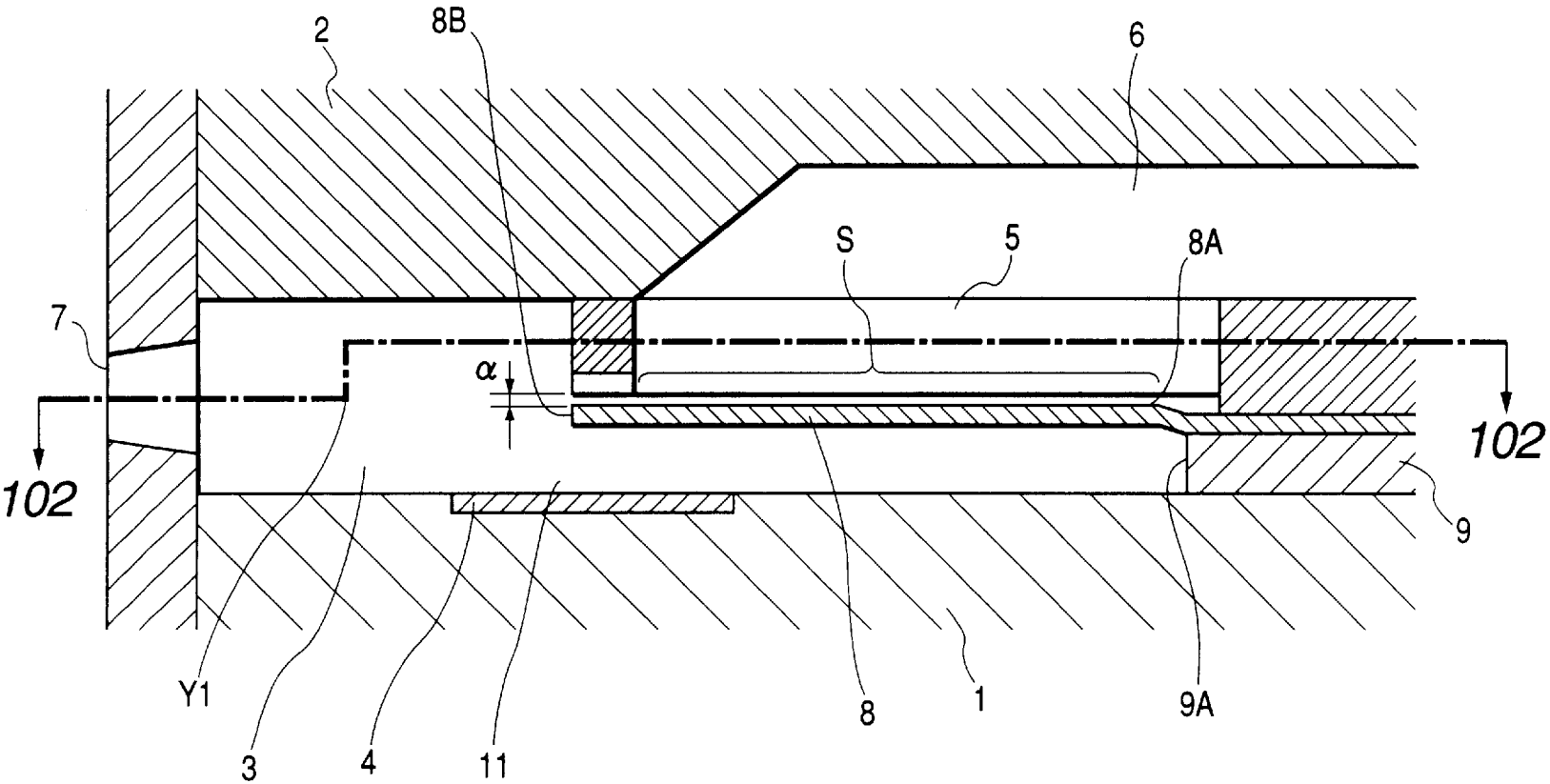
FIG. 101 is a sectional view taken along the direction of one liquid flow path of a liquid discharge head according to the second variation of the seventh embodiment of the present invention.
Figure 102:
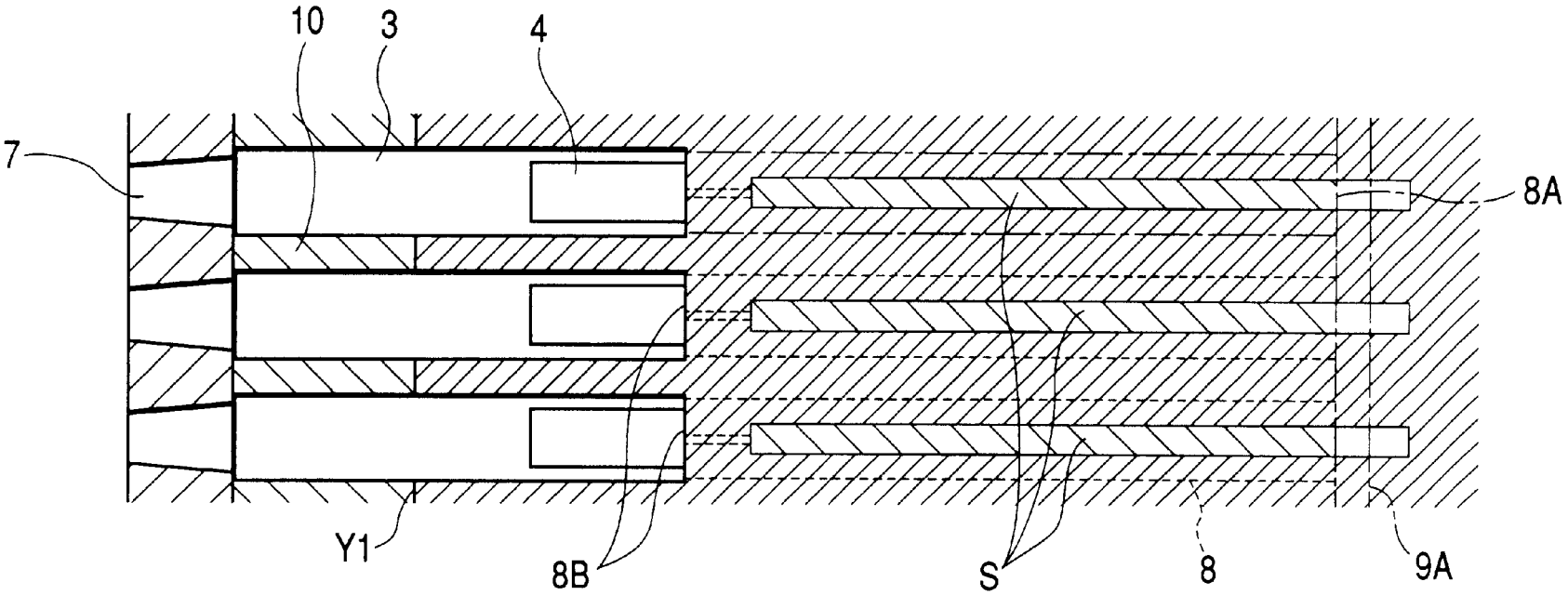
FIG. 102 is a sectional view taken on line 102—102 of FIG. 101.

In the structure of the liquid discharge head in accordance with this embodiment, the very end of the movable member 8–fixed member 9 junction (that is, the point at which the movable member 8 is bent and raised) does not correspond to the end portion 9A of the fixed member 9; accordingly, the opening area S is defined as the area surrounded by three sides of the liquid supply port 5 and the end portion 9A of the fixed member 9, as shown in FIGS. 90 and 92. However, as one of the second variations of this embodiment, the point at which the movable member 8 is bent and raised may correspond to the end portion 9A of the fixed member 9, as shown in FIGS. 101 and 102. In this variation, the opening area S is defined as the area surrounded by three sides of the liquid supply port 5 and the fulcrum 8A of the movable member 8, as shown in FIGS. 101 and 102.

Figure 103:
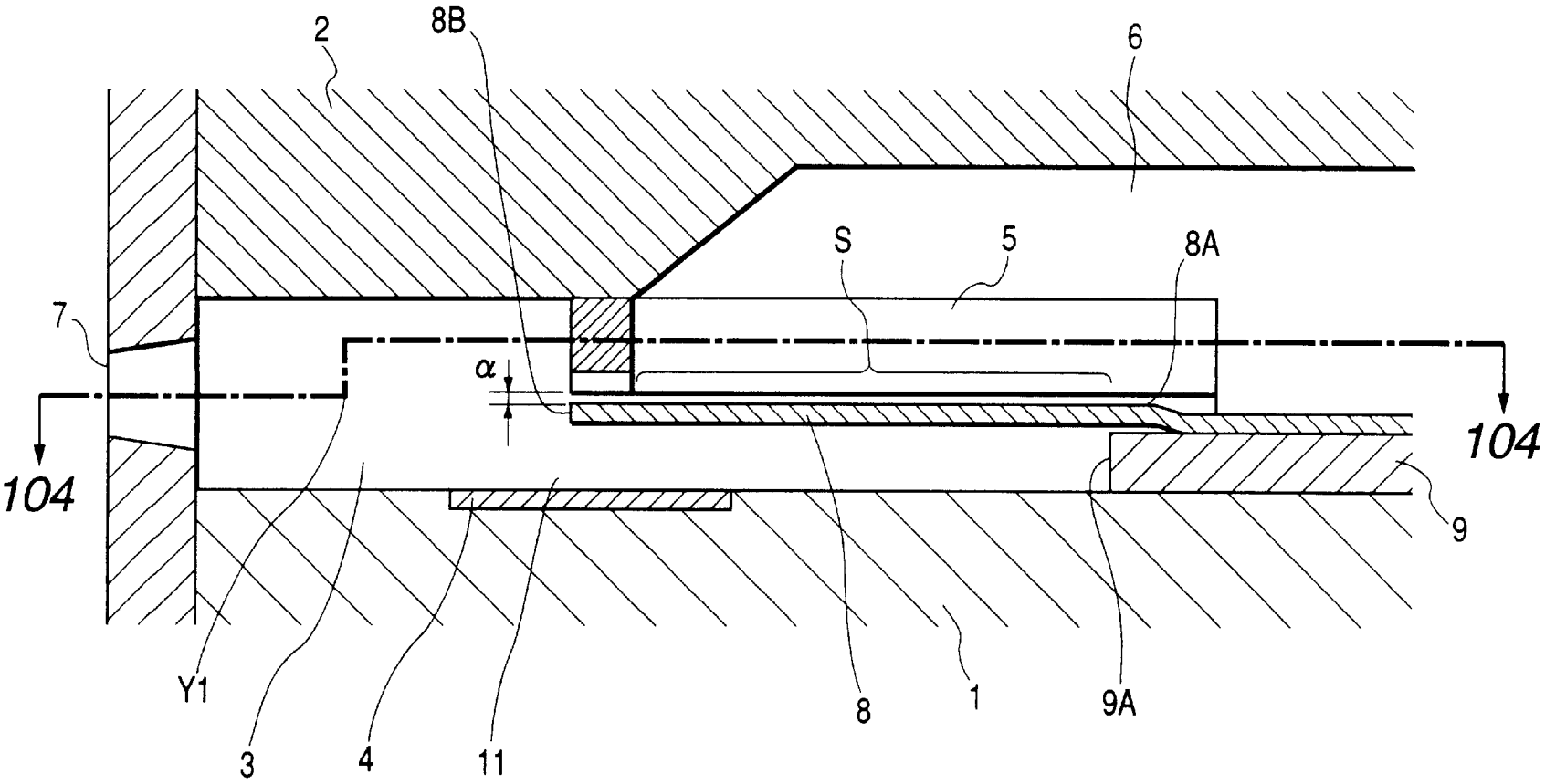
FIG. 103 is a sectional view taken along the direction of one liquid flow path of a liquid discharge head according to the second variation of the seventh embodiment of the present invention.
Figure 104:
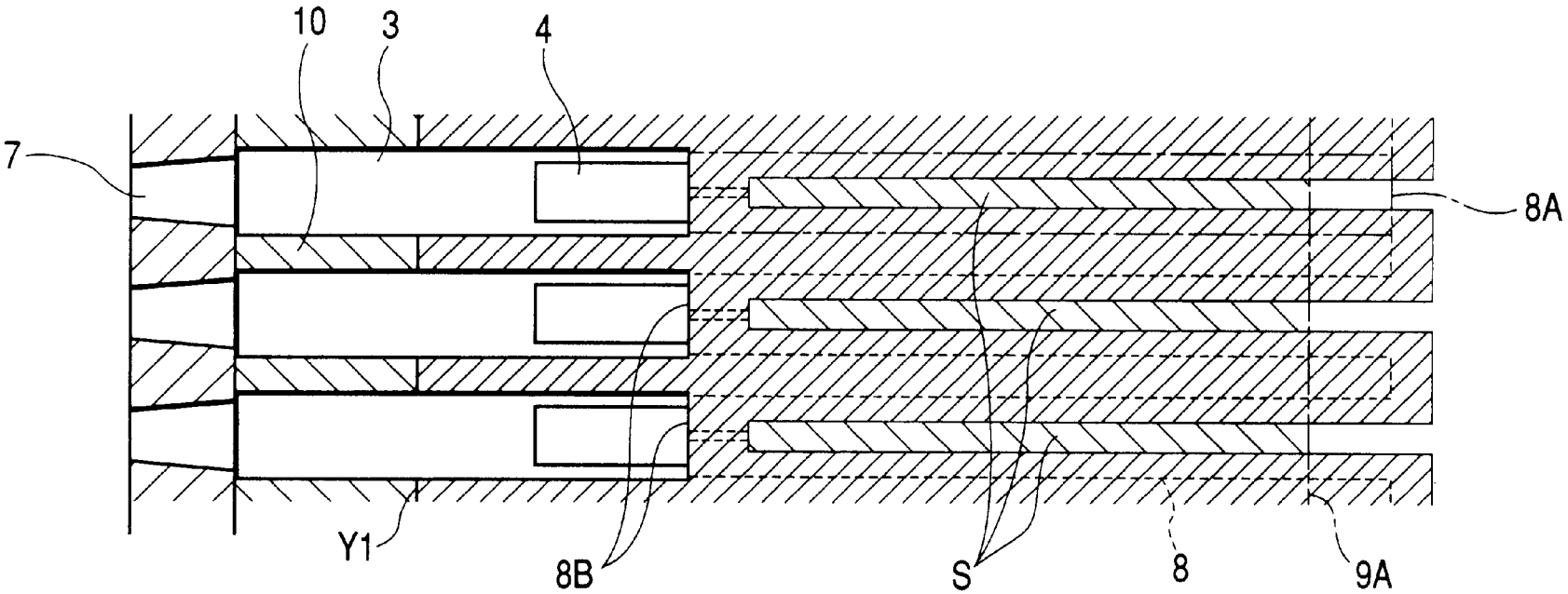
FIG. 104 is a sectional view taken on line 104—104 of FIG. 103.
Figure 105D:
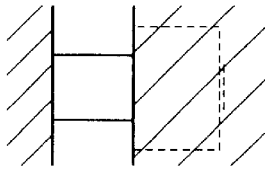
FIG. 105D is a sectional view taken on line 105D—105D of FIG. 105A.
Figure 105C:
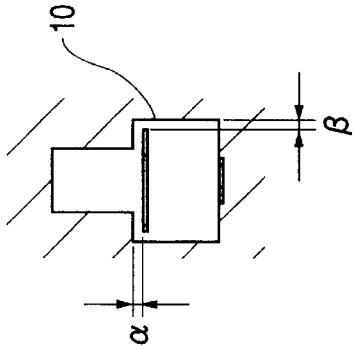
FIG. 105C is a sectional view taken on line 105C—105C of FIG. 105A.
Figure 105A:
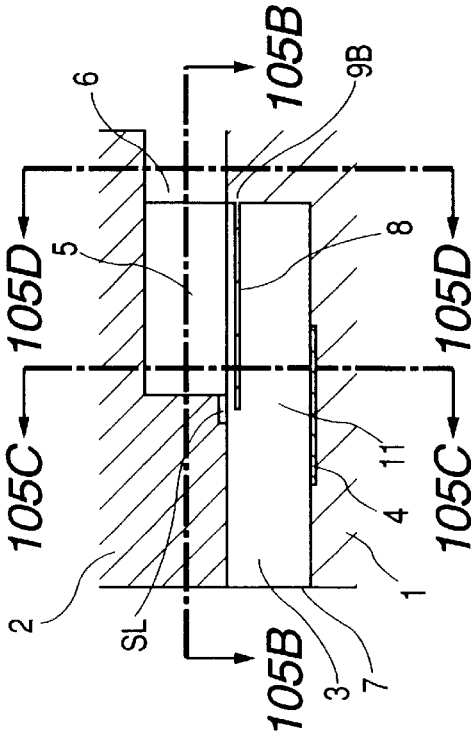
FIG. 105A is a view of a liquid discharge head according to the third variation of the seventh embodiment of the present invention.
Figure 105B:
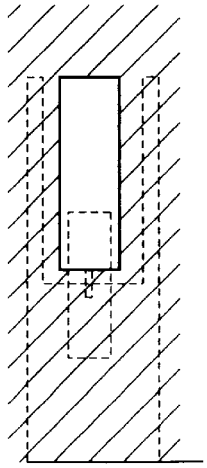
FIG. 105B is a sectional view taken on line 105B—105B of FIG. 105A.
Figure 106:
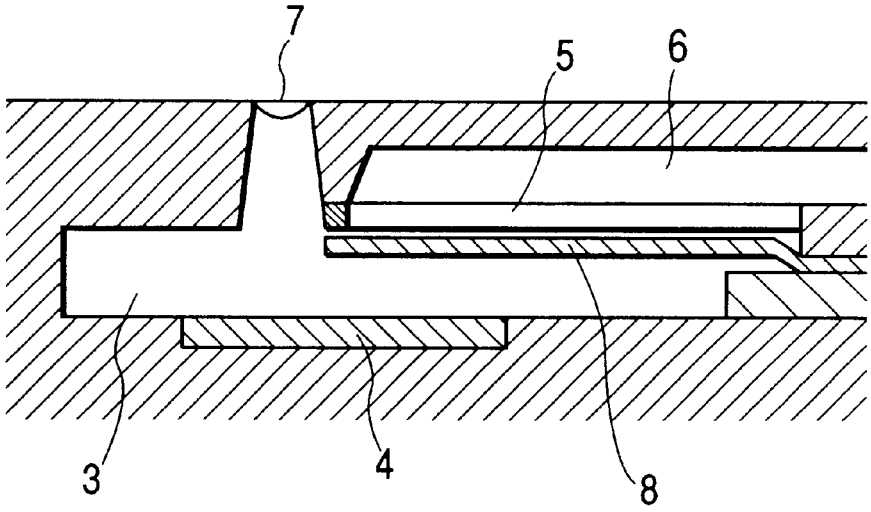
FIG. 106 is an illustration of an example of side-shooter type liquid discharge head corresponding to the configuration of a liquid discharge head according to the seventh embodiment of the present invention.
Figure 107A:
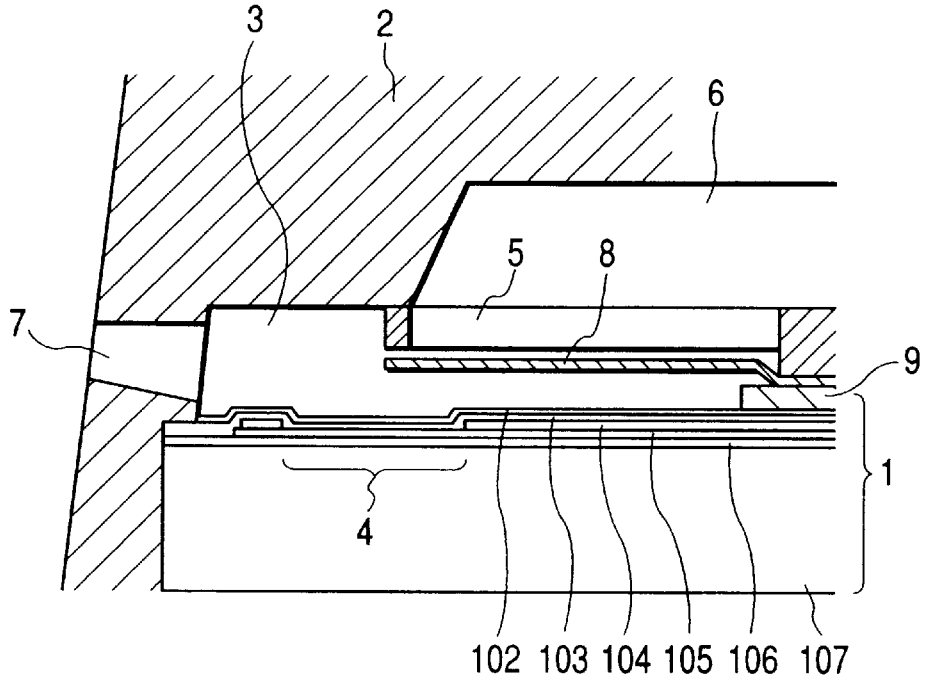
FIG. 107A is a vertically sectional view of a liquid discharge head according to the seventh embodiment of the present invention with a protective film.
Figure 107B:
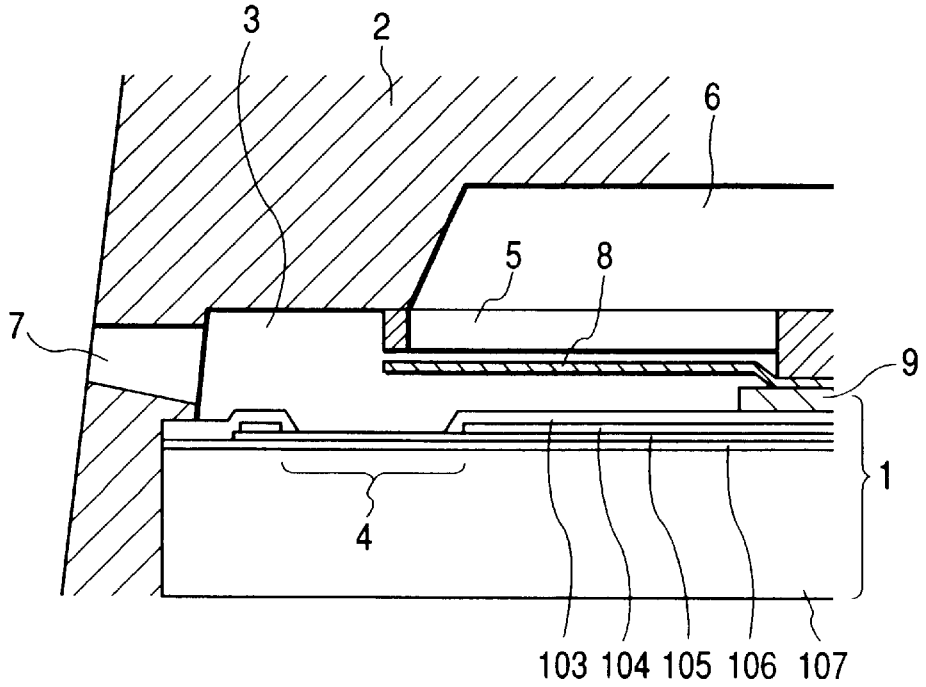
FIG. 107B is a vertically sectional view of a liquid discharge head according to the seventh embodiment of the present invention without a protective film.

In the structure of the liquid discharge head in accordance with this embodiment, the liquid supply port is defined as the opening surrounded by four walls, as shown in FIG. 92; however, as one of the second variations of this embodiment, the wall on the common liquid supply chamber 6 side, which is opposite to a discharge port 7 side, of a supply portion forming member 5A (refer to FIG. 90) may be opened, as shown in FIGS. 103 and 104. In this variation, the opening area S is defined as the area surrounded by three sides of the liquid supply port 5 and the end portion 9A of a fixed member 9, like this embodiment, as shown in FIGS. 103 and 104.

[Third Variation]

In the following the liquid discharge head in accordance with the third variation of this embodiment will be described with reference to FIGS. 105A–105D.

In the liquid discharge head, as the third variation of this embodiment, shown in FIGS. 105A–105D, the element substrate 1 and the top board 2 are joined to each other, and between the two boards the liquid flow path 3 is formed with its one end in communication with the discharge port 7 and the other closed.

The liquid supply port 5 is disposed on the liquid flow path 3 and the common liquid supply chamber 6 is provided which is in communication with the liquid supply port 5.

Between the liquid supply port 5 and the flow path 3, the movable member 8 is provided almost parallel to the opening area of the liquid supply port 5 while allowing an infinitesimal clearance a (for example, 10 $\mu$m or less) between them. The area of the movable member 8 surrounded by at least its free end portion as well as either side portion, which is the continuation of the free end portion, is larger than the opening area S of the liquid supply port 5, which is facing the liquid flow path, and an infinitesimal clearance $\beta$ is allowed between each of the side portions of the movable member 8 and each of the flow path sidewalls 10 sandwiching the movable member. Thus, the movable members 8 can move in the liquid flow path 3 without frictional resistance thereto, and at the same time, the displacement of the movable members 8 toward the opening area S side can be regulated near the same area. This in turn enables preventing liquid flow from the liquid flow path 3 to the common liquid supply chamber 6, because the liquid supply port is substantially blocked up with the movable member. In this variation, the movable member 8 is positioned in such a manner as to face the element substrate 1. And one end of the movable member 8 is a free end which is displaced toward the heat generating member 4 side of the element substrate 1 and the other end is supported with a supporting portion 9B.

Eighth Embodiment

Figure 108:
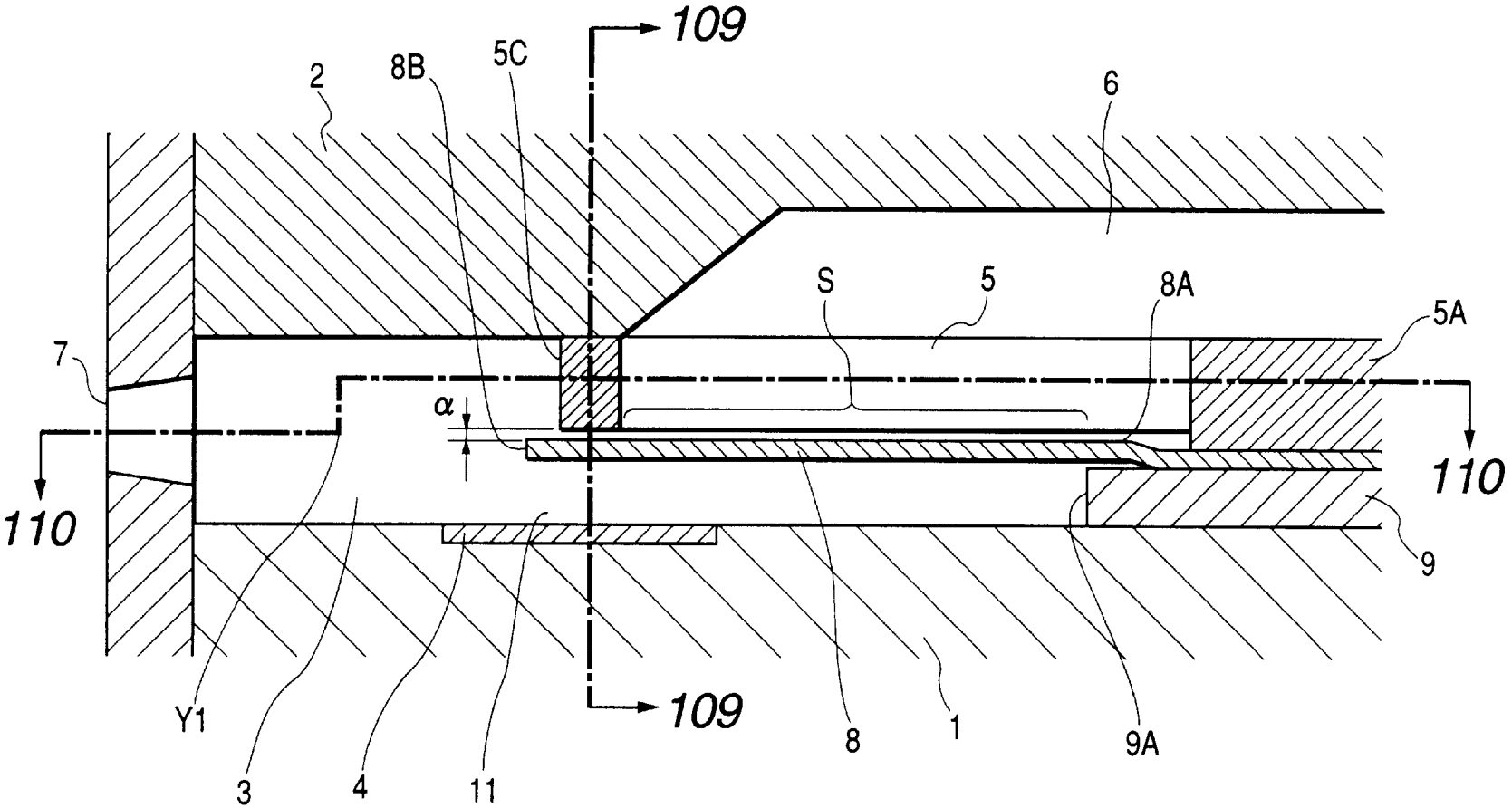
FIG. 108 is a sectional view taken along the direction of one liquid flow path of a liquid discharge head according to the eighth embodiment of the present invention.
Figure 109:
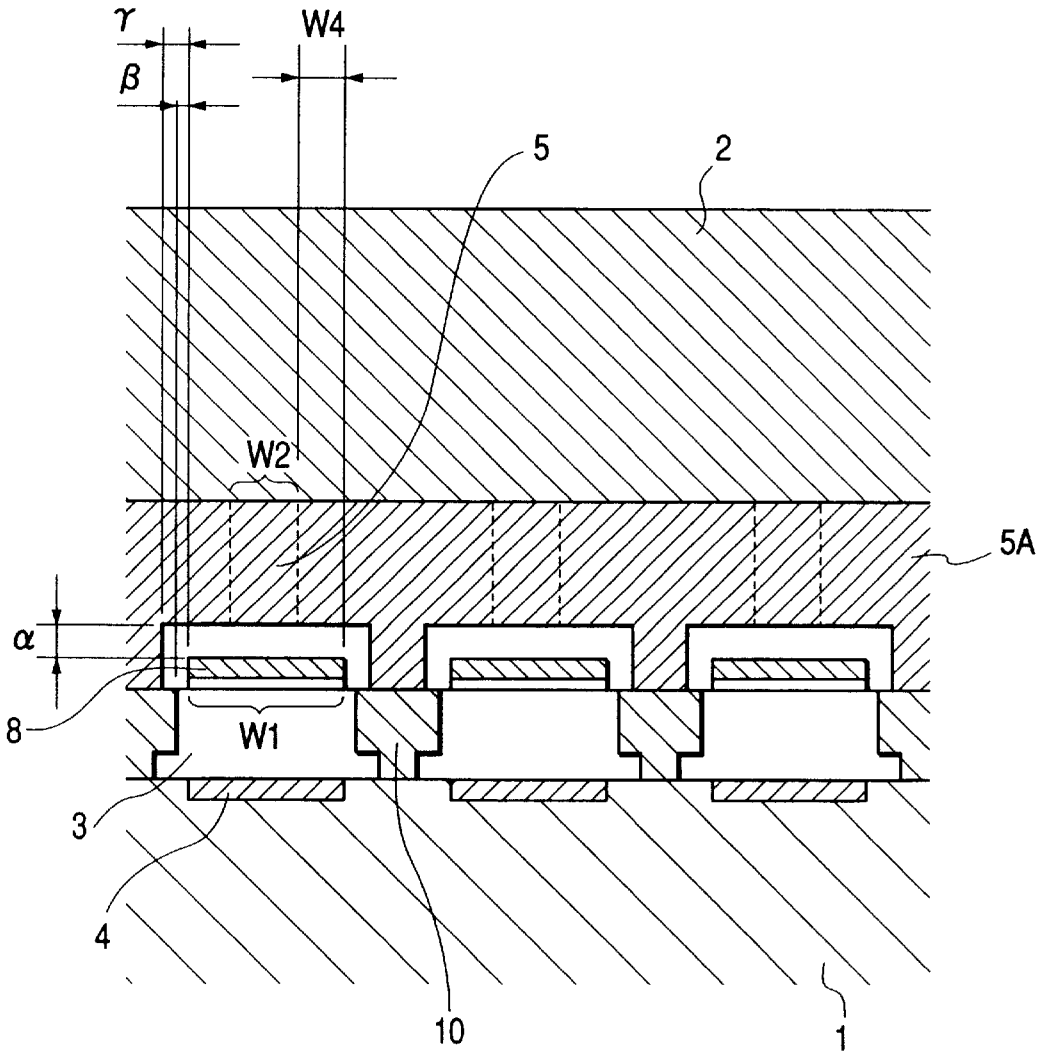
FIG. 109 is a sectional view taken on line 109—109 of FIG. 108.
Figure 110:
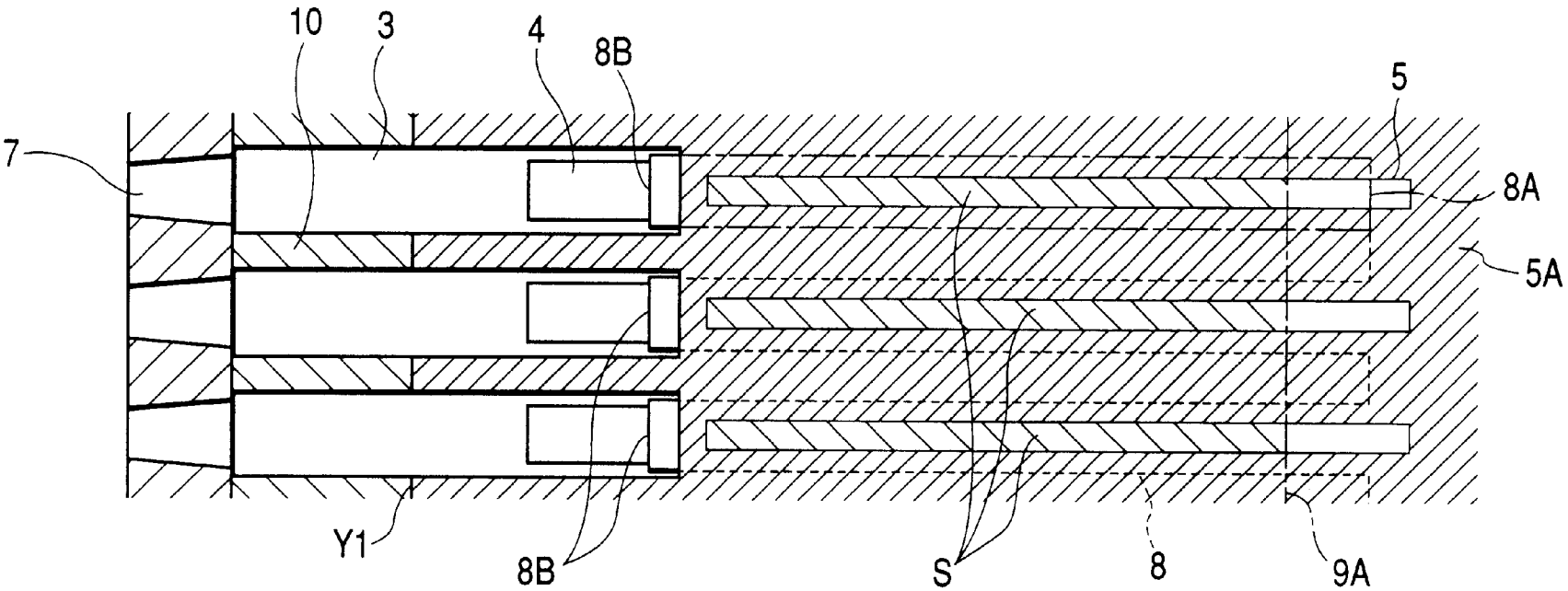

FIG. 108 is a view in section along one of the liquid flow paths showing the liquid discharge head in accordance with the eighth embodiment of the present invention, FIG. 109 is a cross-sectional view of the liquid discharge head of FIG. 108 taken along the line 109—109, and FIG. 110 is a cross-sectional view of the liquid discharge head of FIG. 108 taken along the line 110—110, which is shifted from the center line of the discharge port toward the top board 2 at a point Y1.

In the liquid discharge head in the form of multiple liquid paths-common liquid chamber shown in FIGS. 108 to 110, an element substrate 1 and a top board 2 are fixed on each other via liquid path sidewalls 10 in the stacked state, and between the two boards 1, 2 formed are liquid flow paths 3 of which one end is in communication with the discharge port 7 and the other end is closed. Each liquid discharge head is provided with multiple liquid flow paths 3. On the element substrate 1, heat generating members 4, such as electrothermal converting element, as bubble forming means for bubbling the liquid refilled in the liquid flow paths 3 are disposed for respective liquid flow paths 3. And near the contact surface of each heat generating member 4 with the discharging liquid, there exists a bubble generating area 11 where the discharging liquid is bubbled by rapidly heating the heat generating member 4.

A liquid supply port 5 having been formed on a supply portion forming member 5A is disposed in each of the multiple liquid flow paths 3 and a common liquid supply chamber 6 is provided in the same which is in communication with each liquid supply port 5. In other words, the liquid supply ports 5 are configured in such a manner as to branch from a single common liquid supply chamber 6 into multiple liquid flow paths 3, and they receive liquid from the common liquid supply chamber 6 in the amount which offsets the amount of liquid having been discharged from the discharge ports 7, which are in communication with respective liquid flow paths 3.

Between each liquid supply port 5 and liquid flow path 3, a movable member 8 is provided almost parallel to an opening area S of the liquid supply port 5 while allowing an infinitesimal clearance a (for example, 10 $\mu$m or less) between them. Further, each movable member 8 is positioned parallel to the element substrate 1. And one end portion of each movable member 8 is a free end positioned on the heat generating member 4 side of the element substrate 1 and the other end is supported with a fixed member 9. This fixed member 9 serves to close the end on the side opposite to the discharge port 7 of each liquid flow path 3.

The area of the movable member 8 surrounded by at least its free end portion as well as either side portion, which is the continuation of the free end portion, is larger than the opening area S of the liquid supply port 5 (refer to FIG. 110), and an infinitesimal clearance $\beta$ is allowed between each of the side portions of the movable member 8 and each of the flow path sidewalls 10 sandwiching the movable member (refer to FIG. 109). The above-described supply portion forming member 5A is disposed $\gamma$ apart from the movable member 8 as shown in FIG. 109. The clearances $\beta$, $\gamma$ vary depending on the pitch of the liquid path; however, if the clearance $\gamma$ is large, the movable member 8 is likely to block up the opening area S, on the other hand, if the clearance $\beta$ is large, with the disappearance of bubble, the movable member 8 is likely to move downward from the position a apart from the opening area S, where it is in a steady state, toward the element substrate 1 side. In this embodiment, the clearances $\alpha$, $\beta$ and $\gamma$ are set at values of 3 $\mu$m, 3 $\mu$m and 4 $\mu$m, respectively.

Each movable member 8 is W1 wide laterally between the two adjacent flow path sidewalls 10, the width W1 being larger than the width W2 of the above opening area S and sufficient to fully seal the same. A fulcrum 8A of each movable member 8 specifies the upstream end of the opening area S of each liquid supply port 5 on the extension, on the free end side, of the continuous portion of the multiple movable members perpendicular to the multiple liquid paths (refer to FIG. 110). In this embodiment, for the portions of the supply portion forming member 5A which lie along the movable members 8, their thickness is set at a smaller value than that of the flow path sidewalls themselves and the supply portion forming member 5A is superposed on the flow path sidewalls 10, as shown in FIGS. 109 and 110. For the portions of the supply portion forming member 5A which lie on the discharge port 7 side relative to the free ends 8B of the movable members 8, their thickness is set at the same value as that of the flow path sidewalls 10 themselves, as shown FIG. 110. Setting the thickness of the supply portion forming member 5A as described above allows the movable members 8 to move in respective liquid flow paths 3 without frictional resistance thereto, and at the same time, it enables regulating the displacement of the movable members 8 toward the opening area S side near the same area. This in turn enables preventing liquid flow from the inside of each liquid flow path 3 to the common liquid supply chamber 6, because the opening area S is substantially blocked up, while allowing the state of each liquid flow path to shift from a substantially sealed state to a refillable state with the disappearance of bubble.

In the liquid discharge head in accordance with this embodiment, the free end 8B of the movable member 8 is in the position closer to the discharge port 7 than the end surface 5C, which is a side surface on the discharge port 7 side of the supply portion forming member 5A. In other words, the tip on the discharge port 7 side of the movable member 8 is in the position closer to the discharge port 7 than the end surface 5C on the discharge port 7 side of the supply portion forming member 5A which forms the liquid supply port 5. By allowing the free end 8B of the movable member 8 to extend and project toward the discharge port 7 side relative to the end surface 5C of the supply portion forming member 5A as described above, the speed of refilling the liquid flow path 3 with ink from the common liquid supply portion 6 can be upped in the ink discharge operation described below.

As in the seventh embodiment, the SL slit may be formed on the side surface on the discharge port 7 side of the supply portion forming member 5A which forms the liquid supply port 5.

The opening area S is a substantial area for supplying liquid from the liquid supply port 5 toward the liquid flow path 3, and in this embodiment it is the area surrounded by three sides of the liquid supply port 5 and the end portion 9A of the fixed member 9, as shown in FIGS. 108 and 110.

Figure 111:
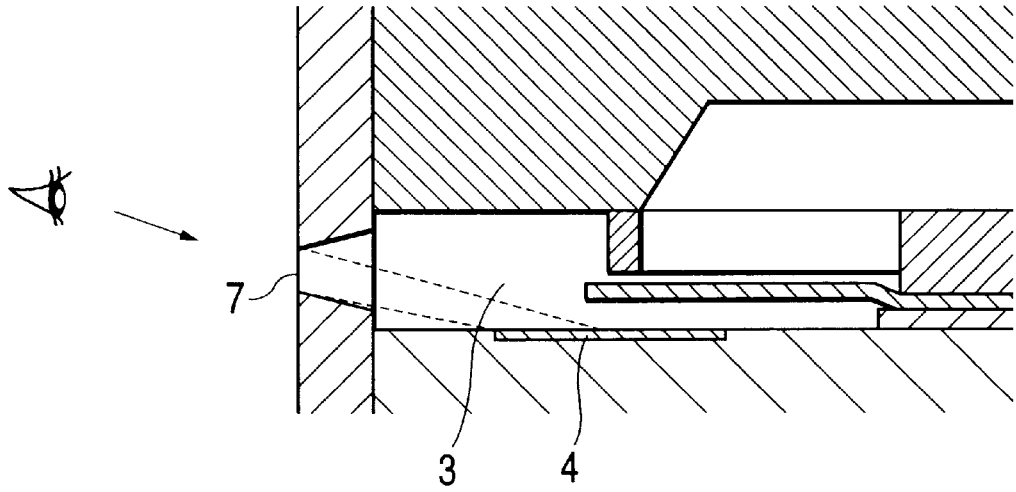

And as shown in FIG. 111, in this embodiment, there exist no obstacles such as valves between the heat generating member 4, as an electrothermal converting element, and the discharge port 7, and the liquid flow path 3 is "in the linearly communicating state" in which its structure allows liquid to flow linearly. More preferably, an ideal state, in which the discharge conditions such as liquid droplets discharging direction and velocity are stabilized at an extremely high level, is created by allowing the direction of propagating pressure waves produced when bubbling and the direction of the associated liquid flow and liquid discharge to linearly correspond to each other. In the present invention, in order to achieve the ideal state or the almost ideal state, the liquid flow path is defined by the construction in which the discharge portion 7 and the heat generating member 4, in particular, the heat generating member 4 on the discharge port 7 side (downstream side) which affects bubbling on the discharge port 7 side are in a straight line, the construction being such that it enables the observation of the heat generating member 4, in particular, the heat generating member 4 on the downstream side from the outside of the discharge port 7 when there is no liquid in the flow path 3 (refer to FIG. 111).

Now the discharging operation of the liquid discharge head in accordance with this embodiment will be described in detail. FIGS. 112A, 112B, 113A and 113B are views in section along the liquid flow path of the liquid discharge head having a structure shown in FIGS. 108 to 110 illustrating the discharge operation of the liquid discharge head and showing the characteristic phenomena associated with the operation by dividing the operation into 7 steps shown in FIGS. 112A and 112B to 115. In FIGS. 112A and 112B to 115, reference letter M denotes a meniscus formed by the discharge liquid.

Figure 112A:
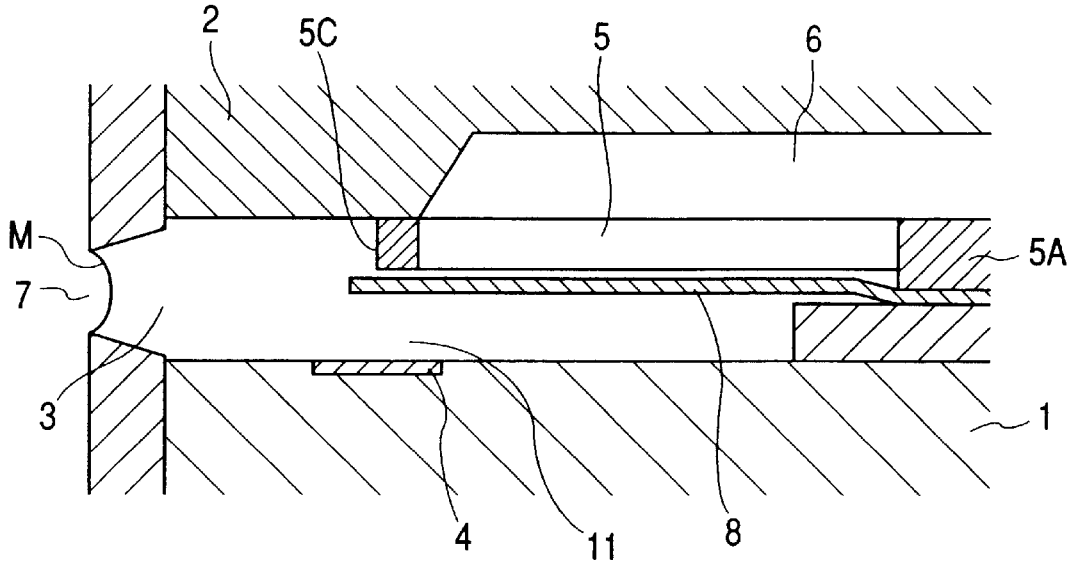

In FIG. 112A, a state is shown in which energy such as electrical energy has not been applied to the heat generating member 4 yet and the heat generating member 4 has not generated heat yet. In this state, there exists an infinitesimal clearance (10 $\mu$m or less) between the movable member 8, which is provided between the liquid supply port 5 and the liquid flow path 3, and the surface forming the liquid supply port 5.

Figure 112B:
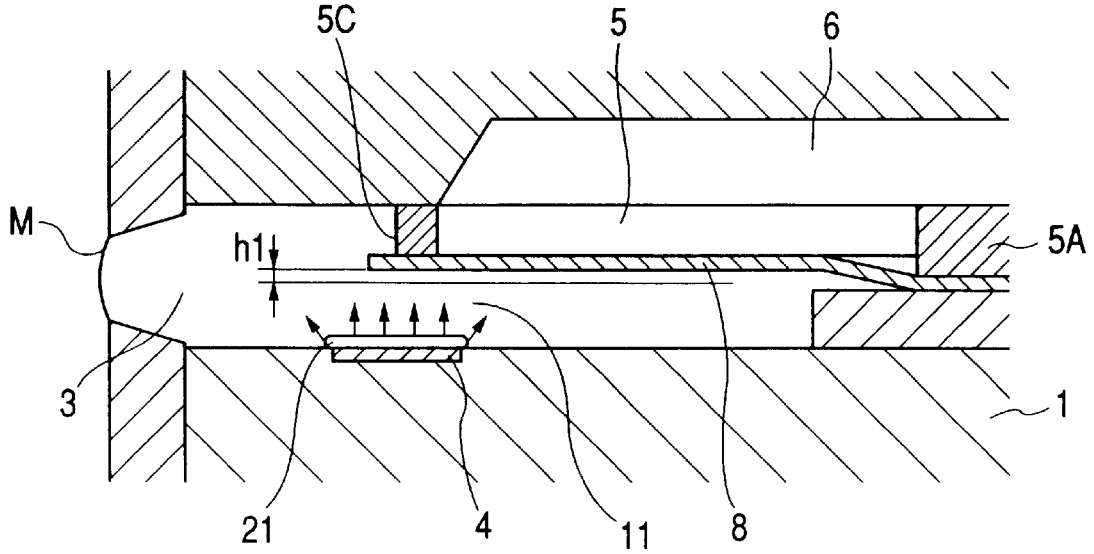

In FIG. 112B, a state is shown in which part of the liquid filling the liquid flow path 3 has been heated with the heat generating member 4, film boiling has occurred on the same, and a bubble 21 has isotropically grown. The terms "a bubble isotropically grows" herein used mean that in spots of the bubble surface, the bubble growing speed in the direction perpendicular to the surface is almost the same.

During the process of the isotropical growth of the bubble 21 at the beginning of the bubble formation, the movable member 8 and the peripheral portion of the liquid supply port 5 closely touch with each other to block up the liquid supply port 5, and the liquid flow path 3 is brought to the substantially sealed state except at the discharge port 7. The duration that the sealed state is kept may be within a period from the application of driving voltage to the heat generating member 4 to the completion of the isotropical growth of the bubble 21. In this sealed state, the inertance (the degree to which still liquid is hard to move when it rapidly starts to move) from the center of the heat generating member 4 toward the liquid supply port side is substantially infinite in the liquid flow path 3. And the larger the spacing between the heat generating member 4 and the movable member 8 becomes, the closer the inertance from the heat generating member 4 toward the liquid supply port side gets to infinity. Here the maximum displacement of the free end of the movable member 8 toward the liquid supply port 5 side is denoted with h1.

Figure 113A:
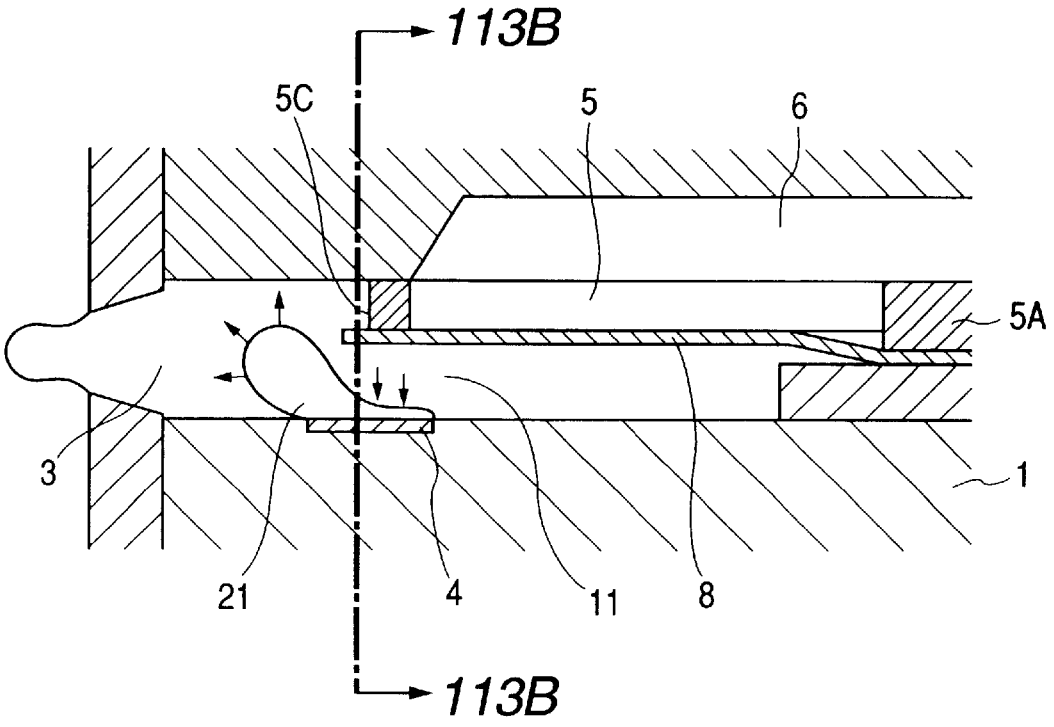

In FIG. 113A, a state is shown in which the bubble 21 continues to grow. In this state, since the liquid flow path 3 is in the substantially sealed state except at the discharge port 7, as described above, the liquid hardly flows toward the liquid supply port 5 side. Thus, the bubble 21 can expand further toward the discharge port 7 side, but does not expand toward the liquid supply port 5 side very much. And the bubble continues to grow on the discharge port 7 side of the bubble generating area 11, on the other hand, it stops growing on the liquid supply port 5 side of the same. This bubble-growth stopping state means the maximum bubbling state on the liquid supply port 5 side of the bubble generating area 11. The volume of the bubble at this point is denoted with Vr.

Now the bubble growing process in this embodiment, as shown in FIGS. 112A, 112B and 113A, will be described in detail with reference to FIGS. 123A to 123E, like the bubble growing process in the first embodiment. As shown in FIG. 123A, when applying heat to the heat generating member 4, initial ebullition occurs on the heat generating member, then it changes to film boiling, in which the bubble covers the surface of the heat generating member 4, as shown in FIG. 123B. The bubble in the film boiling state continues to isotropically grow (the state in which a bubble continues to isotropically grow is referred to as semi-pillow state), as shown in FIGS. 123B and 123C. However, when the liquid flow path 3 is in the substantially sealed state except at the discharge port 7, as shown in FIG. 112B, the liquid cannot flow toward the upstream side; as a result, in the bubble in the semi-pillow state, its part on the upstream side (liquid supply port 5 side) cannot grow very much and the rest on the downstream side (discharge port 7 side) grows lot. This state is shown in FIG. 113A, and FIGS. 123D and 123E.

Hereinafter the area of the heat generating member 4 where the bubble does not grow when heat is applied thereto is referred to as area B and the area on the discharge port 7 side of the heat generating member 4 where the bubble grows is referred to as area A, for convenience's sake. In the area B shown in FIG. 123E, the volume of the bubble reaches the maximum and the volume at this point is denoted with Vr.

Figure 113B:
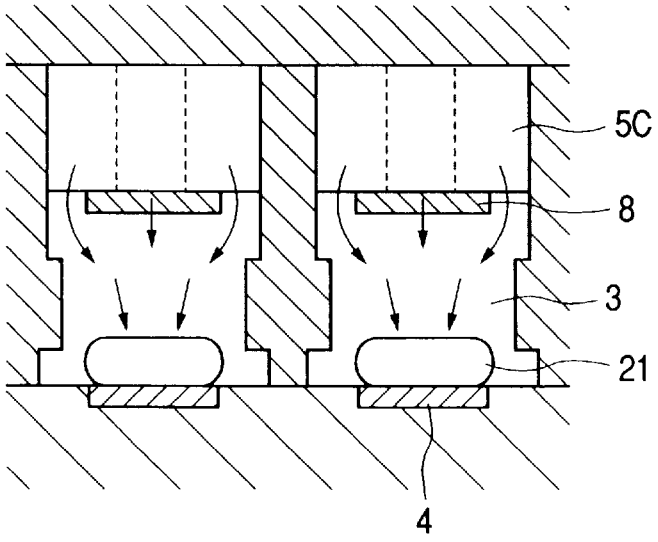

In FIG. 113B, a state is shown in which the bubble continues to grow in the area A and is starting to shrink in the area B. In this state, in the area A the bubble 21 continues to grow lot toward the discharge port side, but on the other hand, in the area B the volume of the bubble starts to decrease. The liquid flow during such a period that the bubble grows in the area A and shrinks in the area B (period of partial growth and partial shrinkage) is illustrated in FIG. 113B, which is a cross-sectional view of the liquid discharge head of FIG. 113A taken along the line A–A'.

Figure 114A:
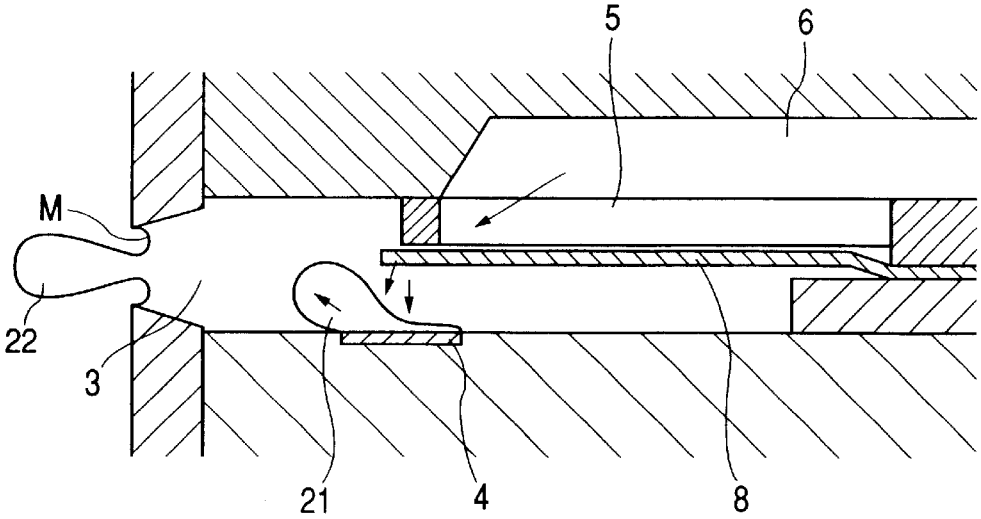

Because the bubble in the area B shown in FIG. 113A stops growing and is about to shrink, the liquid near the area B is about to move toward the bubble in the area B. Accordingly, as shown in FIG. 113B near the side surface of the free end 8B of the movable member 8, liquid flow occurs along the movable member 8. Because of this liquid flow, the free end 8B of the movable member 8 starts to be displaced downwardly at an earlier timing. By allowing the free end 8B of the movable member 8 to react to even such a slight changes in liquid flow, a time lag of starting a refill between the shrinkage of the bubble in the area B and the opening of the liquid supply port can be shortened. As shown in FIG. 113B, on the discharge port 7 side of the bubble 21, there arises ink movement toward the discharge port 7 side; on the other hand, on the liquid supply port 5 side of the bubble 21, since the liquid supply port 5 is kept in a almost sealed state by the movable member 8, with the shrinkage of the bubble 21 in the area B, ink flows from the neighborhood of the bubble 21 in the area A to the neighborhood of the bubble 21 in the area B, and there arises an ink eddy. Since the free end BB of the movable member 8 is projected toward the discharge port 7 side relative to the end surface 5C of the supply portion forming member 5A, as described above, force due to the ink eddy promptly acts on the movable member 8 which displaces the free end 8B of the movable member 8 toward such a position that it is allowed to be in a steady state. Thus, the free end of the movable member 8 starts to be displaced downwardly to such a position that it is allowed to be in a steady state by the restoring force due to its rigidity and the disappearing force of the bubble in the area B. In FIG. 114A, a state is shown in which the bubble continues to grow in the area A and has further shrunk in the area B. In this state, in the area A, the bubble 21 continues to grow toward the discharge port side to become larger than it is in the state shown in FIG. 113B. And due to the decrease in the volume of the bubble in the area B, the free end of the movable member 8 is displaced downwardly to such a position that it is allowed to be in a steady state by the restoring force due to its rigidity and the ink eddy produced on the liquid supply port 5 side of the bubble 21 due to the disappearing force of the bubble in the area B. As a result, the liquid supply port 5 is opened, and the common liquid supply chamber 6 and the liquid flow path 3 start to communication with each other, the liquid flow path 3 starts to be refilled with ink from the common liquid supply chamber 6 through the liquid supply port 5.

Figure 114B:
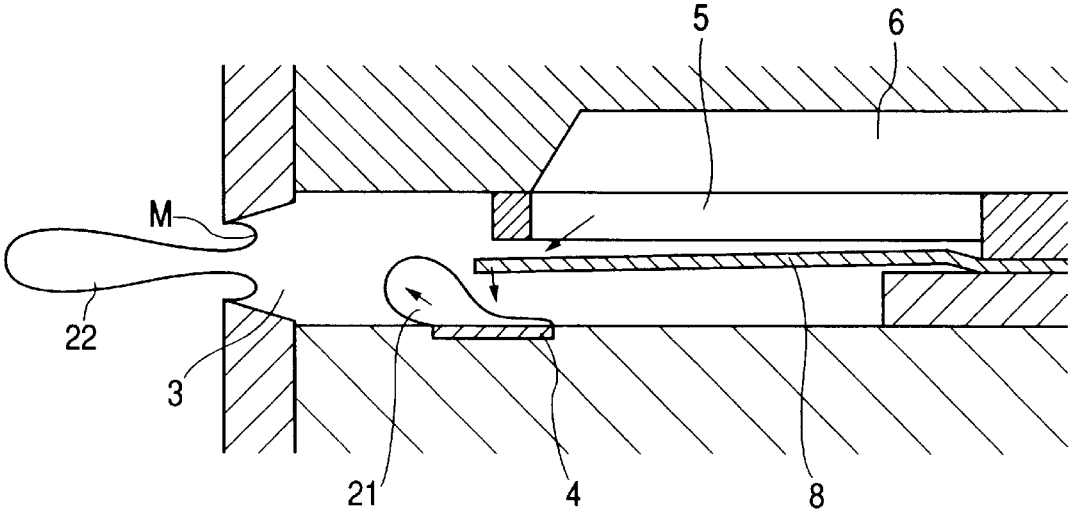

In FIG. 114B, a state is shown in which the bubble 21 has almost grown to be the maximum size. In this state, in the area A the bubble has grown to be the maximum size, and with this, the bubble almost disappears in the area B. The maximum volume of the bubble in the area A at this point is denoted with Vf. A discharge droplet 22 being discharged from the discharge port 7 is still continuous with the meniscus M with its long tail left behind.

Figure 115:
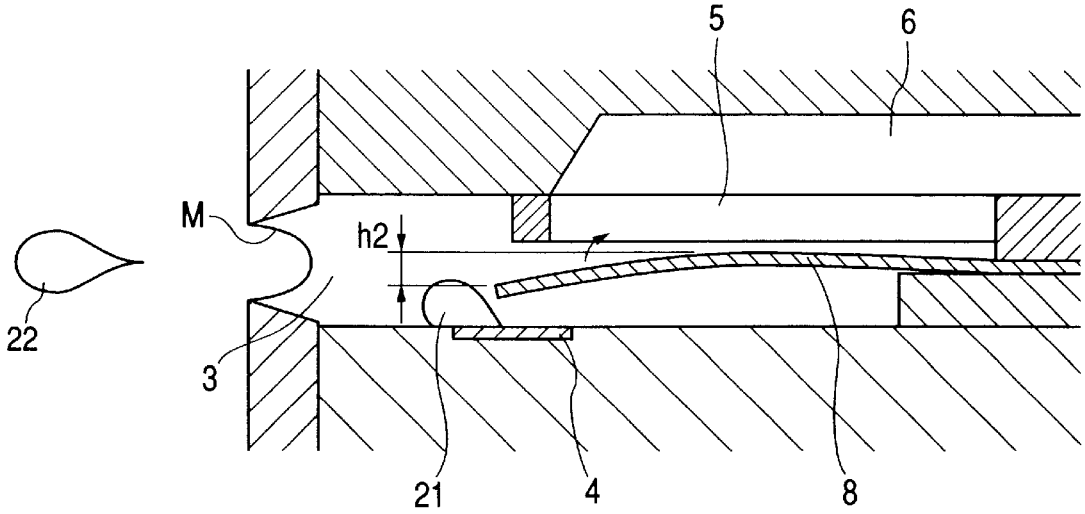
Figure 116A:
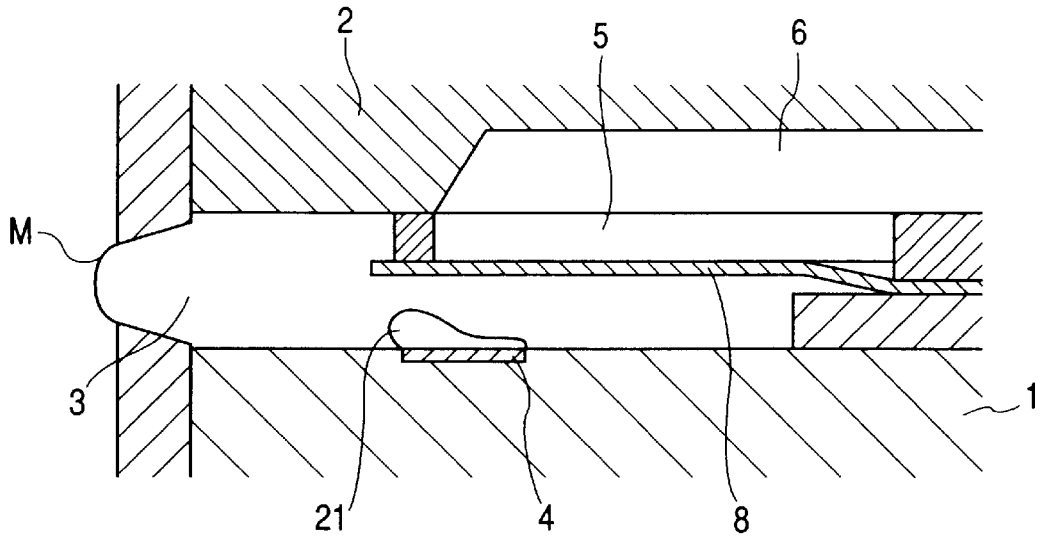
Figure 116B:
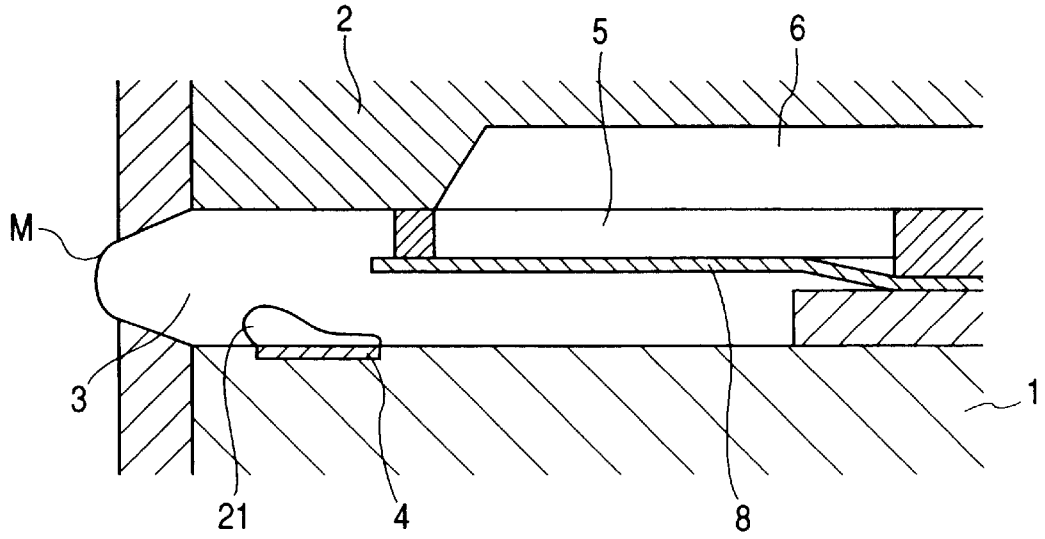

In FIG. 115, a state is shown in which the bubble 21 is disappearing while stopping growing and the discharge droplet 22 and the meniscus M have been separated from each other. Immediately after the bubble stops growing and starts to disappear in the area A, the shrinkage energy of the bubble 21 acts as the force moving the liquid near the discharge port 7 in the upstream direction so as to keep the entire balance. Accordingly, the meniscus M at the discharge port 7 is pulled into the liquid flow path 3 at this point and the liquid column via which the continuity between the meniscus M and the discharge droplet 22 has been kept is quickly separated therefrom by the strong force. On the other hand, with the shrinkage of the bubble, a large flow of liquid rapidly flows into the liquid flow path 3 from the common liquid supply chamber 6 via the liquid supply port 5. This causes a rapid decrease in the liquid flow which pulls the meniscus M rapidly into the liquid flow path 3, and the meniscus M starts to return to its original position before the bubble formation at s relatively low speed. Thus, the liquid discharge method using the movable member in according with the present invention is highly excellent in the vibration-converging characteristics of the meniscus M, compared with the other liquid discharge methods which do not use the movable member in according with the present invention. The maximum displacement of the free end of the movable member 8 toward the bubble generating area 11 side at this point is denoted with h2.

Finally when the bubble 21 has completely disappeared, the movable member 8 returns to the position where it is allowed to be in a steady state, as shown in FIG. 112A. The movable member 8 is displaced upwardly (in the direction shown by a solid arrow in FIG. 115) due to its own elastic force and return to the steady state. In such a state, the meniscus M has already returned to the neighborhood of the discharge port 7.

The correlation between the change in the volume of bubble with time and the behavior of the movable member in both areas A and B shown in FIGS. 112A and 112B to 115 (refer to FIG. 124) and the correlation between the bubble growth and the behavior of movable member in liquid discharge heads provided with a movable member and a heat generating member of which relative position is different from that of this embodiment (refer to FIGS. 116A and 116B, and FIGS. 125 and 126) are both similar to that of the first embodiment described above.

Further, as can be seen from FIGS. 124 to 126, in the liquid discharge head in accordance with this embodiment, like the liquid discharge head of the first embodiment, the following relation holds, $$Vf>Vr$$

where Vf is the maximum volume of the bubble growing on the discharge port 7 side of the bubble generating area 11 (bubble in the area A) and Vr is the maximum volume of the bubble growing on the liquid supply port 5 side of the bubble generating area 11 (bubble in the area B). This relation permanently holds in the liquid discharge heads of the present invention. Further, in the liquid discharge heads of the present invention, the following relation permanently holds, $$Tf>Tr$$

where Tf is the lifetime (period between formation of bubble and disappearance of the same) of the bubble growing on the discharge port 7 side of the bubble generating area 11 (bubble in the area A) and Tr is the lifetime of the bubble growing on the liquid supply port 5 side of the bubble generating area 11 (bubble in the area B). Because of the relation described above, the point of the bubble's disappearing is located on the discharge port 7 side relative to the center portion of the bubble generating area 11.

Further, in the configuration of the liquid discharge head in accordance with this embodiment, the relation holds that the maximum displacement h2 of the free end of the movable member 8 toward the bubble forming means 4 side with the disappearance of bubble is larger than the maximum displacement h1 of the free end of the movable member 8 toward the liquid supply port 5 side at the beginning of the bubble formation (h1<h2), as can be seen from FIGS. 112B and 115. For example, h1 is 2 $\mu$m and h2 is 10 $\mu$m. Because of this relation, the bubble growth in the rear of the heat generating member (in the direction opposite to the discharge port) can be restricted and the bubble growth in the front of the heat generating member (toward the discharge port) can be further promoted. This in turn enables the promotion of efficiency in converting the bubbling power produced on the heat generating member into the kinetic energy of the liquid droplet flying from the discharge port.

As is apparent from the description of the configuration and liquid discharge operation of the liquid discharge head in accordance with this embodiment so far, in accordance with this embodiment, the growth components of a bubble in the downstream direction and in the upstream direction are not equal. And when the growth component in the upstream direction is almost null, the liquid movement in the upstream direction is restricted. Because of the restriction of the liquid flow in the upstream direction, the growth component of a bubble is not lost in the upstream direction, and almost all the growth component is allowed to be in the discharge port direction; thus the discharge power of the liquid discharge head is markedly improved. Further, the backup of the meniscus M after discharging a liquid droplet is reduced, as a result of which the projection of the meniscus from the orifice at the time of liquid refilling is also reduced. Thus, the vibration of the meniscus is restricted, enabling a stable discharge operation at every driving frequency, including both low frequency and high frequency.

In the liquid discharge head in accordance with this embodiment, the tip on the discharge port 7 side of the movable member 8 is in the position closer to the discharge port 7 than the end surface 5C on the discharge port 7 side of the supply portion forming member 5A, which is for forming the liquid supply port 5. In such a liquid discharge head, in the operation of discharging ink from the discharge port 7 performed in state where the liquid supply port 5 of the liquid flow path 3 is allowed to be in the almost sealed state with movable member 8 which is displaced by bubbling the ink in the bubble generating area 11 with the heat generating member 4, the movable member 8 reacts to even a slight ink movement, in particular, a slight ink eddy, which is caused when the bubble formed in the bubble generating area 11 starts to shrink from its liquid supply port 5 side portion, and is rapidly displaced downward.

Accordingly, even when the spacing between the portion on the free end 8B side of the movable member 8 and the heat generating member 4 is large, or even when the movable member 8 has a high rigidity, the time lag can be prevented since the instance of the bubble on the liquid supply port 5 side starting shrinkage to the liquid supply port 5 being opened by the displacement of the movable member 8. As a result, the delay in refilling the liquid flow path 3 with the ink from the common liquid supply chamber 6 can be prevented, thereby the liquid flow path 3 can be refilled with ink more efficiently.

[Variation]

Figure 117:
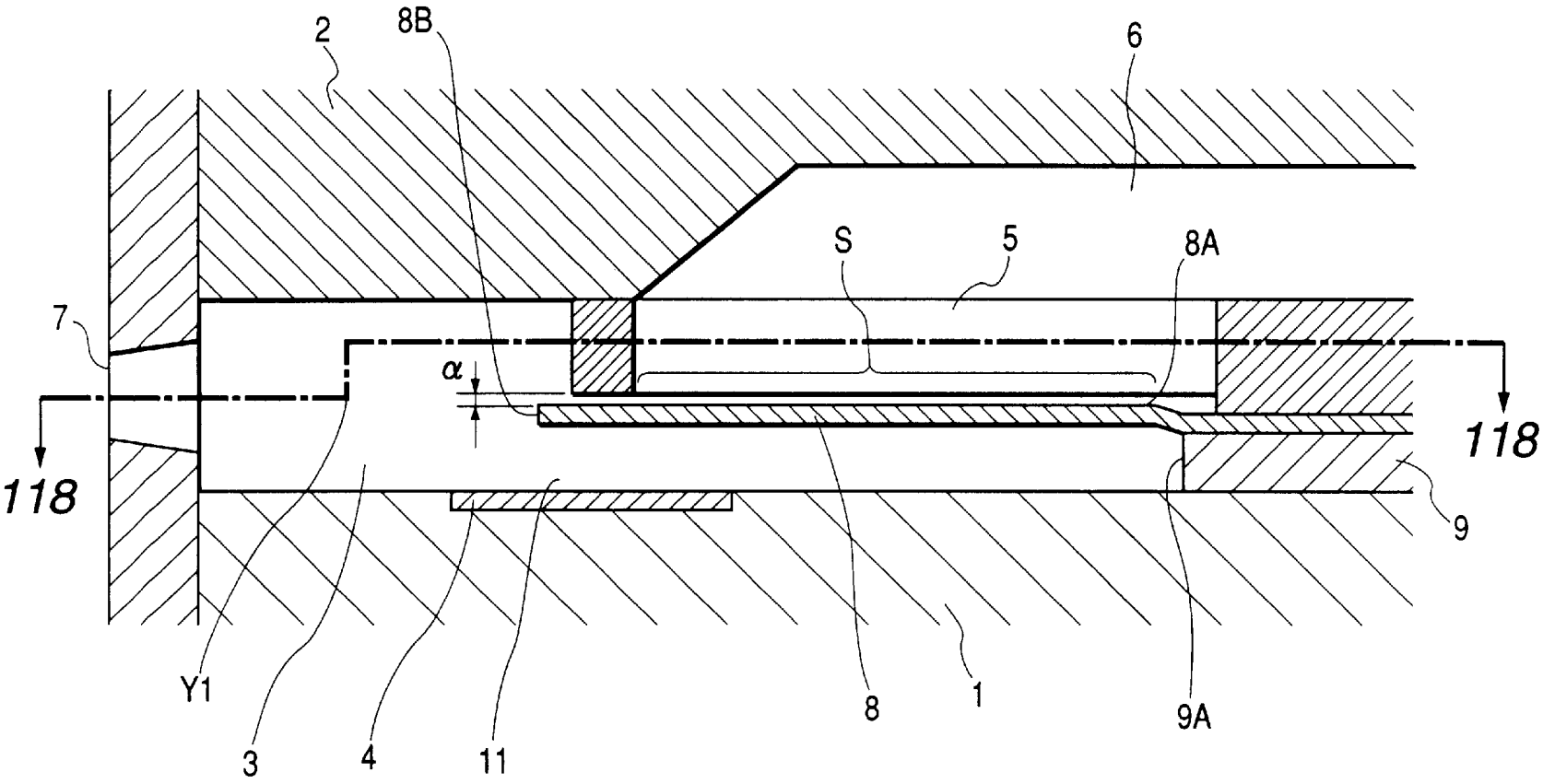
Figure 118:
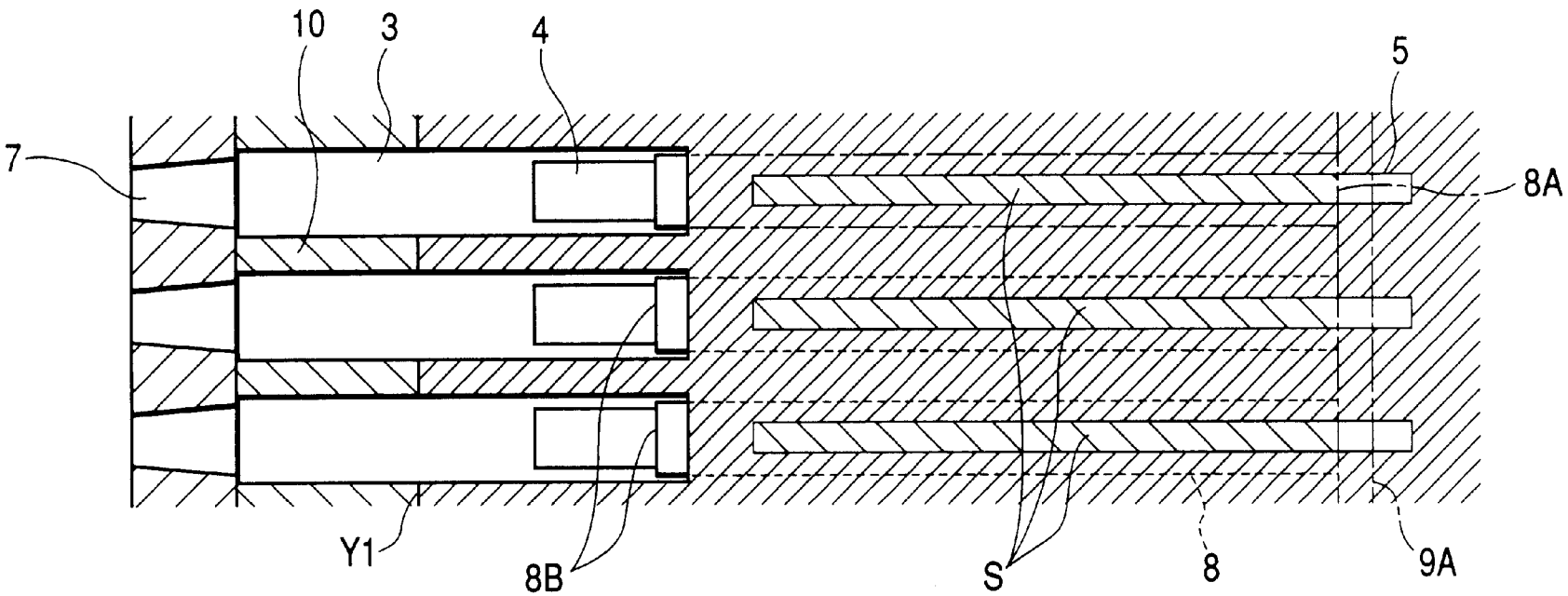

In the structure of the liquid discharge head in accordance with this embodiment, the very end of the movable member 8-fixed member 9 junction (that is, the point at which the movable member 8 is bent and raised) does not correspond to the end portion 9A of the fixed member 9; accordingly, the opening area S is defined as the area surrounded by three sides of the liquid supply port 5 and the end portion 9A of the fixed member 9, as shown in FIGS. 108 and 110. However, the point at which the movable member 8 is bent and raised from the fixed member 9 may correspond to the end portion 9A of the fixed member 9, as shown in FIGS. 117 and 118. In this variation, the opening area S is defined as the area surrounded by three sides of the liquid supply port 5 and the fulcrum 8A of the movable member 8, as shown in FIGS. 110 and 111.

Figure 119:
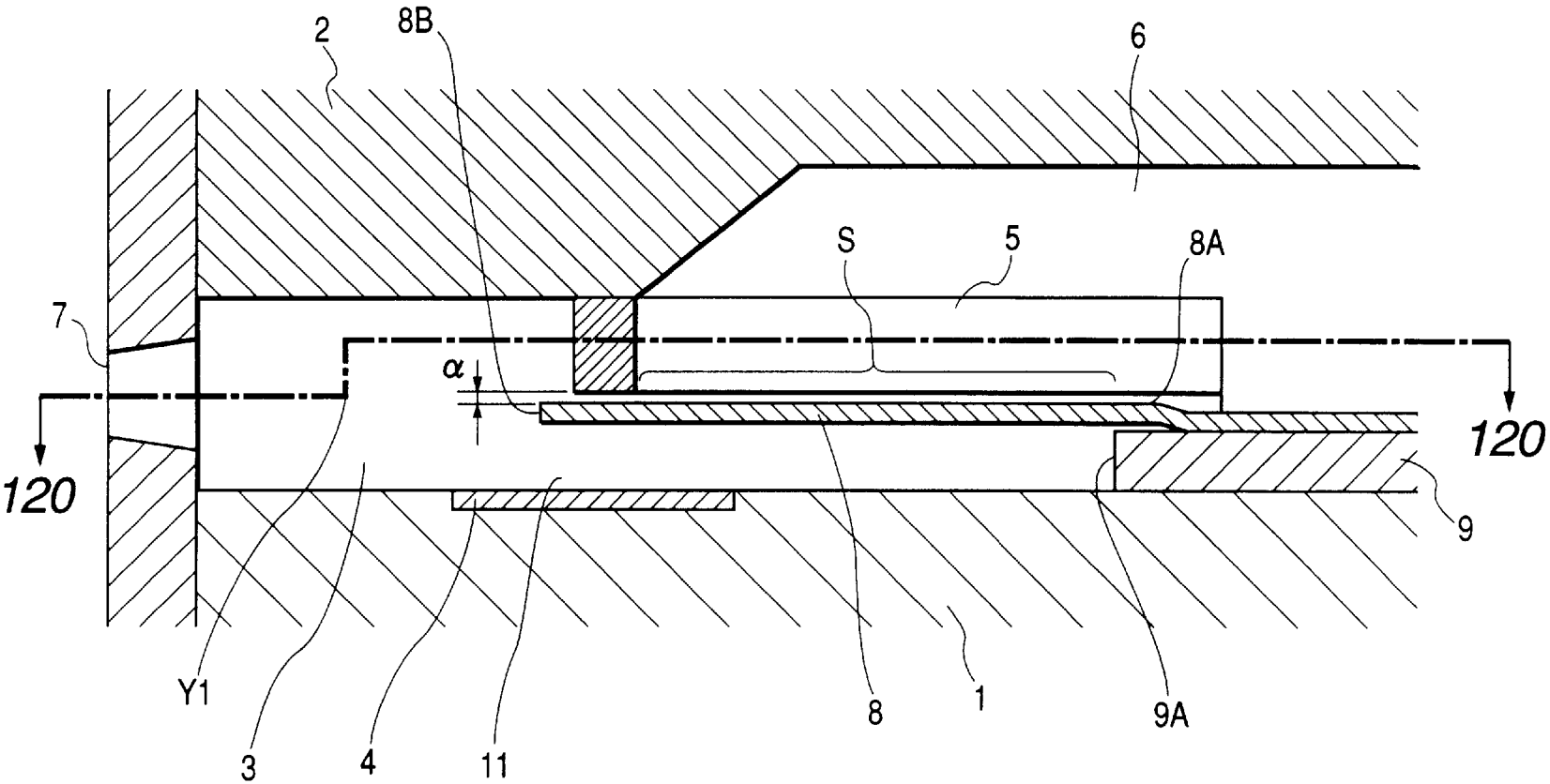
Figure 120:
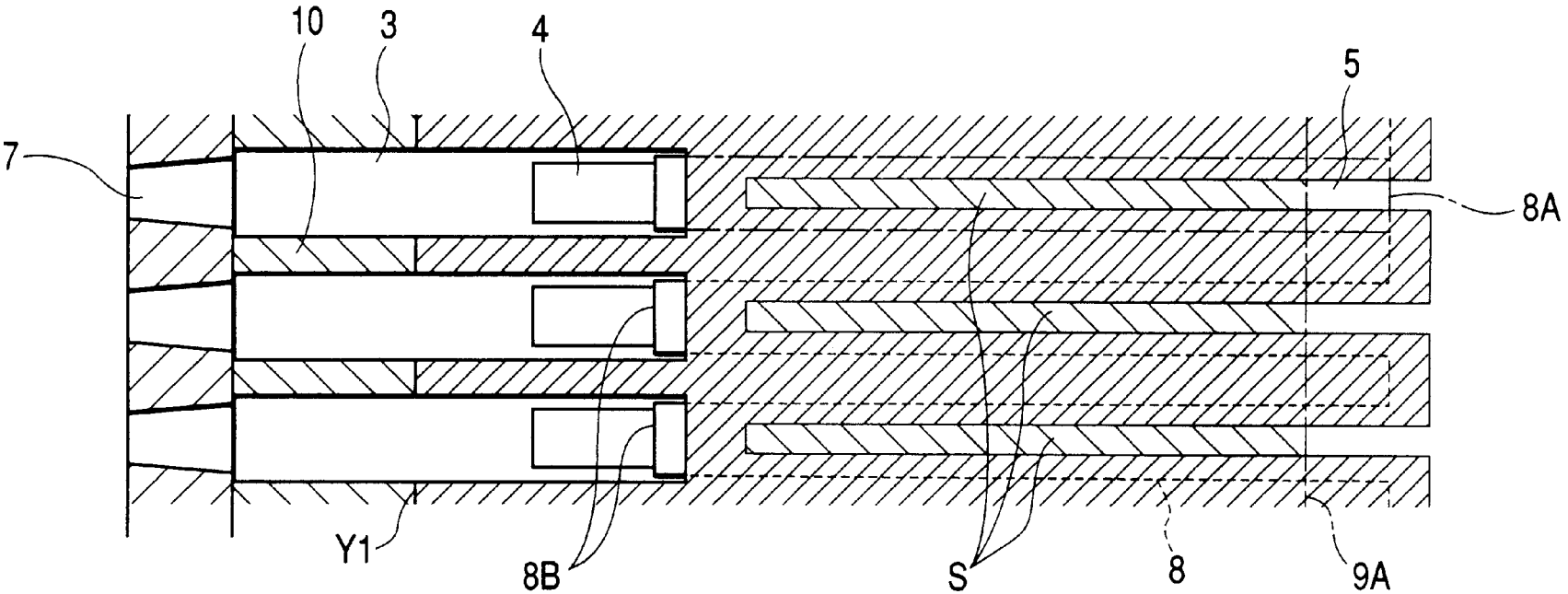

In the structure of the liquid discharge head in accordance with this embodiment, the liquid supply port 5 is defined as the opening surrounded by four walls, as shown in FIGS. 110; however, the wall on the common liquid supply chamber 6 side, which is opposite to a discharge port 7 side, of a supply portion forming member 5A (refer to FIG. 108) may be opened, as shown in FIGS. 119 and 120. In this variation, the opening area S is defined as the area surrounded by three sides of the liquid supply port 5 and the end portion 9A of a fixed member 9, like this embodiment, as shown in FIGS. 119 and 120.

In the liquid discharge head having such a structure, too, as shown in FIGS. 117 and 119 the free end 8B of the movable member 8 is in the position closer to the discharge port 7 than the end surface 5C, which is a side surface on the discharge port 7 side of the supply portion forming member 5A, and the tip on the discharge port 7 side of the movable member 8 is projected relative to the end surface 5C of the supply portion forming member 5A which forms the liquid supply port 5. This enables the improvement in the efficiency in refilling the liquid flow path 3 with ink from the common liquid supply chamber 6 during the ink discharge operation.

Ninth Embodiment

In the following a substrate will be described which is suitably used for various types of liquid discharge heads as described above.

Circuits and elements for driving the heat generating member 4 of the liquid discharge heads as described above or those for controlling the above driving are arranged on either of the element substrate 1 or the top board 2 in a divided manner according to their respective functions. Since the element substrate 1 and the top board 2 consist of silicon materials, these circuits and elements can be formed easily and minutely using the semiconductor wafer process technique.

Now the structure of the element substrate 1 formed using the semiconductor wafer process technique will be described.

FIG. 128 is a cross-sectional view of an element substrate 1 for use in liquid discharge heads in accordance with various embodiments described above. In the element substrate 1 shown in FIG. 128, a thermal oxide film 202 as a thermal storage layer and an interlayer film 203 also serving as a thermal storage layer are stacked on the surface of a silicon substrate 201 in this order. For the interlayer film 203, a $SiO_2$ film or a $Si_{3N4}$ film is used. On part of the surface of the interlayer film 203 formed is a resistor layer 204, and on part of the resistor layer 204 a wiring 205 is formed. For the wiring 205 used is an Al wiring or an Al alloy wiring such as Al—Si or Al—Cu wiring. On the surface of the wiring 205, the resistor layer 204 and the interlayer film 203, a protective film 206 is formed which consists of a $SiO_2$ film or a $Si_3N_4$ film. On the portion of the surface of the protective layer 206 corresponding to the resistor layer 204 and its vicinities, a cavitation-resistant film 207 is formed so as to protect the protective layer 206 against the chemical and physical impacts caused by the heat generation of the resistor layer 204. The area on the surface of the resistor layer 204 on which the wiring 205 is not formed is a heat application portion 208 to which the heat of the resistor layer 204 is applied.

These films on the element substrate 1 are formed on the silicon substrate 201 in order by the semiconductor manufacturing technique, and the heat application portion 208 is provided for the silicon substrate 201.

FIG. 129 is a schematic view in vertical section of the element substrate 1 of FIG. 128 showing the main elements thereof.

As seen from FIG. 129, an N-type well area 422 and a P-type well area 423 are provided on part of the surface layer of the silicon substrate 201 which is a P-type conductive material. And a P-Mos 420 and an N-Mos 421 are provided in the N-type well area 422 and P-type well area 423, respectively, by the impurity introduction and diffusion, such as ion plantation, using the Mos process in common use. The P-Mos 420 consists of, for example, a source area 425 and a drain area 426, which are formed by introducing N- or P-type impurity to part of the surface layer of the N-type well area 422, and a gate wiring 435 deposited on the part of the N-type well area 422 other than the source area 425 and the drain area 426 via a gate insulating film 428 several hundreds Å wide. And the N-Mos 421 consists of, for example, a source area 425 and a drain area 426, which are formed by introducing N- or P-type impurity to part of the surface layer of the P-type well area 423, and a gate wiring 435 deposited on the part of the surface layer of the P-type well area 423 other than the source area 425 and the drain area 426 via a gate insulating film 428 several hundreds Å wide.

The gate wiring 435 consists of polysilicon 4000 Å to 5000 Å thick deposited by the CVD method. These P-Mos 420 and N-Mos 421 constitute a C-Mos logic.

An N-Mos transistor 430 for driving an electrothermal converting element is provided in the part of the P-type well area 423 different from the N-Mos 421. The N-Mos transistor 430 also consists of, for example, a source area 432 and a drain area 431, which are formed on part of the surface layer of the P-type well area 423 by the impurity introduction and diffusion process, and a gate wiring 433 deposited on the part of the surface layer of the P-type well area 423 other than the source area 432 and the drain area 431 via the gate insulating film 428.

Although the N-Mos transistor 430 was used as a transistor for driving an electrothermal converting element, any transistors can be used as long as they are capable of driving more than one electrothermal converting elements individually and provide such a minute structure as described above.

An oxide film separating area 424 5000 Å to 10000 Å thick is formed between two adjacent elements, for example between the P-Mos 420 and the N-Mos 421 and between the N-Mos 421 and the N-Mos transistor 430, by the field oxidation, so as to separate the adjacent elements from each other. The portion of the oxide film separating area 424 corresponding to the heat application portion 208 functions as the first thermal storage layer 434 of the silicon substrate 201, as seen from the surface side of the silicon substrate 201.

An interlayer insulating film 436 consisting of a PSG film or a BPSG film about 7000 Å thick is formed on the surface of each element, P-Mos 420, N-Mos 421 and N-Mos transistor 430 by the CVD method. After planarizing the interlayer insulating film 436 by heat treatment, wiring is formed with Al electrodes 437, which is to be a first wiring layer, via a contact hole passing through the interlayer insulating film 436 and the gate insulating film 428. On the surface of the interlayer insulating film 436 and the Al electrodes 437, an interlayer insulating film 438 consisting of $SiO_2$ film 10000 Å to 15000 Å thick is formed by the plasma CVD method. And a resistor layer 204 consisting of $TaN_{0.8}$, hex film about 1000 Å thick is formed on the portion on the surface of the interlayer insulating film 438 corresponding to the heat application portion 208 and the N-Mos transistor 430 by the DC spattering method. The resistor layer 204 is electrically connected to the A1 electrodes 437 near the drain area 431 via a through hole formed in the interlayer insulating film 438. On the surface of the resistor layer 204 formed is an Al wiring 205 as a second wiring layer connected to each electrothermal converting element.

The wiring 205, the resistor layer 204, and the protective film 206 on the surface of the interlayer insulating film 438 consist of $Si_3N_4$ film 10000 Å thick formed by the plasma CVD method. The cavitation-resistant film 207 deposited on the surface of the protective film 206 consists of a thin film about 2500 Å thick of at least one amorphous alloy selected from the group consisting of Ta (tantalum), Fe (iron), Ni (nickel), Cr (chromium), Ge (germanium) and Ru (ruthenium).

Other Embodiments

In the following various embodiments suitable for the liquid discharge head using the liquid discharge principle of the present invention will be described.

<Side-Shooter Type>

FIGS. 18, 34, 73, 88, 106 and 121 are cross-sectional views of side-shooter type liquid discharge heads corresponding to the liquid discharge heads having the configurations in accordance with the first, second, fifth, sixth, seventh and eighth embodiments described above, respectively. In the description of these side-shooter type liquid discharge heads, the same constituents as those of the embodiments described above shall be denoted with the same reference numerals. As shown in FIGS. 18, 34, 73, 88, 106, and 121, the liquid discharge heads of this type are different from those of the embodiments described above in that a heat generating member 4 and a discharge port 7 are facing each other on two different planes parallel to each other and a liquid flow path 3 is in communication with the discharge port 7 in such a manner as to be perpendicular to the axis in the direction in which liquid is discharged from the discharge port 7. The liquid discharge heads of this type also have such effects as described above based on the same discharge principle as those of the embodiments described above do.

<Movable Member>

In the embodiment described above, the materials forming the movable member should be such that they have good solvent resistance to the discharge liquid and sufficient elasticity to satisfactorily operate as a movable member.

The desirable materials for the movable member includes: in terms of its durability, metals such as silver, nickel, gold, iron, titanium, aluminum, platinum, tantalum, stainless steel and phosphor bronze; alloys thereof; or resins with a nitrile group such as acrylonitrile-butdiene-styrene; resins with amide groups such as polyamides; resins with carboxyl groups such as polycarbonates; resins with aldehyde groups such as polyacetals; resins with sulfone groups such as polysulfones; other resins such as liquid crystal polymers; and compounds thereof; in terms of resistance to ink, metals such as gold, tungsten, tantalum, nickel, stainless steel and titanium; alloys thereof; materials coated therewith; resins with amide groups such as polyamides; resins with aldehyde groups such as polyacetals; resins with ketone groups such as Poly(ether ether ketone); resins with imide groups such as polyimides; resins with a hydroxyl group such as phenolic resins; resins with ethyl groups such as polyethylenes; resins with alkyl groups such as polypropylenes; resins with an epoxy group such as epoxy resins; resins with amino groups such as melamine resin; resins with methylol groups such as xylene resins; compounds thereof; and ceramics such as silicon dioxide and silicon nitride; compounds thereof. For the movable member of the present invention, thickness of the order of $\mu$m is contemplated.

Then the arrangement of the heat generating member and the movable member will be described. An effective use of liquid flow can be achieved by arranging the heat generating member and the movable member optimally so as to properly control the liquid flow during the bubbling with a heat generating member.

In the prior arts of ink jet recording method, what is called bubble jet recording method, which forms an image on a recording medium by applying energy, such as heat energy, to ink so as to cause a change in the state of the ink involving a steep volume change (formation of bubble) and utilizing the force produced by the above change and acting on the ink to discharge the ink from a discharge port, it is apparent from FIG. 127 that, although the area of the heat generating member is proportional to the amount of the ink discharged, as shown by the broken line, there exists a non-bubbling effective area S which does not contribute to discharging ink. It is also apparent from the state of char left on the heat generating member that the non-bubbling effective area S exists around the heat generating member. And it has been considered from these results that the periphery of the heat generating member up to about 4 $\mu$m wide does not contribute to the bubbling. On the other hand, in the liquid discharge head of the present invention, since the liquid flow path including the bubble forming means is substantially sealed except at the discharge port, the maximum discharge amount is regulated and there exists an area where the discharge amount does not change even if variation in the area of the heat generating member and the bubbling power is large, as shown by the solid line of FIG. 127, and utilizing this area enables the discharge amount for a large dot to be stabilized.

<Element Substrate>

In the following the construction of the element substrate 1 will be described which is provided with a heat generating member 10 for providing heat to liquid.

FIGS. 19A, 19B, 35A, 35B, 74A, 74B, 89A, 89B, 107A, 107B, 122A and 122B are views in section along one of the liquid flow paths of the liquid discharge heads in accordance with the first, second, fifth, sixth, seventh and eighth embodiments described above, respectively, showing the main part thereof. All of the liquid discharge heads of FIGS. 18A, 35A, 74A, 89A, 107A, and 122A are provided with protective films, respectively, but on the other hand those of FIGS. 18B, 35B, 74B, 89B, 107B, and 122B are not.

A top board 2 is provided on the element substrate 1 and between the element substrate 1 and the top board 2 a liquid flow path 3 is formed.

The element substrate 1 is produced by forming a silicon oxide film or silicon nitride film 106, which is for insulation or thermal storage, on a silicon substrate 107 and patterning an electric resistance layer 105 (0.01 to 0.2 $\mu$m thick) of, for example, hafnium boride ($HfB_2$), tantalum nitride (TaN) and tantalum aluminum (TaAl) for forming a heat generating member 10 and wiring electrodes 104 (0.2 to 1.0 $\mu$m thick) of, for example, aluminum on thereon, as shown in FIGS. 18A, 35A, 74A, 89A, 107A, and 122A. Voltage is applied to the resistance layer 105 from the wiring electrodes 104 to pass a current therethrough, so as to allow the resistance layer to generate heat. On the resistance layer 105 between the wiring electrodes 104, formed is a protective film 103 of, for example, silicon oxide or silicon nitride 0.1 to 2.0 $\mu$m thick, on which a cavitation-resistant layer 102 (0.1 to 0.6 $\mu$m thick) of, for example, tantalum is also formed, so as to protect the resistance layer 105 against various liquid such as ink.

In particular, the pressure and shock wave produced at the time of bubble formation as well as bubble disappearance is so strong that the durability of the hard and brittle oxide film is reduced markedly; accordingly, a metal material, tantalum (Ta), or the like is used for the cavitation-resistant layer 102.

Depending on the combination of liquid, the construction of the liquid flow path and the resistance material, the construction of the element substrate 1 may be such that it requires no protective film 103 on the above resistance layer 105. The examples are shown in FIGS. 19B, 35B, 74B, 89B, 107B, and 122B. The materials for the resistance layer 105 in cases where the protective layer 103 is not required include, for example, iridium-tantalum-aluminum alloy.

As described above, the heat generating member 4 in accordance with the above embodiments may consist of the resistance layer 105 (heat generating portion) between the electrodes 104 alone or include the protective layer 103 for protecting the resistance layer 105.

Although each embodiment described so far has a heat generating portion consisting of the resistance layer 105, which generates heat in response to electric signals, as a heat generating member 4, the present invention is not intended to be limited to those examples. Any heat generating members may be used as well as they are capable of bubbling liquid sufficiently enough to discharge the discharge liquid. For example, the heat generating member 4 may be a photothermal converting element which generates heat when receiving light such as laser beams or a heat generating element having a heat generating portion which generates heat when receiving high frequency.

The above element substrate 1 may comprise not only the heat generating member 4 consisting of the resistance layer 105 forming a heat generating portion and the wiring electrodes 104 for supplying electric signals to the resistance layer 105, but also functional elements, such as transistor, diode, latch and shift resister, for selectively driving the heat generating member 4 (electrothermal converting element) which are integrally formed in the semiconductor manufacturing process.

In order to discharge liquid by driving the heat generating portion of the heat generating member 4 provided on the element substrate 1 described above, a rectangular pulse as shown in FIG. 130 is applied to the above resistance layer 105 via the wiring electrodes 104 and allows the resistance layer 105 between the wiring electrodes 104 to generate heat steeply. In the liquid discharge heads in accordance with the embodiments described above, ink as a liquid is discharged from the discharge port 7 by driving the heat generating member under a voltage of 24 V, a pulse width of 7 $\mu$sec, a current of 150 mA and electric signals at 6 kHz and performing the operation described above. However, the requirement of the driving signals is not limited to the above example, any driving signals can be applicable as long as they can properly bubble the liquid to be bubbled.

<Discharge Liquid>

As liquid for use in recording (recording liquid), ink may be used which has the same composition as that has been used in the bubble jet recording apparatus in current use.

However, the liquid is desirably such that its characteristics do not interfere with the discharge and bubbling, or the operation of the movable member.

Highly viscous ink can also be used as the discharge liquid for recording.

In the present invention, recording has been performed using dye ink having the composition shown in Table 1, as one example of the recording liquids used as discharge liquid.

TABLE 1

| | | |
|---|---|---|
| Dye Ink with Viscosity of 2 cP | (C.I. Food Black 2) Dye | 3 wt % |
| | Diethylene Glycol | 10 wt % |
| | Thiodiglycol | 6 wt % |
| | Ethanol | 3 wt % |
| | Water | 77 wt % |

Even when using the ink having the above composition, the use of the liquid discharge heads of the present invention improves the discharge power and increases the discharge speed; consequently, the impact accuracy of the liquid droplets is improved, thereby very satisfactory recording images can be obtained.

<Liquid Discharge Apparatus>

FIG. 131 is a schematic view of an ink jet recording apparatus as one example of liquid discharge apparatus which can be equipped with a liquid discharge head having the same structure as the liquid discharge heads described in the above various embodiments. A head cartridge 601 mounted on the ink jet recording apparatus 600 shown in FIG. 131 includes a liquid discharge head having the same structure as described above and a liquid container for containing the liquid to be supplied to the above liquid discharge head. The head cartridge 601 is mounted on a carriage 607 which engages a spiral groove 606 of a lead screw 605 rotating with the forward and backward rotation of a driving motor 602 via drive transmission gears 603 and 604. The head cartridge 601, together with the carriage 607, is allowed to perform a reciprocating motion along the guide 608 in the direction of a and b by the power from the driving motor 602. For the ink jet recording apparatus 600 provided is a recording medium conveying means (not shown in the figure) for conveying print paper P, as a recording medium, which receives liquid such as ink discharged from the head cartridge 601. A paper holding plate 610 for holding print paper P, which is conveyed on a platen 609 by the recording medium conveying means, presses the print paper P against the platen 609 all through the width of the print paper in the direction in which the carriage 607 moves.

Photo couplers 611 and 612 are disposed near one end of the lead screw 605. The photo couplers 611 and 612 are home position detecting means for detecting the presence of the lever 607*a* of the carriage 607 in the area of the photo couplers 611 and 612 and changing the rotational direction of the driving motor 602. A supporting member 613 for supporting a cap member 614, which covers the front surface of the head cartridge 601 with a discharge port thereon, is provided near one end of the platen 609. An ink suction means 615 for suctioning the ink accumulated within the cap member 614 due to the bad discharge from the head cartridge 601 is also provided near the same. The ink suction means 615 performs suction recovery of the head cartridge 601 via the opening portion of the cap member 614.

The ink jet recording apparatus 600 is provided wit a body supporting member 619. A movable member 618 is supported by the body supporting member 619 in such a manner that it can move back and force, in other words, it can move in the direction perpendicular to the direction in which the carriage 607 moves. A cleaning blade 617 is attached to the movable member 618. The present invention is not intended to be limited to this type of cleaning blade 617, the other types of cleaning blades known may be applicable to the present invention. A lever 620 is provided for starting to suction in the recovery suction operation with the ink suction means 615, the lever 620 moving with the movement of a cam 621 which engages the carriage 607 and its movement being controlled by the driving force from the driving motor 602 via a known transmission means such as engaging or disengaging a clutch. The ink jet recording controlling portion, which sends signals to the heat generating member provided in the head cartridge 601 and controls the driving of each mechanism described above, is provided on the recording apparatus body side and not shown in the FIG. 131.

In the ink jet recording apparatus 600 having the construction described above, the head cartridge 601 performs a reciprocating motion over the print paper P conveyed on the platen 609 by the recording medium conveying means described above all though its width. If a driving signal is supplied to the head cartridge 601 from a driving signal supplying means not shown in the figure during this reciprocating motion, in response to the signal, ink (recording liquid) is discharged from the liquid discharge head portion toward the recording medium, thereby recording is performed.

FIG. 132 is a block diagram of the entire recording apparatus for performing ink jet recording with a liquid discharge apparatus.

The recording apparatus receives printing information as a controlling signal from a host computer 300. The printing information is temporarily stored in an input interface 301 within the printing apparatus while being converted into data processable in the recording apparatus, and input into a CPU (central processing unit) 302 which also serves as a head driving signal supplying means. The CPU 302 processes the data having been input thereinto using peripheral units such as RAM (random access memory) 304 based on the control program stored in a ROM (read only memory) 303 and converts them into printing data (image data).

The CPU 302 creates driving data for driving the driving motor 602 which moves the recording paper and the carriage 607 mounted with the head cartridge 601 synchronously with the image data. The image data as well as the motor driving data are transmitted to the head cartridge 601 and the driving motor 602 via a head driver 307 and a motor driver 305 respectively, and are driven at respective controlled timing so as to form an image.

Various types of paper and OHP sheets, plastic materials for use in compact discs and decorative boards, textiles, metal materials such as aluminum and copper, cow skin, pig skin, artificial leathers, wood, wood materials such as plywood, bamboo materials, ceramic materials such as tiles, three dimensional structure such as sponges can be as the objects of the recording medium 150 for use in various recording apparatus described above and provided with liquid such as ink.

The recording apparatus include, for example, printing apparatus for performing printing on various types of paper and OHP sheets, recording apparatus for recording on plastic materials such as compact discs, recording apparatus for recording on metal plates, recording apparatus for recording on leathers, recording apparatus for recording on wood materials, recording apparatus for recording on ceramic materials and recording apparatus for recording three dimensional structure such as sponges, and textile printing apparatus for recording on textiles.

As the discharge liquid for use in these liquid discharge apparatus, any types of liquid can be used as long as they are suitable for the recording medium used and recording conditions under which recording is performed.

What is claimed is:

1. A liquid discharge head, having a plurality of discharge ports to discharge a liquid, a plurality of liquid flow paths, in which an end part permanently communicates with said respective discharge ports, having a bubble generating area to generate a bubble in the liquid, bubble generating means to generate energy to generate and grow the bubble, a plurality of liquid supply ports arranged in said plurality of liquid flow paths and communicating with a common liquid supply chamber, and a movable member, having a free end, supported with a very small gap by at least part of said liquid flow path side of said liquid supply port, the area surrounded by at least an edge of the free end of said movable member and both sides of said movable member being larger than an opening area prepared in the liquid flow path of said liquid supply port, wherein, in a status of said movable member at rest, the part of said discharge port side of said movable member contacts with a member for forming said liquid supply port and a very small gap is placed between the part of a fulcrum side of said movable member and said liquid supply port.

2. The liquid discharge head according to claim 1, wherein in the status of said movable member at rest, the part of said discharge port side of said movable member presses the member for forming said liquid supply port to curve elastically convexly said movable member toward said liquid supply port side.

3. The liquid discharge head according to claim 1, wherein in the status of said movable member at rest, the part of said discharge port side of said movable member contacts with the member for forming said liquid supply port and the very small gap is placed between a side part in the part of a fulcrum side of said movable member and the member to form said liquid supply port.

4. A liquid discharge head according to claim 1, wherein in a state that said movable member is stationary, said movable member is in contact at an leading end thereof with a member for forming said liquid discharge port.

5. A liquid discharge apparatus, having the liquid discharge head according to claim 1 and recording medium-carrying means to carry a recording medium, which receives a liquid discharged from the liquid discharge head.

6. A recovery method of the liquid discharge head according to claim 1, wherein in the liquid discharge head, the movable member has a communication port around a supporting end in a side opposite to the free end to allow the liquid supply port to communicate with the liquid flow path, the free end of the movable member is adapted to be displaced to the liquid supply port side and the bubble generating means in the liquid flow path, in addition, in displacement from a standing position of the free end of the movable member, displacement to the bubble generating means is larger than displacement to the liquid supply port side, in the period while the whole of the bubble generated grows substantially isotropically by the bubble generating means, the movable member closes the liquid supply port to shut it substantially, and in a recovery action to suck the liquid in the liquid flow path through the discharge port, the liquid flow flowing in the area covered by the movable member of the liquid flow path occurs from the liquid supply port through the communication port.

7. A recovery method of the liquid discharge head according to claim 1, wherein in the liquid discharge head, the movable member has a communication port around a supporting end in the side opposite to the free end to allow the liquid supply port to communicate with the liquid flow path, the free end of the movable member is adapted to be displaced to the liquid supply port side and the bubble generating means in the liquid flow path, in addition, in displacement from a standing position of the free end of the movable member, displacement to the bubble generating means is larger than displacement to the liquid supply port side, the liquid discharge head has the period from application of a driving voltage to the bubble generating means until the period while the whole of the bubble is substantially isotropically grown by the bubble generating means, is terminated, the movable member closes tightly the opening area to shut substantially, and in the recovery action to suck the liquid in the liquid flow path through the discharge port, the liquid flow flowing in the area covered by the movable member of the liquid flow path occurs from the liquid supply port through the communication port.

8. The liquid discharge head according to claim 1, wherein the free end of said movable member is adapted to be displaced to said liquid supply port side and said bubble generating means in said liquid flow path, in addition, in displacement from a standing position of the free end of said movable member, displacement to said bubble generating means is larger than displacement to said liquid supply port side, in the period while the whole of the bubble generated grows substantially isotropically by said bubble generating means, said movable member closes the liquid supply port to shut it substantially, and said movable member has the communication port around a supporting end in the side opposite to said free end to allow said liquid supply port to communicate with said liquid flow path.

9. The liquid discharge head according to claim 8, wherein the displacement of the free end of said movable member, if displacement to said liquid supply port side in said liquid flow path in the early period of said bubble is assumed as h1 and displacement to said bubble generating means in said liquid flow path together with disappearance of said bubble is assumed as h2, always satisfies the relation h1<h2.

10. The liquid discharge head according to claim 1, wherein the free end of said movable member is adapted to be displaced to said liquid supply port side and said bubble generating means in said liquid flow path, and in addition, in displacement from a standing position of the free end of said movable member, displacement to said bubble generating means is larger than displacement to said liquid supply port side, in the period after the driving voltage is applied to said bubble generating means until the period while the whole of the bubble grows substantially isotropically by said bubble generating means, is terminated, said movable member closes said liquid supply port to shut it substantially, and said movable member has the communication port around a supporting end in the side opposite to said free end to allow said liquid supply port to communicate with said liquid flow path.

11. The liquid discharge head according to claim 1, wherein said movable member is adapted such that an end supported in said liquid flow path and extending in a length direction of said liquid flow path is the free end located around said bubble generating means, is almost parallel to the opening area of said liquid supply port, having a very small gap, when located in the standing position, opens and closes the opening area of said liquid supply port, by moving from the standing position, and a bottom face in an upstream side of said bubble generating means of said liquid flow path from near the end of said liquid supply port of said bubble generating means to around a fulcrum of said movable member forms a slope face and the slope face is located outside a movable area of said movable member.

12. The liquid discharge head according to claim 11, wherein said slope face is a curved face convexed toward movable member.

13. The liquid discharge head according to claim 1, wherein the bottom face in the upstream side of said bubble generating means of said liquid flow path from near the end of said liquid supply port of said bubble generating means to around the fulcrum of said movable member forms the slope face and the slope face is located outside a movable area of said movable member.

14. The liquid discharge head according to claim 13, wherein said slope face is a curved face convexed toward movable member.

15. A recovery method of the liquid discharge head according to claim 1, wherein while sucking the liquid in the liquid flow path from the discharge port, the bubble is generated by driving the bubble-generating means.

16. A liquid discharge method of the liquid discharge head according to claim 1, wherein in the liquid discharge head, the fulcrum in the side opposite to the free end of the movable member is arranged in the common liquid supply chamber, a communication part to allow the common liquid supply chamber to communicate with the area covered by the movable member of the liquid flow path is formed around the fulcrum of the movable member, the free end of the movable member is adapted to be displaced to be displaced to the liquid supply port side and the bubble generating means in the liquid flow path, and in addition, in displacement from a standing position of the free end of the movable member, displacement to the bubble generating means is larger than displacement to the liquid supply port side, in the period while the whole of the bubble generated grows substantially isotropically by the bubble generating means, the movable member closes the liquid supply port to shut it substantially, and when the liquid flows in the liquid flow path from the common liquid supply chamber through the gap between the liquid supply port and the movable member, flow of the liquid flowing from the common liquid supply chamber to the area of the liquid flow path covered by the movable member through the communication part is generated.

17. The liquid discharge method according to claim 16, wherein after the liquid supply port is substantially shut by the movable member, during an early period, while part of the bubble generated by the bubble generating means in the discharge port grows and during a subsequent period, while the part of the bubble in the liquid supply port side shrinks, flow of the liquid flowing from the common liquid supply chamber to the liquid flow path through the communication port is generated.

18. The liquid discharge method according to claim 16, wherein between the discharge port side and the liquid supply port side in the bubble generating area, a change of a volume of the bubble grown and the time from occurrence to disappearance of the bubble differ greatly.

19. A liquid discharge method of the liquid discharge head according to claim 1, wherein in the liquid discharge head, the fulcrum in the side opposite to the free end of the movable member is arranged in the common liquid supply chamber, a communication part to allow the common liquid supply chamber to communicate with the area covered by the movable member of the liquid flow path is formed around the fulcrum of the movable member, the free end of the movable member is adapted to be displaced to the liquid supply port side and the bubble generating means in the liquid flow path, in addition, in displacement from a standing position of the free end of the movable member, displacement to the bubble generating means is larger than displacement to the liquid supply port side, in the period after the driving voltage is applied to the bubble generating means up to completion of the period while the whole of the bubble generated grows substantially isotropically by the bubble generating means, the movable member closes tightly the liquid supply port to shut it substantially, and when the liquid flows in the liquid flow path from the common liquid supply chamber through the gap between the liquid supply port and the movable member, flow of the liquid flowing from the common liquid supply chamber to the area of the liquid flow path covered by the movable member through the communication part is generated.

20. The liquid discharge method according to claim 19, wherein after the period while the liquid supply port is substantially shut by the movable member, during an early period while part of the bubble generated by the bubble generating means in the discharge port grows and during a subsequent period, while the part of the bubble in the liquid supply port side shrinks, flow of the liquid flowing from the common liquid supply chamber to the liquid flow path through the communication port is generated.

21. The liquid discharge method according to claim 19, wherein between the discharge port side and the liquid supply port side in the bubble generating area, a change of a volume of the bubble grown and the time from occurrence to disappearance of the bubble differ greatly.

22. The liquid discharge head according to claim 21, wherein the displacement of the free end of said movable member, if displacement to said liquid supply port side in said liquid flow path in the early period of said bubble is assumed as h1 and displacement to said bubble generating means in said liquid flow path together with disappearance of said bubble is assumed as h2, always satisfies the relation $h1<h2$.

23. The liquid discharge head according to claim 1, wherein the free end of said movable member is adapted to be displaced to said liquid supply port side and said bubble generating means in said liquid flow path, and in addition, in displacement from a standing position of the free end of said movable member, displacement to said bubble generating means is larger than displacement to said liquid supply port side, in the period while the whole of the bubble generated grows substantially isotropically by said bubble generating means, said movable member closes the liquid supply port to shut it substantially, and the fulcrum of the opposite side to said free end of said movable member is located in said common liquid supply chamber, and around said fulcrum of said movable member, the communication part to allow said common liquid supply chamber to communicate with the area covered with said movable member of said liquid flow path.

24. The liquid discharge head according to claim 1, wherein the free end of said movable member is adapted to be displaced to said liquid supply port side and said bubble generating means in said liquid flow path, and in addition, in displacement from a standing position of the free end of said movable member, displacement to said bubble generating means is larger than displacement to said liquid supply port side, in the period since the driving voltage is applied to said bubble generating means until the period while the whole of the bubble generated is isotropically grown by said bubble generating means, is terminated, the period while said movable member closes said opening area to shut tightly it substantially, is inserted, said fulcrum opposite to said free end of said movable member is located in said common liquid supply chamber, and around said fulcrum of said movable member, the communication part is formed to communicate said liquid common liquid supply chamber with the area covered by said movable member of said liquid flow path.

25. The discharge method of the liquid discharge head according to claim 1, wherein in the liquid discharge head, the free end of the movable member is adapted to be displaced to the liquid supply port side and the bubble generating means side in the liquid flow path, and in addition, in displacement from a standing position of the free end of the movable member, displacement to the bubble generating means side is larger than displacement to the liquid supply port side, in the period while the whole of the bubble generated grows isotropically by the bubble generating means, the movable member closes the liquid supply port to shut it substantially, a small slit, which allows the liquid supply port to communicate with the liquid flow path even in the status in which the movable member closes the liquid supply port, is formed in the part of the discharge port side of the member forming the liquid supply port, after the movable member closes the liquid supply port to shut it substantially, in the early period, while the part of the bubble generated by the bubble generating means, in the discharge port grows and while the part of the bubble in the liquid supply port side shrinks, the liquid flow occurs flowing from the liquid supply port to the liquid flow path through the slit.

26. The liquid discharge method according to claim 25, wherein between the discharge port side and the liquid supply port side in the bubble generating area, the change of the volume of the bubble grown and the time from occurrence to disappearance of the bubble differ greatly.

27. The discharge method of the liquid discharge head according to claim 1, wherein in the liquid discharge head, the free end of the movable member is adapted to be displaced to the liquid supply port side and the bubble generating means side in the liquid flow path, and in addition, in displacement from the standing position of the free end of the movable member, displacement to the bubble generating means side is larger than displacement to the liquid supply port side, in the period after the driving voltage is applied to the bubble generating means up to completion of the period while the whole of the bubble generated grows isotropically by the bubble generating means, the movable member closes the opening area to shut it substantially tightly, a small slit, which allows the liquid supply port to communicate with the liquid flow path even in the status in which the movable member closes the liquid supply port, is formed in the part of the discharge port side of the member forming the liquid supply port, after the movable member closes the liquid supply port to shut it substantially, in the early period, while the part of the bubble generated by bubble generating means in the discharge port side grows and while the part of the bubble in the liquid supply port side shrinks, the liquid flow occurs flowing from the liquid supply port to the liquid flow path through the slit.

28. The liquid discharge method according to claim 27, wherein between the discharge port side and the liquid supply port side in the bubble generating area, the change of the volume of the bubble grown and the time from occurrence to disappearance of the bubble differ greatly.

29. The liquid discharge head according to claim 1, wherein the free end of said movable member is adapted to be displaced to said liquid supply port side and said bubble generating means side in said liquid flow path, and in addition, in displacement from a standing position of the free end of said movable member, displacement to said bubble generating means side is larger than displacement to said liquid supply port side, in the period while the whole of the bubble generated grows isotropically by said bubble generating means, said movable member closes said liquid supply port to shut it substantially, a small slit, which allows said liquid supply port to communicate with said liquid flow path even in the status in which said movable member closes said liquid supply port, is formed in the part of said discharge port side of the member forming said liquid supply port.

30. The liquid discharge head according to claim 29, wherein the displacement of the free end of said movable member, if displacement to said liquid supply port side in said liquid flow path in the early period of said bubble is assumed as h1 and displacement to said bubble generating means side in said liquid flow path together with disappearance of said bubble is assumed as h2, always satisfies the relation $h1<h2$.

31. The liquid discharge head according to claim 1, wherein the free end of said movable member is adapted to be displaced to said liquid supply port side and said bubble generating means side in said liquid flow path, and in addition, in displacement from a standing position of the free end of said movable member, displacement to said bubble generating means side is larger than displacement to said liquid supply port side, in the period since the driving voltage is applied to said bubble generating means until the period while the whole of the bubble generated is isotropically grown by said bubble generating means, is terminated, the period while said movable member closes said opening area to shut it substantially tightly, is inserted, a small slit, which allows said liquid supply port to communicate with said liquid flow path even in the status in which said movable member closes said liquid supply port, is formed in the part of said discharge port side of the member forming said liquid supply port.

32. The liquid discharge head according to claim 1, wherein an end of said discharge port side of said movable member projects to said discharge port side rather than the end face of said discharge port side in the member for forming said liquid supply port.

33. A liquid discharge head, having:

a discharge port to discharge a liquid, a liquid flow path, in which one end permanently communicates with said discharge port, having a bubble generating area to generate a bubble in the liquid, a liquid supply port opened in said liquid flow path allow a liquid supply chamber holding the liquid to be supplied to said liquid flow path to communicate with said liquid flow path, and a movable member arranged oppositely to said liquid supply port through the gap in said liquid flow path, making one end of said liquid flow path as a free end, the area surrounded by at least an edge of said free end and both side parts of said movable member being larger than an opening area prepared in said liquid flow path of said liquid supply port, wherein, in the free end of said movable member, the flow path passing from said liquid supply port formed by said gap to said liquid flow path bends.

34. The liquid discharge head according to claim 33, wherein said liquid flow path has a projected part in a position oppositely located to the free end of said movable member through the gap.

35. The liquid discharge head according to claim 33, wherein said discharge port and said bubble generating area are in a linear communication status.

36. The liquid discharge head according to claim 33, wherein said liquid supply port is substantially shut by said movable member during a period, while a whole of bubble generated in said bubble generating area grows is substantially isotropically, and during subsequent period, while the part, of said bubble, in said discharge port side grows and the part in said movable member side shrinks, said movable member is displaced to said bubble generating area to allow liquid supply from said liquid supply chamber to said liquid flow path through said liquid supply port.

37. The liquid discharge head according to claim 33, wherein the free end of said movable member in an early period of the bubble is displaced to said liquid supply port to shut substantially said liquid supply port toward said liquid flow path, and together with disappearance of the bubble, the free end of said movable member is displaced toward said bubble generating area to allow liquid supply from said liquid supply chamber to said liquid flow path through said liquid supply port.

38. The liquid discharge head according to claim 33, wherein from application of a driving voltage to said bubble generating means until the period, while the whole of the bubble is substantially isotropically grown by said bubble generating means, is terminated, said movable member closes tightly said opening area to shut substantially and thereafter, while the part of the bubble generated by said bubble generating means in said discharge port side part grows, said movable member starts to be displaced from the position in which said opening area is closed tightly to shut substantially, to said bubble generating means in said liquid flow path to make liquid supply from said common liquid supply chamber to said liquid flow path possible.

39. A liquid discharge apparatus, having the liquid discharge head according to claim 33 and carrying means to carry the recording medium to receive the liquid discharged from the liquid discharge head.

40. A recovery method of the liquid discharge head according to claim 33, wherein in said liquid discharge head, said movable member has a communication port around a supporting end in a side opposite to said free end to allow said liquid supply port to communicate with said liquid flow path, and said free end of said movable member is adapted to be displaced to said liquid supply port side and said bubble generating means in said liquid flow path, and in addition, in displacement from a standing position of the free end of said movable member, displacement to said bubble generating means is larger than displacement to said liquid supply port side, and in the period while the whole of the bubble generated grows substantially isotropically by said bubble generating means, said movable member closes said liquid supply port to shut it substantially, and in a recovery action to suck said liquid in said liquid flow path through said discharge port, said liquid flow flowing in the area covered by said movable member of said liquid flow path occurs from said liquid supply port through said communication port.

41. A recovery method of the liquid discharge head according to claim 33, wherein in said liquid discharge head, the movable member has the communication port around a supporting end in the side opposite to said free end to allow said liquid supply port to communicate with said liquid flow path, the free end of said movable member is adapted to be displaced to said liquid supply port side and said bubble generating means in said liquid flow path, and in addition, in displacement from a standing position of the free end of said movable member, displacement to said bubble generating means is larger than displacement to said liquid supply port side, said liquid discharge head has the period from application of a driving voltage to said bubble generating means until the period while the whole of the bubble is substantially isotropically grown by said bubble generating means, is terminated, said movable member closes tightly said opening area to shut substantially, and in the recovery action to suck said liquid in said liquid flow path through said discharge port, said liquid flow flowing in the area covered by said movable member of said liquid flow path occurs from said liquid supply port through said communication port.

42. The liquid discharge head according to claim 33, wherein the free end of said movable member is adapted to be displaced to said liquid supply port side and said bubble generating means in said liquid flow path, and in addition, in displacement from a standing position of the free end of said movable member, displacement to said bubble generating means is larger than displacement to said liquid supply port side, in the period while the whole of the bubble generated grows substantially isotropically by said bubble generating means, said movable member closes the liquid supply port to shut it substantially, and said movable member has the communication port around a supporting end in the side opposite to said free end to allow said liquid supply port to communicate with said liquid flow path.

43. The liquid discharge head according to claim 42, wherein the displacement of the free end of said movable member, if displacement to said liquid supply port side in said liquid flow path in the early period of said bubble is assumed as h1 and displacement to said bubble generating means in said liquid flow path together with disappearance of said bubble is assumed as h2, always satisfies the relation $h1<h2$.

44. The liquid discharge head according to claim 33, wherein the free end of said movable member is adapted to be displaced to said liquid supply port side and said bubble generating means in said liquid flow path, and in addition, in displacement from a standing position of the free end of said movable member, displacement to said bubble generating means is larger than displacement to said liquid supply port side, in the period after the driving voltage is applied to said bubble generating means until the period while the whole of the bubble grows substantially isotropically by said bubble generating means, is terminated, said movable member closes said liquid supply port to shut it substantially, and said movable member has the communication port around a supporting end in the side opposite to said free end to allow said liquid supply port to communicate with said liquid flow path.

45. The liquid discharge head according to claim 33, wherein said movable member is adapted such that an end supported in said liquid flow path and extending in a length direction of said liquid flow path is the free end located around said bubble generating means, is almost parallel to the opening area of said liquid supply port, having a very small space, when located in the standing position, opens and closes the opening area of said liquid supply port, by moving from the standing position, and a bottom face in an upstream side of said bubble generating means of said liquid flow path from near the end of said liquid supply port of said bubble generating means to around a fulcrum of said movable member forms a slope face and the slope face is located outside a movable area of said movable member.

46. The liquid discharge head according to claim 45, wherein said slope face is a curved face convexed toward movable member.

47. The liquid discharge head according to claim 33, wherein the bottom face in the upstream side of said bubble generating means of said liquid flow path from near the end of said liquid supply port of said bubble generating means to around the fulcrum of said movable member forms the slope face and the slope face is located outside a movable area of said movable member.

48. The liquid discharge head according to claim 47, wherein said slope face is a curved face convexed toward movable member.

49. A recovery method of the liquid discharge head according to claim 33, wherein while sucking the liquid in the liquid flow path from the discharge port, the bubble is generated by driving the bubble-generating means.

50. The discharge method of the liquid discharge head according to claim 33, wherein in the liquid discharge head, the fulcrum in the side opposite to the free end of the movable member is arranged in the common liquid supply chamber, a communication part to communicate the common liquid supply chamber with the area covered by the movable member of the liquid flow path is formed around the fulcrum of the movable member, the free end of the movable member is adapted to be displaced to the liquid supply port side and the bubble generating means side in the liquid flow path, in addition, in displacement from a standing position of the free end of the movable member, displacement to the bubble generating means side is larger than displacement to the liquid supply port side, in the period while the whole of the bubble generated grows isotropically by the bubble generating means, the movable member closes the liquid supply port to shut it substantially, when the liquid flows in the liquid flow path from the movable member, the liquid flow flowing in the area, of the liquid flow path, covered by the movable member occurs from the common liquid supply chamber through the communication part.

51. The liquid discharge method according to claim 50, wherein after the liquid supply port is substantially shut by the movable member, during an early period, while part of the bubble generated by the bubble generating means in the discharge port grows and during a subsequent period, while the part of the bubble in the liquid supply port side shrinks, the liquid flow occurs flowing from the common liquid supply chamber to the liquid flow path through the communication port.

52. The liquid discharge method according to claim 50, wherein between the discharge port side and the liquid supply port side in the bubble generating area, a change of a volume of the bubble grown and the time from occurrence to disappearance of the bubble differ greatly.

53. The discharge method of the liquid discharge head according to claim 33, wherein in the liquid discharge head, the fulcrum in the side opposite to the free end of the movable member is arranged in the common liquid supply chamber, a communication port to communicate the common liquid supply chamber with the area covered by the movable member of the liquid flow path is formed around the fulcrum of the movable member, the free end of the movable member is adapted to be displaced to the liquid supply port side and the bubble generating means side in the liquid flow path, and in addition, in displacement from a standing position of the free end of the movable member, displacement to the bubble generating means side is larger than displacement to the liquid supply port side, in the period after the driving voltage is applied to the bubble generating means up to completion of the period while the whole of the bubble generated grows isotropically by the bubble generating means, the movable member closes tightly the opening area to shut it substantially tightly, when the liquid flows in the liquid flow path from the common liquid supply chamber through the gap between the liquid supply port and the movable member, the liquid flow flowing in the area, of the liquid flow path, covered by the movable member occurs from the common liquid supply chamber through the communication part.

54. The liquid discharge method according to claim 53, wherein after the period while the liquid supply port is substantially shut by the movable member, during an early period, while part of the bubble generated by the bubble generating means in discharge port grows and during a subsequent period, while the part of the bubble in the liquid supply port side shrinks, the liquid flow occurs flowing from the common liquid supply chamber to the liquid flow path through the communication port.

55. The liquid discharge method according to claim 53, wherein between the discharge port side and the liquid supply port side in the bubble generating area, a change of a volume of the bubble grown and the time from occurrence to disappearance of the bubble differ greatly.

56. The liquid discharge head according to claim 33, wherein the free end of said movable member is adapted to be displaced to said liquid supply port side and said bubble generating means side in said liquid flow path, and in addition, in displacement from a standing position of the free end of said movable member, displacement to said bubble generating means side is larger than displacement to said liquid supply port side, in the period while the whole of the bubble generated grows isotropically by said bubble generating means, said movable member closes the liquid supply port to shut it substantially, the fulcrum of the opposite side to said free end of said movable member is located in said common liquid supply chamber, and around said fulcrum of said movable member, the communication part is formed to communicate said common liquid supply chamber with the area covered with said movable member of said liquid flow path.

57. The liquid discharge head according to claim 56, wherein the displacement of the free end of said movable member, if displacement to said liquid supply port side in said liquid flow path in the early period of said bubble is assumed as h1 and displacement to said bubble generating means side in said liquid flow path together with disappearance of said bubble is assumed as h2, always satisfies the relation h1<h2.

58. The liquid discharge head according to claim 33, wherein the free end of said movable member is adapted to be displaced to said liquid supply port side and said bubble generating means side in said liquid flow path, and in addition, in displacement from a standing position of the free end of said movable member, displacement to said bubble generating means is larger than displacement side to said liquid supply port side, in the period since the driving voltage is applied to said bubble generating means until the period while the whole of the bubble generated is isotropically grown by said bubble generating means, is terminated, the period while said movable member closes said opening area to shut it substantially tightly, is inserted, said fulcrum opposite to said free end of said movable member is located in said common liquid supply chamber, and around said fulcrum of said movable member, the communication part is formed to communicate said liquid common liquid supply chamber with the area covered by said movable member of said liquid flow path.

59. The liquid discharge head according to claim 58, wherein the displacement of the free end of said movable member, if displacement to said liquid supply port side in said liquid flow path in the early period of said bubble is assumed as h1 and displacement to said bubble generating means side in said liquid flow path together with disappearance of said bubble is assumed as h2, always satisfies the relation h1<h2.

60. The discharge method of the liquid discharge head according to claim 33, wherein in the liquid discharge head, the free end of the movable member is adapted to be displaced to the liquid supply port side and the bubble generating means side in the liquid flow path, in addition, in displacement from the standing position of the free end of the movable member, displacement to the bubble generating means side is larger than displacement to the liquid supply port side, in the period while the whole of the bubble generated grows isotropically by the bubble generating means, the movable member closes the liquid supply port to shut it substantially, a small slit, which allows the liquid supply port to communicate with the liquid flow path even in the status in which the movable member closes the liquid supply port, is formed in the part of the discharge port side of the member forming the liquid supply port, after the movable member closes the liquid supply port to shut it substantially, in the early period, while the part of the bubble, generated by the bubble generating means, in the discharge port side grows and while the part of the bubble in the liquid supply port side shrinks, the liquid flow occurs flowing from the liquid supply port to the liquid flow path through the slit.

61. The liquid discharge method according to claim 60, wherein between the discharge port side and the liquid supply port side in the bubble generating area, a change of a volume of the bubble grown and the time from occurrence to disappearance of the bubble differ greatly.

62. The discharge method of the liquid discharge head according to claim 33, wherein in the liquid discharge head, the free end of the movable member is adapted to be displaced to the liquid supply port side and the bubble generating means side in the liquid flow path, in addition, in displacement from the standing position of the free end of the movable member, displacement to the bubble generating means side is larger than displacement to the liquid supply port side, in the period since the driving voltage is applied to the bubble generating means until the period while the whole of the bubble generated is isotropically grown by the bubble generating means, is terminated, the period while the movable member closes the opening area to shut it substantially tightly, is inserted, a small slit, which allows the liquid supply port to communicate with the liquid flow path even in the status in which the movable member closes the liquid supply port, is formed in the part of the discharge port side of the member forming the liquid supply port, in the early period, while the part of the bubble, generated by the bubble generating means, in the discharge port side grows and while the part of the bubble in the liquid supply port side shrinks, the liquid flow occurs flowing from the liquid supply port to the liquid flow path through the slit.

63. The liquid discharge method according to claim 62, wherein between the discharge port side and the liquid supply port side in the bubble generating area, a change of a volume of the bubble grown and the time from occurrence to disappearance of the bubble differ greatly.

64. The liquid discharge head according to claim 33, wherein the free end of the movable member is adapted to be displaced to the liquid supply port side and the bubble generating means side in the liquid flow path, in addition, in displacement from a standing position of the free end of the movable member, displacement to the bubble generating means is larger than displacement to the liquid supply port side, in the period while the whole of the bubble generated grows substantially isotropically by the bubble generating means, the movable member closes the liquid supply port to shut it substantially, and a small slit, which allows the liquid supply port to communicate with the liquid flow path even in the status in which the movable member closes the liquid supply port, is formed in the part of the discharge port side of the member configuring the liquid supply port.

65. The liquid discharge head according to claim 64, wherein the displacement of the free end of the movable member, if displacement to the liquid supply port side in the liquid flow path in the early period of the bubble is assumed as h1 and displacement to the bubble generating means side in the liquid flow path together with disappearance of the bubble is assumed as h2, always satisfies the relation h1<h2.

66. The liquid discharge head according to claim 33, wherein the free end of said movable member is adapted to be displaced to said liquid supply port side and said bubble generating means side in said liquid flow path, and in addition, in displacement from a standing position of the free end of said movable member, displacement to said bubble generating means side is larger than displacement to said liquid supply port side, in the period after the driving voltage is applied to the bubble generating means until the period while the whole of the bubble grows isotropically by the bubble generating means, is terminated, the opening area closes tightly the liquid supply port to shut it substantially, a small slit, which allows the liquid supply port to communicate with the liquid flow path even in the status in which the movable member closes the liquid supply port, is formed in the part of the discharge port side of the member forming the liquid supply port.

67. The liquid discharge head according to claim 33, wherein an end of said discharge port side of said movable member projects to said discharge port side rather than the end face of said discharge port side in the member for forming said liquid supply port.

68. The liquid discharge head according to claim 67, wherein in the status in which to the member for forming said liquid supply port, the part of said free end side of said movable member contacts, said liquid supply port communicates slightly with said liquid flow path near the part of said free end side of said movable member.

69. A liquid discharge head, having:

a discharge port to discharge the liquid, a liquid flow path, in which one end permanently communicates with said discharge port, having a bubble generating area to generate a bubble in the liquid, a liquid supply port opened in said liquid flow path allow a liquid supply chamber holding the liquid to be supplied to said liquid flow path to communicate with said liquid flow path, and a movable member arranged oppositely to said liquid supply port through a gap in said liquid flow path, making one end of said liquid flow path as a free end, the area surrounded by at least an edge of said free end and both side parts of said movable member being larger than an opening area prepared in said liquid flow path of said liquid supply port, wherein said liquid flow path has a projected part in the position oppositely located to the free end of said movable member through the gap.

70. The liquid discharge head according to claim 69, wherein said discharge port and said bubble generating area are in a linear communication status.

71. The liquid discharge head according to claim 69, wherein said liquid supply port is substantially shut by said movable member during a period, while a whole of a bubble generated in said bubble generating area grows substantially isotropically, and during subsequent period, while the part of the bubble in said discharge port side grows and the part in said movable member side shrinks, said movable member is displaced to said bubble generating area to allow liquid supply from said liquid supply chamber to said liquid flow path through said liquid supply port.

72. The liquid discharge head according to claim 69, wherein the free end of said movable member in an early period of the bubble is displaced to said liquid supply port to shut substantially said liquid supply port toward said liquid flow path, and together with disappearance of the bubble, the free end of said movable member is displaced toward said bubble generating area to allow liquid supply from said liquid supply chamber to said liquid flow path through said liquid supply port.

73. The liquid discharge head according to claim 69, wherein from application of a driving voltage to said bubble generating means until the period, while the whole of the bubble is substantially isotropically grown by said bubble generating means, is terminated, said movable member closes tightly said opening area to shut substantially and thereafter, while the part of the bubble generated by said bubble generating means in said discharge port side part grows, said movable member starts to be displaced from the position in which said opening area is closed tightly to shut substantially, to said bubble generating means in said liquid flow path to make liquid supply from said common liquid supply chamber to said liquid flow path possible.

74. A liquid discharge apparatus, having the liquid discharge head according to claim 69 and carrying means to carry the recording medium to receive the liquid discharged from the liquid discharge head.

75. A recovery method of the liquid discharge head according to claim 69, wherein in said liquid discharge head, said movable member has a communication port around a supporting end in a side opposite to said free end to allow said liquid supply port to communicate with said liquid flow path, said free end of said movable member is adapted to be displaced to said liquid supply port side and said bubble generating means in said liquid flow path, and in addition, in displacement from a standing position of the free end of said movable member, displacement to said bubble generating means is larger than displacement to said liquid supply port side, in the period while the whole of the bubble generated grows substantially isotropically by said bubble generating means, said movable member closes said liquid supply port to shut it substantially, and in a recovery action to suck said liquid in said liquid flow path through said discharge port, said liquid flow flowing in the area covered by said movable member of said liquid flow path occurs from said liquid supply port through said communication port.

76. A recovery method of the liquid discharge head according to claim 69, wherein in said liquid discharge head, the movable member has the communication port around a supporting end in the side opposite to said free end to allow said liquid supply port to communicate with said liquid flow path, the free end of said movable member is adapted to be displaced to said liquid supply port side and said bubble generating means in said liquid flow path, and in addition, in displacement from a standing position of the free end of said movable member, displacement to said bubble generating means is larger than displacement to said liquid supply port side, said liquid discharge head has the period from application of a driving voltage to said bubble generating means until the period while the whole of the bubble is substantially isotropically grown by said bubble generating means, is terminated, said movable member closes tightly said opening area to shut substantially, and in the recovery action to suck said liquid in said liquid flow path through said discharge port, said liquid flow flowing in the area covered by said movable member of said liquid flow path occurs from said liquid supply port through said communication port.

77. The liquid discharge head according to claim 69, wherein the free end of said movable member is adapted to be displaced to said liquid supply port side and said bubble generating means in said liquid flow path, and in addition, in displacement from a standing position of the free end of said movable member, displacement to said bubble generating means is larger than displacement to said liquid supply port side, in the period while the whole of the bubble generated grows substantially isotropically by said bubble generating means, said movable member closes the liquid supply port to shut it substantially, and said movable member has the communication port around a supporting end in the side opposite to said free end to allow said liquid supply port to communicate with said liquid flow path.

78. The liquid discharge head according to claim 77, wherein the displacement of the free end of said movable member, if displacement to said liquid supply port side in said liquid flow path in the early period of said bubble is assumed as h1 and displacement to said bubble generating means in said liquid flow path together with disappearance of said bubble is assumed as h2, always satisfies the relation h1<h2.

79. The liquid discharge head according to claim 69, wherein the free end of said movable member is adapted to be displaced to said liquid supply port side and said bubble generating means in said liquid flow path, in addition, in displacement from a standing position of the free end of said movable member, displacement to said bubble generating means is larger than displacement to said liquid supply port side, in the period after the driving voltage is applied to said bubble generating means until the period while the whole of the bubble grows substantially isotropically by said bubble generating means, is terminated, said movable member closes said liquid supply port to shut it substantially, and said movable member has the communication port around a supporting end in the side opposite to said free end to allow said liquid supply port to communicate with said liquid flow path.

80. The liquid discharge head according to claim 69, wherein said movable member is adapted such that an end supported in said liquid flow path and extending in a length direction of said liquid flow path is the free end located around said bubble generating means, is almost parallel to the opening area of said liquid supply port, having a very small gap, when located in the standing position, opens and closes the opening area of said liquid supply port, by moving from the standing position, and a bottom face in an upstream side of said bubble generating means of said liquid flow path from near the end of said liquid supply port of said bubble generating means to around a fulcrum of said movable member forms a slope face and the slope face is located outside a movable area of said movable member.

81. The liquid discharge head according to claim 80, wherein said slope face is a curved face convexed toward movable member.

82. The liquid discharge head according to claim 69, wherein the bottom face in the upstream side of said bubble generating means of said liquid flow path from near the end of said liquid supply port of said bubble generating means to around the fulcrum of said movable member forms the slope face and the slope face is located outside a movable area of said movable member.

83. The liquid discharge head according to claim 82, wherein said slope face is a curved face convexed toward movable member.

84. A recovery method of the liquid discharge head according to claim 69, wherein while the liquid in the liquid flow path from the discharge port, the bubble is generated by driving the bubble-generating means.

85. The discharge method of the liquid discharge head according to claim 69, wherein in the liquid discharge head, the fulcrum in the side opposite to the free end of the movable member is arranged in the common liquid supply chamber, a communication part to communicate the common liquid supply chamber with the area covered by the movable member of the liquid flow path is formed around said fulcrum of the movable member, the free end of the movable member is adapted to be displaced to the liquid supply port side and the bubble generating means side in the liquid flow path, and in addition, in displacement from a standing position of the free end of the movable member, displacement to the bubble generating means is larger than displacement to the liquid supply port side, in the period while the whole of the bubble generated grows isotropically by the bubble generating means, the movable member closes the liquid supply port to shut it substantially, when the liquid flows in the liquid flow path from the common liquid supply chamber through the gap between the liquid supply port and the movable member, said liquid flow flowing in the area, of the liquid flow path, covered by the movable member occurs from the common liquid supply chamber through the communication part.

86. The liquid discharge method according to claim 85, wherein after the liquid supply port is substantially shut by the movable member, during an early period, while part of the bubble generated by the bubble generating means in the discharge port side grows and during a subsequent period, while the part of the bubble in the liquid supply port side shrinks, the liquid flow occurs flowing from the common liquid supply chamber to the liquid flow path through the communication port.

87. The liquid discharge method according to claim 85, wherein between the discharge port side and the liquid supply port side in the bubble generating area, a change of a volume of the bubble grown and the time from occurrence to disappearance of the bubble differ greatly.

88. The discharge method of the liquid discharge head according to claim 69, wherein in the liquid discharge head, the fulcrum in the side opposite to the free end of the movable member is arranged in the common liquid supply chamber, a communication port to communicate the common liquid supply chamber with the area covered by the movable member of the liquid flow path is formed around the fulcrum of the movable member, the free end of the movable member is adapted to be displaced to the liquid supply port side and the bubble generating means side in the liquid flow path, and in addition, in displacement from a standing position of the free end of the movable member, displacement to the bubble generating means side is larger than displacement to the liquid supply port side, in the period after the driving voltage is applied to the bubble generating means up to completion of the period while the whole of the bubble generated grows isotropically by the bubble generating means, the movable member closes the opening area to shut it substantially tightly, and when the liquid flows in the liquid flow path from the common liquid supply chamber through the gap between the liquid supply port and the movable member, the liquid flow flowing in the area, of the liquid flow path, covered by the movable member occurs from the common liquid supply chamber through the communication part.

89. The liquid discharge method according to claim 88, wherein after the period while the liquid supply port is substantially shut by the movable member, during an early period, while part of the bubble generated by the bubble generating means in the discharge port side grows and during a subsequent period, while the part of the bubble in the liquid supply port side shrinks, the liquid flow occurs flowing from the common liquid supply chamber to the liquid flow path through the communication port.

90. The liquid discharge method according to claim 88, wherein between the discharge port side and the liquid supply port side in the bubble generating area, a change of a volume of the bubble grown and the time from occurrence to disappearance of the bubble differ greatly.

91. The liquid discharge head according to claim 69, wherein the free end of said movable member is adapted to be displaced to said liquid supply port side and said bubble generating means side in said liquid flow path, and in addition, in displacement from a standing position of the free end of said movable member, displacement to said bubble generating means side is larger than displacement to said liquid supply port side, in the period while the whole of the bubble generated grows isotropically by said bubble generating means, said movable member closes the liquid supply port to shut it substantially, the fulcrum of the opposite side to said free end of said movable member is located in said common liquid supply chamber, and around said fulcrum of said movable member, the communication part is formed to communicate said common liquid supply chamber with the area covered with said movable member of said liquid flow path is formed.

92. The liquid discharge head according to claim 91, wherein the displacement of the free end of said movable member, if displacement to said liquid supply port side in said liquid flow path in the early period of said bubble is assumed as h1 and displacement to said bubble generating means side in said liquid flow path together with disappearance of said bubble is assumed as h2, always satisfies the relation $h1<h2$.

93. The liquid discharge head according to claim 69, wherein the free end of said movable member is adapted to be displaced to said liquid supply port side and said bubble generating means side in said liquid flow path, and in addition, in displacement from a standing position of the free end of said movable member, displacement to said bubble generating means side is larger than displacement to said liquid supply port side, in the period since the driving voltage is applied to said bubble generating means until the period while the whole of the bubble generated is isotropically grown by said bubble generating means, is terminated, the period, while said movable member closes said opening area to shut it substantially tightly, is inserted, said fulcrum opposite to said free end of said movable member is located in said common liquid supply chamber, and around said fulcrum of said movable member, the communication part is formed to communicate said liquid common liquid supply chamber with the area covered by said movable member of said liquid flow path.

94. The discharge method of the liquid discharge head according to claim 69, wherein in the liquid discharge head, the free end of the movable member is adapted to be displaced to the liquid supply port side and the bubble generating means side in the liquid flow path, in addition, in displacement from the standing position of the free end of the movable member, displacement to the bubble generating means side is larger than displacement to the liquid supply port side, in the period while the whole of the bubble generated grows isotropically by the bubble generating means, the movable member closes the liquid supply port to shut it substantially, a small slit, which allows the liquid supply port to communicate with the liquid flow path even in the status in which the movable member closes the liquid supply port, is formed in the part of the discharge port side of the member forming the liquid supply port, after the movable member closes the liquid supply port to shut it substantially, in the early period, while the part of the bubble generated by the bubble generating means in the discharge port side grows and while the part of the bubble in the liquid supply port side shrinks, the liquid flow occurs flowing from the liquid supply port to the liquid flow path through the slit.

95. The liquid discharge method according to claim 94, wherein between the discharge port side and the liquid supply port side in the bubble generating area, a change of a volume of the bubble grown and the time from occurrence to disappearance of the bubble differ greatly.

96. The discharge method of the liquid discharge head according to claim 69, wherein in the liquid discharge head, the free end of the movable member is adapted to be displaced to the liquid supply port side and the bubble generating means side in the liquid flow path, and in addition, in displacement from the standing position of the free end of the movable member, displacement to the bubble generating means side is larger than displacement to the liquid supply port side, in the period since the driving voltage is applied to the bubble generating means until the period while the whole of the bubble generated is isotropically grown by the bubble generating means, is terminated, the period while the movable member closes the opening area to shut it substantially tightly, is inserted, a small slit, which allows the liquid supply port to communicate with the liquid flow path even in the status in which the movable member closes the liquid supply port, is formed in the part of the discharge port side of the member forming the liquid supply port, in the early period, while the part of bubble generated by the bubble generating means in the discharge port side grows and while the part of the bubble in the liquid supply port side shrinks, the liquid flow occurs flowing from the liquid supply port to the liquid flow path through the slit.

97. The liquid discharge method according to claim 96, wherein between the discharge port side and the liquid supply port side in the bubble generating area, a change of a volume of the bubble grown and the time from occurrence to disappearance of the bubble differ greatly.

98. The liquid discharge head according to claim 69, wherein the free end of said movable member is adapted to be displaced to said liquid supply port side and said bubble generating means side in said liquid flow path, and in addition, in displacement from a standing position of the free end of said movable member, displacement to said bubble generating means is larger than displacement to said liquid supply port side, in the period while the whole of the bubble generated grows substantially isotropically by said bubble generating means, said movable member closes the liquid supply port to shut it substantially, and a small slit, which allows said liquid supply port to communicate with said liquid flow path even in the status in which said movable member closes said liquid supply port, is formed in the part of said discharge port side of the member configuring said liquid supply port.

99. The liquid discharge head according to claim 98, wherein the displacement of the free end of said movable member, if displacement to said liquid supply port side in said liquid flow path in the early period of said bubble is assumed as h1 and displacement to said bubble generating means side in said liquid flow path together with disappearance of said bubble is assumed as h2, always satisfies the relation h1<h2.

100. The liquid discharge head according to claim 69, wherein the free end of said movable member is adapted to be displaced to said liquid supply port side and said bubble generating means side in said liquid flow path, and in addition, in displacement from a standing position of the free end of said movable member, displacement to said bubble generating means side is larger than displacement to said liquid supply port side, in the period after the driving voltage is applied to said bubble generating means until the period while the whole of the bubble grows isotropically by said bubble generating means, is terminated, said opening area closes tightly said liquid supply port to shut it substantially, a small slit, which allows said liquid supply port to communicate with said liquid flow path even in the status in which said movable member closes said liquid supply port, is formed in the part of said discharge port side of the member forming said liquid supply port.

101. The liquid discharge head according to claim 69, wherein an end of said discharge port side of said movable member projects to said discharge port side rather than the end face of said discharge port side in the member for forming said liquid supply port.

102. The liquid discharge head according to claim 101, wherein in the status in which to the member for forming said liquid supply port, the part of said free end side of said movable member contacts, said liquid supply port communicates slightly with said liquid flow path near the part of said free end side of said movable member.

103. A fluid structure having a fluid element comprising a mechanism to move a free end part of a movable member to a stopper and displace between a first position, in which a flow of the fluid between said stopper and the free end part of said movable member is almost shut, and a second position, in which the free end part of said movable member moves to a direction with a distance from said stopper to cause a flow of said liquid between said stopper and the free end part of said movable member, wherein said stopper has a vacant part formed in a part opposite to the free end part of said movable member, said vacant part does not cause the flow of said liquid between said stopper and the free end part of said movable member in said first position, and when said free end part moves from said first position to said second position, the flow of said liquid is enhanced between said stopper and the free end part of said movable member.

* * * * *

UNITED STATES PATENT AND TRADEMARK OFFICE

CERTIFICATE OF CORRECTION

PATENT NO. : 6,435,670 B1
DATED : August 20, 2002
INVENTOR(S) : Ryoji Inoue et al.

It is certified that error appears in the above-identified patent and that said Letters Patent is hereby corrected as shown below:

Column 1,
Lines 27 and 49, "as" should read -- as a --.
Line 41, "such" should read --such as--.

Column 2,
Line 12, "in almost" should read -- almost in the --.
Lines 19 and 20, "piece" should read -- pieces --.

Column 4,
Line 22, "completely is" should read -- is completely --.
Line 41, "the an" should read -- the --.

Column 14,
Line 10, "a" should read -- an --.

Column 15,
Line 39, "which the" should read -- which --.

Column 17,
Line 43, "infinity" should read -- infinity as --.
Line 45, "hi" should read -- hl --.

Column 18,
Line 3, "does" should be deleted.

Column 20,
Line 49, "ember" should read -- member --.

Column 23,
Line 5, "The" should read -- the --.

Column 25,
Lines 44 and 66, "a" should read -- a --.

Column 26,
Line 6, "continuous" (second occurrence) should be deleted.

Column 27,
Line 45, "does" should be deleted.

UNITED STATES PATENT AND TRADEMARK OFFICE

CERTIFICATE OF CORRECTION

PATENT NO. : 6,435,670 B1
DATED : August 20, 2002
INVENTOR(S) : Ryoji Inoue et al.

It is certified that error appears in the above-identified patent and that said Letters Patent is hereby corrected as shown below:

Column 33,
Line 60, "perform" should read -- performs --.
Line 61, "are" should read -- is --.

Column 34,
Line 25, "are" should read -- is --.
Line 26, "and" should read -- and is --.
Line 44, "according" should read -- conforming --.
Line 49, "choice" should read -- choose --.

Column 35,
Line 10, "grow" should read -- grows --.

Column 36,
Line 3, "propagate" should read -- propagates --.

Column 39,
Line 26, "variation" should read -- variations --.

Column 40,
Line 6, "remain" should read -- remains --.
Line 7, "are" should read -- is --.

Column 42,
Line 23, "a" should read -- α --.
Line 25, "a," should read -- α--.
Line 43, "shown" should read -- shown in --.

Column 43,
Line 42, "a" should read -- α --.

Column 44,
Line 38, “lot.” should read -- a lot. --.
Line 50, "lot" should read -- a lot --.

Column 46,
Lines 23, 29, 33 and 35, "bubble" should read -- bubbles --.

Column 47,
Line 31, "bubble" should read -- bubbles --.

UNITED STATES PATENT AND TRADEMARK OFFICE

CERTIFICATE OF CORRECTION

PATENT NO. : 6,435,670 B1
DATED : August 20, 2002
INVENTOR(S) : Ryoji Inoue et al.

It is certified that error appears in the above-identified patent and that said Letters Patent is hereby corrected as shown below:

Column 48,
Line 29, "a" should read -- α--.

Column 49,
Line 2, "other" should read -- the other --.

Column 50,
Lines 34 and 37, "bubble" should read -- bubbles --.

Column 52,
Line 42, "lot." should read -- a lot. --.
Line 56, "lot" should read -- a lot --.

Column 53,
Line 40, "s" should read -- α --.
Lines 41 and 45, "according" should read -- accordance --.
Line 64, "higher-speed." should read -- higher speed. --.

Column 54,
Line 3, "stay bubble" should read -- remains a bubble --.
Line 13, "bubble" should read -- bubbles --.
Line 21, "return" should read -- returns --.

Column 55,
Line 59, "bubble" should read -- bubbles --,

Column 60,
Line 24, "lot." should read -- a lot. --.
Line 37, "lot" should read -- a lot --.

Column 61,
Line 54, "s" should read -- α --.
Lines 55 and 59, "according" should read -- accordance --.

Column 62,
Line 9, "return" should read -- returns --.

Column 63,
Line 60, "slit" should read -- slits --.

UNITED STATES PATENT AND TRADEMARK OFFICE

CERTIFICATE OF CORRECTION

PATENT NO. : 6,435,670 B1
DATED : August 20, 2002
INVENTOR(S) : Ryoji Inoue et al.

It is certified that error appears in the above-identified patent and that said Letters Patent is hereby corrected as shown below:

Column 64,
Line 38, "a" should read -- α --.

Column 65,
Lines 35 and 58, "a" should read -- α --.

Column 68,
Line 17, "lot." should read -- a lot. --.
Line 30, "lot" should read -- a lot --.
Line 47, "a" (first occurrence) should be deleted.
Line 54, "a" should read -- an --.

Column 69,
Line 13, "to" should be deleted.
Line 42, "s" should read -- α --.
Lines 43 and 47, "according" should read -- accordance --.
Line 57, "return" should read -- returns --.

Column 72,
Line 20, "$Si_{3N4}$" should read -- $Si_3N_4$ --.

Column 77,
Line 31, "wit" should read -- with --.
Line 56, "all though its" should read -- across its entire --.

Column 79,
Line 14, "an" should read -- a --.

Column 81,
Line 24, "to be displaced" should be deleted.

Column 82,
Line 1, "path," should read -- path, and --.

Column 83,
Line 9, "tightly it substantially, is inserted," should read -- it substantially tightly, is inserted, and --.
Line 31, "port" should read -- port, and --.

UNITED STATES PATENT AND TRADEMARK OFFICE

CERTIFICATE OF CORRECTION

PATENT NO. : 6,435,670 B1
DATED : August 20, 2002
INVENTOR(S) : Ryoji Inoue et al.

It is certified that error appears in the above-identified patent and that said Letters Patent is hereby corrected as shown below:

Column 84,
Line 3, "port," should read -- port, and --.
Line 27, "substantially," should read -- substantially, and --.
Line 56, "inserted," should read -- inserted, and --.

Column 85,
Line 29, "is" should be deleted.
Line 59, "claim 33" should read -- claim 33, --.

Column 88,
Line 1, "path," should read -- path, and --.
Line 9, "substantially," should read -- substantially, and --.
Line 50, "tightly," should read -- tightly, and --.

Column 89,
Line 19, "substantially," should read -- substantially, and --.
Line 51, "inserted," should read -- inserted, and --.

Column 90,
Line 6, "path," should read -- path, and --.
Line 23, "substantially," should read --substantially, and--.
Line 40, "path," should read -- path, and --.
Line 55, "port," should read -- port, and --.

Column 91,
Line 5, "path," should read -- path, and- -.
Line 41, "substantially," should read -- substantially, and --.

Column 92,
Line 49, "claim 69" should read -- claim 69, --.

Column 93,
Line 65, "path," should read -- path, and --.

Column 95,
Line 2, "substantially," should read -- substantially, and --.

Column 96,
Line 13, "substantially," should read --substantially, and--. Line 43, "inserted," should read --inserted, and--.

UNITED STATES PATENT AND TRADEMARK OFFICE

CERTIFICATE OF CORRECTION

PATENT NO. : 6,435,670 B1
DATED : August 20, 2002
INVENTOR(S) : Ryoji Inoue et al.

It is certified that error appears in the above-identified patent and that said Letters Patent is hereby corrected as shown below:

Column 97,
Line 5, "substantially," should read -- substantially, and --.
Line 38, "port." should read -- port, and --.

Column 98,
Line 26, "substantially," should read -- substantially, and --.

Signed and Sealed this

Thirty-first Day of August, 2004

JON W. DUDAS
*Director of the United States Patent and Trademark Office*